US008714083B2

(12) United States Patent
Numauchi et al.

(10) Patent No.: US 8,714,083 B2
(45) Date of Patent: May 6, 2014

(54) INK TRANSFER MEMBER POSITION ADJUSTING METHOD AND APPARATUS OF ROTARY STENCIL PRINTING PRESS

(75) Inventors: Hiromitsu Numauchi, Tsukuba (JP); Isao Komuro, Noda (JP); Akehiro Kusaka, Noda (JP)

(73) Assignee: Komori Corporation, Tokyo (JP)

( * ) Notice: Subject to any disclaimer, the term of this patent is extended or adjusted under 35 U.S.C. 154(b) by 1163 days.

(21) Appl. No.: 12/016,035

(22) Filed: Jan. 17, 2008

(65) Prior Publication Data

US 2008/0178755 A1 Jul. 31, 2008

(30) Foreign Application Priority Data

Jan. 22, 2007 (JP) ..... 2007-11240
Jul. 25, 2007 (JP) ..... 2007-192846

(51) Int. Cl.
*B41L 13/04* (2006.01)
*B41L 13/18* (2006.01)
*B41F 15/42* (2006.01)

(52) U.S. Cl.
USPC ..... 101/120; 101/116; 101/119; 101/129

(58) Field of Classification Search
USPC ..... 101/116, 118, 119, 120, 123, 124, 129
See application file for complete search history.

(56) References Cited

U.S. PATENT DOCUMENTS 5,479,854 A 1/1996 Chikahisa et al.
5,671,671 A 9/1997 Wyssmann et al.
5,809,877 A 9/1998 Szyszko et al.
6,412,407 B1 7/2002 Brocker et al.
6,477,946 B1 * 11/2002 Ogata ..... 101/119
6,508,168 B1 * 1/2003 Takahashi et al. ..... 101/120
2003/0015106 A1 1/2003 Schaede

FOREIGN PATENT DOCUMENTS

EP 0723864 A1 7/1996
EP 1157832 A1 11/2001
JP 9-169156 A 6/1997
JP 11-042844 A 2/1999
JP 2001-096879 A 4/2001
JP 2001-191484 A 7/2001
JP 2002-002080 A 1/2002
WO WO 99/19146 A1 4/1999
WO WO 01/54907 A1 8/2001

OTHER PUBLICATIONS

Japanese Office Action in Japanese Patent Application No. 2007-192846 on Mar. 5, 2013.

* cited by examiner

*Primary Examiner* — Leslie J Evanisko
(74) *Attorney, Agent, or Firm* — Birch, Stewart, Kolasch & Birch, LLP

(57) ABSTRACT

In a rotary stencil printing press including a rotary screen cylinder which supports a screen printing form and is supported rotatably, and a squeegee which is located within the rotary screen cylinder and, when printing is done, contacts an inner peripheral surface of the screen printing form to transfer ink stored within the rotary screen cylinder to a web via holes of the screen printing form and, when printing is stopped, leaves the inner peripheral surface of the screen printing form, throw-on and throw-off of the squeegee with respect to the inner peripheral surface of the screen printing form, and adjustment of the position of the throw-on are performed by motors.

14 Claims, 68 Drawing Sheets

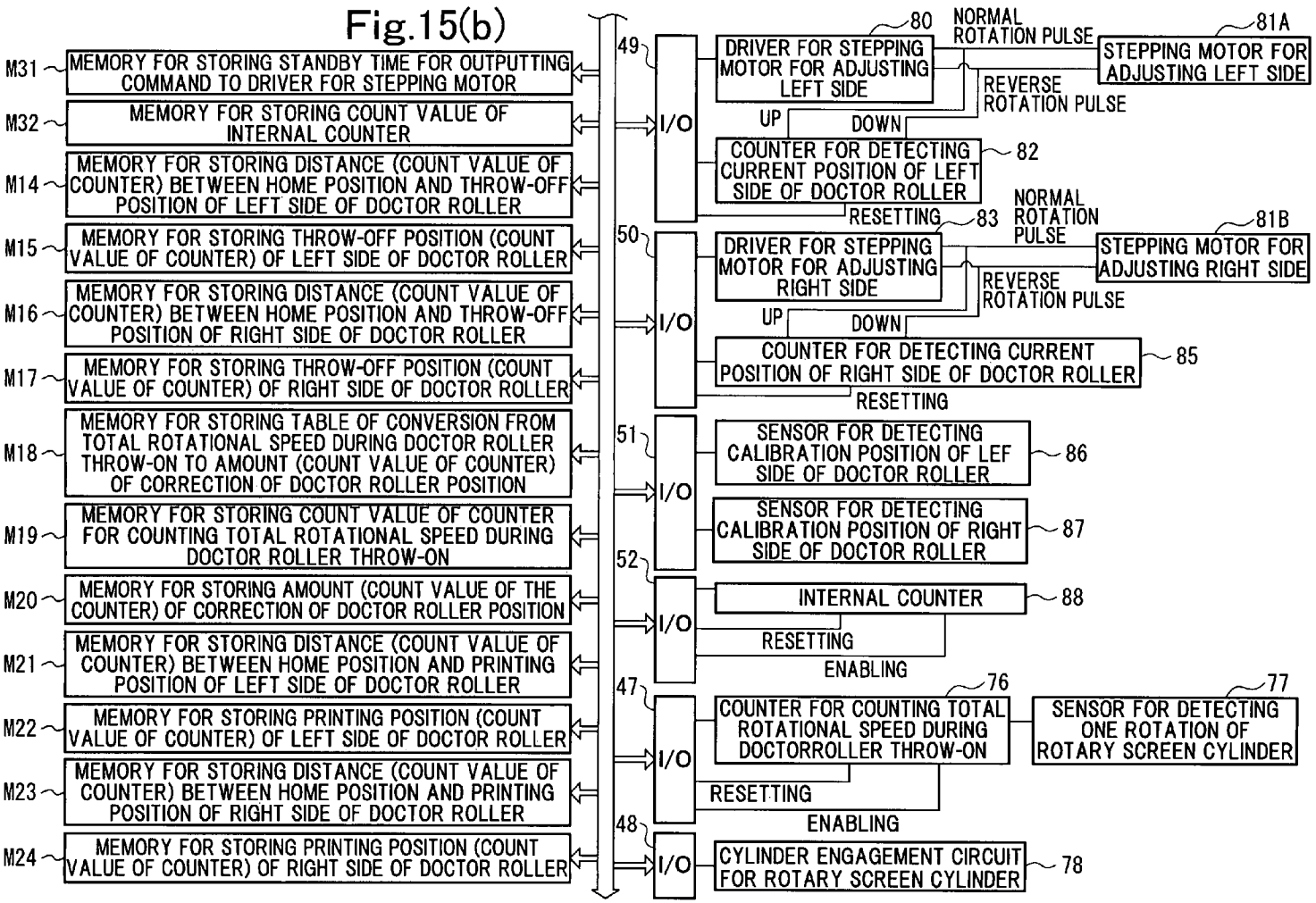
Fig.15(b)
M31
MEMORY FOR STORING STANDBY TIME FOR OUTPUTTING COMMAND TO DRIVER FOR STEPPING MOTOR
M32
MEMORY FOR STORING COUNT VALUE OF INTERNAL COUNTER
M14
MEMORY FOR STORING DISTANCE (COUNT VALUE OF COUNTER) BETWEEN HOME POSITION AND THROW-OFF POSITION OF LEFT SIDE OF DOCTOR ROLLER
M15
MEMORY FOR STORING THROW-OFF POSITION (COUNT VALUE OF COUNTER) OF LEFT SIDE OF DOCTOR ROLLER
M16
MEMORY FOR STORING DISTANCE (COUNT VALUE OF COUNTER) BETWEEN HOME POSITION AND THROW-OFF POSITION OF RIGHT SIDE OF DOCTOR ROLLER
M17
MEMORY FOR STORING THROW-OFF POSITION (COUNT VALUE OF COUNTER) OF RIGHT SIDE OF DOCTOR ROLLER
M18
MEMORY FOR STORING TABLE OF CONVERSION FROM TOTAL ROTATIONAL SPEED DURING DOCTOR ROLLER THROW-ON TO AMOUNT (COUNT VALUE OF COUNTER) OF CORRECTION OF DOCTOR ROLLER POSITION
M19
MEMORY FOR STORING COUNT VALUE OF COUNTER FOR COUNTING TOTAL ROTATIONAL SPEED DURING DOCTOR ROLLER THROW-ON
M20
MEMORY FOR STORING AMOUNT (COUNT VALUE OF THE COUNTER) OF CORRECTION OF DOCTOR ROLLER POSITION
M21
MEMORY FOR STORING DISTANCE (COUNT VALUE OF COUNTER) BETWEEN HOME POSITION AND PRINTING POSITION OF LEFT SIDE OF DOCTOR ROLLER
M22
MEMORY FOR STORING PRINTING POSITION (COUNT VALUE OF COUNTER) OF LEFT SIDE OF DOCTOR ROLLER
M23
MEMORY FOR STORING DISTANCE (COUNT VALUE OF COUNTER) BETWEEN HOME POSITION AND PRINTING POSITION OF RIGHT SIDE OF DOCTOR ROLLER
M24
MEMORY FOR STORING PRINTING POSITION (COUNT VALUE OF COUNTER) OF RIGHT SIDE OF DOCTOR ROLLER
49
50
51
52
47
48
I/O
80
DRIVER FOR STEPPING MOTOR FOR ADJUSTING LEFT SIDE
NORMAL ROTATION PULSE
REVERSE ROTATION PULSE
81A
STEPPING MOTOR FOR ADJUSTING LEFT SIDE
UP
DOWN
82
COUNTER FOR DETECTING CURRENT POSITION OF LEFT SIDE OF DOCTOR ROLLER
83
RESETTING
81B
STEPPING MOTOR FOR ADJUSTING RIGHT SIDE
DRIVER FOR STEPPING MOTOR FOR ADJUSTING RIGHT SIDE
85
COUNTER FOR DETECTING CURRENT POSITION OF RIGHT SIDE OF DOCTOR ROLLER
86
SENSOR FOR DETECTING CALIBRATION POSITION OF LEF SIDE OF DOCTOR ROLLER
87
SENSOR FOR DETECTING CALIBRATION POSITION OF RIGHT SIDE OF DOCTOR ROLLER
88
INTERNAL COUNTER
ENABLING
76
COUNTER FOR COUNTING TOTAL ROTATIONAL SPEED DURING DOCTORROLLER THROW-ON
77
SENSOR FOR DETECTING ONE ROTATION OF ROTARY SCREEN CYLINDER
78
CYLINDER ENGAGEMENT CIRCUIT FOR ROTARY SCREEN CYLINDER

INK TRANSFER MEMBER POSITION ADJUSTING METHOD AND APPARATUS OF ROTARY STENCIL PRINTING PRESS

BACKGROUND OF THE INVENTION

1. Field of the Invention

This invention relates to an ink transfer member position adjusting method and apparatus of a rotary stencil printing press such as a rotary screen printing press.

2. Description of the Related Art

In screen printing using a rotary screen printing press, ink is placed in a screen printing forme, and a squeegee or a doctor roller, as an ink transfer member, is pressed against the screen printing forme, whereby the ink is transferred to a printing surface of paper via holes. Pressure, which the squeegee or the doctor roller exerts on the screen printing forme, affects a printing quality, and thus needs to be adjusted in accordance with an image area and a material to be printed.

Fine adjustment of the throw-on position of the squeegee or the doctor roller with respect to the screen printing forme during printing has been made manually by an operator who uses a tool to adjust a position adjusting mechanism for the squeegee or the doctor roller present in a rotary screen printing unit.

Thus, the operator is burdened, and may have to repeat motions, such as manual adjustment in the rotary screen printing unit, followed by confirmation of the resulting product, further followed by manual adjustment in the rotary screen printing unit. As noted here, the adjustment operation takes time, posing the problem that a large amount of wasted paper occurs.

Moreover, the squeegee or the doctor roller in the rotary screen printing press always contacts the screen printing forme (i.e., its inner peripheral surface) during printing, and is thus worn. After its use for a certain period, therefore, a corresponding fine adjustment has to be made. Repeated fine adjustment has resulted in a decreased rate of operation, and has aroused the problem of wasted paper occurrence.

The present invention has been accomplished in light of the above-described problems. It is an object of the invention to provide an ink transfer member position adjusting method and apparatus of a rotary stencil printing press, which can automate the fine adjustment of the throw-on position of an ink transfer member with respect to a stencil printing plate, to lessen burden on the operator and cut down on the adjusting time, thereby increasing the rate of operation and decreasing wasted paper.

SUMMARY OF THE INVENTION

A first aspect of the present invention is an ink transfer member position adjusting method of a rotary stencil printing press including a stencil printing plate cylinder which supports a stencil printing plate and is supported rotatably, and an ink transfer member which is located within the stencil printing plate cylinder and, when printing is done, contacts an inner peripheral surface of the stencil printing plate to transfer ink stored within the stencil printing plate cylinder to a material to be printed via holes of the stencil printing plate and, when printing is stopped, leaves the inner peripheral surface of the stencil printing plate, and wherein throw-on and throw-off of the ink transfer member with respect to the inner peripheral surface of the stencil printing plate, and adjustment of a position of the throw-on are performed by a motor.

Preferably, a home position for the throw-on and throw-off of the ink transfer member with respect to the inner peripheral surface of the stencil printing plate can be adjusted.

It is preferred that a relative position between the home position and a position of the throw-off be constant.

Preferably, a relative position between the home position and the position of the throw-on can be adjusted.

The relative position between the home position and the position of the throw-on may change according to an amount of adjustment of the position of the throw-on by an operator.

The ink transfer member position adjusting method may further comprise: obtaining a total number of rotation of the rotary stencil printing press in a state in which the ink transfer member has been thrown on the inner peripheral surface of the stencil printing plate after adjustment of a home position for the throw-on and throw-off of the ink transfer member with respect to the inner peripheral surface of the stencil printing plate; and adjusting the position of the throw-on of the ink transfer member with respect to the inner peripheral surface of the stencil printing plate in accordance with the obtained total number of rotation of the rotary stencil printing press.

A second aspect of the present invention is an ink transfer member position adjusting apparatus of a rotary stencil printing press including a stencil printing plate cylinder which supports a stencil printing plate and is supported rotatably, and an ink transfer member which is located within the stencil printing plate cylinder and, when printing is done, contacts an inner peripheral surface of the stencil printing plate to transfer ink stored within the stencil printing plate cylinder to a material to be printed via holes of the stencil printing plate and, when printing is stopped, leaves the inner peripheral surface of the stencil printing plate, the ink transfer member position adjusting apparatus comprising: a motor for performing throw-on and throw-off of the ink transfer member with respect to the inner peripheral surface of the stencil printing plate, and adjustment of a position of the throw-on; and control means for controlling driving of the motor.

Preferably, the control means adjusts a home position for the throw-on and throw-off of the ink transfer member with respect to the inner peripheral surface of the stencil printing plate.

The control means may render constant a relative position between the home position and a position of the throw-off.

Preferably, the control means adjusts a relative position between the home position and the position of the throw-on.

The control means may change the relative position between the home position and the position of the throw-on according to an amount of adjustment of the position of the throw-on by an operator.

The control means may obtain a total number of rotation speed of the rotary stencil printing press in a state in which the ink transfer member has been thrown on the inner peripheral surface of the stencil printing plate after adjustment of a home position for the throw-on and throw-off of the ink transfer member with respect to the inner peripheral surface of the stencil printing plate, and adjust the position of the throw-on of the ink transfer member with respect to the inner peripheral surface of the stencil printing plate in accordance with the obtained total number of rotation of the rotary stencil printing press.

According to the ink transfer member position adjusting method and apparatus of a rotary stencil printing press concerned with the present invention, fine adjustment of the throw-on position of the ink transfer member with respect to the stencil printing plate can be automated by motor driving to lessen burden on the operator and cut down on the adjusting time, thereby increasing the rate of operation and decreasing wasted paper.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4(*b*) is an operating state view;

FIG. 5(*b*) is a control block diagram of the control device;

FIG. 6(*b*) is a motion flow chart of the control device;

FIG. 6(*c*) is a motion flow chart of the control device;

FIG. 6(*d*) is a motion flow chart of the control device;

FIG. 7(*b*) is a motion flow chart of the control device;

FIG. 7(*c*) is a motion flow chart of the control device;

FIG. 7(*d*) is a motion flow chart of the control device;

FIG. 9(*b*) is a motion flow chart of the control device;

FIG. 9(*c*) is a motion flow chart of the control device;

FIG. 9(*d*) is a motion flow chart of the control device;

FIG. 10(*b*) is a motion flow chart of the control device;

FIG. 10(*c*) is a motion flow chart of the control device;

FIG. 10(*d*) is a motion flow chart of the control device;

FIG. 11(*b*) is a motion flow chart of the control device;

FIG. 11(*c*) is a motion flow chart of the control device;

FIG. 11(*d*) is a motion flow chart of the control device;

FIG. 11(*e*) is a motion flow chart of the control device;

FIG. 12(*b*) is a motion flow chart of the control device;

FIG. 12(*c*) is a motion flow chart of the control device;

FIG. 12(*d*) is a motion flow chart of the control device;

FIG. 14(*b*) is an explanation drawing of an ink supply pipe;

FIG. 15(*b*) is a control block diagram of the control device;

FIG. 16(*b*) is a motion flow chart of the control device;

FIG. 17(*b*) is a motion flow chart of the control device;

FIG. 17(*c*) is a motion flow chart of the control device;

FIG. 18(*b*) is a motion flow chart of the control device;

FIG. 18(*c*) is a motion flow chart of the control device;

FIG. 18(*d*) is a motion flow chart of the control device;

FIG. 19(*b*) is a motion flow chart of the control device;

FIG. 19(*c*) is a motion flow chart of the control device;

FIG. 21(*b*) is a motion flow chart of the control device;

FIG. 21(*c*) is a motion flow chart of the control device;

FIG. 21(*d*) is a motion flow chart of the control device;

FIG. 22(*b*) is a motion flow chart of the control device;

FIG. 22(*c*) is a motion flow chart of the control device;

FIG. 22(*d*) is a motion flow chart of the control device;

FIG. 23(*b*) is a motion flow chart of the control device;

FIG. 23(*c*) is a motion flow chart of the control device;

FIG. 23(*d*) is a motion flow chart of the control device;

FIG. 24(*b*) is a motion flow chart of the control device;

FIG. 24(*c*) is a motion flow chart of the control device;

FIG. 25(*b*) is a motion flow chart of the control device;

FIG. 25(*c*) is a motion flow chart of the control device; and

FIG. 25(*d*) is a motion flow chart of the control device.

DETAILED DESCRIPTION OF THE INVENTION

An ink transfer member position adjusting method and apparatus of a rotary stencil printing press according to the present invention will be described in detail by embodiments with reference to the accompanying drawings. In Embodiment 1, a rotary screen printing press using a squeegee as an ink transfer member is illustrated. In Embodiment 2, a rotary screen printing press using a doctor roller as an ink transfer member is illustrated.

Embodiment 1

Figure 1:
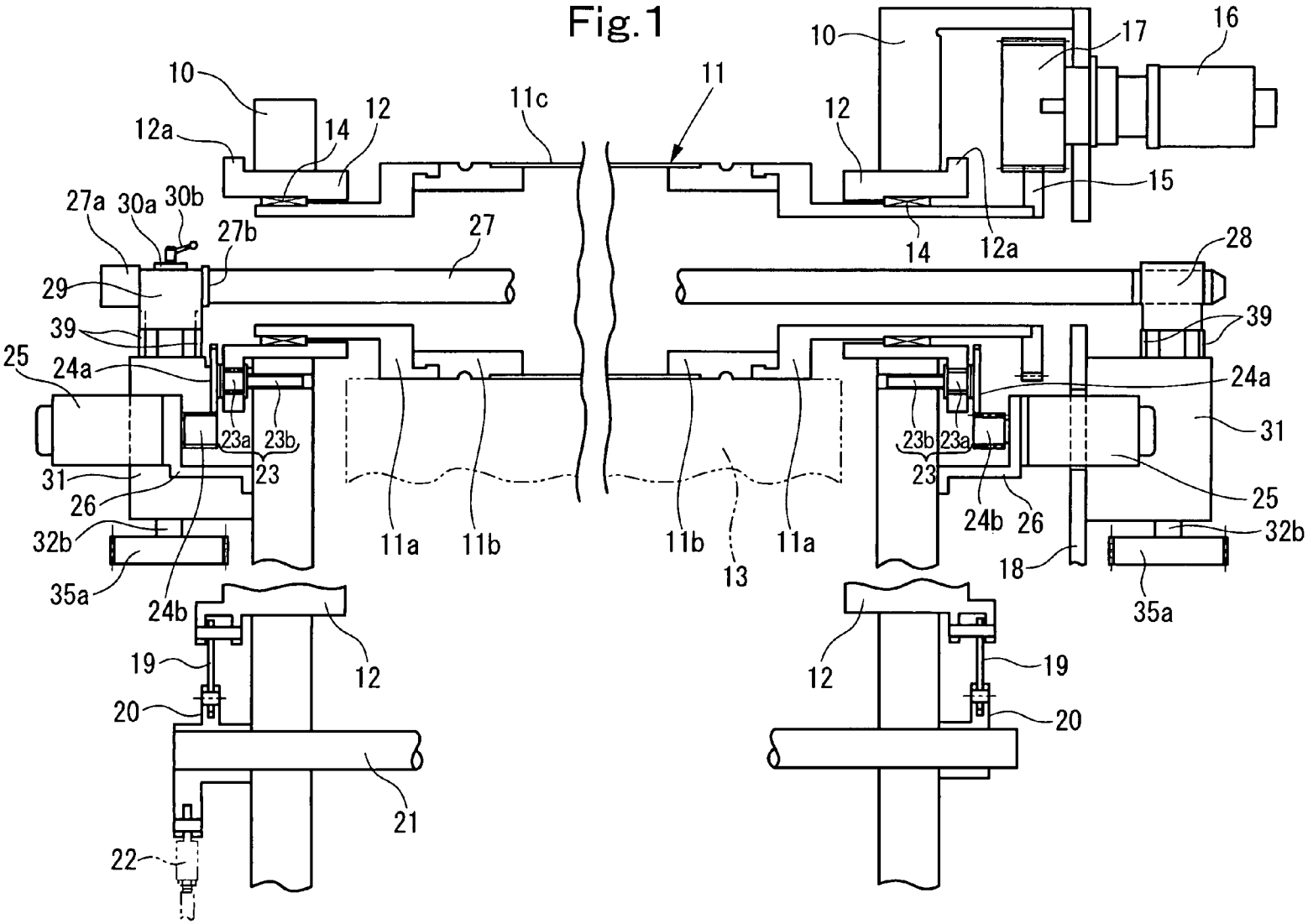
FIG. 1 is a schematic configurational sectional view of a rotary screen printing unit in a rotary screen printing press showing Embodiment 1 of the present invention.
Figure 2:
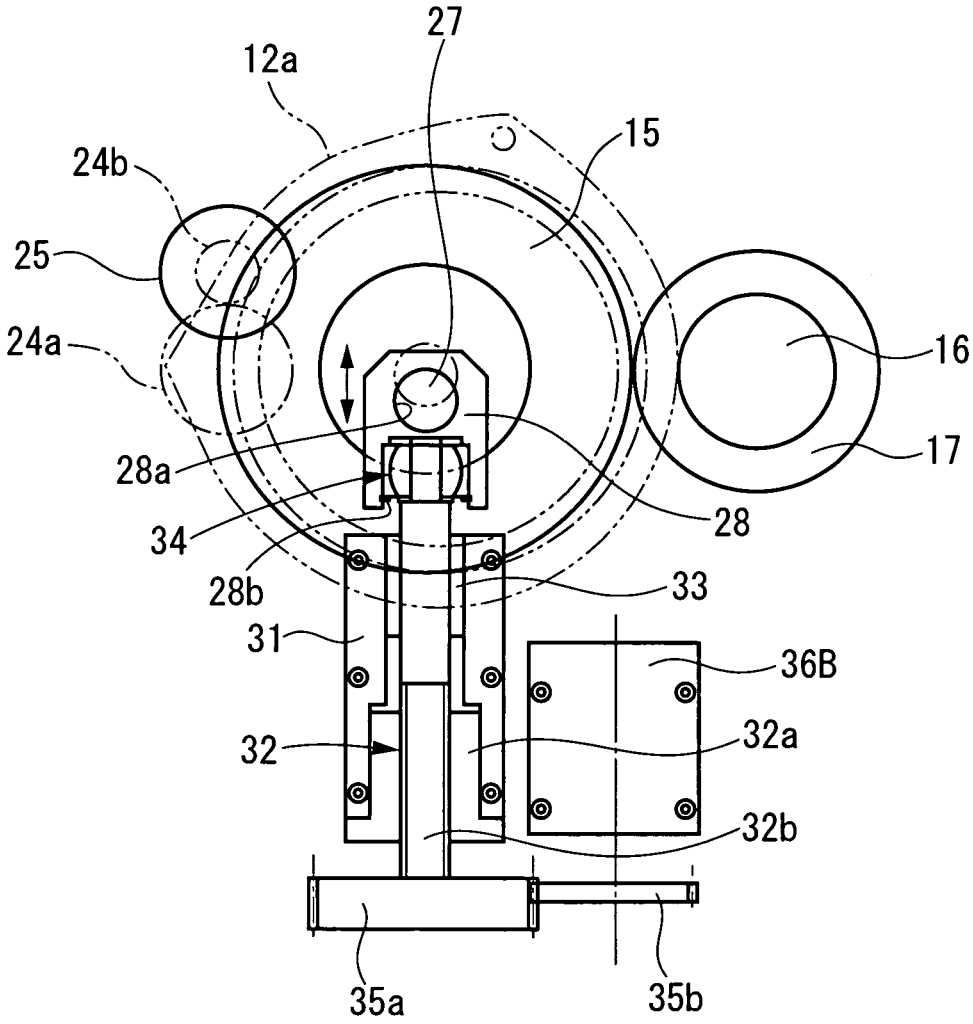
FIG. 2 is a right side view of the rotary screen printing unit in FIG. 1.
Figure 3:
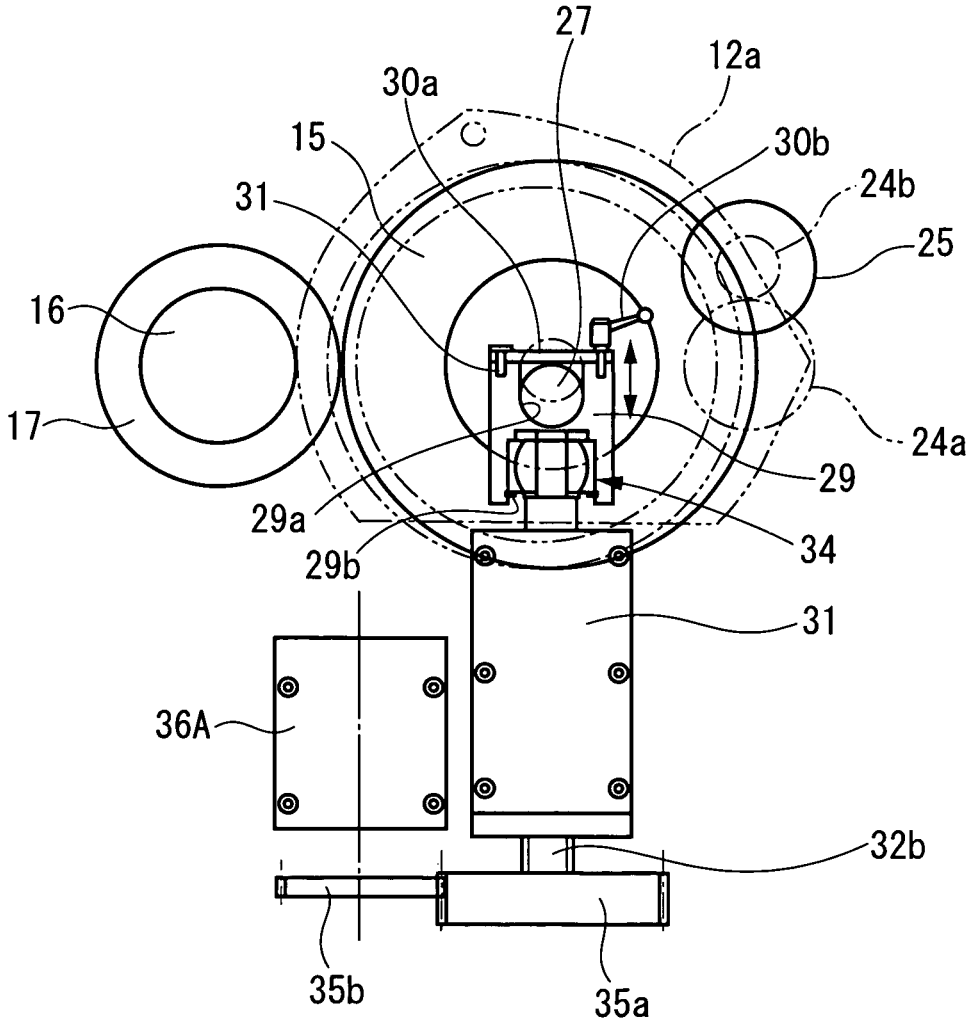
FIG. 3 is a left side view of the rotary screen printing unit in FIG. 1.
Figure 4A:
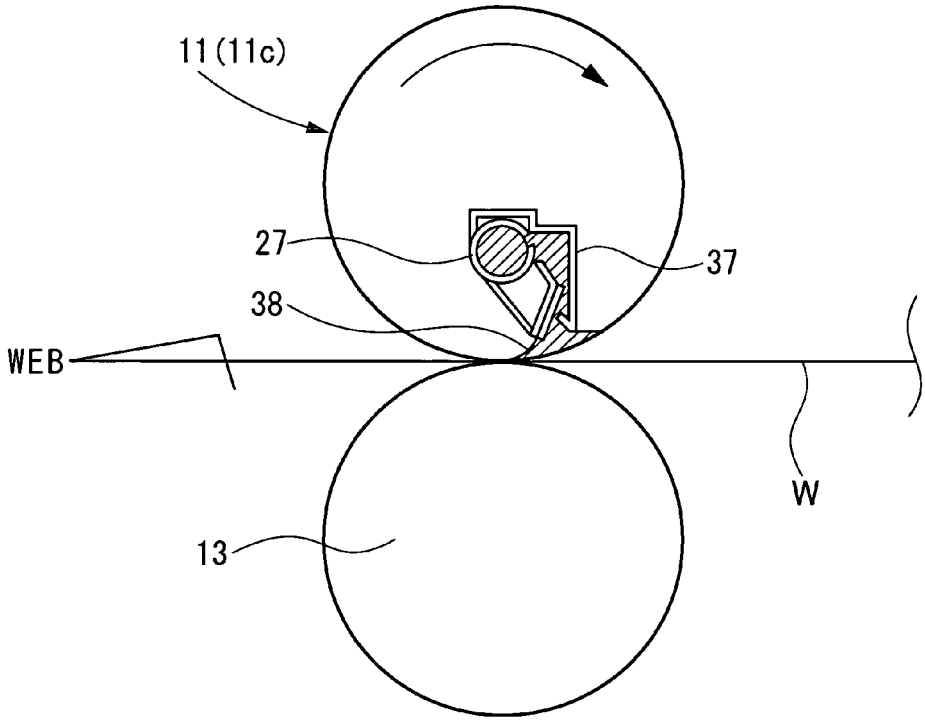
FIG. 4(*a*) is an operating state view.
Figure 4B:
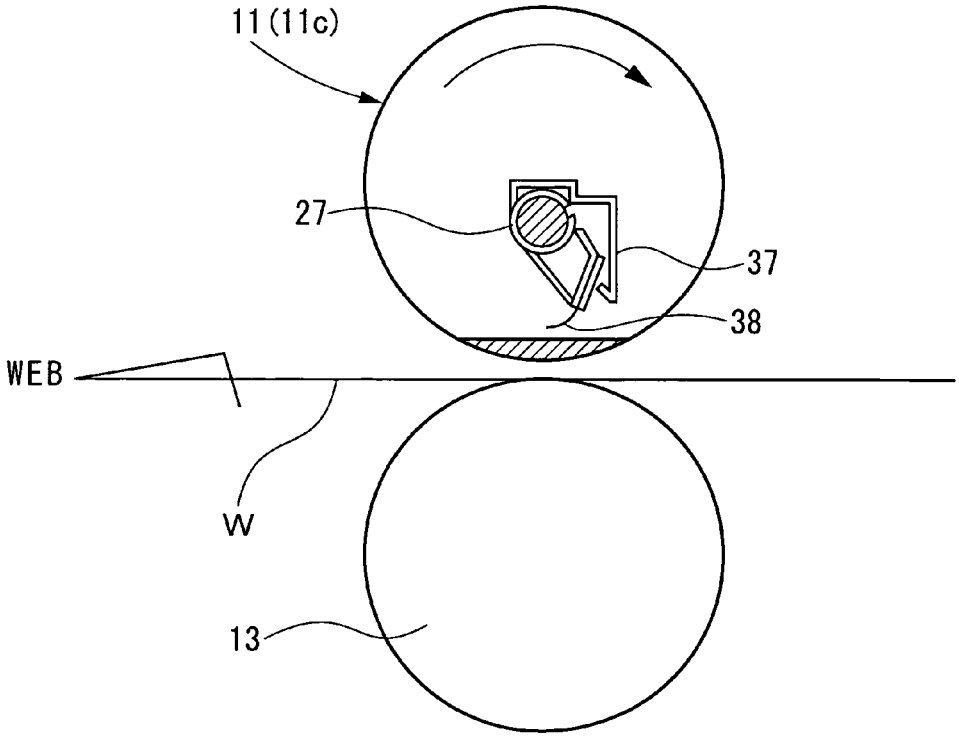
Figure 5A:
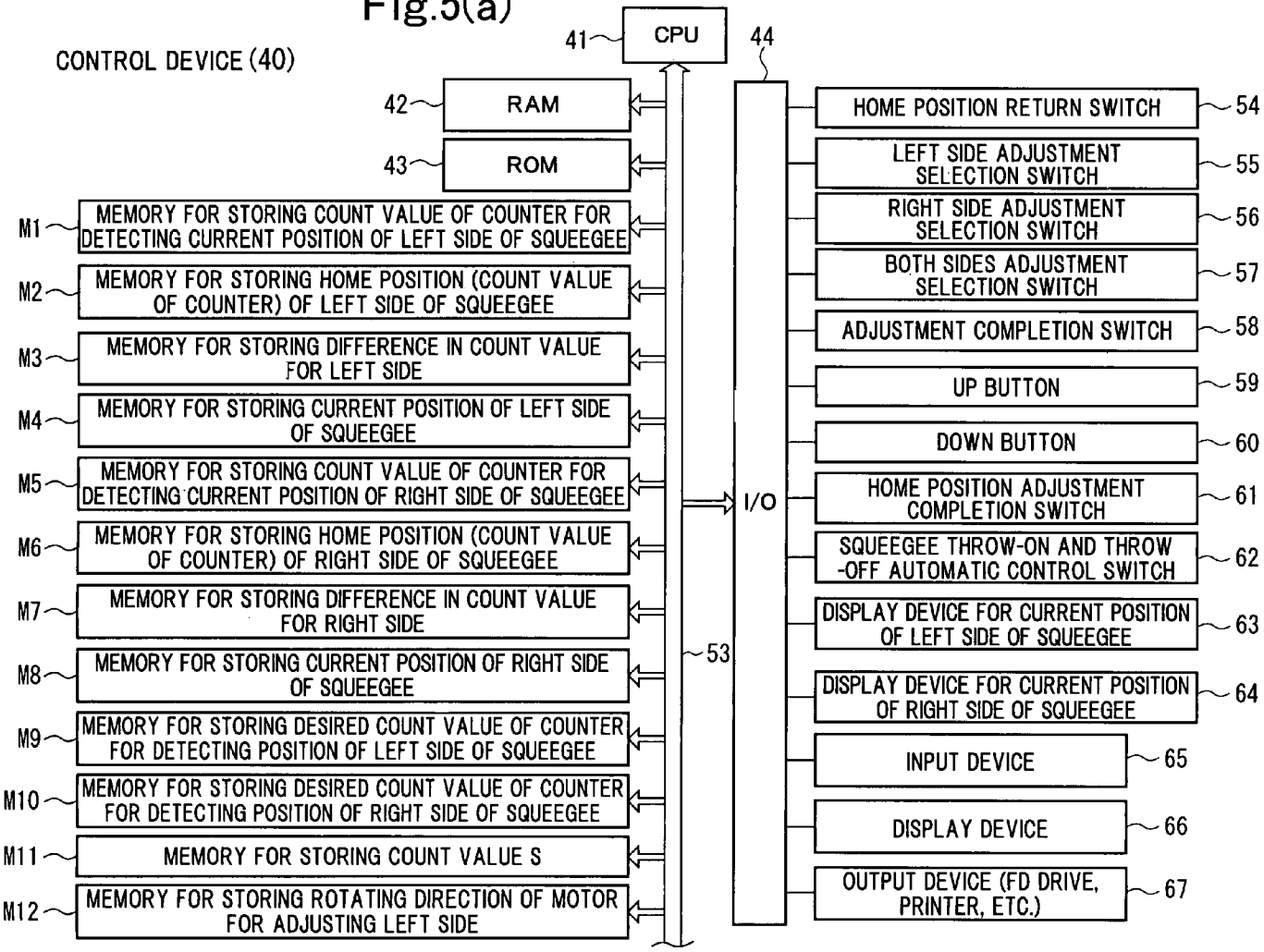
FIG. 5(*a*) is a control block diagram of a control device.
Figure 5B:
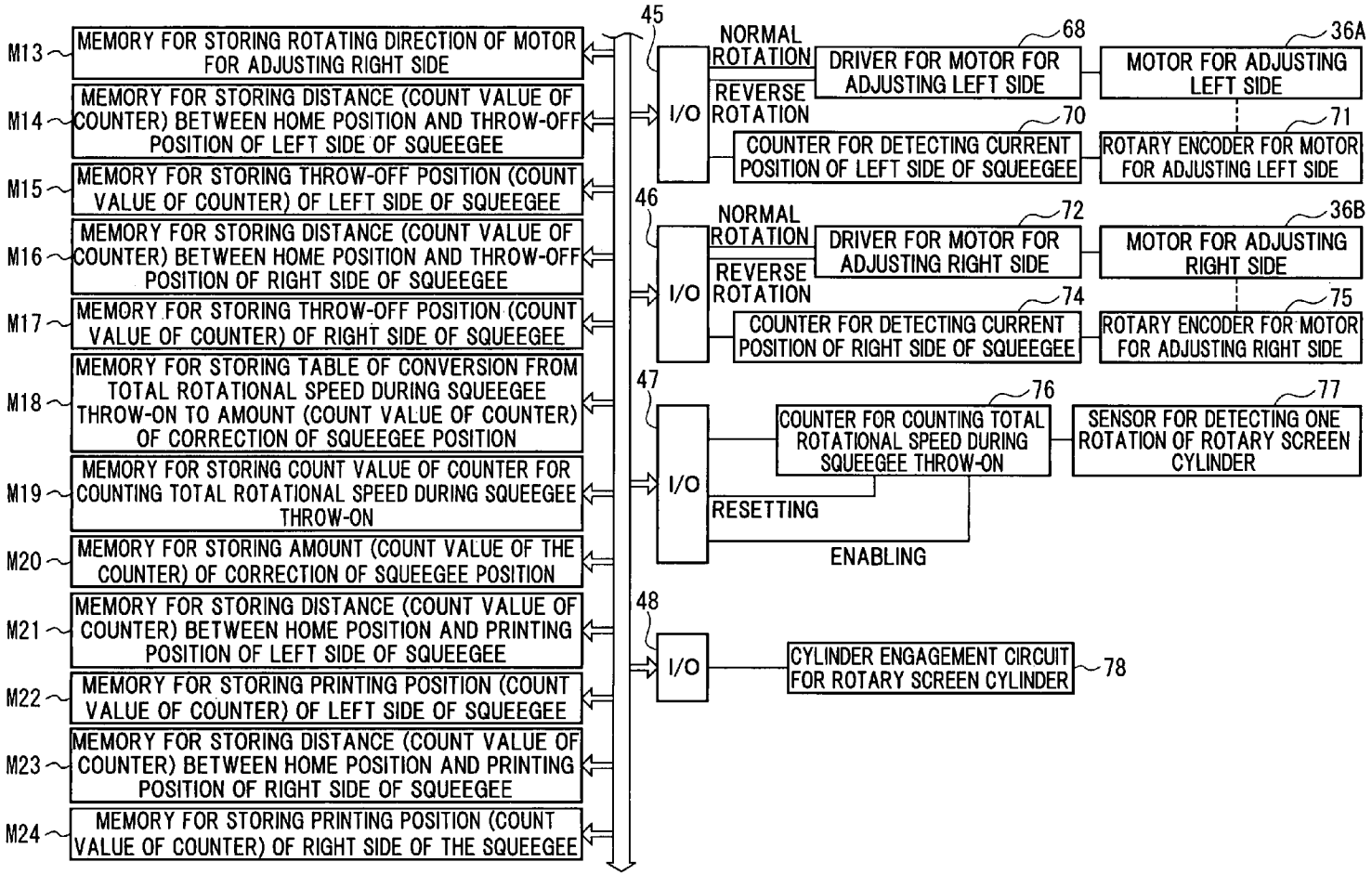
Figure 6A:
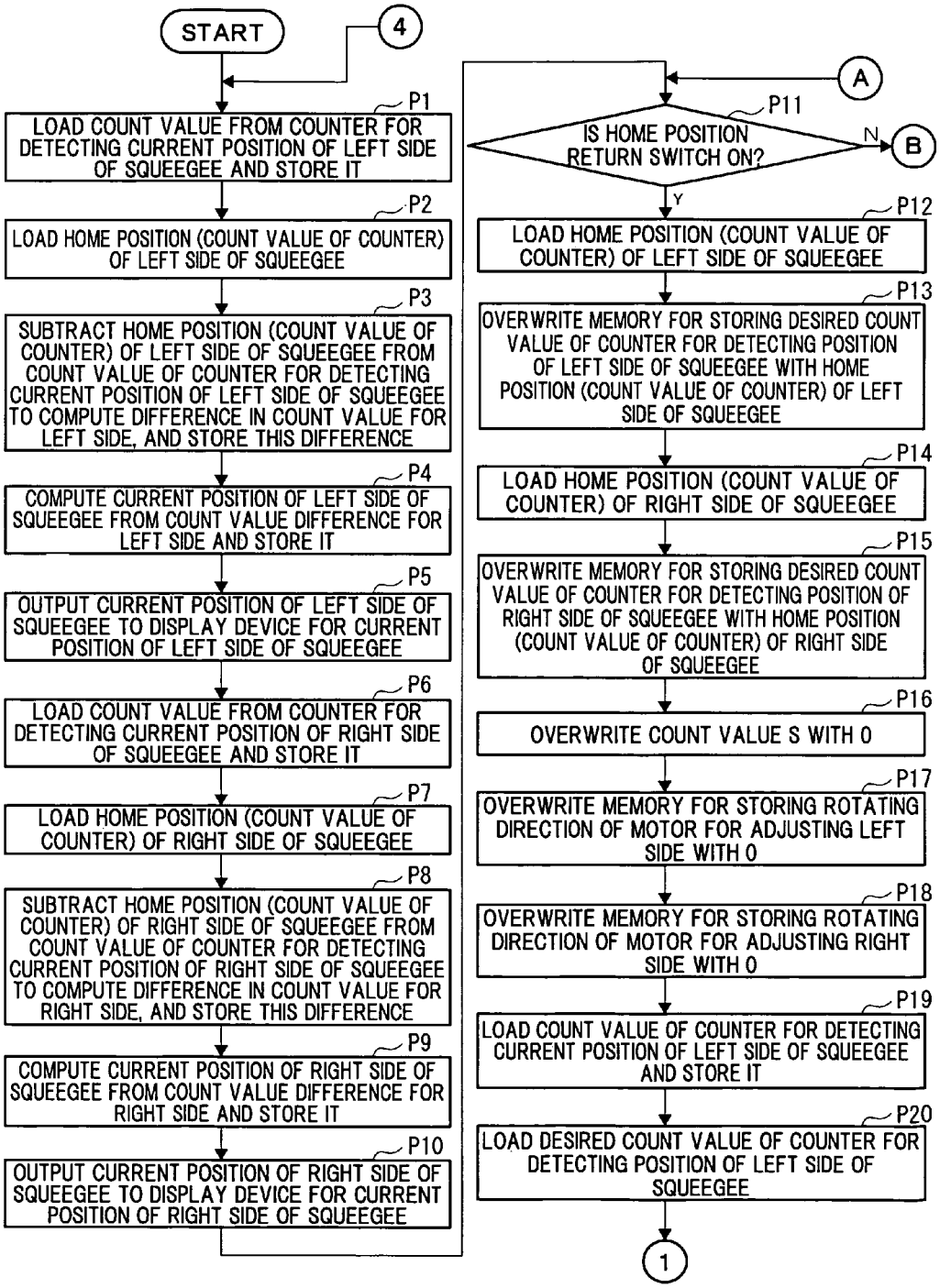
FIG. 6(*a*) is a motion flow chart of the control device.
Figure 6B:
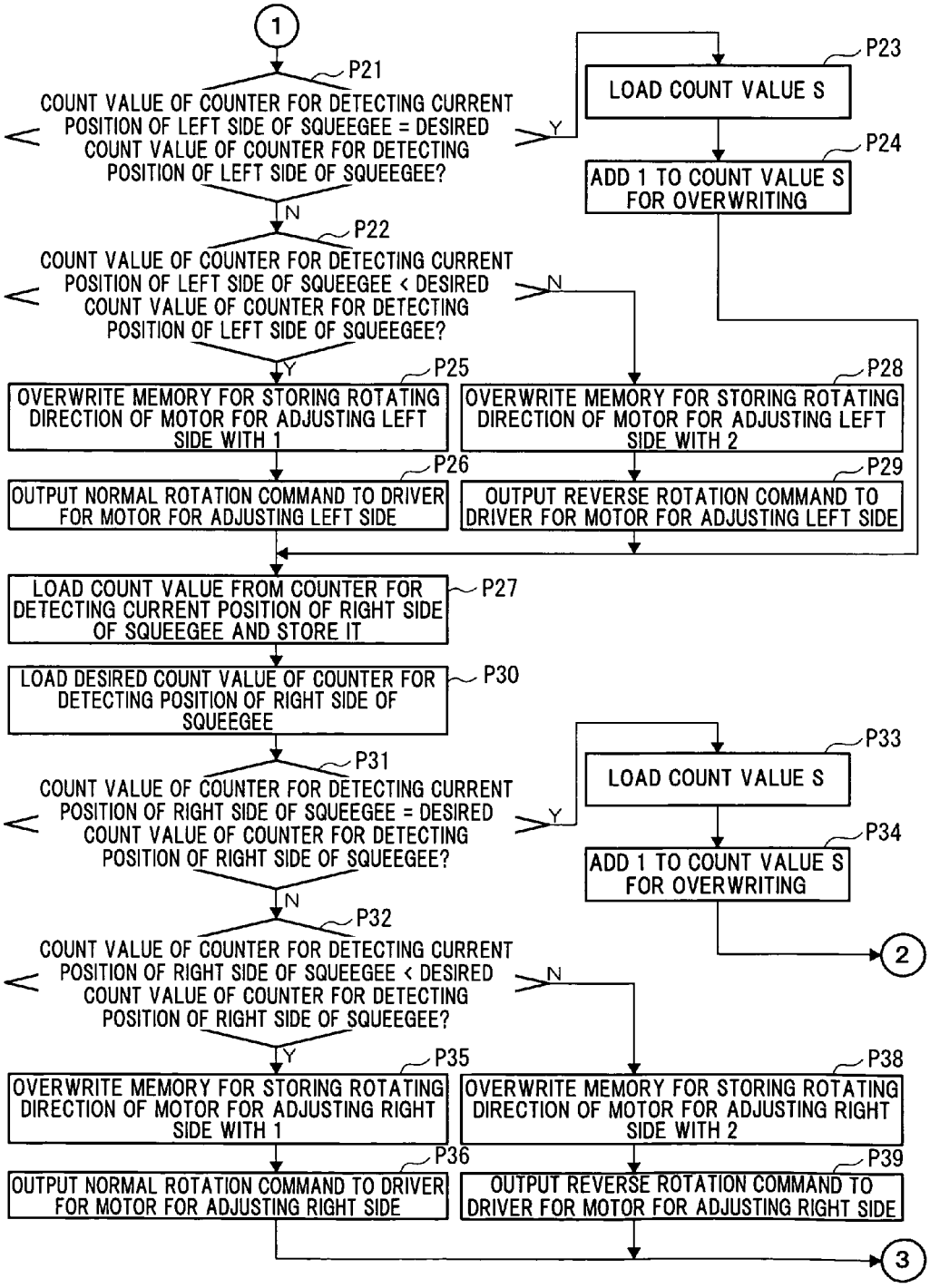
Figure 6C:
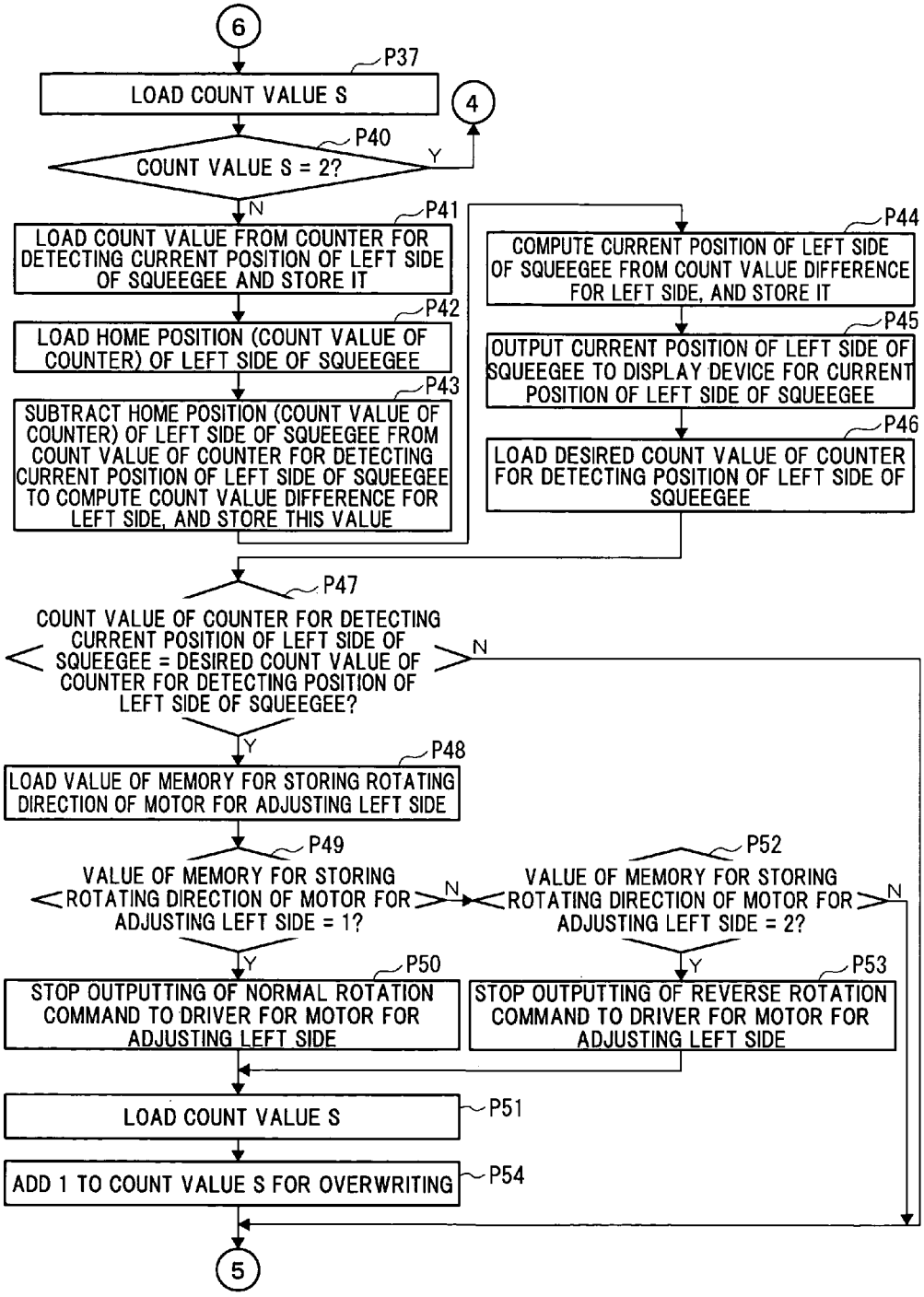
Figure 6D:
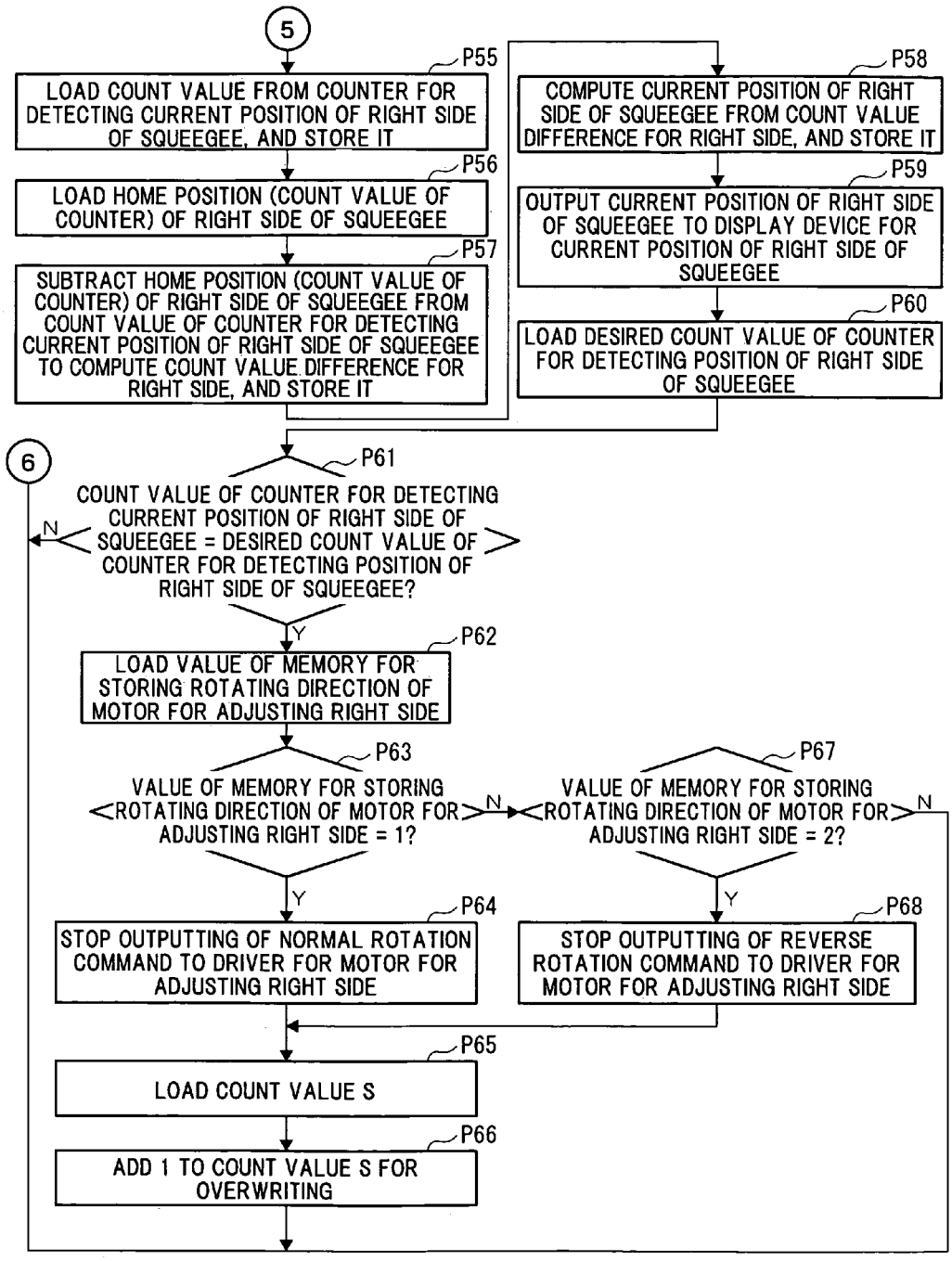
Figure 7A:
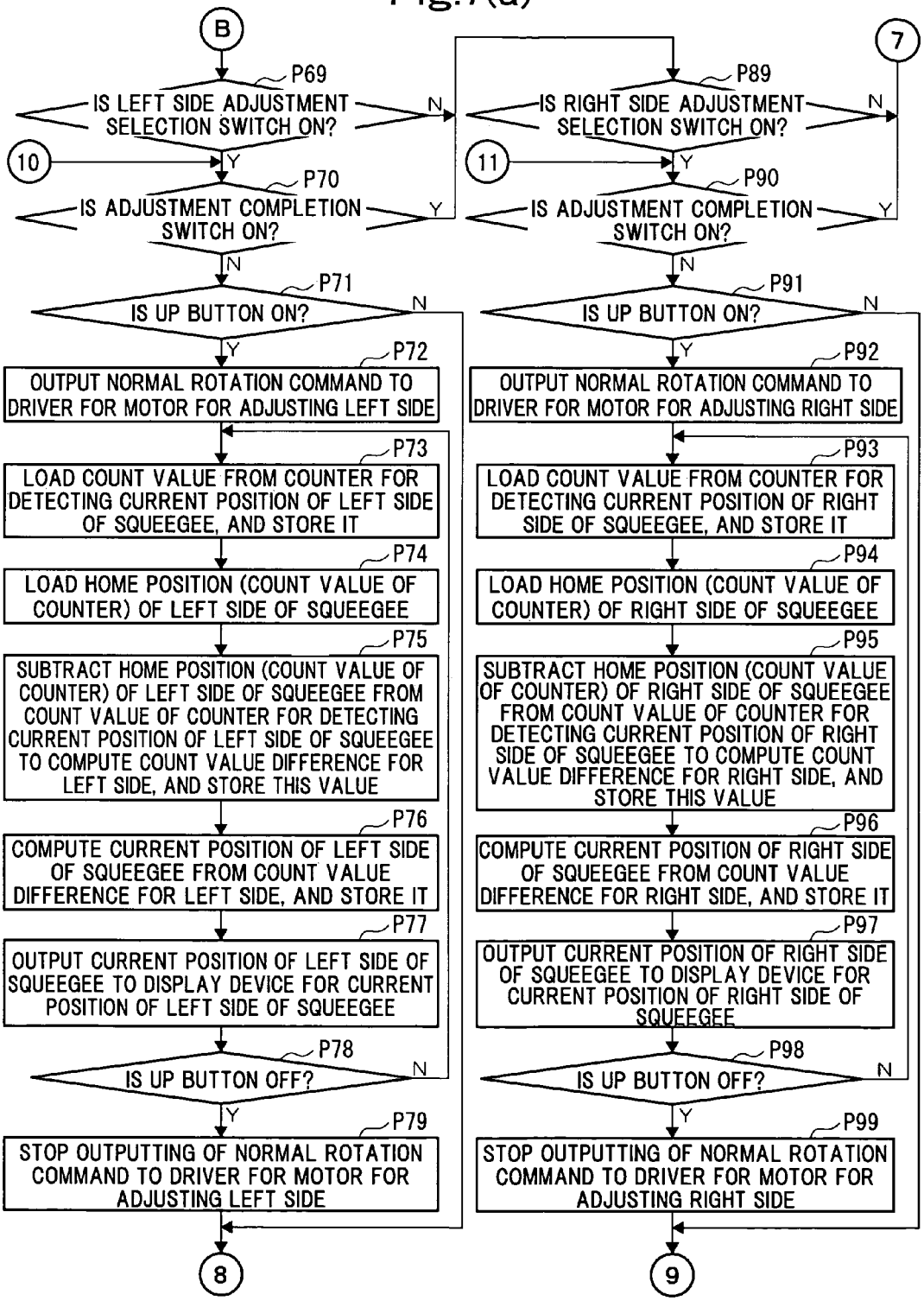
FIG. 7(*a*) is a motion flow chart of the control device.
Figure 7B:
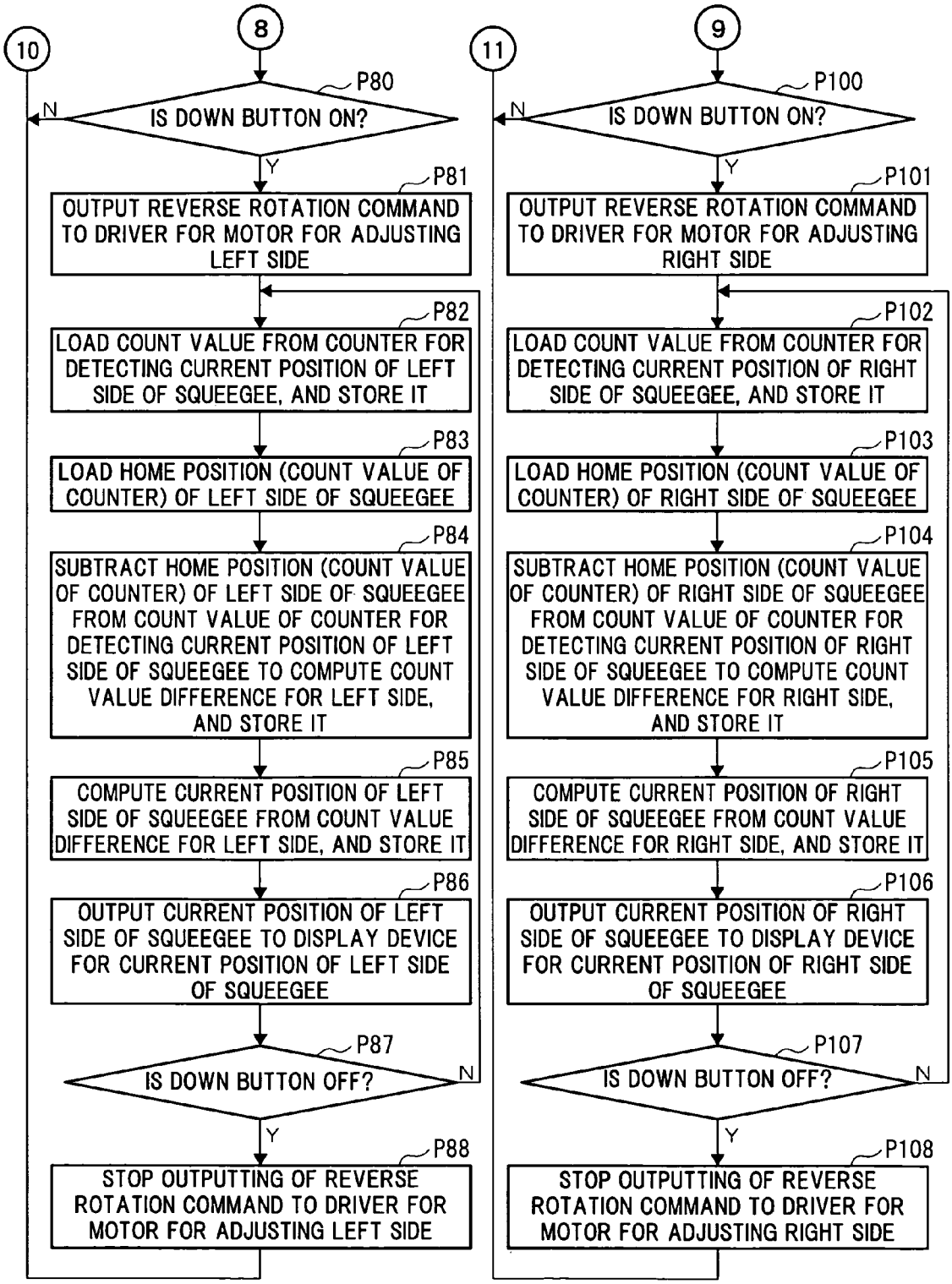
Figure 7C:
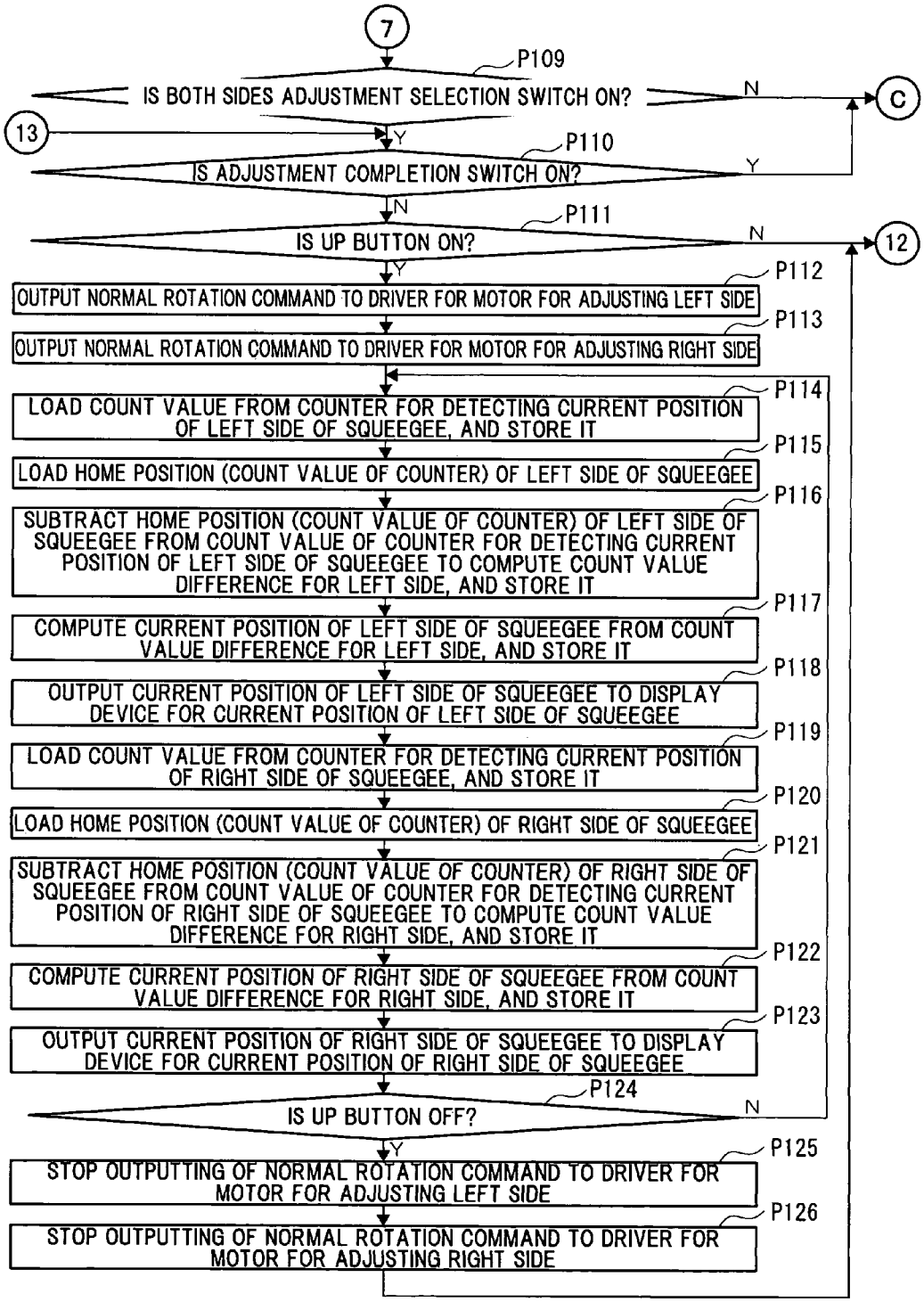
Figure 7D:
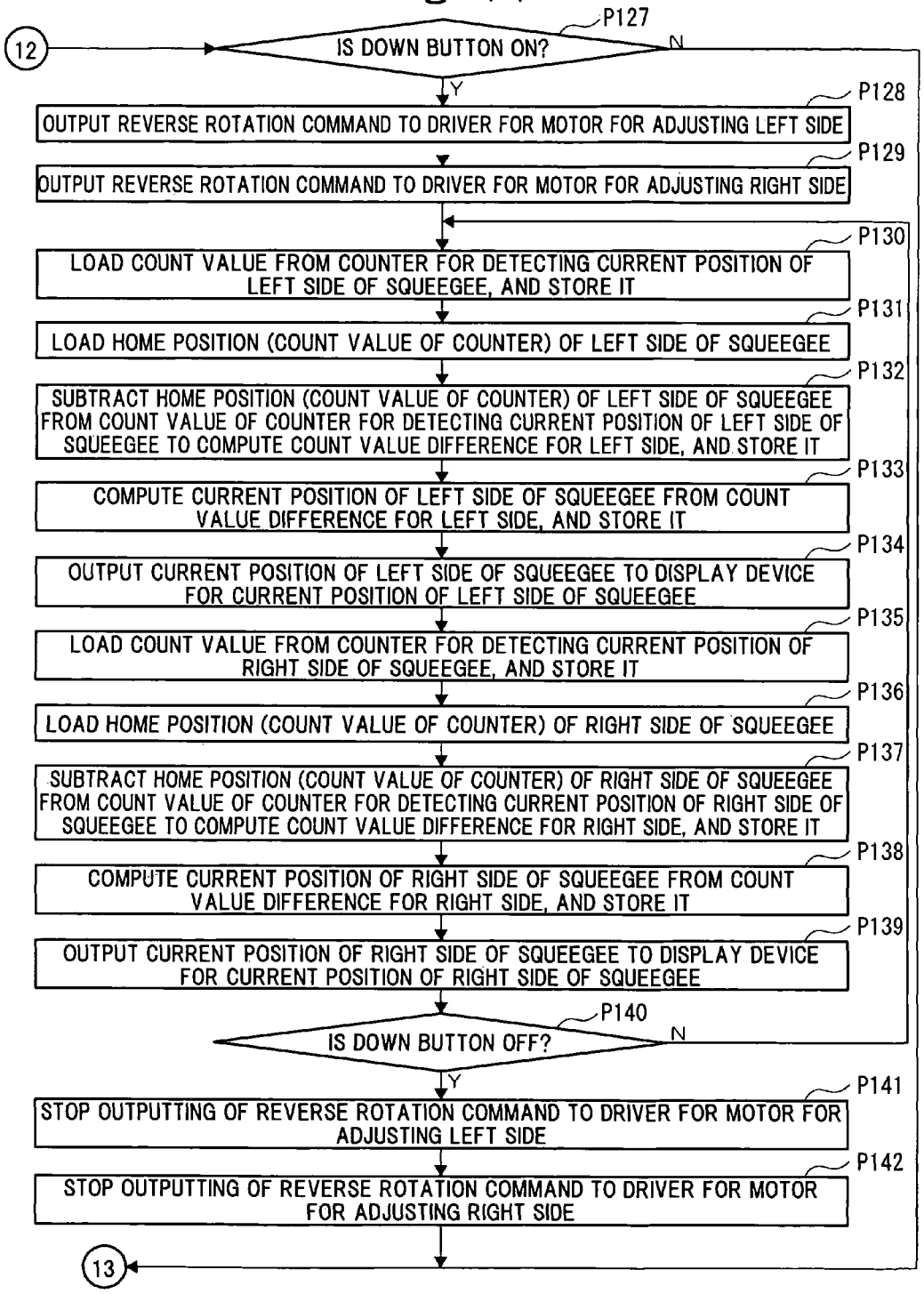
Figure 8:
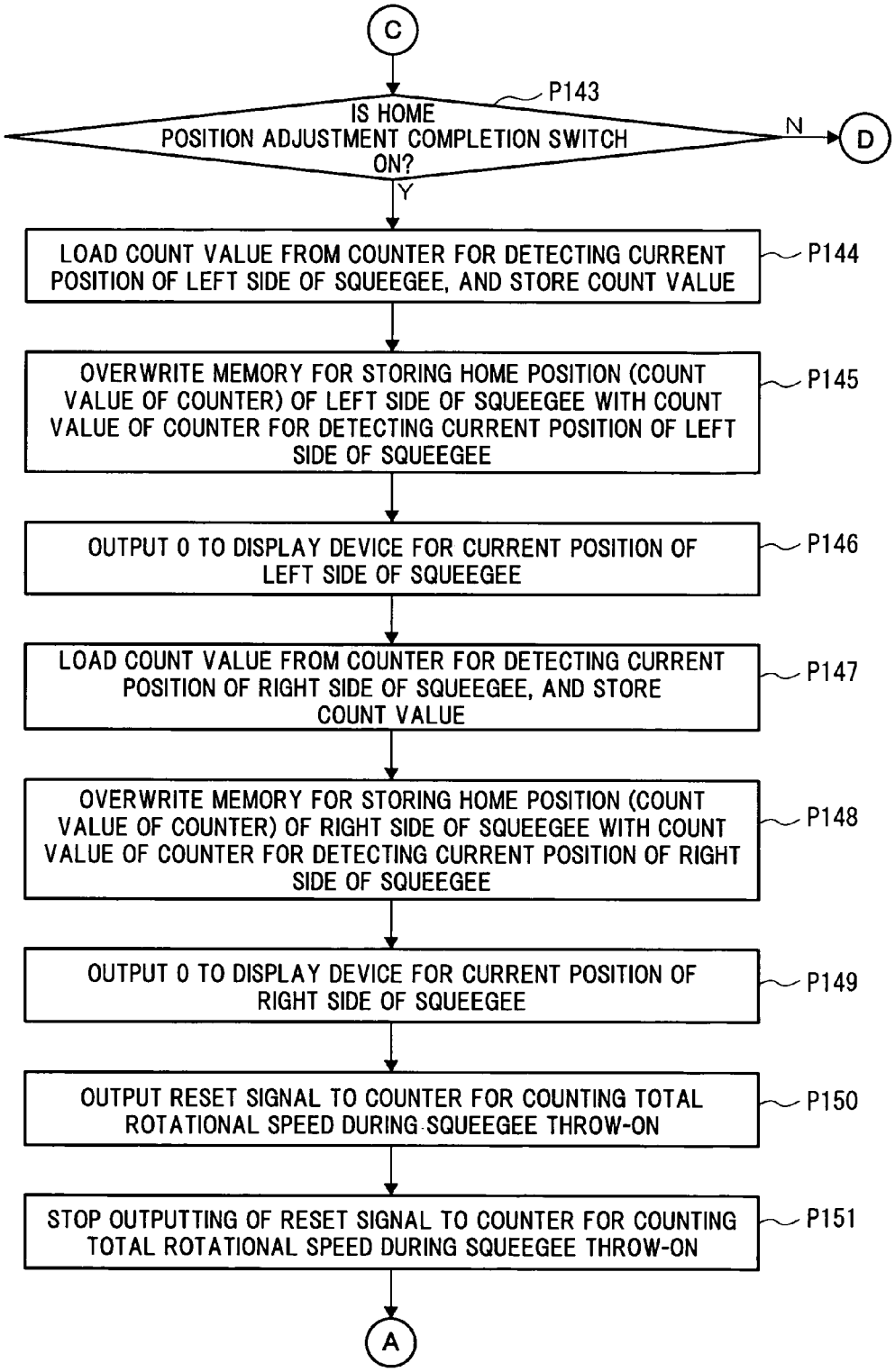
FIG. 8 is a motion flow chart of the control device.
Figure 9A:
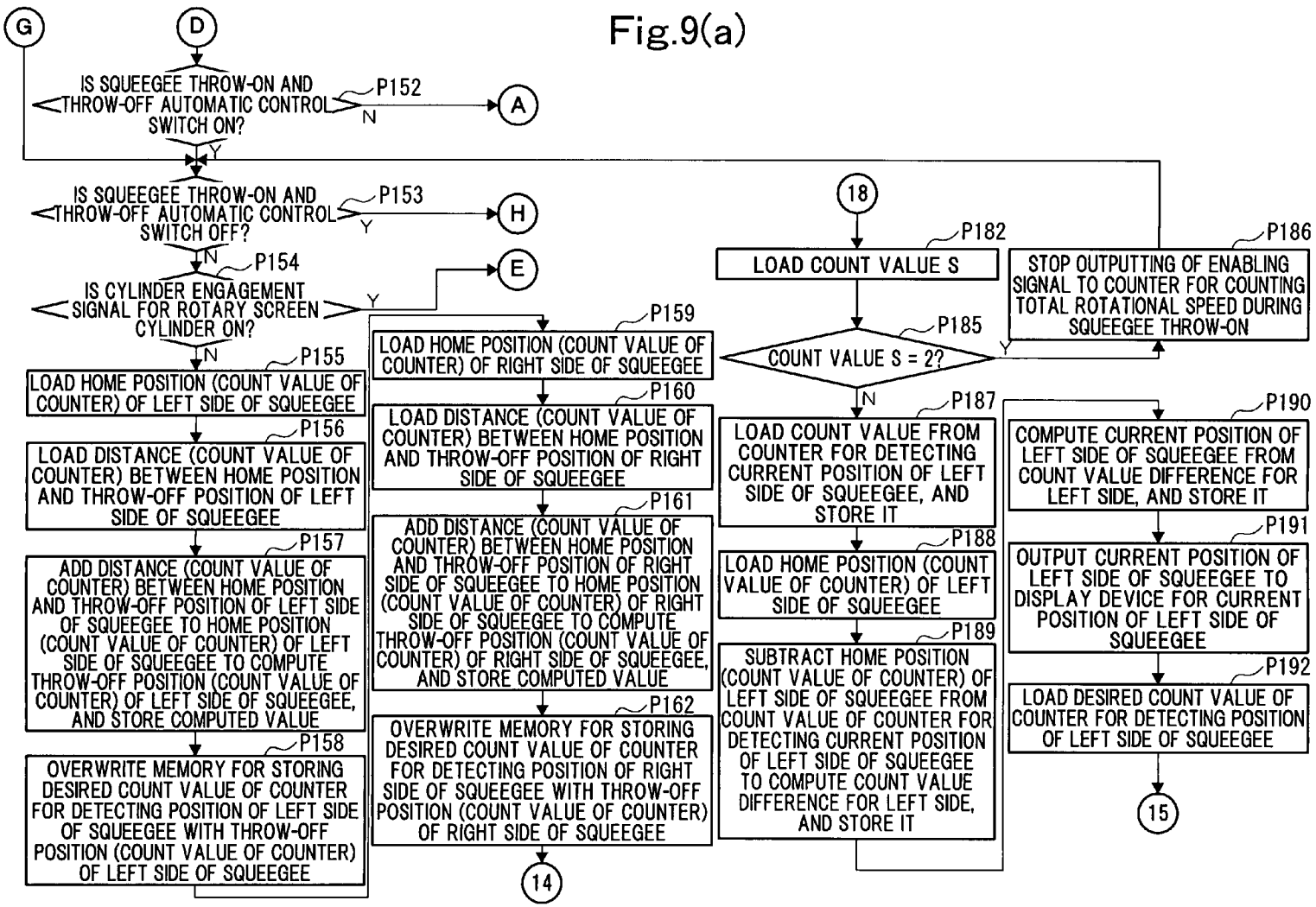
FIG. 9(*a*) is a motion flow chart of the control device.
Figure 9B:
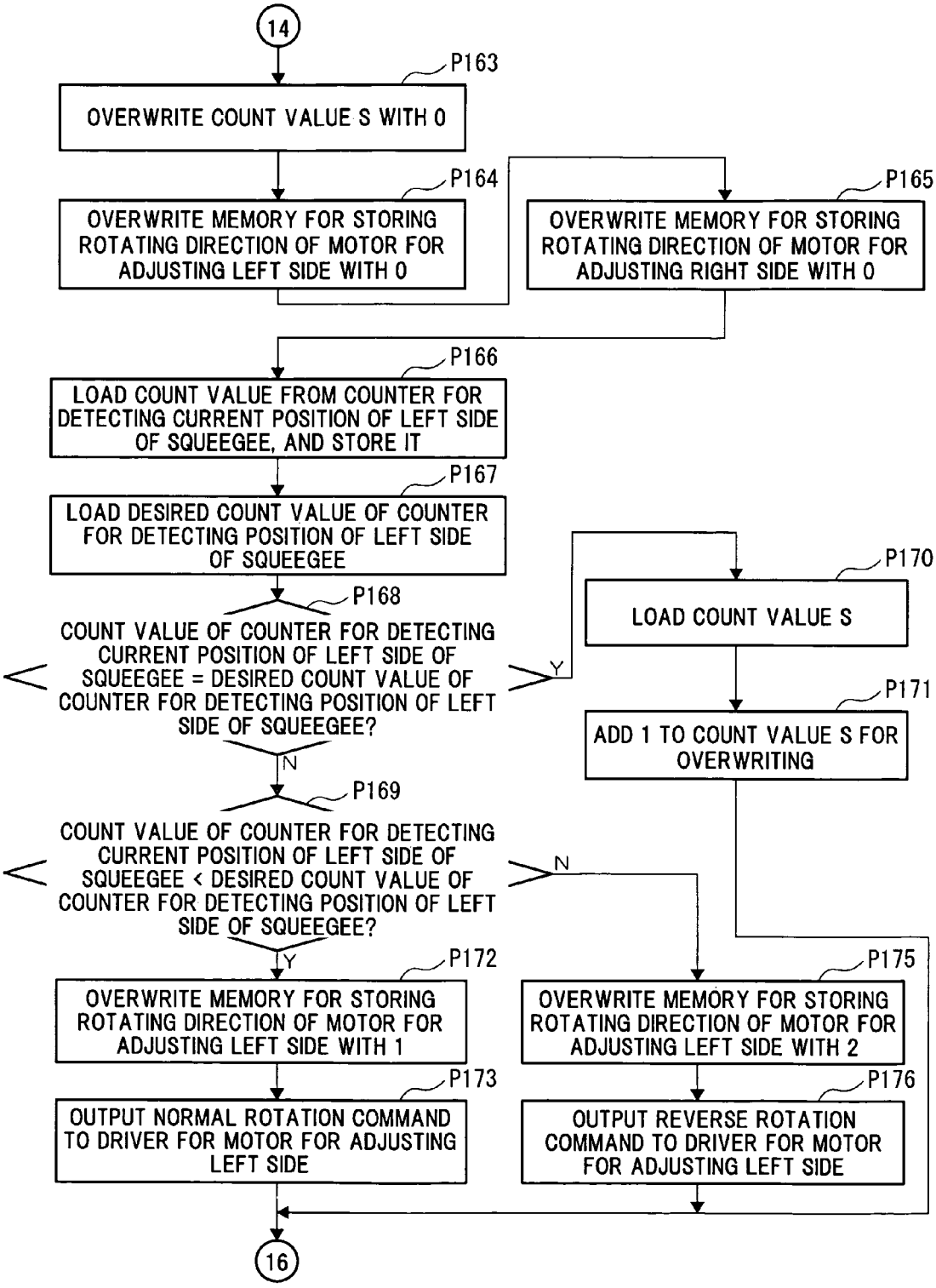
Figure 9C:
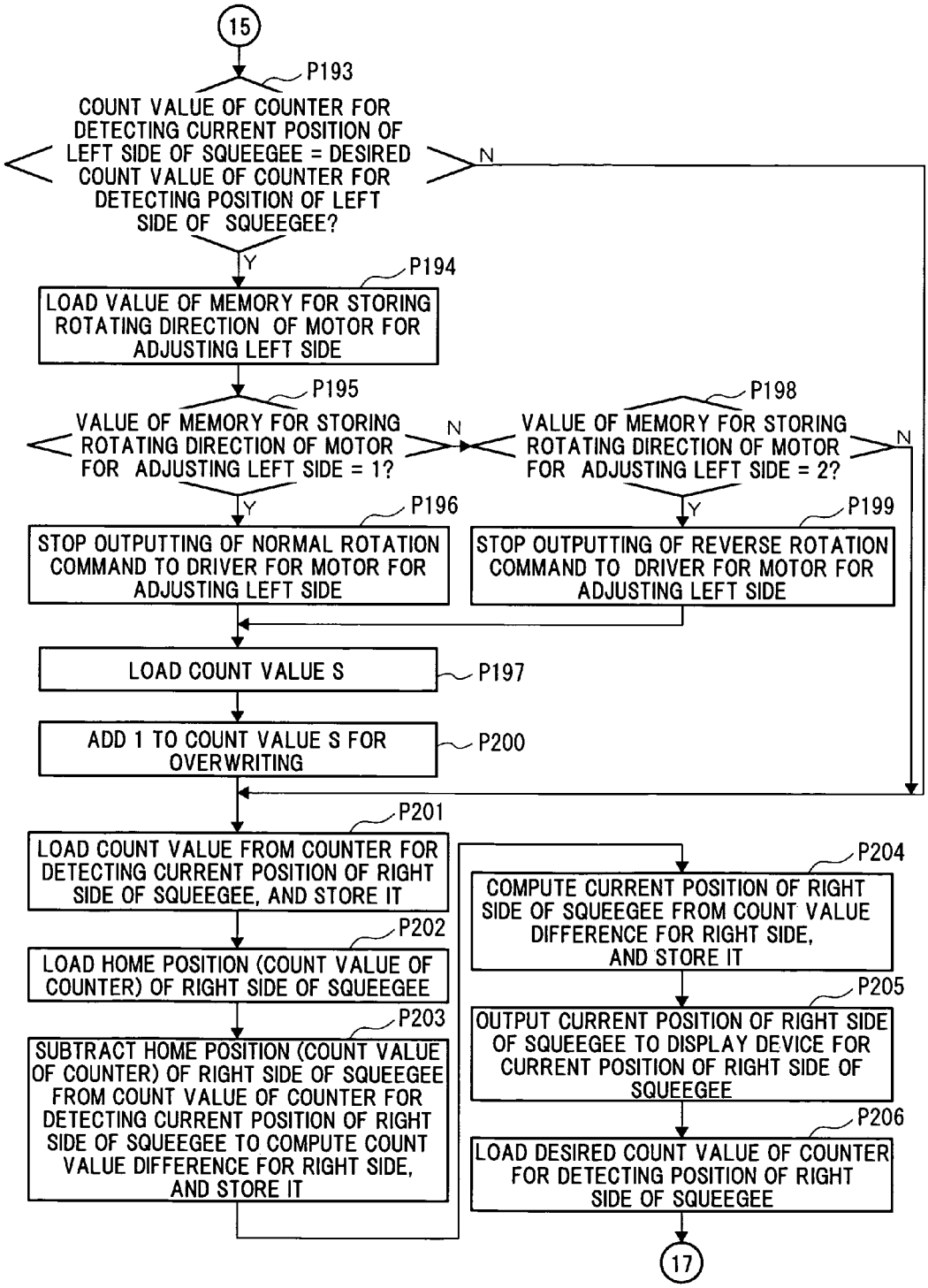
Figure 9D:
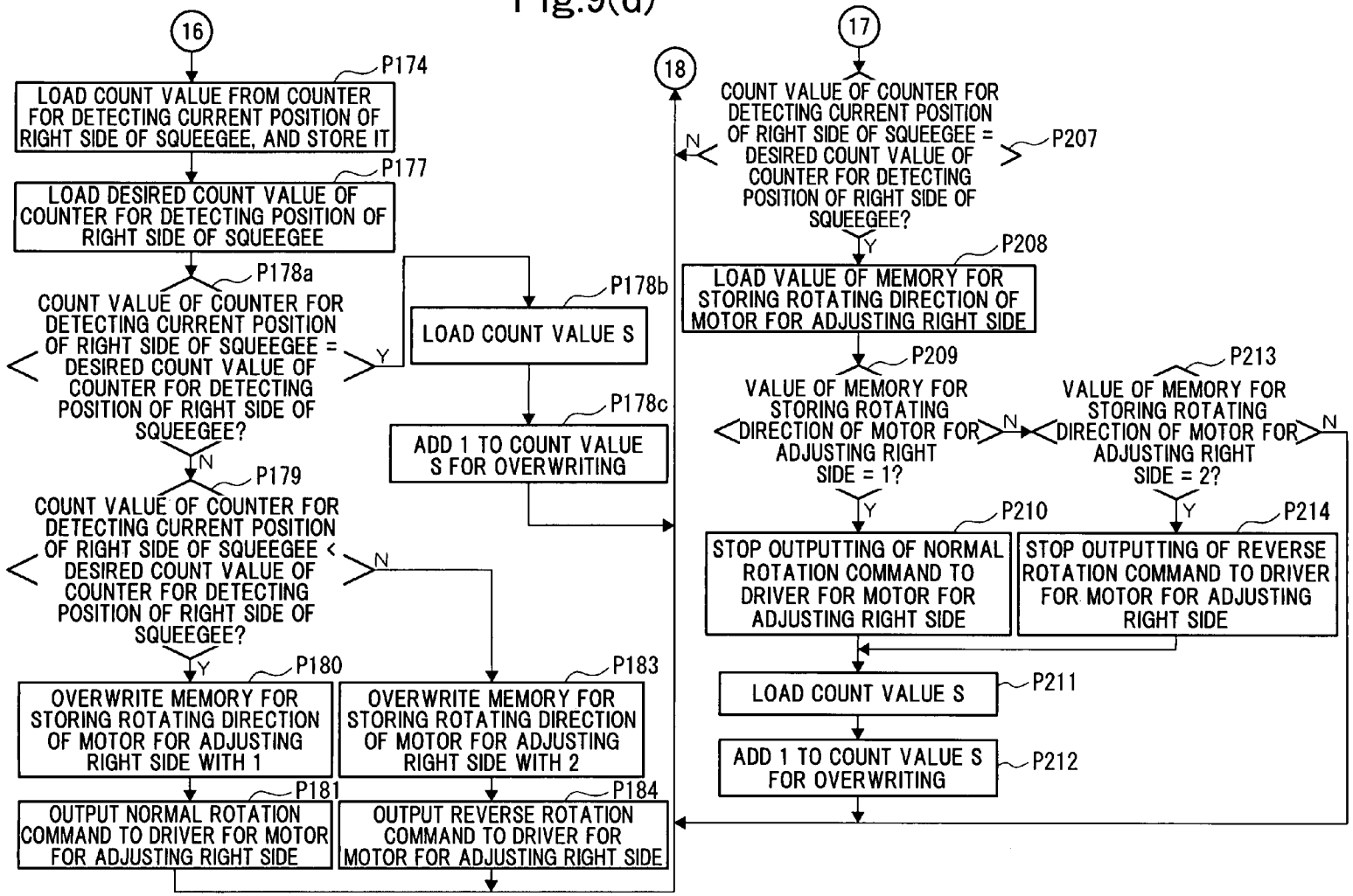
Figure 10A:
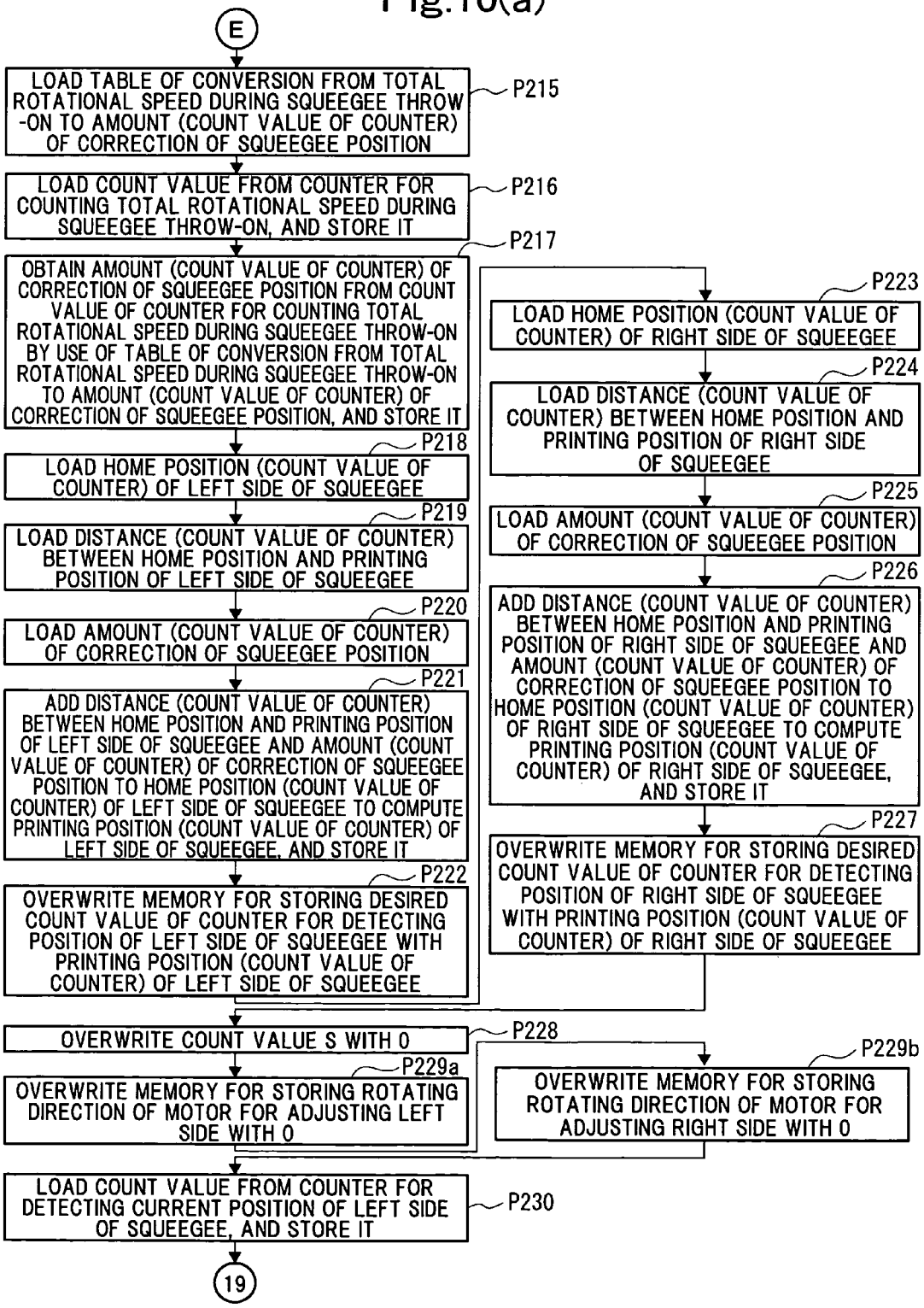
FIG. 10(*a*) is a motion flow chart of the control device.
Figure 10B:
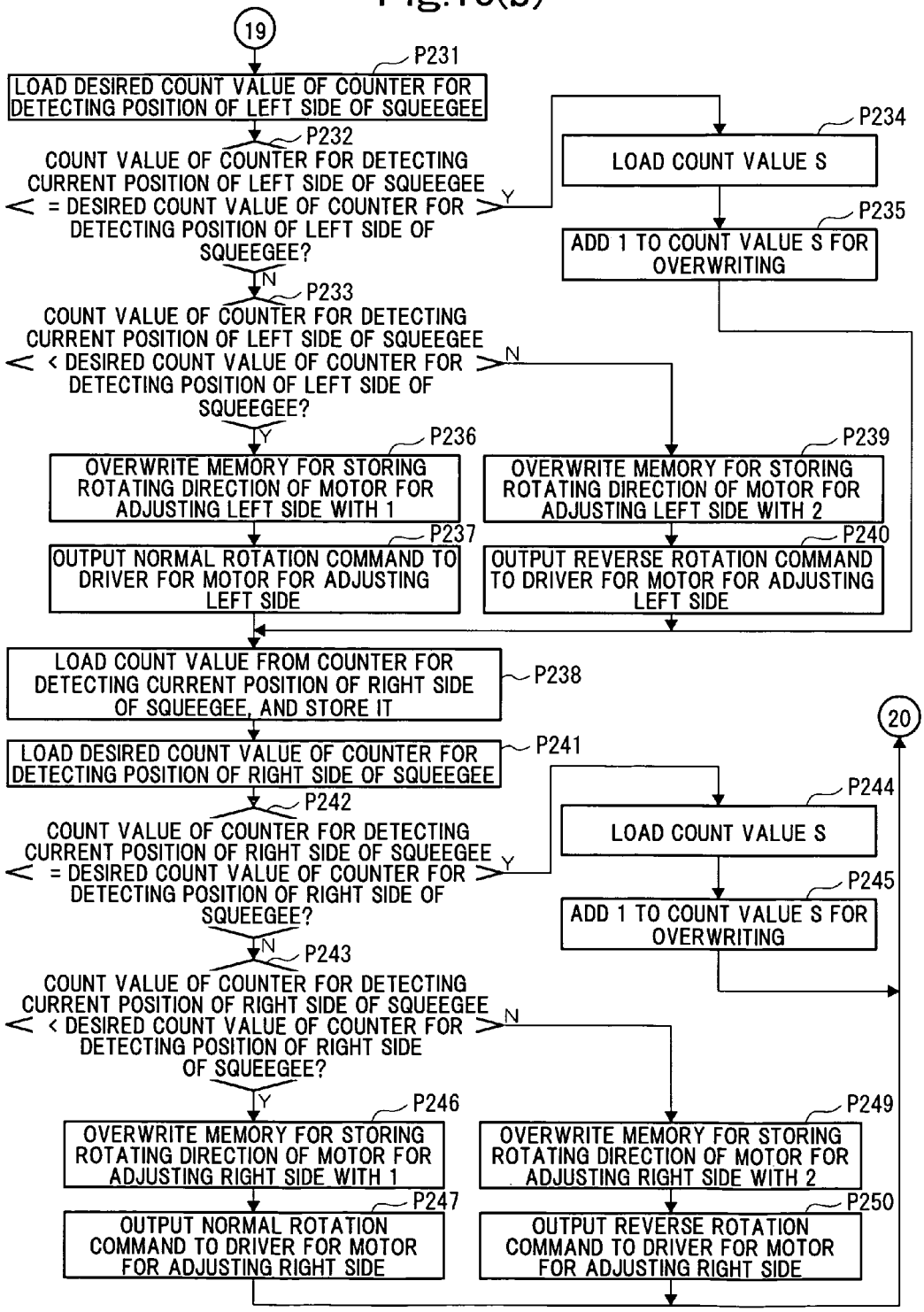
Figure 10C:
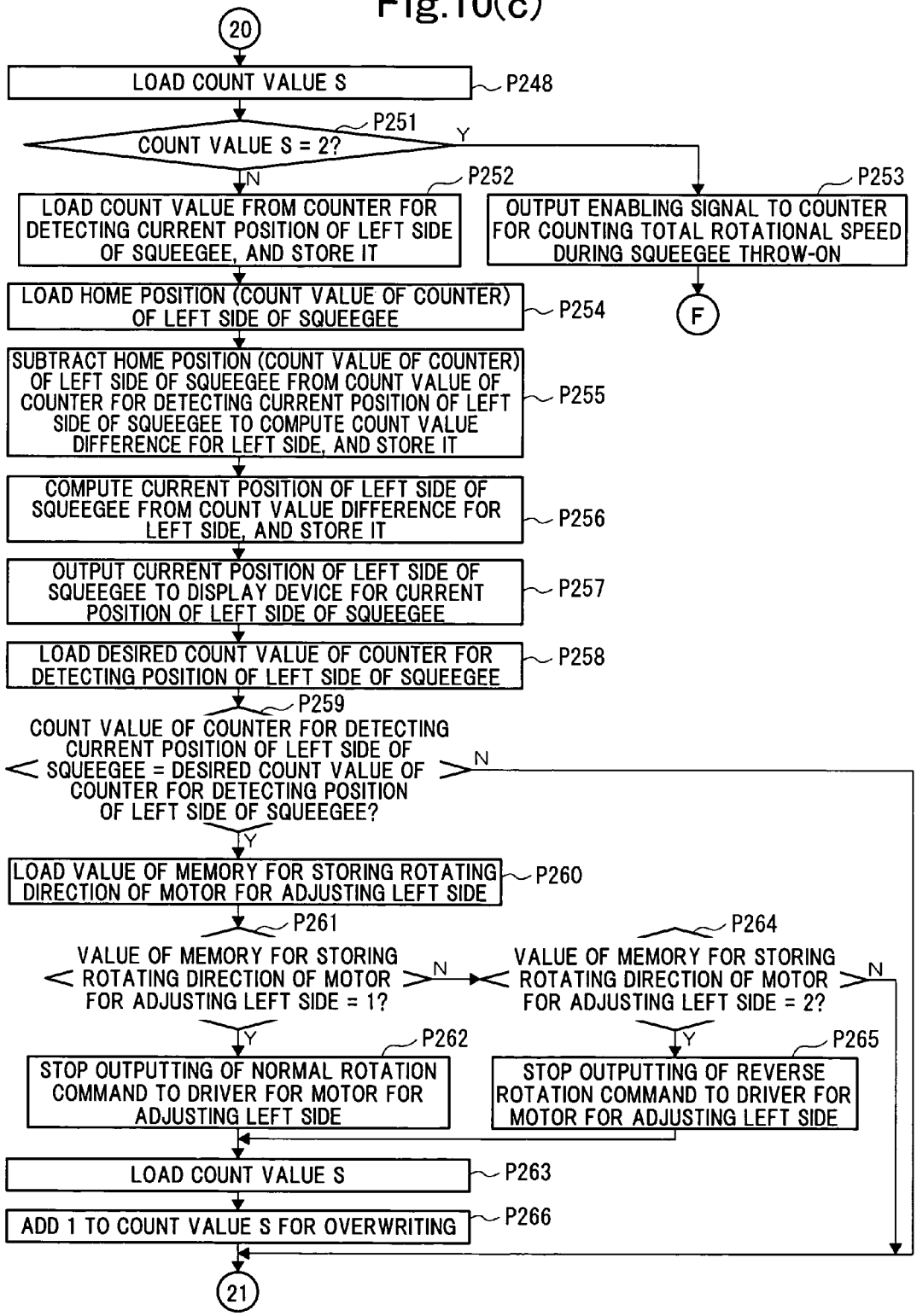
Figure 10D:
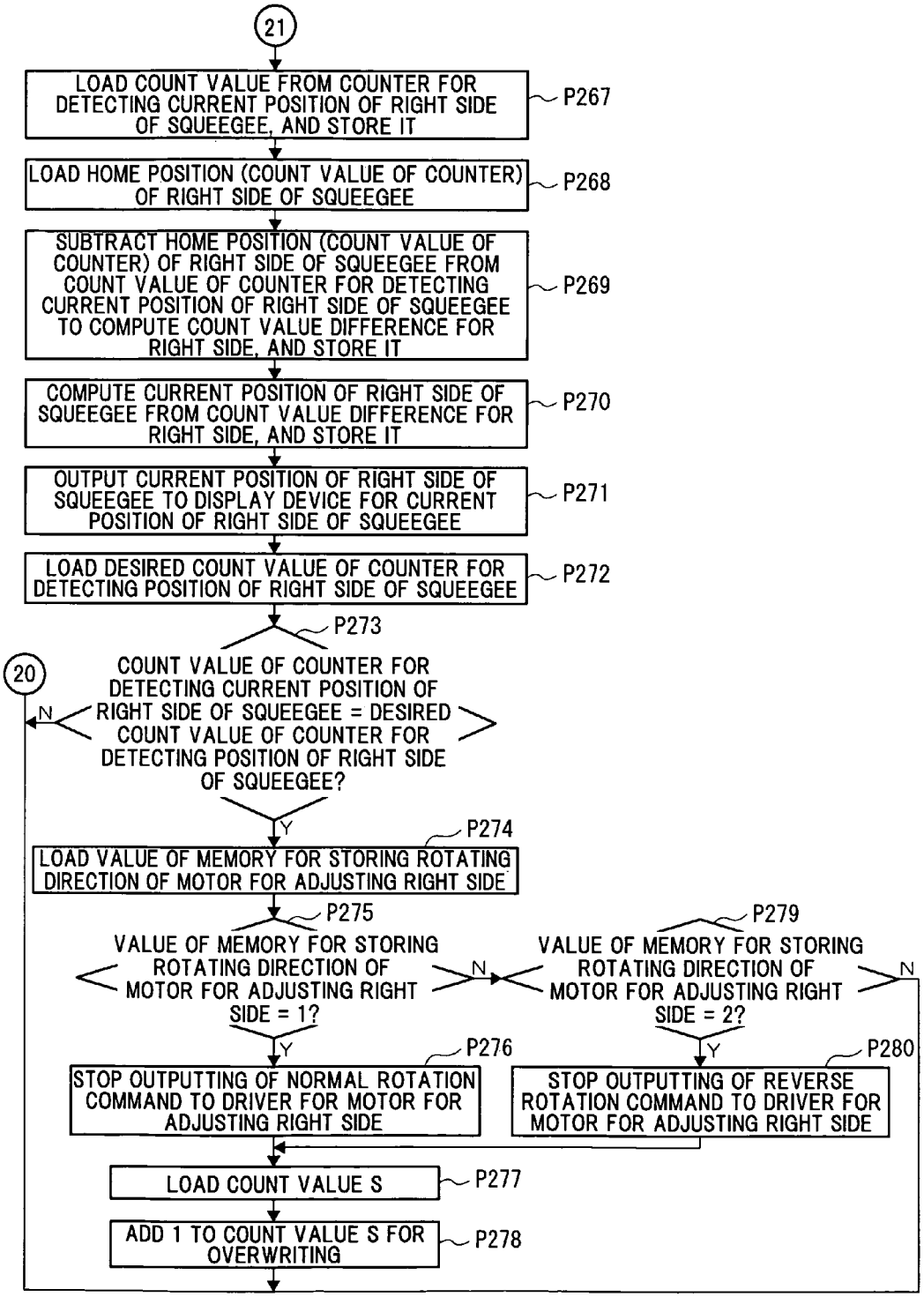
Figure 11A:
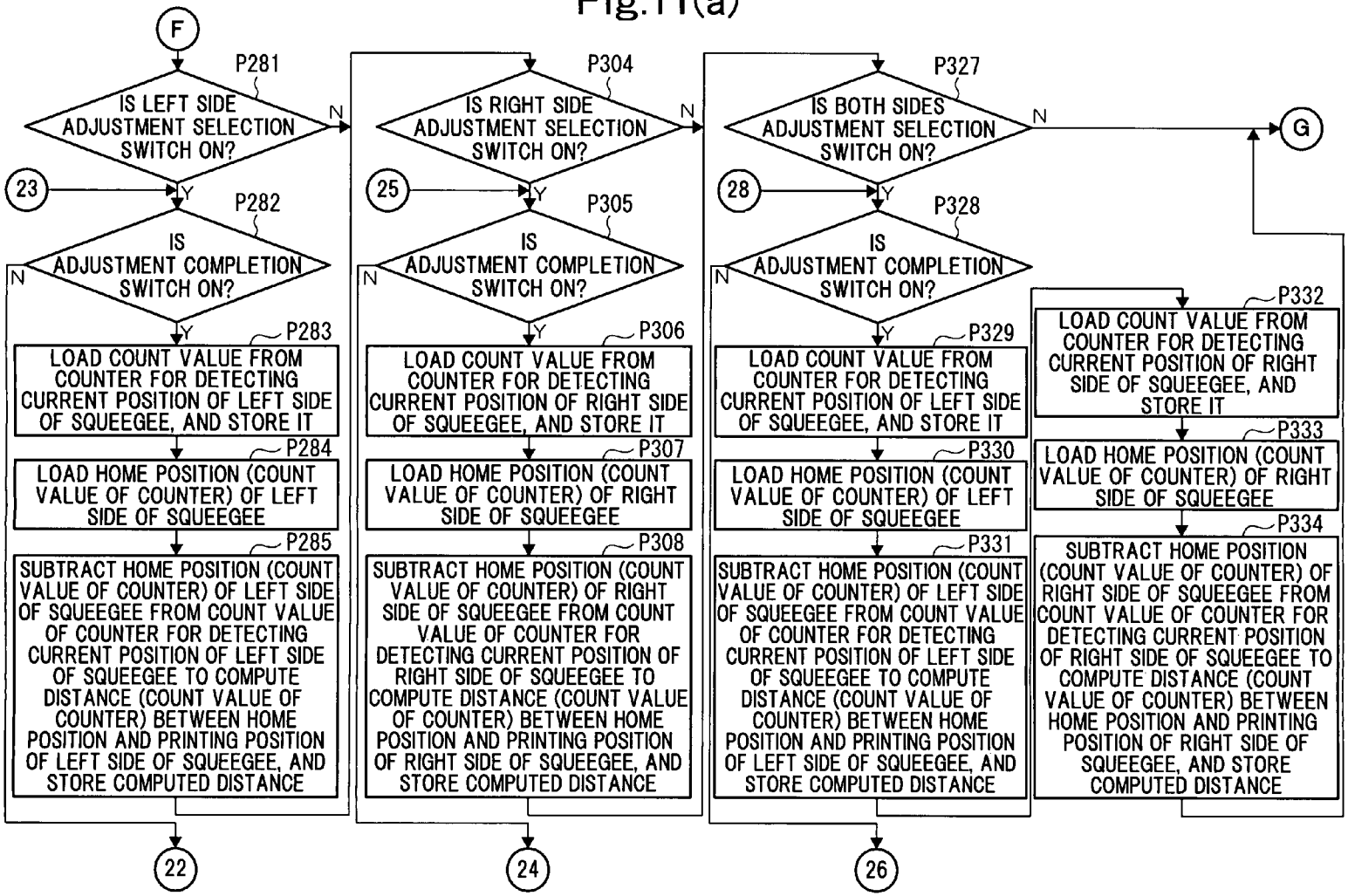
FIG. 11(*a*) is a motion flow chart of the control device.
Figure 11B:
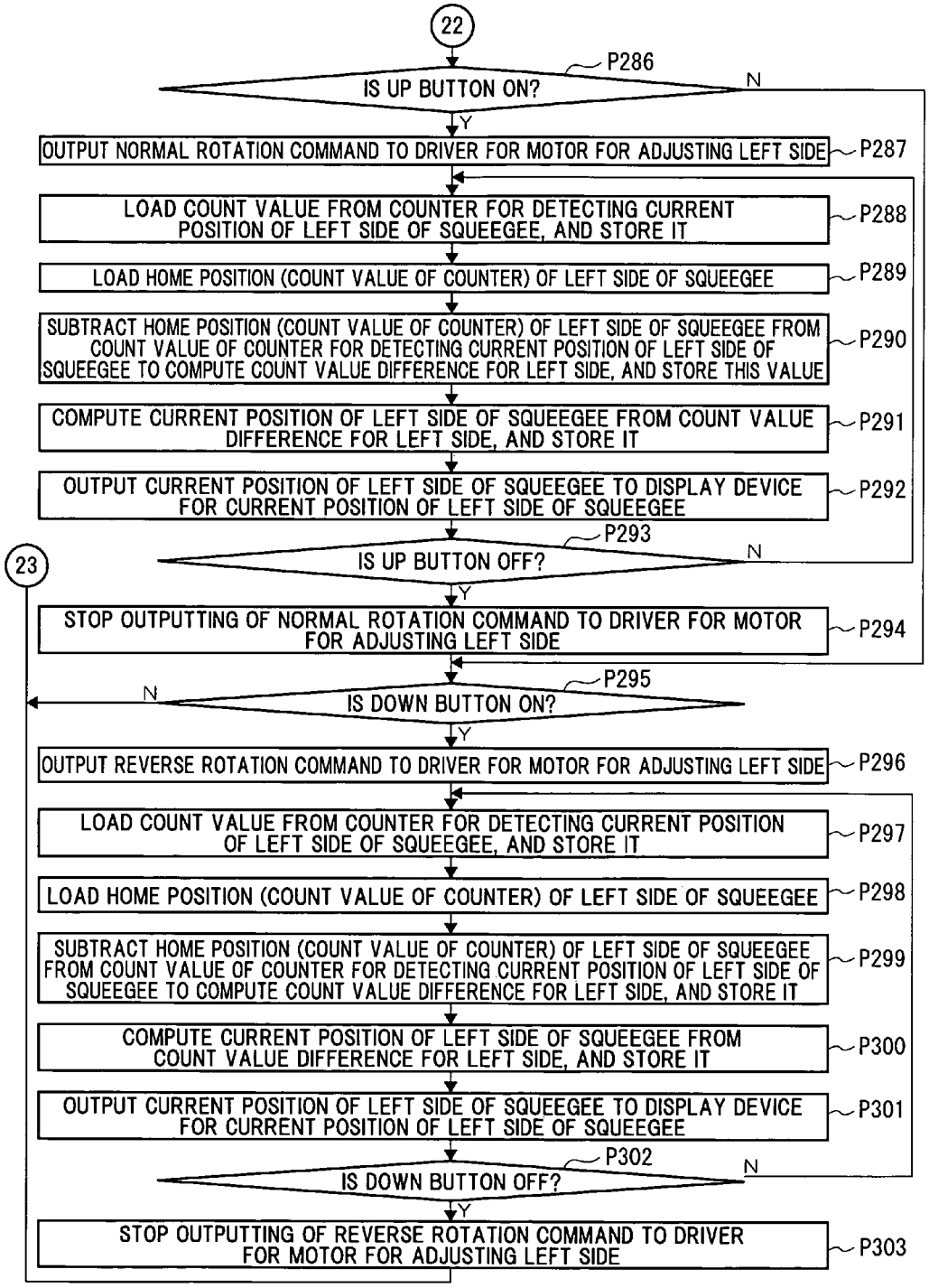
Figure 11C:
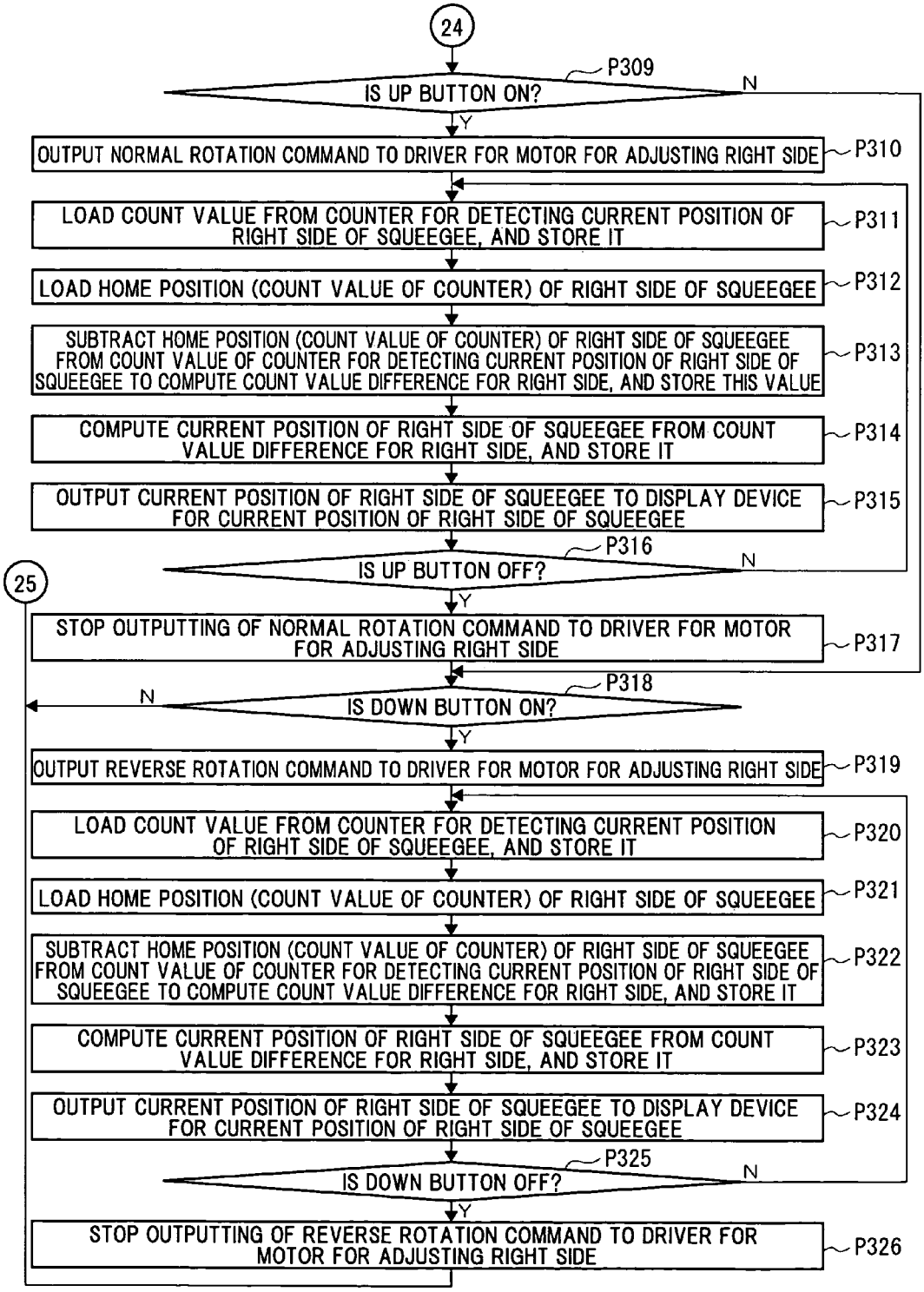
Figure 11D:
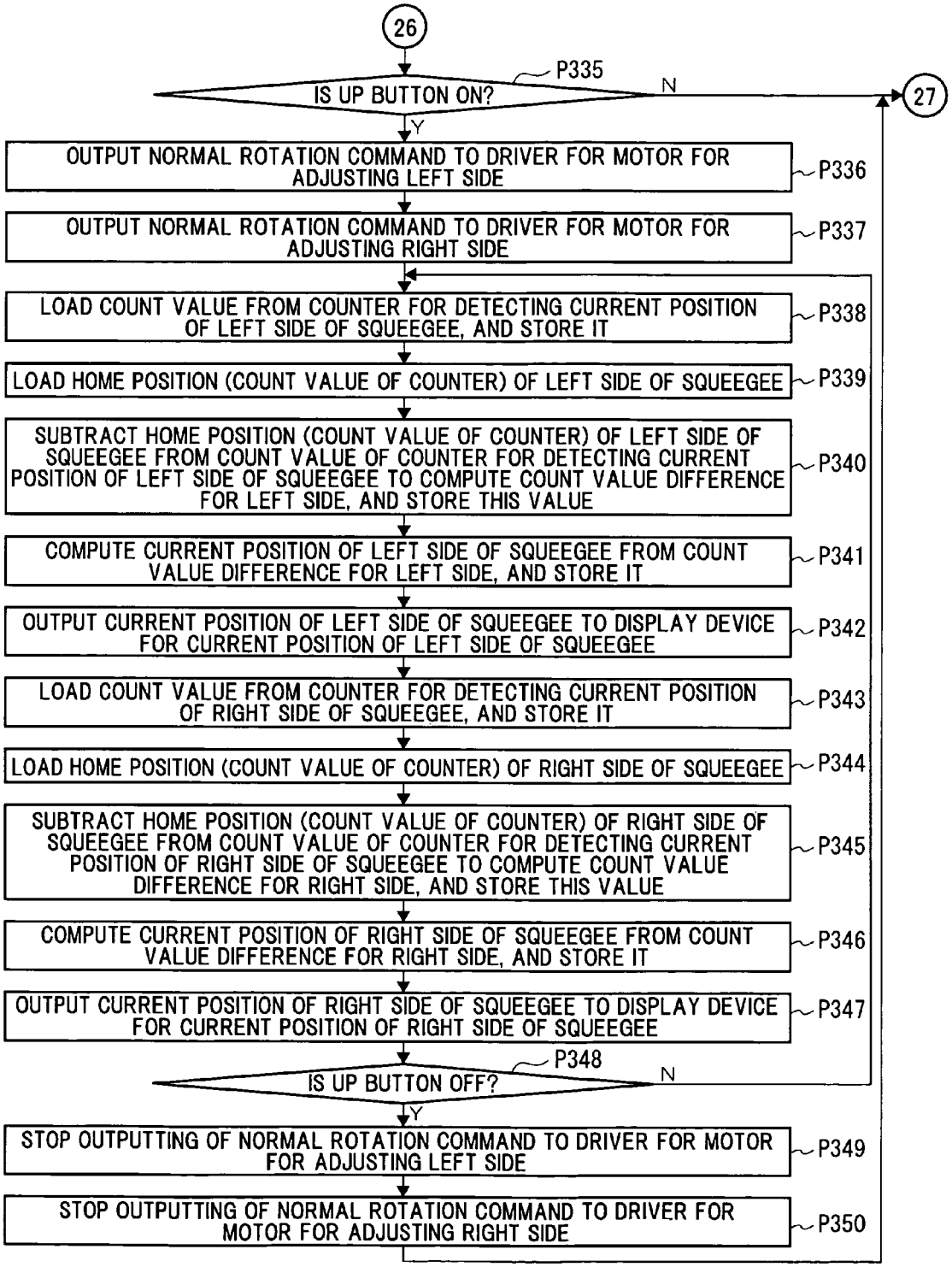
Figure 11E:
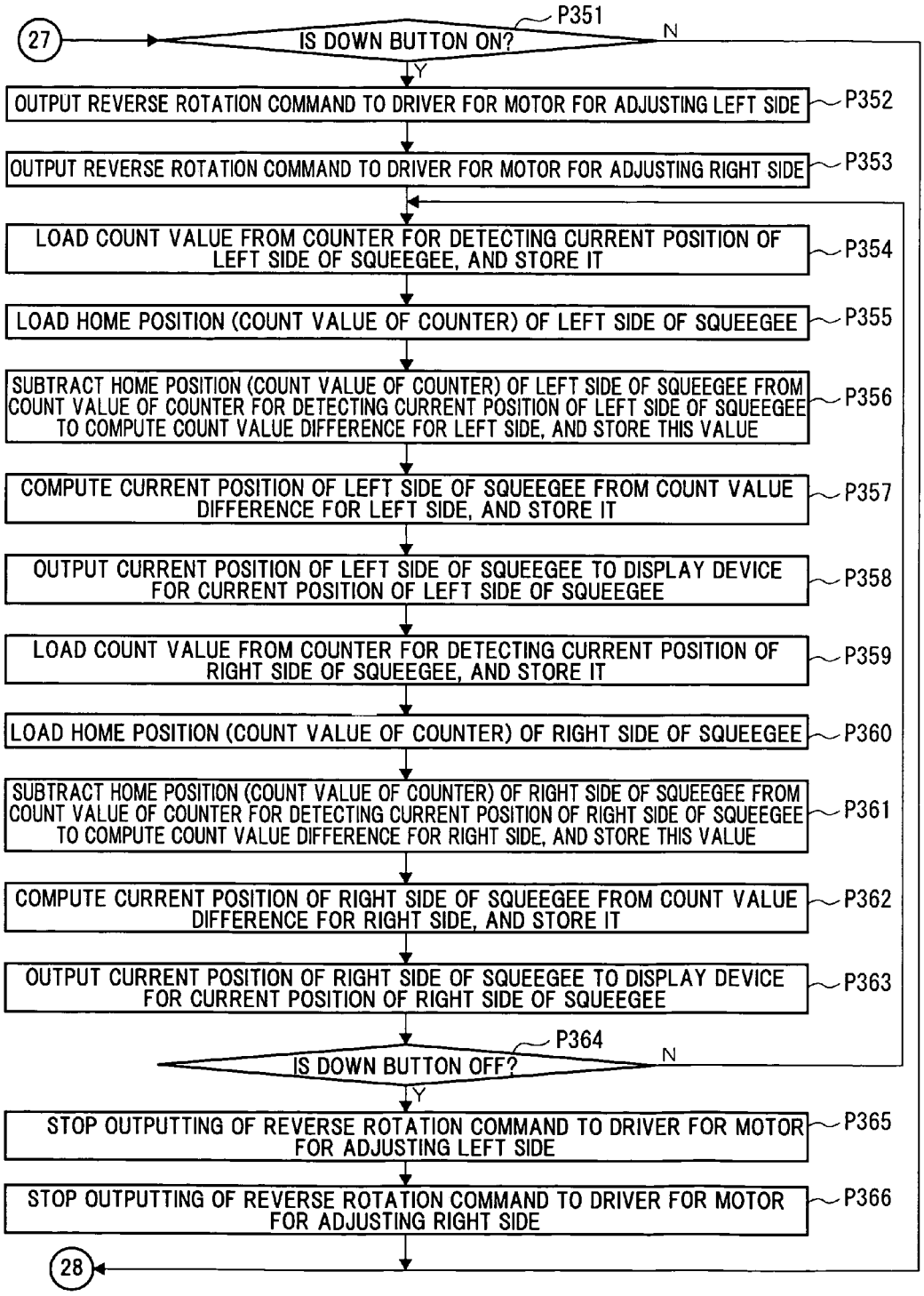
Figure 12A:
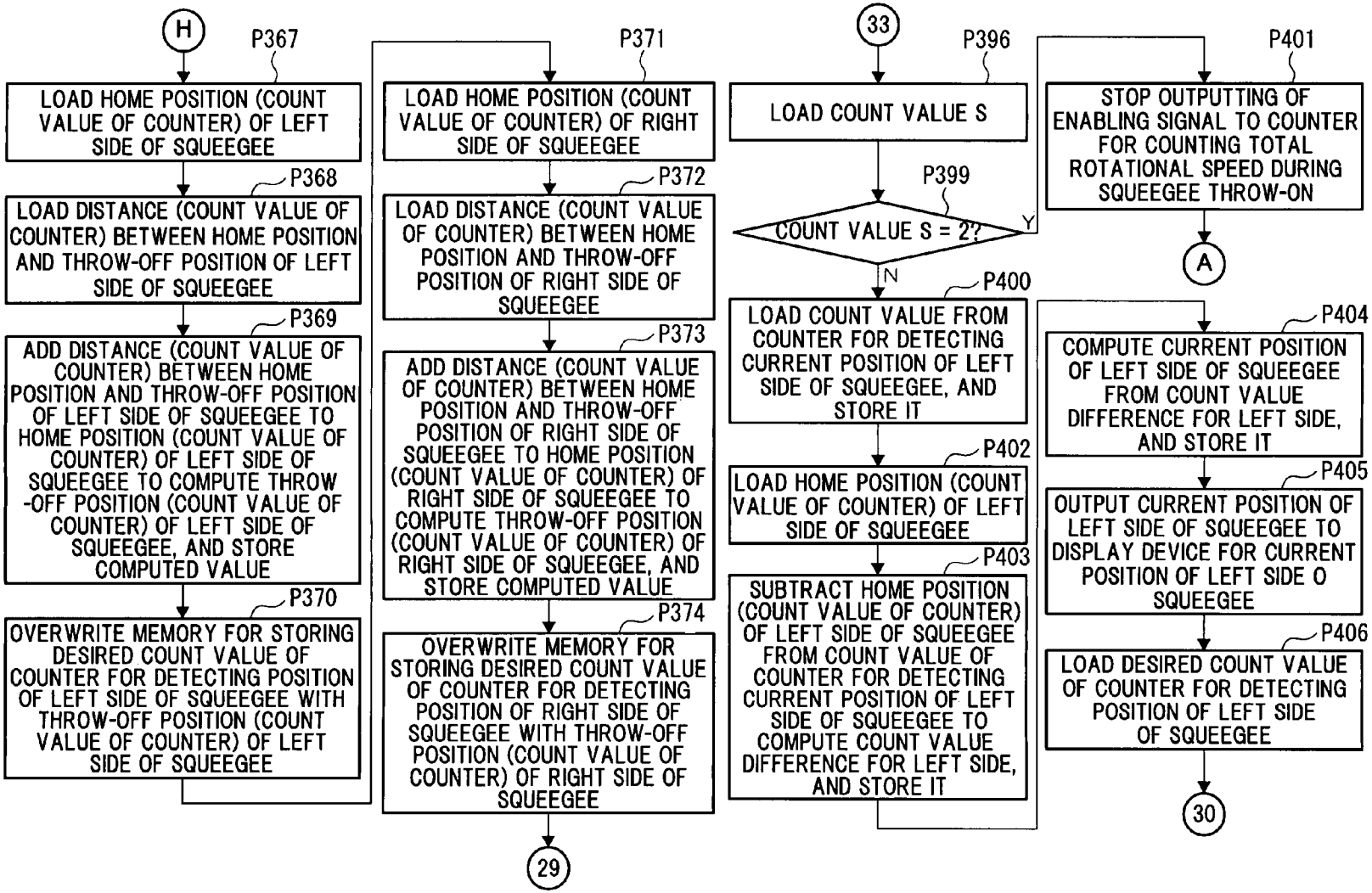
FIG. 12(*a*) is a motion flow chart of the control device.
Figure 12B:
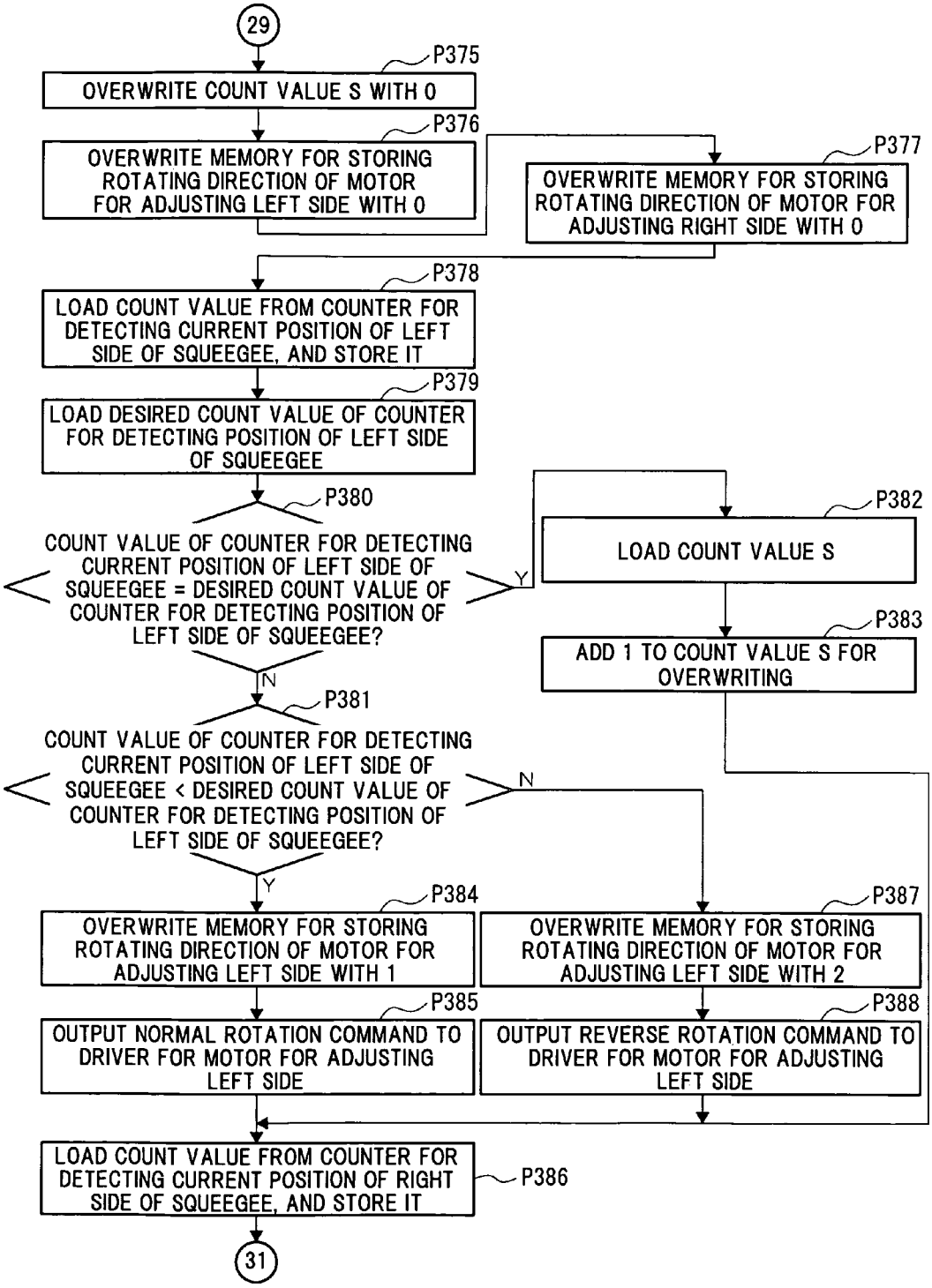
Figure 12C:
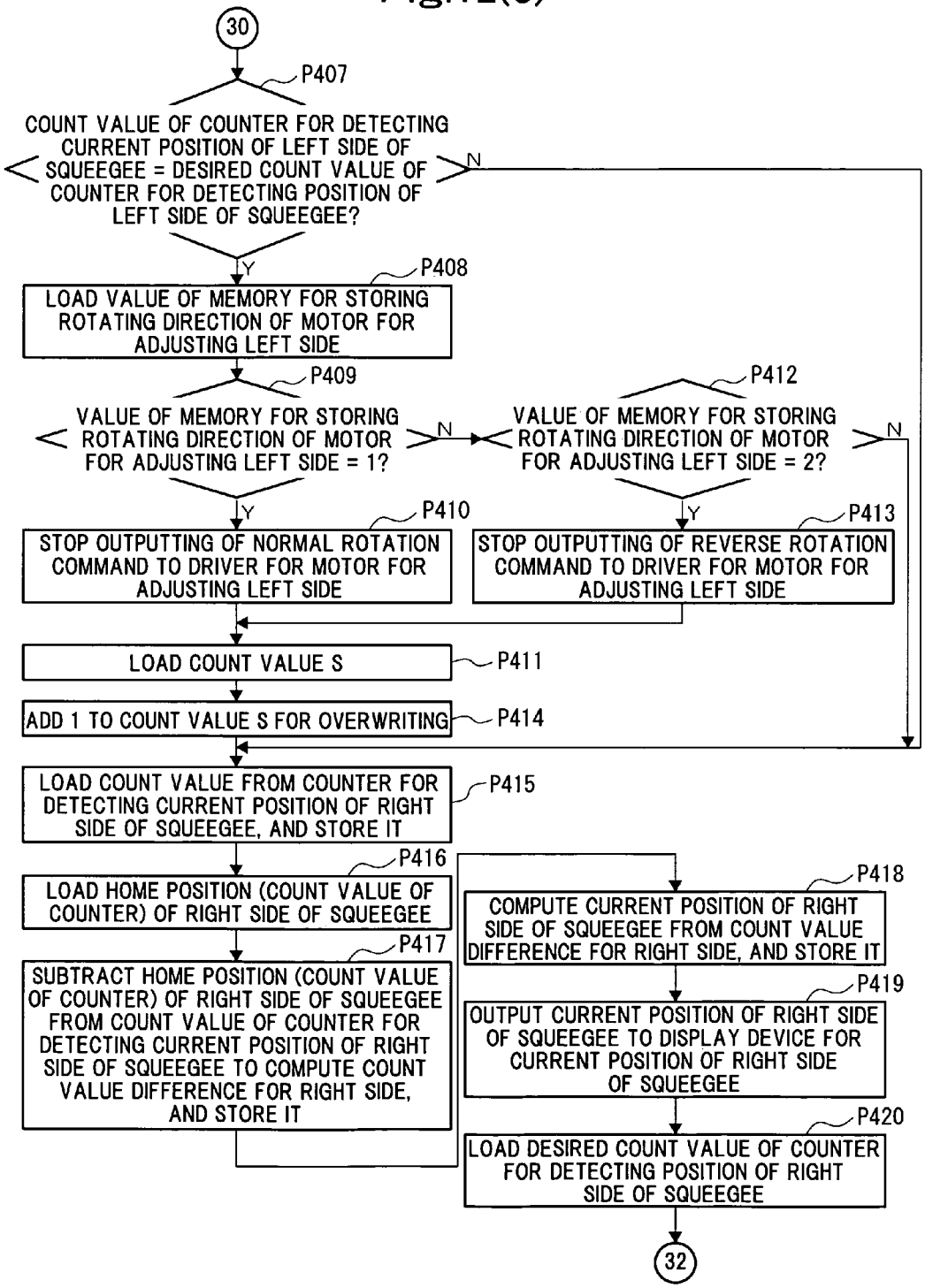
Figure 12D:
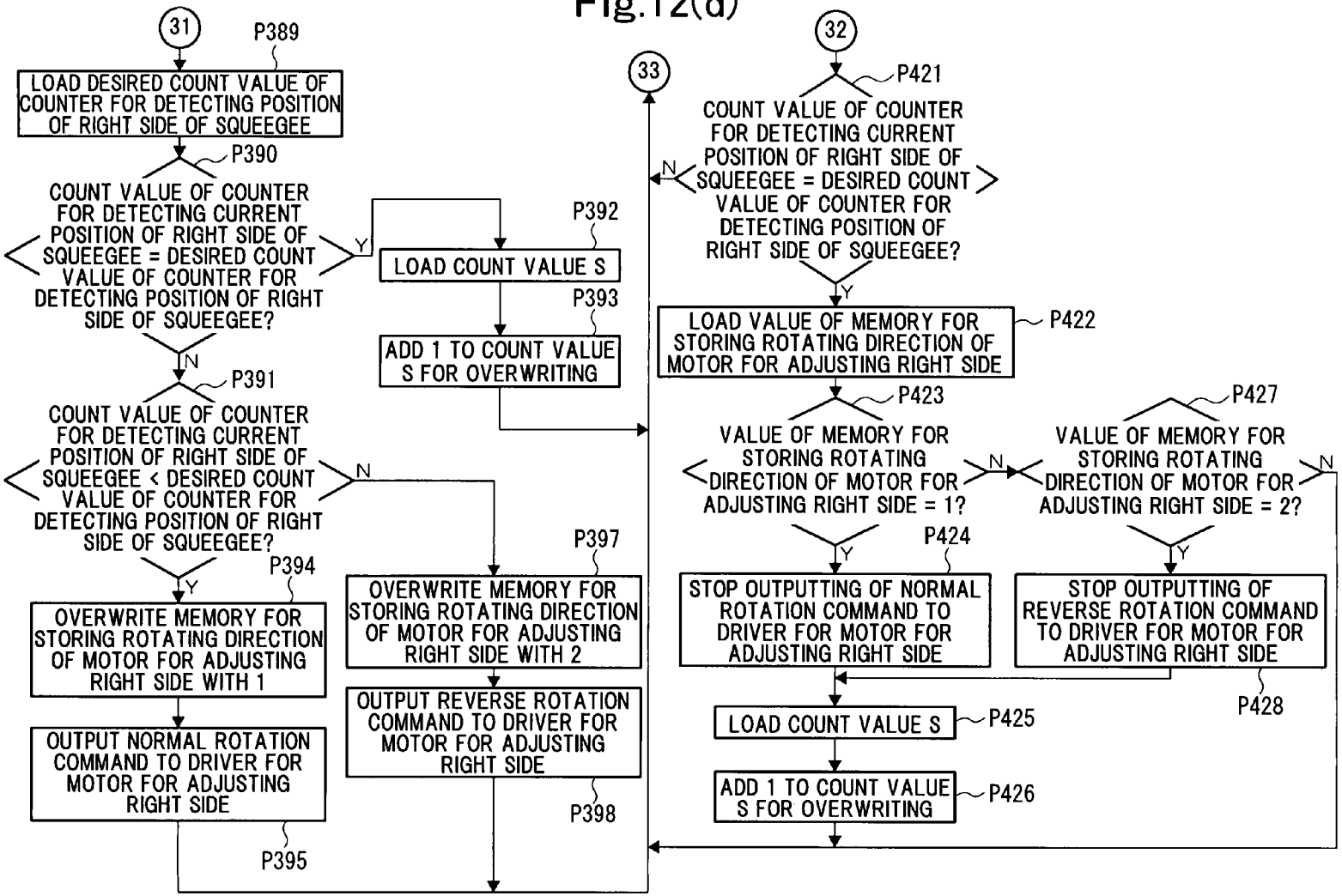

FIG. 1 is a schematic configurational sectional view of a rotary screen printing unit in a rotary screen printing press showing Embodiment 1 of the present invention. FIG. 2 is a right side view of the rotary screen printing unit in FIG. 1. FIG. 3 is a left side view of the rotary screen printing unit in FIG. 1. FIGS. 4(*a*) and 4(*b*) are operating state views. FIGS. 5(*a*) and 5(*b*) are control block diagrams of a control device. FIGS. 6(*a*) to 6(*d*) are motion flow charts of the control device. FIGS. 7(*a*) to 7(*d*) are motion flow charts of the control device. FIG. 8 is a motion flow chart of the control device. FIGS. 9(*a*) to 9(*d*) are motion flow charts of the control device. FIGS. 10(*a*) to 10(*d*) are motion flow charts of the control device. FIGS. 11(*a*) to 11(*e*) are motion flow charts of the control device. FIGS. 12(*a*) to 12(*d*) are motion flow charts of the control device.

In the rotary screen printing unit in the rotary screen printing press (rotary stencil printing press), as shown in FIG. 1, a rotary screen cylinder (stencil printing plate cylinder) 11 is supported between right and left frames 10 via eccentric bearings 12 to be capable of being thrown on and off an impression cylinder 13. The right and left eccentric bearings 12 are supported by the right and left frames 10 to be pivotable and slidable in a lateral direction (axial direction).

The rotary screen cylinder 11 comprises a cylindrical screen printing forme (stencil printing plate) 11*c* supported between right and left tubular end members 11*a* via intermediate members 11*b*. Also, the rotary screen cylinder 11 is supported by bearings 14 to be rotatable with respect to the eccentric bearings 12 at small-diameter portions of the right and left tubular end members 11*a*.

A gear 15 is located at, and secured to, an end part of the small-diameter portion of the right tubular end member 11*a*, and a gear 17 secured onto an output shaft of a motor 16 meshes with the gear 15. The motor 16 is mounted on a subframe 18 bound to the right frame 10.

Thus, the rotary screen cylinder 11 can be rotationally driven and circumferentially registered by the motor 16 via the above-mentioned gear mechanism.

One end of a link 19 is pinned to each of the right and left eccentric bearings 12, and a leading end of a lever 20 is pinned to the other end of the link 19. Proximal end portions of the right and left levers 20 are secured to right and left end portions of a rotating shaft 21 journaled between the right and left frames 10. A leading end of an actuator 22 is pinned to the left lever 20.

Hence, the eccentric bearing 12 is pivoted by the actuator 22 via the above-mentioned link mechanism, whereby the rotary screen cylinder 11 is eccentrically rotated to be capable of being thrown on and off the impression cylinder 13 (see FIG. 4(*a*) and FIG. 4(*b*)).

An elongated hole, which is formed in a flange portion 12*a* of each of the right and left eccentric bearings 12, is fitted with a head 23*a* of a bolt 23 such that the head 23*a* is rotatable, and movable in the direction of the major diameter of the elongated hole, but immovable in the axial direction. On the other hand, a threaded portion 23*b* of the bolt 23 is fitted into a tapped hole of the frame 10. A gear 24*a* is secured to the head 23*a* of each of the right and left bolts 23, and a gear 24*b* secured onto an output shaft of a motor 25 meshes with the gear 24*a*. The right and left motors 25 are mounted on support brackets 26 bound to the right and left frames 10.

Thus, the right and left eccentric bearings 12 are slid in the lateral direction (axial direction) by the motors 25 via the aforementioned gear mechanism and feed screw mechanism to make possible the tension adjustment of the screen printing forme 11*c* and the movement of the bearing at the time of rotary screen cylinder removal.

As shown in FIGS. 2 and 3 as well, a pipe-shaped support shaft 27 closed at the right end is inserted through the interior of the rotary screen cylinder 11. The right end side of the support shaft 27 is fitted into, and supported by, a fitting hole 28*a* of a bearing member 28, which is located outwardly and laterally of the subframe 18, in such a manner as to be turnable and movable (slidable) in the lateral direction (axial direction), while the left end side of the support shaft 27 is fitted into, and supported by, a bearing member 29, which is located outwardly and laterally of the left frame 10, in such a manner as not to be turnable and movable (slidable) in the lateral direction (axial direction).

That is, the left end side of the support shaft 27 is inhibited from moving (sliding) in the lateral direction (axial direction) by stepped portions 27*a* and 27*b* at two (right and left) locations, and is also inhibited from turning because it is pressed from above by a holding plate 30*a* while being accommodated within a fitting groove 29*a* of the bearing member 29 having a groove bottom formed in a taper shape.

The holding plate 30*a* horizontally rotates about a fulcrum pin 31, and can thus open and close the fitting groove 29*a*. With the fitting groove 29*a* being closed, a fixing lever 30*b* is screwed into the holding plate 30*a* and the bearing member 29, whereby the closed state is retained.

The right and left bearing members 28 and 29 are supported vertically movably via ball screws 32 by support cases 31 annexed to the frame 10 and the subframe 18. Concretely, a nut member 32*a* of the ball screw 32 is secured to the interior of the support case 31, and a screw member 32*b* screwed to the nut member 32*a* penetrates the interior of the support case 31 in a vertical direction. A non-screw-forming shaft portion of the screw member 32*b* is supported pivotably within the support case 31 via a bearing 33.

An upper end portion of the screw member 32*b* is engaged with an engaging hole 28*b* or 29*b* of the bearing member 28 or 29 via a spherical bearing 34 to permit the rotation of the screw member 32*b* and the inclination of the support shaft 27 during position adjustment (to be described later) of the support shaft 27. A gear 35*a* is secured to a lower end portion of the screw member 32*b*, and a gear 35*b* secured onto an output shaft of a motor 36A or 36B meshes with the gear 35*a*. The left motor 36A is mounted on an outer surface of the frame 10, and the right motor 36B is mounted on an outer surface of the subframe 18.

In FIG. 1, reference numeral 39 denotes a whirl-stop pin for positioning of the bearing member 28 or 29 in the absence of the support shaft 27, and for positioning, in the longitudinal direction, of the support shaft 27.

A rubber squeegee (ink transfer member) 38 is supported on the support shaft 27 via a holder 37, as shown in FIGS. 4(*a*) and 4(*b*). A leading end of the squeegee 38 makes a sliding contact with the inner peripheral surface of the screen printing forme 11*c*, with the result that ink supplied into the screen printing forme 11*c* through the interior of the support shaft 27 is transferred onto a printing surface of a web W (material to be printed) via holes of the screen printing forme 11*c*.

In the present embodiment, the motors 36A and 36B are drivingly controlled, independently of each other, by a control device (control means) 40 to be described later, whereby throw-on and throw-off of the squeegee 38 with respect to the inner peripheral surface of the screen printing forme 11*c*, and the adjustment of the throw-on position of the squeegee 38, which have been stated earlier, are automatically carried out.

In addition, the control device 40 adjusts a home position for throw-on and throw-off of the squeegee 38 with respect to the inner peripheral surface of the screen printing forme 11*c*, and controls a relative position between the home position and the throw-off position to be constant. The control device 40 also variably controls the relative position between the home position and the throw-on position in accordance with the amount of throw-on position adjustment by an operator. Moreover, the control device 40 measures the total rotational speed of the rotary screen cylinder 11 (rotary stencil printing press) during throw-on of the squeegee 38 with respect to the inner peripheral surface of the screen printing forme 11*c* after adjustment of the home position for the throw-on and throw-off of the squeegee 38 with respect to the inner peripheral surface of the screen printing forme 11*c*. In response to the measured total rotational speed of the rotary screen cylinder 11, the control device 40 adjusts the throw-on position of the squeegee 38 with respect to the inner peripheral surface of the screen printing forme 11*c*.

That is, the control device 40 comprises a CPU 41, an RAM 42, an ROM 43, and input/output devices 44 to 48 connected by a BUS line 53, as shown in FIGS. 5(*a*) and 5(*b*). To the BUS line 53, the following memories are connected: A memory M1 for storing the count value of a counter for detecting the current position of the left side of the squeegee, a memory M2 for storing the home position (count value of the counter) of the left side of the squeegee, a memory M3 for storing the difference in the count value for the left side, and a memory M4 for storing the current position of the left side of the squeegee.

To the BUS line 53, the following memories are further connected: A memory M5 for storing the count value of a counter for detecting the current position of the right side of the squeegee, a memory M6 for storing the home position (count value of the counter) of the right side of the squeegee, a memory M7 for storing the difference in the count value for the right side, a memory M9 for storing the current position of the right side of the squeegee, a memory M9 for storing the desired count value of the counter for detecting the position of the left side of the squeegee, a memory M10 for storing the desired count value of the counter for detecting the position of the right side of the squeegee, a memory M11 for storing the count value S, a memory M12 for storing the rotating direction of the motor for adjusting the left side, and a memory M13 for storing the rotating direction of the motor for adjusting the right side.

To the BUS line 53, the following memories are further connected: A memory M14 for storing the distance (count value of the counter) between the home position and the throw-off position of the left side of the squeegee, a memory M15 for storing the throw-off position (count value of the counter) of the left side of the squeegee, a memory M16 for storing the distance (count value of the counter) between the home position and the throw-off position of the right side of the squeegees a memory M17 for storing the throw-off position (count value of the counter) of the right side of the squeegee, a memory M18 for storing a table of conversion from the total rotational speed during squeegee throw-on to the amount (count value of the counter) of correction of the squeegee position, and a memory M19 for storing the count value of a counter for counting the total rotational speed during squeegee throw-on.

To the BUS line 53, the following memories are further connected: A memory M20 for storing the amount (count value of the counter) of correction of the squeegee position, a memory M21 for storing the distance (count value of the counter) between the home position and the printing position of the left side of the squeegee, a memory M22 for storing the printing position (count value of the counter) of the left side of the squeegee, a memory M23 for storing the distance (count value of the counter) between the home position and the printing position of the right side of the squeegee, and a memory M24 for storing the printing position (count value of the counter) of the right side of the squeegee.

To the input/output device 44, the following are connected: A home position return switch 54, a left side adjustment selection switch 55, a right side adjustment selection switch 56, a both sides adjustment selection switch 57, an adjustment completion switch 58, an up button 59, a down button 60, a home position adjustment completion switch 61, a squeegee throw-on and throw-off automatic control switch 62, a display device 63 for the current position of the left side of the squeegee, a display device 64 for the current position of the right side of the squeegee, an input device 65 such as a keyboard, a display device 66 such as a CRT or a display, and an output device 67 such as a printer or a floppy disk (registered trademark) drive.

To the input/output device 45, the motor 36A for adjusting the left side is connected via a driver 68 for the motor for adjusting the left side, and a rotary encoder 71 for the motor for adjusting the left side drivingly connected to the motor 36A is connected via a counter 70 for detecting the current position of the left side of the squeegee.

To the input/output device 46, the motor 36B for adjusting the right side is connected via a driver 72 for the motor for adjusting the right side, and a rotary encoder 75 for the motor for adjusting the right side drivingly connected to the motor 36B is connected via a counter 74 for detecting the current position of the right side of the squeegee.

To the input/output device 47, a sensor 77 for detecting one rotation of the rotary screen cylinder is connected via a counter 76 for counting the total rotational speed during squeegee throw-on. To the input/output device 48, a cylinder engagement circuit 78 for the rotary screen cylinder is connected. The sensor 77 for detecting one rotation of the rotary screen cylinder is provided in a rotating part of the rotary screen printing press so as to produce one pulse each time the rotary screen cylinder makes one rotation. Thus, the counter 74 for counting the total rotational speed during squeegee throw-on is adapted to count the rotational speed of the rotary screen cylinder in an operating state.

The control actions or motions of the control device 40 configured as above will be described in detail based on the motion flow charts of FIGS. 6(*a*) to 6(*d*), FIGS. 7(*a*) to 7(*d*), FIG. 8, FIGS. 9(*a*) to 9(*d*), FIGS. 10(*a*) to 10(*d*), FIGS. 11(*a*) to 11(*e*), and FIGS. 12(*a*) to 12(*d*).

In Step P1, a count value is loaded from the counter 70 for detecting the current position of the left side of the squeegee, and stored into the memory M1. Then, in Step P2, the home position (count value of the counter) of the left side of the squeegee is loaded from the memory M2. Then, in Step P3, the home position (count value of the counter) of the left side of the squeegee is subtracted from the count value of the counter 70 for detecting the current position of the left side of the squeegee to compute the difference in the count value for the left side, and this difference is stored into the memory M3.

Then, in Step P4, the current position of the left side of the squeegee is computed from the count value difference for the left side, and stored into the memory M4, whereafter in Step P5, the current position of the left side of the squeegee is outputted to the display device 63 for the current position of the left side of the squeegee.

Then, in Step PG, a count value is loaded from the counter 74 for detecting the current position of the right side of the squeegee, and stored into the memory M5. Then, in Step P7, the home position (count value of the counter) of the right side of the squeegee is loaded from the memory M6. Then, in Step P8, the home position (count value of the counter) of the right side of the squeegee is subtracted from the count value of the counter 74 for detecting the current position of the right side of the squeegee to compute the difference in the count value for the right side, and this difference is stored into the memory M7.

Then, in Step P9, the current position of the right side of the squeegee is computed from the count value difference for the right side, and stored into the memory M8, whereafter in Step P10, the current position of the right side of the squeegee is outputted to the display device 64 for the current position of the right side of the squeegee.

Then, in Step P11, it is determined whether the home position return switch 54 is ON. If the answer is YES, the home position (count value of the counter) of the left side of the squeegee is loaded from the memory M2 in Step P12. If the answer is NO, the program shifts to Step P69 to be described later.

Then, in Step P13, the memory M9 for storing the desired count value of the counter for detecting the position of the left side of the squeegee is overwritten with the home position (count value of the counter) of the left side of the squeegee, whereafter the home position (count value of the counter) of the right side of the squeegee is loaded from the memory M6 in Step P14.

Then, in Step P15, the memory M10 for storing the desired count value of the counter for detecting the position of the right side of the squeegee is overwritten with the home position (count value of the counter) of the right side of the squeegee, whereafter the count value S of the memory M11 is overwritten with 0 in Step P16.

Then, in Step P17, the memory M12 for storing the rotating direction of the motor for adjusting the left side is overwritten with 0, whereafter the memory M13 for storing the rotating direction of the motor for adjusting the right side is overwritten with 0 in Step P18.

Then, in Step P19, the count value is loaded from the counter 70 for detecting the current position of the left side of the squeegee, and stored into the memory M4. Afterwards, in Step P20, the desired count value of the counter for detecting the position of the left side of the squeegee is loaded from the memory M9.

Then, it is determined in Step P21 whether the count value of the counter for detecting the current position of the left side of the squeegee is equal to the desired count value of the counter for detecting the position of the left side of the squeegee. If the answer is NO, it is determined in Step P22 whether the count value of the counter for detecting the current position of the left side of the squeegee is less than the desired count value of the counter for detecting the position of the left side of the squeegee. If the answer is YES in Step P21, the count value S is loaded from the memory M11 in Step P23, whereafter 1 is added to the count value S of the memory M11 for overwriting in Step P24. Then, the program shifts to Step P27 to be described later.

If the answer is YES in Step P22, the memory M12 for storing the rotating direction of the motor for adjusting the left side is overwritten with 1 in Step P25. Then, in Step P26, a normal rotation command is outputted to the driver 68 for the motor for adjusting the left side, whereafter the program proceeds to Step P27.

If the answer is NO in Step P22, the memory M12 for storing the rotating direction of the motor for adjusting the left side is overwritten with 2 in Step P25. Then, in Step P29, a reverse rotation command is outputted to the driver 68 for the motor for adjusting the left side, whereafter the program shifts to Step P27.

Then, in Step P27, the count value is loaded from the counter 74 for detecting the current position of the right side of the squeegee, and stored into the memory M8. Subsequently, in Step P30, the desired count value of the counter for detecting the position of the right side of the squeegee is loaded from the memory M10.

Then, it is determined in Step P31 whether the count value of the counter for detecting the current position of the right side of the squeegee is equal to the desired count value of the counter for detecting the position of the right side of the squeegee. If the answer is NO, it is determined in Step P32 whether the count value of the counter for detecting the current position of the right side of the squeegee is less than the desired count value of the counter for detecting the position of the right side of the squeegee. If the answer is YES in Step P31, the count value S is loaded from the memory M11 in Step P33, whereafter 1 is added to the count value S of the memory M11 for overwriting in Step P34. Then, the program shifts to Step P37 to be described later.

If the answer is YES in Step P32, the memory M13 for storing the rotating direction of the motor for adjusting the right side is overwritten with 1 in Step P35. Then, in Step P36, a normal rotation command is outputted to the driver 72 for the motor for adjusting the right side, whereafter the program proceeds to Step P37.

If the answer is NO in Step P32, the memory M13 for storing the rotating direction of the motor for adjusting the right side is overwritten with 2 in Step P38. Then, in Step P39, a reverse rotation command is outputted to the driver 72 for the motor for adjusting the right side, whereafter the program shifts to Step P37.

Then, after the count value S is loaded from the memory M11 in Step P37, a determination is made in Step P40 as to whether the count value S is equal to 2.

If the answer is YES in Step P40, the program returns to Step P1. If the answer is NO in Step P40, the count value is loaded from the counter 70 for detecting the current position of the left side of the squeegee, and stored into the memory M1 in Step P41.

Then, in Step P42, the home position (count value of the counter) of the left side of the squeegee is loaded from the memory M2. Then, in Step P43, the home position (count value of the counter) of the left side of the squeegee is subtracted from the count value of the counter for detecting the current position of the left side of the squeegee to compute the count value difference for the left side, which is stored into the memory M3.

Then, in Step P44, the current position of the left side of the squeegee is computed from the count value difference for the left side, and stored into the memory M4. Subsequently, in Step P45, the current position of the left side of the squeegee is outputted to the display device 63 for the current position of the left side of the squeegee.

Then, in Step P46, the desired count value of the counter for detecting the position of the left side of the squeegee is loaded from the memory M9. This is followed by Step P47 in which it is determined whether the count value of the counter for detecting the current position of the left side of the squeegee is equal to the desired count value of the counter for detecting the position of the left side of the squeegee.

If the answer is YES in Step P47, the value of the memory M12 for storing the rotating direction of the motor for adjusting the left side is loaded in Step P48. If the answer is NO in Step P47, the program shifts to Step P55 to be described later.

Then, in Step P49, it is determined whether the value of the memory for storing the rotating direction of the motor for adjusting the left side is equal to 1. If the answer is YES, outputting of the normal rotation command to the driver 68 for the motor for adjusting the left side is stopped in Step P50, and the program proceeds to Step P1. If the answer is NO in Step P49, it is determined in Step P52 whether the value of the memory for storing the rotating direction of the motor for adjusting the left side is equal to 2.

If the answer is YES in Step P52, outputting of the reverse rotation command to the driver 68 for the motor for adjusting the left side is stopped in Step P53, and the program shifts to Step P51. If the answer is NO in Step P52, the program shifts to Step P55 to be described later.

After the count value S is loaded from the memory M11 in Step P51, 1 is added to the count value S of the memory M11 for overwriting in Step P54. Then, in Step P55, the count value is loaded from the counter 74 for detecting the current position of the right side of the squeegee, and stored into the memory M5.

Then, in Step P56, the home position (count value of the counter) of the right side of the squeegee is loaded from the memory M6. Then, in Step P57, the home position (count value of the counter) of the right side of the squeegee is subtracted from the count value of the counter 74 for detecting the current position of the right side of the squeegee to compute the count value difference for the right side, which is stored into the memory M7.

Then, in Step P58, the current position of the right side of the squeegee is computed from the count value difference for the right side, and stored into the memory M8. Subsequently, in Step P59, the current position of the right side of the squeegee is outputted to the display device 64 for the current position of the right side of the squeegee.

Then, in Step P60, the desired count value of the counter for detecting the position of the right side of the squeegee is loaded from the memory M10. This is followed by Step P61 in which it is determined whether the count value of the counter for detecting the current position of the right side of the squeegee is equal to the desired count value of the counter for detecting the position of the right side of the squeegee.

If the answer is YES in Step P61, the value of the memory M13 for storing the rotating direction of the motor for adjusting the right side is loaded in Step P62. If the answer is NO in Step P61, the program returns to Step P37.

Then, in Step P63, it is determined whether the value of the memory for storing the rotating direction of the motor for adjusting the right side is equal to 1. If the answer is YES, outputting of the normal rotation command to the driver 72 for the motor for adjusting the right side is stopped in Step P64. If the answer is NO in Step P63, it is determined in Step P67 whether the value of the memory for storing the rotating direction of the motor for adjusting the right side is equal to 2.

If the answer is YES in Step P67, outputting of the reverse rotation command to the driver 72 for the motor for adjusting the right side is stopped in Stop P68, and the program shifts to Step P65. If the answer is NO in Step P67, the program immediately returns to Step P37.

After the count value S is loaded from the memory M11 in Step P65, 1 is added to the count value S of the memory M11 for overwriting in Step P66. Then, the program returns to Step P37. In accordance with the above-described motion flow, both sides (right and left sides) of the support shaft 27 are returned to the home position at the point in time, at which the home position return switch 54 was pressed, in order to replace the squeegee 38.

Then, in Step P69 shifted from the aforementioned Step P1, it is determined whether the left side adjustment selection switch 55 is ON. If the answer is YES, it is determined in Step P70 whether the adjustment completion switch 58 is ON. If the answer is NO in Step P69, the program shifts to Step P89 to be described later.

If the answer is YES in Step P70, the program shifts to Step P89 to be described later. If the answer is NO in Step P70, it is determined in Step P71 whether the up button 59 is ON. If the answer is YES in Step P71, this is followed by Step P72 in which a normal rotation command is outputted to the driver 68 for the motor for adjusting the left side. If the answer is NO in Step P71, the program shifts to Step P80 to be described later.

Then, in Step P73, the count value is loaded from the counter 70 for detecting the current position of the left side of the squeegee, and stored into the memory M1. Subsequently, in Step P74, the home position (count value of the counter) of the left side of the squeegee is loaded from the memory M2.

Then, in Step P75, the home position (count value of the counter) of the left side of the squeegee is subtracted from the count value of the counter 70 for detecting the current position of the left side of the squeegee to compute the count value difference for the left side, which is stored into the memory M3. This is followed by Step P76 in which the current position of the left side of the squeegee is computed from the count value difference for the left side, and stored into the memory M4.

Then, in Step P77, the current position of the left side of the squeegee is outputted to the display device 63 for the current position of the left side of the squeegee. Subsequently, in Step P78, it is determined whether the up button 59 is OFF. If the answer is YES in Step P78, Step P79 is executed to stop outputting of the normal rotation command to the driver 68 for the motor for adjusting the left side. If the answer is NO, the program returns to Step P73.

Then, in Step P80, it is determined whether the down button 60 is ON. If the answer is YES, Step P81 is executed to output a reverse rotation command to the driver 68 for the motor for adjusting the left side. If the answer is NO in Step P80, the program returns to Step P70.

Then, in Step P82, the count value is loaded from the counter 70 for detecting the current position of the left side of the squeegee, and stored into the memory M1. Subsequently, in Step P83, the home position (count value of the counter) of the left side of the squeegee is loaded from the memory M2.

Then, in Step P84, the home position (count value of the counter) of the left side of the squeegee is subtracted from the count value of the counter 70 for detecting the current position of the left side of the squeegee to compute the count value difference for the left side, which is stored into the memory M3. This is followed by Step P85 in which the current position of the left side of the squeegee is computed from the count value difference for the left side, and stored into the memory M4.

Then, in Step P86, the current position of the left side of the squeegee is outputted to the display device 63 for the current position of the left side of the squeegee. Subsequently, in Step P87, it is determined whether the down button 60 is OFF. If the answer is YES in Step P87, Step P88 is executed to stop outputting of the reverse rotation command to the driver 68 for the motor for adjusting the left side, and the program returns to Step P70. If the answer is NO in Step P87, the program returns to Step P82.

Then, in Step P89, it is determined whether the right side adjustment selection switch 56 is ON. If the answer is YES, it is determined in Step P90 whether the adjustment completion switch 58 is ON. If the answer is NO in Step P89, the program shifts to Step P109 to be described later.

If the answer is YES in Step P90, the program shifts to Step P109 to be described later. If the answer is NO in Step P90, it is determined in Step P91 whether the up button 59 is ON. If the answer is YES in Step P91, this is followed by Step P92 in which a normal rotation command is outputted to the driver 72 for the motor for adjusting the right side. If the answer is NO in Step P91, the program shifts to Step P100 to be described later.

Then, in Step P93, the count value is loaded from the counter 74 for detecting the current position of the right side of the squeegee, and stored into the memory M5. Subsequently, in Step P94, the home position (count value of the counter) of the right side of the squeegee is loaded from the memory M6.

Then, in Step P95, the home position (count value of the counter) of the right side of the squeegee is subtracted from the count value of the counter 74 for detecting the current position of the right side of the squeegee to compute the count value difference for the right side, which is stored into the memory M7. This is followed by Step P96 in which the current position of the right side of the squeegee is computed from the count value difference for the right side, and stored into the memory M8.

Then, in Step P97, the current position of the right side of the squeegee is outputted to the display device 64 for the current position of the right side of the squeegee. Subsequently, in Step P98, it is determined whether the up button 59 is OFF. If the answer is YES in Step P98, Step P99 is executed to stop outputting of the normal rotation command to the driver 72 for the motor for adjusting the right side. If the answer is NO in Step P98, the program returns to Step P93.

Then, in Step P100, it is determined whether the down button 60 is ON. If the answer is YES, Step P101 is executed to output a reverse rotation command to the driver 72 for the motor for adjusting the right side. If the answer is NO in Step P100, the program returns to Step P90.

Then, in Step P102, the count value is loaded from the counter 74 for detecting the current position of the right side of the squeegee, and stored into the memory M5. Subsequently, in Step P103, the home position (count value of the counter) of the right side of the squeegee is loaded from the memory M6.

Then, in Step P104, the home position (count value of the counter) of the right side of the squeegee is subtracted from the count value of the counter 74 for detecting the current position of the right side of the squeegee to compute the count value difference for the right side, which is stored into the memory M7. This is followed by Step P105 in which the current position of the right side of the squeegee is computed from the count value difference for the right side, and stored into the memory M8.

Then, in Step P106, the current position of the right side of the squeegee is outputted to the display device 64 for the current position of the right side of the squeegee. Subsequently, in Step P107, it is determined whether the down button 60 is OFF. If the answer is YES in Step P107, Step P108 is executed to stop outputting of the reverse rotation command to the driver 72 for the motor for adjusting the right side. If the answer is NO in Step P107, the program returns to Step P102.

Then, in Step P109, it is determined whether the both sides adjustment selection switch 57 is ON. If the answer is YES, it is determined in Step P110 whether the adjustment completion switch 58 is ON. If the answer is NO in Step P109, the program shifts to Step P143 to be described later.

If the answer is YES in Step P110, the program shifts to Step P143 to be described later. If the answer is NO in Step P110, it is determined in Step P111 whether the up button 59 is ON. If the answer is YES in Step P111 this is followed by Step P112 in which a normal rotation command is outputted to the driver 68 for the motor for adjusting the left side. If the answer is NO in Step P111, the program shifts to Step P127 to be described later.

Then, in Step P113, a normal rotation command is outputted to the driver 72 for the motor for adjusting the right side. Then, Step P114 is executed in which the count value is loaded from the counter 70 for detecting the current position of the left side of the squeegee, and stored into the memory M1.

Subsequently, in Step P115, the home position (count value of the counter) of the left side of the squeegee is loaded from the memory M2. Then, in Step P116, the home position (count value of the counter) of the left side of the squeegee is subtracted from the count value of the counter 70 for detecting the current position of the left side of the squeegee to compute the count value difference for the left side, which is stored into the memory M3.

Then follows Step P117 in which the current position of the left side of the squeegee is computed from the count value difference for the left side, and stored into the memory M4. Then, in Step P118, the current position of the left side of the squeegee is outputted to the display device 63 for the current position of the left side of the squeegee.

Then, Step P119 is executed in which the count value is loaded from the counter 74 for detecting the current position of the right side of the squeegee, and stored into the memory M5. Subsequently, in Step P120, the home position (count value of the counter) of the right side of the squeegee is loaded from the memory M6.

Then, in Step P121, the home position (count value of the counter) of the right side of the squeegee is subtracted from the count value of the counter 74 for detecting the current position of the right side of the squeegee to compute the count value difference for the right side, which is stored into the memory M7. Then follows Step P122 in which the current position of the right side of the squeegee is computed from the count value difference for the right side, and stored into the memory M8.

Then, in Step P123, the current position of the right side of the squeegee is outputted to the display device 64 for the current position of the right side of the squeegee. Subsequently, in Step P124, it is determined whether the up button 59 is OFF. If the answer is YES in Step P124, Step P125 is executed to stop outputting of the normal rotation command to the driver 68 for the motor for adjusting the left side. If the answer is NO in Step P124, the program returns to Step P114.

Then, in Step P126, outputting of the normal rotation command to the driver 72 for the motor for adjusting the right side is stopped. Then follows Step P127 in which it is determined whether the down button 60 is ON. If the answer is YES in Step P127, this is followed by Step P128 in which a reverse rotation command is outputted to the driver 68 for the motor for adjusting the left side. If the answer is NO in Step P127, the program returns to Step P110.

Then, in Step P129, a reverse rotation command is outputted to the driver 72 for the motor for adjusting the right side. Then, Step P130 is executed in which the count value is loaded from the counter 70 for detecting the current position of the left side of the squeegee, and stored into the memory M1.

Subsequently, in Step P131, the home position (count value of the counter) of the left side of the squeegee is loaded from the memory M2. Then, in Step P132, the home position (count value of the counter) of the left side of the squeegee is subtracted from the count value of the counter 70 for detecting the current position of the left side of the squeegee to compute the count value difference for the left side, which is stored into the memory M3.

Then follows Step P133 in which the current position of the left side of the squeegee is computed from the count value difference for the left side, and stored into the memory M4. Then, in Step P134, the current position of the left side of the squeegee is outputted to the display device 63 for the current position of the left side of the squeegee.

Then, Step P135 is executed in which the count value is loaded from the counter 74 for detecting the current position of the right side of the squeegee, and stored into the memory M5. Subsequently, in Step P136, the home position (count value of the counter) of the right side of the squeegee is loaded from the memory M6.

Then, in Step P137, the home position (count value of the counter) of the right side of the squeegee is subtracted from the count value of the counter 74 for detecting the current position of the right side of the squeegee to compute the count value difference for the right side, which is stored into the memory M7. Then follows Step P138 in which the current position of the right side of the squeegee is computed from the count value difference for the right side, and stored into the memory M8.

Then, in Step P139, the current position of the right side of the squeegee is outputted to the display device 64 for the current position of the right side of the squeegee. Subsequently, in Step P140, it is determined whether the down button 60 is OFF. If the answer is YES in Step P140, Step P141 is executed to stop outputting of the reverse rotation command to the driver 68 for the motor for adjusting the left side. If the answer is NO in Step P140, the program returns to Step P130. The above-described motion flow is adopted to carry out the home position adjustment of the support shaft 27 after replacement of the squeegee 38 by the operator's manual operation, in other words, the paralleling of right and left end portions of the squeegee 38.

Then, in Step P142, outputting of the reverse rotation command to the driver 72 for the motor for adjusting the right side is stopped whereafter the program returns to Step P110.

Then, in Step P143 shifted from the aforementioned Step P109 and Step P110, it is determined whether the home position adjustment completion switch 61 is ON. If the answer is YES, Step P144 is executed to load the count value from the counter 70 for detecting the current position of the left side of the squeegee, and store the count value into the memory M1. If the answer is NO, the program shifts to Step P152 to be described later.

Then, in Step P145, the memory M2 for storing the home position (count value of the counter) of the left side of the squeegee is overwritten with the count value of the counter 70 for detecting the current position of the left side of the squeegee. Subsequently, in Step P146, 0 is outputted to the display device 63 for the current position of the left side of the squeegee.

Then, Step P147 is executed to load the count value from the counter 74 for detecting the current position of the right side of the squeegee, and store the count value into the memory M5. Then, in Step P148, the memory M6 for storing the home position (count value of the counter) of the right side of the squeegee is overwritten with the count value of the counter 74 for detecting the current position of the right side of the squeegee.

Subsequently, in Step P149, 0 is outputted to the display device 64 for the current position of the right side of the squeegee, whereafter in Step P150 a reset signal is outputted to the counter 76 for counting the total rotational speed during squeegee throw-on. Then, Step P151 is executed to stop outputting of the reset signal to the counter 76 for counting the total rotational speed during squeegee throw-on, and the program returns to Step P11. In accordance with the above-described motion flow, the home position of the support shaft 27 after replacement of the squeegee 38, which has been adjusted by the operator's manual operation, is stored as a subsequent new home position. Moreover, the state of the counter 76 for counting the total rotational speed during squeegee throw-on is brought to the initial state (is reset).

Then, in Step P152 shifted from the aforementioned Step P143, it is determined whether the squeegee throw-on and throw-off automatic control switch 62 is ON. If the answer is YES, it is determined in Step P153 whether the squeegee throw-on and throw-off automatic control switch 62 is OFF. If the answer is NO in Step P152, the program returns to Step P11.

If the answer is YES in Step P153, the program shifts to Step P367 to be described later. If the answer is NO in Step P153, it is determined in Step P154 whether a cylinder engagement signal for the rotary screen cylinder has been rendered ON by the cylinder engagement circuit 78 for the rotary screen cylinder.

If the answer is YES in Step P154, the program shifts to Step P215. If the answer is NO in Step P154, the home position (count value of the counter) of the left side of the squeegee is loaded from the memory M2 in Step P155.

Then, in Step P156, the distance (count value of the counter) between the home position and the throw-off position of the left side of the squeegee is loaded from the memory M14. Then follows Step P157 in which the distance (count value of the counter) between the home position and the throw-off position of the left side of the squeegee is added to the home position (count value of the counter) of the left side of the squeegee to compute the throw-off position (count value of the counter) of the left side of the squeegee, and the computed value is stored into the memory M15.

Then, in Step P158, the memory M9 for storing the desired count value of the counter for detecting the position of the left side of the squeegee is overwritten with the throw-off position (count value of the counter) of the left side of the squeegee. Subsequently, in Step P159, the home position (count value of the counter) of the right side of the squeegee is loaded from the memory M6.

Then, in Step P160, the distance (count value of the counter) between the home position and the throw-off position of the right side of the squeegee is loaded from the memory M16. Then follows Step P161 in which the distance (count value of the counter) between the home position and the throw-off position of the right side of the squeegee is added to the home position (count value of the counter) of the right side of the squeegee to compute the throw-off position (count value of the counter) of the right side of the squeegee, and the computed value is stored into the memory M17.

Then, in Step P162, the memory M10 for storing the desired count value of the counter for detecting the position of the right side of the squeegee is overwritten with the throw-off position (count value of the counter) of the right side of the squeegee. Then, the count value S of the memory M11 is overwritten with 0 in Step P163.

After the memory M12 for storing the rotating direction of the motor for adjusting the left side is overwritten with 0 in Step P164, the memory M13 for storing the rotating direction of the motor for adjusting the right side is overwritten with 0 in Step P165.

Then, in Step P166, the count value is loaded from the counter 70 for detecting the current position of the left side of the squeegee, and stored into the memory M1. Subsequently, in Step P167, the desired count value of the counter for detecting the position of the left side of the squeegee is loaded from the memory M9.

Then, in Step P168, it is determined whether the count value of the counter for detecting the current position of the left side of the squeegee is equal to the desired count value of the counter for detecting the position of the left side of the squeegee. If the answer is NO, it is determined in Step P169 whether the count value of the counter for detecting the current position of the left side of the squeegee is less than the desired count value of the counter for detecting the position of the left side of the squeegee. If the answer is YES in Step P168, the count value S is loaded from the memory M11 in Step P170.

Then, in Step P171, 1 is added to the count value S of the memory M11 for overwriting, whereafter the program shifts to Step P174 to be described later.

If the answer is YES in Step P169, the memory M12 for storing the rotating direction of the motor for adjusting the left side is overwritten with 1 in Step P172. Then, in Step P173, a normal rotation command is outputted to the driver 68 for the motor for adjusting the left side. Then follows Step P174 in which the count value is loaded from the counter 74 for detecting the current position of the right side of the squeegee, and stored into the memory M5.

If the answer is NO in Step P169, the memory M12 for storing the rotating direction of the motor for adjusting the left side is overwritten with 2 in Step P175. Then, in Step P176, a reverse rotation command is outputted to the driver 68 for the motor for adjusting the left side. Then, the program shifts to Step P174.

Then, in Step P177, the desired count value of the counter for detecting the position of the right side of the squeegee is loaded from the memory M10. Then, in Step P178*a*, it is determined whether the count value of the counter for detecting the current position of the right side of the squeegee is equal to the desired count value of the counter for detecting the position of the right side of the squeegee.

If the answer is NO in the above Step P178*a*, it is determined in Step P179 whether the count value of the counter for detecting the current position of the right side of the squeegee is less than the desired count value of the counter for detecting the position of the right side of the squeegee. If the answer is YES in Step P178*a*, the count value S is loaded from the memory M11 in Step P178*b*.

Then, in Step P178*c*, 1 is added to the count value S of the memory M11 for overwriting, whereafter the program shifts to Step P182 to be described later.

If the answer is YES in Step P179, the memory M13 for storing the rotating direction of the motor for adjusting the right side is overwritten with 1 in Step P180. Then, in Step P181, a normal rotation command is outputted to the driver 72 for the motor for adjusting the right side. Then, the program proceeds to Step P182.

If the answer is NO in Step P179, the memory M13 for storing the rotating direction of the motor for adjusting the right side is overwritten with 2 in Step P183. Then, in Step P184, a reverse rotation command is outputted to the driver 72 for the motor for adjusting the right side. Then, the program shifts to Step P182.

Then, in Step P182, the count value S is loaded from the memory M11, whereafter it is determined in Step P185 whether the count value S is equal to 2. If the answer is YES in Step P185, outputting of the enabling signal to the counter 76 for counting the total rotational speed during squeegee row-on is stopped in Step P186, and the program returns to Step P153. If the answer is NO in Step P185, the program shifts to Step P187.

Then, in Step P187, the count value is loaded from the counter 70 for detecting the current position of the left side of the squeegee, and stored into the memory M1. Subsequently, in Step P188, the home position (count value of the counter) of the left side of the squeegee is loaded from the memory M2. Then follows Step P189 in which the home position (count value of the counter) of the left side of the squeegee is subtracted from the count value of the counter 70 for detecting the current position of the left side of the squeegee to compute the count value difference for the left side, which is stored into the memory M3

Then, in Step P190, the current position of the left side of the squeegee is computed from the count value difference for the left side, and stored into the memory M4. Subsequently, in Step P191, the current position of the left side of the squeegee is outputted to the display device 63 for the current position of the left side of the squeegee.

Then, in Step P192, the desired count value of the counter for detecting the position of the left side of the squeegee is loaded from the memory M9. Then follows Step P193 for determining whether the count value of the counter for detecting the current position of the left side of the squeegee is equal to the desired count value of the counter for detecting the position of the left side of the squeegee.

If the answer is YES in Step P193, the value of the memory M12 for storing the rotating direction of the motor for adjusting the left side is loaded in Step P194. If the answer is NO in Step P193, the program shifts to Step P201 to be described later.

Then, in Step P195, it is determined whether the value of the memory for storing the rotating direction of the motor for adjusting the left side is equal to 1. If the answer is YES, outputting of the normal rotation command to the driver 68 for the motor for adjusting the left side is stopped in Step P196, and the program proceeds to Step P197. If the answer is NO in Step P195, it is determined in Step P198 whether the value of the memory for storing the rotating direction of the motor for adjusting the left side is equal to 2.

If the answer is YES in Step P198, outputting of the reverse rotation command to the driver 68 for the motor for adjusting the left side is stopped in Step P199, and the program shifts to Step P197. If the answer is NO in Step P198, the program shifts to Step P201 to be described later.

Then, the count value S is loaded from the memory M1 in Step P197, whereafter 1 is added to the count value S of the memory M11 for overwriting in Step P200.

Then, in Step P201, the count value is loaded from the counter 74 for detecting the current position of the right side of the squeegee, and stored into the memory M5. Subsequently, in Step P202, the home position (count value of the counter) of the right side of the squeegee is loaded from the memory M6. Then follows Step P203 in which the home position (count value of the counter) of the right side of the squeegee is subtracted from the count value of the counter 74 for detecting the current position of the right side of the squeegee to compute the count value difference for the right side, which is stored into the memory M7.

Then, in Step P204, the current position of the right side of the squeegee is computed from the count value difference for the right side, and stored into the memory M8. Subsequently, in Step P205, the current position of the right side of the squeegee is outputted to the display device 64 for the current position of the right side of the squeegee.

Then, in Step P206, the desired count value of the counter for detecting the position of the right side of the squeegee is loaded from the memory M10. Then follows Step P207 for determining whether the count value of the counter for detecting the current position of the right side of the squeegee is equal to the desired count value of the counter for detecting the position of the right side of the squeegee.

If the answer is YES in Step P207, the value of the memory M13 for storing the rotating direction of the motor for adjusting the right side is loaded in Step P208. If the answer is NO in Step P207, the program shifts to Step P182.

Then, in Step P209, it is determined whether the value of the memory for storing the rotating direction of the motor for adjusting the right side is equal to 1. If the answer is YES, outputting of the normal rotation command to the driver 72 for the motor for adjusting the right side is stopped in Step P210, and the program proceeds to Step P211. If the answer is NO in Step P209, it is determined in Step P213 whether the value of the memory for storing the rotating direction of the motor for adjusting the right side is equal to 2.

If the answer is YES in Step P213, outputting of the reverse rotation command to the driver 72 for the motor for adjusting the right side is stopped in Step P214, and the program shifts to Step P211. If the answer is NO in Step P213, the program immediately returns to Step P182.

Then, the count value S is loaded from the memory M11 in Step P211, whereafter 1 is added to the count value S of the memory M11 for overwriting in Step P212. Then, the program returns to Step P182. In accordance with the above-described motion flow, when the cylinder engagement signal for the rotary screen cylinder 11 is not ON, in other words, when no printing is done by the rotary screen cylinder 11, the right and left sides of the support shaft 27 are moved to the throw-off position, and the state of the counter 76 for counting the total rotational speed during squeegee throw-on is rendered inoperative.

Then, in Step P215 shifted from the aforementioned Step P154, the table of conversion from the total rotational speed during squeegee throw-on to the amount (count value of the counter) of correction of the squeegee position is loaded from the memory M18. Then, in Step P216, the count value is loaded from the counter 76 for counting the total rotational speed during squeegee throw-on, and stored into the memory M19.

Then, in Step P217, the amount (count value of the counter) of correction of the squeegee position is obtained from the count value of the counter 76 for counting the total rotational speed during squeegee throw-on by use of the table of conversion from the total rotational speed during squeegee throw-on to the amount (count value of the counter) of correction of the squeegee position, and the obtained amount is stored into the memory M20. Then follows Step P218 in which the home position (count value of the counter) of the left side of the squeegee is loaded from the memory M2.

Then, in Step P219, the distance (count value of the counter) between the home position and the printing position of the left side of the squeegee is loaded from the memory M21. Subsequently, in Step P220, the amount (count value of the counter) of correction of the squeegee position is loaded from the memory M20.

Then, in Step P221, the distance (count value of the counter) between the home position and the printing position of the left side of the squeegee and the amount (count value of the counter) of correction of the squeegee position are added to the home position (count value of the counter) of the left side of the squeegee to compute the printing position (count value of the counter) of the left side of the squeegee, which is stored into the memory M22. Then, in Step P222, the memory M9 for storing the desired count value of the counter for detecting the position of the left side of the squeegee is overwritten with the printing position (count value of the counter) of the left side of the squeegee.

Then, in Step P223, the home position (count value of the counter) of the right side of the squeegee is loaded from the memory MG. Then follows Step P224 in which the distance (count value of the counter) between the home position and the printing position of the right side of the squeegee is loaded from the memory M23.

Subsequently, in Step P225, the amount (count value of the counter) of correction of the squeegee position is loaded from the memory M20. Then, in Step P226, the distance (count value of the counter) between the home position and the printing position of the right side of the squeegee and the amount (count value of the counter) of correction of the squeegee position are added to the home position (count value of the counter) of the right side of the squeegee to compute the printing position (count value of the counter) of the right side of the squeegee, which is stored into the memory M24.

Then, in Step P227, the memory MIO for storing the desired count value of the counter for detecting the position of the right side of the squeegee is overwritten with the printing position (count value of the counter) of the right side of the squeegee. Then, Step P228 is executed to overwrite the count value S of the memory M11 with 0.

Then, in Step P229*a*, the memory M12 for storing the rotating direction of the motor for adjusting the left side is overwritten with 0. Then follows Step P229*b* in which the memory M13 for storing the rotating direction of the motor for adjusting the right side is overwritten with 0.

Then, in Step P230, the count value is loaded from the counter 70 for detecting the current position of the left side of the squeegee, and stored into the memory M1. Subsequently, in Step P231, the desired count value of the counter for detecting the position of the left side of the squeegee is loaded from the memory M9.

Then, in Step P232, it is determined whether the count value of the counter for detecting the current position of the left side of the squeegee is equal to the desired count value of the counter for detecting the position of the left side of the squeegee. If the answer is NO in the above Step P232, the program proceeds to Step P233. If the answer is YES in Step P232, the count value S is loaded from the memory M11 in Step P234. Then, in Step P235, 1 is added to the count value S of the memory M11 for overwriting, whereafter the program shifts to Step P238 to be described later.

Then, in Step P233, it is determined whether the count value of the counter for detecting the current position of the left side of the squeegee is less than the desired count value of the counter for detecting the position of the left side of the squeegee. If the answer is YES in Step P233, the memory M12 for storing the rotating direction of the motor for adjusting the left side is overwritten with 1 in Step P236. Then, in Step P237, a normal rotation command is outputted to the driver 68 for the motor for adjusting the left side. Then, the program proceeds to Step P238.

If the answer is NO in Step P233, the memory M12 for storing the rotating direction of the motor for adjusting the left side is overwritten with 2 in Step P239. Then, in Step P240, a reverse rotation command is outputted to the driver 68 for the motor for adjusting the left side. Then, the program shifts to Step P238.

Then follows Step P238 in which the count value is loaded from the counter 74 for detecting the current position of the right side of the squeegee, and stored into the memory M5. Then, in Step P241, the desired count value of the counter for detecting the position of the right side of the squeegee is loaded from the memory M10.

Then, in Step P242, it is determined whether the count value of the counter for detecting the current position of the right side of the squeegee is equal to the desired count value of the counter for detecting the position of the right side of the squeegee. If the answer is NO in the above Step P242, the program proceeds to Step P243. If the answer is YES in Step P242, the count value S is loaded from the memory M11 in Step P244. Then, in Step P245, 1 is added to the count value S of the memory M11 for overwriting, whereafter the program shifts to Step P248 to be described later.

Then, it is determined in Step P243 whether the count value of the counter for detecting the current position of the right side of the squeegee is less than the desired count value of the counter for detecting the position of the right side of the squeegee. If the answer is YES in Step P243, the memory M13 for storing the rotating direction of the motor for adjusting the right side is overwritten with 1 in Step P246. Then, in Step P247, a normal rotation command is outputted to the driver 72 for the motor for adjusting the right side. Then, the program proceeds to Step P248.

If the answer is NO in Step P243, the memory M13 for storing the rotating direction of the motor for adjusting the right side is overwritten with 2 in Step P249. Then, in Step P250, a reverse rotation command is outputted to the driver 72 for the motor for adjusting the right side. Then, the program shifts to Step P248.

Then, in Step P248, the count value S is loaded from the memory M11, whereafter it is determined in Step P251 whether the count value S is equal to 2. If the answer is NO in Step P251, the program proceeds to Step P252. If the answer is YES in Step P251, Step P253 is executed to output an enabling signal to the counter 76 for counting the total rotational speed during squeegee throw-on. Then, the program shifts to Step P281 to be described later.

Then, in Step P252, the count value is loaded from the counter 70 for detecting the current position of the left side of the squeegee, and stored into the memory M1. Subsequently, in Step P254, the home position (count value of the counter) of the left side of the squeegee is loaded from the memory M2.

Then follows Step P255 in which the home position (count value of the counter) of the left side of the squeegee is subtracted from the count value of the counter 70 for detecting the current position of the left side of the squeegee to compute the count value difference for the left side, which is stored into the memory M3. Then, in Step P256, the current position of the left side of the squeegee is computed from the count value difference for the left side, and stored into the memory M4.

Subsequently, in Step P257, the current position of the left side of the squeegee is outputted to the display device 63 for the current position of the left side of the squeegee. Then, in Step P258, the desired count value of the counter for detecting the position of the left side of the squeegee is loaded from the memory M9.

Then follows Step P259 for determining whether the count value of the counter for detecting the current position of the left side of the squeegee is equal to the desired count value of the counter for detecting the position of the left side of the squeegee. If the answer is YES in Step P259, the value of the memory M12 for storing the rotating direction of the motor for adjusting the left side is loaded in Step P260. If the answer is NO in Step P259, the program shifts to Step P267 to be described later.

Then, in Step P261, it is determined whether the value of the memory for storing the rotating direction of the motor for adjusting the left side is equal to 1. If the answer is YES, outputting of the normal rotation command to the driver 68 for the motor for adjusting the left side is stopped in Step P262, and the program proceeds to Step P263. If the answer is NO in Step P261, it is determined in Step P264 whether the value of the memory for storing the rotating direction of the motor for adjusting the left side is equal to 2.

If the answer is YES in Step P264, outputting of the reverse rotation command to the driver 68 for the motor for adjusting the left side is stopped in Step P265, and the program shifts to Step P263. If the answer is NO in Step P264, the program shifts to Step P267.

Then, the count value S is loaded from the memory M11 in Step P263, whereafter 1 is added to the count value S of the memory M11 for overwriting in Step P266.

Then, in Step P267, the count value is loaded from the counter 74 for detecting the current position of the right side of the squeegee, and stored into the memory M5. Subsequently, in Step P268, the home position (count value of the counter) of the right side of the squeegee is loaded from the memory M6.

Then follows Step P269 in which the home position (count value of the counter) of the right side of the squeegee is subtracted from the count value of the counter 74 for detecting the current position of the right side of the squeegee to compute the count value difference for the right side, which is stored into the memory M7. Then, in Step P270, the current position of the right side of the squeegee is computed from the count value difference for the right side, and stored into the memory M8.

Subsequently, in Step P271, the current position of the right side of the squeegee is outputted to the display device 64 for the current position of the right side of the squeegee. Then, in Step P272, the desired count value of the counter for detecting the position of the right side of the squeegee is loaded from the memory M10.

Then follows Step P273 for determining whether the count value of the counter for detecting the current position of the right side of the squeegee is equal to the desired count value of the counter for detecting the position of the right side of the squeegee. If the answer is YES in Step P273, the value of the memory M13 for storing the rotating direction of the motor for adjusting the right side is loaded in Step P274. If the answer is NO in Step P273, the program returns to Step P248.

Then, in Step P275, it is determined whether the value of the memory for storing the rotating direction of the motor for adjusting the right side is equal to 1. If the answer is YES, outputting of the normal rotation command to the driver 72 for the motor for adjusting the right side is stopped in Step P276, and the program proceeds to Step P277. If the answer is NO in Step P275, it is determined in Step P279 whether the value of the memory for storing the rotating direction of the motor for adjusting the right side is equal to 2.

If the answer is YES in Step P279, outputting of the reverse rotation command to the driver 72 for the motor for adjusting the right side is stopped in Step P280, and the program returns to Step P248. If the answer is NO in Step P279, the program immediately shifts to Step P248.

Then, after the count value S is loaded from the memory M11 in Step P277, 1 is added to the count value S of the memory M11 for overwriting in Step P278.

In accordance with the above-described motion flow, when the cylinder engagement signal for the rotary screen cylinder 11 is ON, in other words, when printing is done by the rotary screen cylinder 11, the right and left sides of the support shaft 27 are moved to the printing position, and the state of the counter 76 for counting the total rotational speed during squeegee throw-on is rendered operative.

Then, in Step P281 shifted from the aforementioned Step P253, it is determined whether the left side adjustment selection switch 55 is ON. If the answer is YES, it is determined in Step P282 whether the adjustment completion switch 58 is ON. If the answer is NO, the program shifts to Step P304 to be described later.

If the answer is YES in Step P282, Step P283 is executed in which the count value is loaded from the counter 70 for detecting the current position of the left side of the squeegee, and stored into the memory M1. Then, in Step P284, the home position (count value of the counter) of the left side of the squeegee is loaded from the memory M2.

Then, in Step P285, the home position (count value of the counter) of the left side of the squeegee is subtracted from the count value of the counter 70 for detecting the current position of the left side of the squeegee to compute the distance (count value of the counter) between the home position and the printing position of the left side of the squeegee, and the computed distance is stored into the memory M21. Then, the program shifts to Step P304 to be described later.

If the answer is NO in Step P282, it is determined in Step P286 whether the up button 59 is ON. If the answer is YES in Step P286, this is followed by Step P287 in which a normal rotation command is outputted to the driver 68 for the motor for adjusting the left side. If the answer is NO in Step P286, the program shifts to Step P295 to be described later.

Then, in Step P288, the count value is loaded from the counter 70 for detecting the current position of the left side of the squeegee, and stored into the memory M1. Subsequently, in Step P289, the home position (count value of the counter) of the left side of the squeegee is loaded from the memory M2.

Then, in Step P290, the home position (count value of the counter) of the left side of the squeegee is subtracted from the count value of the counter 70 for detecting the current position of the left side of the squeegee to compute the count value difference for the left side, which is stored into the memory M3. This is followed by Step P291 in which the current position of the left side of the squeegee is computed from the count value difference for the left side, and stored into the memory M4.

Then, in Step P292, the current position of the left side of the squeegee is outputted to the display device 63 for the current position of the left side of the squeegee. Subsequently, in Step P293, it is determined whether the up button 59 is OFF. If the answer is YES in Step P293, Step P294 is executed to stop outputting of the normal rotation command to the driver 68 for the motor for adjusting the left side. Then, the program proceeds to Step P295. If the answer is NO in Step P293, the program returns to Step P288.

Then, in Step P295, it is determined whether the down button 60 is ON. If the answer is YES, Step P296 is executed to output a reverse rotation command to the driver 68 for the motor for adjusting the left side. If the answer is NO in Step P295, the program returns to Step P282.

Then, in Step P297, the count value is loaded from the counter 70 for detecting the current position of the left side of the squeegee, and stored into the memory M1. Subsequently, in Step P298, the home position (count value of the counter) of the left side of the squeegee is loaded from the memory M2.

Then, in Step P299, the home position (count value of the counter) of the left side of the squeegee is subtracted from the count value of the counter 70 for detecting the current position of the left side of the squeegee to compute the count value difference for the left side, which is stored into the memory M3. This is followed by Step P300 in which the current position of the left side of the squeegee is computed from the count value difference for the left side, and stored into the memory M4.

Then, in Step P301, the current position of the left side of the squeegee is outputted to the display device 63 for the current position of the left side of the squeegee. Subsequently, in Step P302, it is determined whether the down button 60 is OFF. If the answer is YES in Step P302, Step P303 is executed to stop outputting of the reverse rotation command to the driver 68 for the motor for adjusting the left side. Then, the program returns to Step P282. If the answer is NO in Step P302, the program returns to Step P297.

Then, in Step P304, it is determined whether the right side adjustment selection switch 56 is ON. If the answer is YES, it is determined in Step P305 whether the adjustment completion switch 58 is ON. If the answer is NO in Step P304, the program shifts to Step P327 to be described later.

If the answer is YES in Step P305, Step P306 is executed in which the count value is loaded from the counter 74 for detecting the current position of the right side of the squeegee, and stored into the memory M5. Then, in Step P307, the home position (count value of the counter) of the right side of the squeegee is loaded from the memory M6.

Then, in Step P308, the home position (count value of the counter) of the right side of the squeegee is subtracted from the count value of the counter 74 for detecting the current position of the right side of the squeegee to compute the distance (count value of the counter) between the home position and the printing position of the right side of the squeegee, and the computed distance is stored into the memory M23. Then, the program shifts to Step P327 to be described later.

If the answer is NO in Step P305, it is determined in Step P309 whether the up button 59 is ON. If the answer is YES in Step P309, this is followed by Step P310 in which a normal rotation command is outputted to the driver 72 for the motor for adjusting the right side. If the answer is NO in Step P309, the program shifts to Step P318 to be described later.

Then, in Step P311, the count value is loaded from the counter 74 for detecting the current position of the right side of the squeegee, and stored into the memory M5. Subsequently, in Step P312, the home position (count value of the counter) of the right side of the squeegee is loaded from the memory M6.

Then, in Step P313, the home position (count value of the counter) of the right side of the squeegee is subtracted from the count value of the counter 74 for detecting the current position of the right side of the squeegee to compute the count value difference for the right side, which is stored into the memory M7. This is followed by Step P314 in which the current position of the right side of the squeegee is computed from the count value difference for the right side, and stored into the memory M8.

Then, in Step P315, the current position of the right side of the squeegee is outputted to the display device 64 for the current position of the right side of the squeegee. Subsequently, in Step P316, it is determined whether the up button 59 is OFF. If the answer is YES in Step P316, Step P317 is executed to stop outputting of the normal rotation command to the driver 72 for the motor for adjusting the right side. Then, the program proceeds to Step P318. If the answer is NO in Step P316, the program returns to Step P311.

Then, in Step P318, it is determined whether the down button 60 is ON. If the answer is YES, Step P319 is executed to output a reverse rotation command to the driver 72 for the motor for adjusting the right side. If the answer is NO in Step P318, the program returns to Step P305.

Then, in Step P320, the count value is loaded from the counter 74 for detecting the current position of the right side of the squeegee, and stored into the memory M5. Subsequently, in Step P321, the home position (count value of the counter) of the right side of the squeegee is loaded from the memory M6.

Then, in Step P322, the home position (count value of the counter) of the right side of the squeegee is subtracted from the count value of the counter 74 for detecting the current position of the right side of the squeegee to compute the count value difference for the right side, which is stored into the memory M7. This is followed by Step P323 in which the current position of the right side of the squeegee is computed from the count value difference for the right side, and stored into the memory M8.

Then, in Step P324, the current position of the right side of the squeegee is outputted to the display device 64 for the current position of the right side of the squeegee. Subsequently, in Step P325, it is determined whether the down button 60 is OFF. If the answer is YES in Step P325, Step P326 is executed to stop outputting of the reverse rotation command to the driver 72 for the motor for adjusting the right side. Then, the program returns to Step P305. If the answer is NO in Step P325, the program returns to Step P320.

Then, in Step P327, it is determined whether the both sides adjustment selection switch 57 is ON. If the answer is YES, it is determined in Step P328 whether the adjustment completion switch 58 is ON. If the answer is NO in Step P327, the program returns to Step P153.

If the answer is YES in Step P329, Step P329 is executed in which the count value is loaded from the counter 70 for detecting the current position of the left side of the squeegee, and stored into the memory M1. Then, in Step P330, the home position (count value of the counter) of the left side of the squeegee is loaded from the memory M2.

Then, in Step P331, the home position (count value of the counter) of the left side of the squeegee is subtracted from the count value of the counter 70 for detecting the current position of the left side of the squeegee to compute the distance (count value of the counter) between the home position and the printing position of the left side of the squeegee, and the computed distance is stored into the memory M21. Then, Step P332 is executed in which the count value is loaded from the counter 74 for detecting the current position of the right side of the squeegee, and stored into the memory M5.

Then, in Step P333, the home position (count value of the counter) of the right side of the squeegee is loaded from the memory M6. Then, in Step P334, the home position (count value of the counter) of the right side of the squeegee is subtracted from the count value of the counter 74 for detecting the current position of the right side of the squeegee to compute the distance (count value of the counter) between the home position and the printing position of the right side of the squeegee, and the computed distance is stored into the memory M23. Then, the program returns to Step P153.

If the answer is NO in Step P328, it is determined in Step P335 whether the up button 59 is ON. If the answer is YES in Step P335, this is followed by Step P336 in which a normal rotation command is outputted to the driver 68 for the motor for adjusting the left side. If the answer is NO in Step P335, the program shifts to Step P351 to be described later.

Then, in Step P337, a normal rotation command is outputted to the driver 72 for the motor for adjusting the right side. Then, in Step P338, the count value is loaded from the counter 70 for detecting the current position of the left side of the squeegee, and stored into the memory M1.

Subsequently, in Step P339, the home position (count value of the counter) of the left side of the squeegee is loaded from the memory M2. Then, in Step P340, the home position (count value of the counter) of the left side of the squeegee is subtracted from the count value of the counter 70 for detecting the current position of the left side of the squeegee to compute the count value difference for the left side, which is stored into the memory M3.

This is followed by Step P341 in which the current position of the left side of the squeegee is computed from the count value difference for the left side, and stored into the memory M4. Then, in Step P342, the current position of the left side of the squeegee is outputted to the display device 63 for the current position of the left side of the squeegee.

Then, in Step P343, the count value is loaded from the counter 74 for detecting the current position of the right side of the squeegee, and stored into the memory M5. Subsequently, in Step P344, the home position (count value of the counter) of the right side of the squeegee is loaded from the memory M6.

Then, in Step P345, the home position (count value of the counter) of the right side of the squeegee is subtracted from the count value of the counter 74 for detecting the current position of the right side of the squeegee to compute the count value difference for the right side, which is stored into the memory M7. This is followed by Step P346 in which the current position of the right side of the squeegee is computed from the count value difference for the right side, and stored into the memory M8.

Then, in Step P347, the current position of the right side of the squeegee is outputted to the display device 64 for the current position of the right side of the squeegee. Subsequently, in Step P348, it is determined whether the up button 59 is OFF.

If the answer is YES in Step P348, Step P349 is executed to stop outputting of the normal rotation command to the driver 68 for the motor for adjusting the left side. Then, in Step P350, outputting of the normal rotation command to the driver 72 for the motor for adjusting the right side is stopped. Then, the program proceeds to Step P351. If the answer is NO in Step P348, the program returns to Step P338.

Then, it is determined in Step P351 whether the down button 60 is ON. If the answer is YES in Step P351, this is followed by Step P352 in which a reverse rotation command is outputted to the driver 68 for the motor for adjusting the left side. If the answer is NO in Step P351, the program returns to Step P328.

Then, in Step P353, a reverse rotation command is outputted to the driver 72 for the motor for adjusting the right side. Then, in Step P354, the count value is loaded from the counter 70 for detecting the current position of the left side of the squeegee, and stored into the memory M1.

Subsequently, in Step P355, the home position (count value of the counter) of the left side of the squeegee is loaded from die memory M2. Then, in Step P356, the home position (count value of the counter) of the left side of the squeegee is subtracted from the count value of the counter 70 for detecting the current position of the left side of the squeegee to compute the count value difference for the left side, which is stored into the memory M3.

This is followed by Step P357 in which the current position of the left side of the squeegee is computed from the count value difference for the left side, and stored into the memory M4. Then, in Step P358, the current position of the left side of the squeegee is outputted to the display device 63 for the current position of the left side of the squeegee.

Then, in Step P359, the count value is loaded from the counter 74 for detecting the current position of the right side of the squeegee, and stored into the memory M5. Subsequently, in Step P360, the home position (count value of the counter) of the right side of the squeegee is loaded from the memory M6.

Then, in Step P361, the home position (count value of the counter) of the right side of the squeegee is subtracted from the count value of the counter 74 for detecting the current position of the right side of the squeegee to compute the count value difference for the right side, which is stored into the memory M7. This is followed by Step P362 in which the current position of the right side of the squeegee is computed from the count value difference for the right side, and stored into the memory M8.

Then, in Step P363, the current position of the right side of the squeegee is outputted to the display device 64 for the current position of the right side of the squeegee. Subsequently, in Step P364, it is determined whether the down button 60 is OFF.

If the answer is YES in Step P364, Step P365 is executed to stop outputting of the reverse rotation command to the driver 68 for the motor for adjusting the left side. Then, in Step P366, outputting of the reverse rotation command to the driver 72 for the motor for adjusting the right side is stopped. Then, the program returns to Step P328. If the answer is NO in Step P364, the program returns to Step P354. In accordance with the above-described motion flow, the distance between the home position and the printing position of the support shaft 27, which has been adjusted by the operator's manual operation during printing, is stored as a new distance between the home position and the printing position. In other words, the adjusted printing position is stored as a new printing position.

Then, in Step P367 shifted from the aforementioned P153, the home position (count value of the counter) of the left side of the squeegee is loaded from the memory M2. Then, in Step P368, the distance (count value of the counter) between the home position and the throw-off position of the left side of the squeegee is loaded from the memory M14.

Then follows Step P369 in which the distance (count value of the counter) between the home position and the throw-off position of the left side of the squeegee is added to the home position (count value of the counter) of the left side of the squeegee to compute the throw-off position (count value of the counter) of the left side of the squeegee, and the computed value is stored into the memory M15. Then, in Step P370, the memory M9 for storing the desired count value of the counter for detecting the position of the left side of the squeegee is overwritten with the throw-off position (count value of the counter) of the left side of the squeegee.

Subsequently, in Step P371, the home position (count value of the counter) of the right side of the squeegee is loaded from the memory M6. Then, in Step P372, the distance (count value of the counter) between the home position and the throw-off position of the right side of the squeegee is loaded from the memory M16.

Then follows Step P373 in which the distance (count value of the counter) between the home position and the throw-off position of the right side of the squeegee is added to the home position (count value of the counter) of the right side of the squeegee to compute the throw-off position (count value of the counter) of the right side of the squeegee, and the computed value is stored into the memory M17. Then, in Step P374, the memory M10 for storing the desired count value of the counter for detecting the position of the right side of the squeegee is overwritten with the throw-off position (count value of the counter) of the right side of the squeegee.

Then, the count value S of the memory M11 is overwritten with 0 in Step P375. After the memory M12 for storing the rotating direction of the motor for adjusting the left side is overwritten with 0 in Step P376, the memory M13 for storing the rotating direction of the motor for adjusting the right side is overwritten with 0 in Step P377.

Then, in Step P378, the count value is loaded from the counter 70 for detecting the current position of the left side of the squeegee, and stored into the memory M1. Subsequently, in Step P379, the desired count value of the counter for detecting the position of the left side of the squeegee is loaded from the memory M9.

Then, in Step P380, it is determined whether the count value of the counter for detecting the current position of the left side of the squeegee is equal to the desired count value of the counter for detecting the position of the left side of the squeegee. If the answer is YES in Step P380, the count value S is loaded from the memory M11 in Step P382. Then, in Step P383, 1 is added to the count value S of the memory M11 for overwriting, whereafter the program shifts to Step P386 to be described later.

If the answer is NO in Step P380, it is determined in Step P381 whether the count value of the counter for detecting the current position of the left side of the squeegee is less than the desired count value of the counter for detecting the position of the left side of the squeegee. If the answer is YES in Step P381, the memory M12 for storing the rotating direction of the motor for adjusting the left side is overwritten with 1 in Step P384. Then, in Step P385, a normal rotation command is outputted to the driver 68 for the motor for adjusting the left side.

If the answer is NO in Step P381, the memory M12 for storing the rotating direction of the motor for adjusting the left side is overwritten with 2 in Step P387. Then, in Step P388, a reverse rotation command is outputted to the driver 68 for the motor for adjusting the left side.

Then follows Step P386 in which the count value is loaded from the counter 74 for detecting the current position of the right side of the squeegee, and stored into the memory M5. Then, in Step P389, the desired count value of the counter for detecting the position of the right side of the squeegee is loaded from the memory M10.

Then, in Step P390, it is determined whether the count value of the counter for detecting the current position of the right side of the squeegee is equal to the desired count value of the counter for detecting the position of the right side of the squeegee. If the answer is YES in Step P390, the count value S is loaded from the memory M1 in Step P392. Then, in Step P393, 1 is added to the count value S of the memory M11 for overwriting, whereafter the program shifts to Step P396 to be described later.

If the answer is NO in the above Step P390, it is determined in Step P391 whether the count value of the counter for detecting the current position of the right side of the squeegee is less than the desired count value of the counter for detecting the position of the right side of the squeegee. If the answer is YES in Step P391, the memory M13 for storing the rotating direction of the motor for adjusting the right side is overwritten with 1 in Step P394. Then, in Step P395, a normal rotation command is outputted to the driver 72 for the motor for adjusting the right side.

If the answer is NO in Step P391, the memory M13 for storing the rotating direction of the motor for adjusting the right side is overwritten with 2 in Step P397. Then, in Step P398, a reverse rotation command is outputted to the driver 72 for the motor for adjusting the right side.

Then, in Step P396, the count value S is loaded from the memory M11, whereafter it is determined in Step P399 whether the count value S is equal to 2. If the answer is YES in Step P399, outputting of the enabling signal to the counter 76 for counting the total rotational speed during squeegee throw-on is stopped in Step P401, and the program returns to Step P11.

If the answer is NO in Step P399, Step P400 is executed in which the count value is loaded from the counter 70 for detecting the current position of the left side of the squeegee, and stored into the memory M1. Subsequently, in Step P402, the home position (count value of the counter) of the left side of the squeegee is loaded from the memory M2.

Then follows Step P403 in which the home position (count value of the counter) of the left side of the squeegee is subtracted from the count value of the counter 70 for detecting the current position of the left side of the squeegee to compute the count value difference for the left side, which is stored into the memory M3. Then, in Step P404, the current position of the left side of the squeegee is computed from the count value difference for the left side, and stored into the memory M4.

Subsequently, in Step P405, the current position of the left side of the squeegee is outputted to the display device 63 for the current position of the left side of the squeegee. Then, in Step P406, the desired count value of the counter for detecting the position of the left side of the squeegee is loaded from the memory M9.

Then follows Step P407 for determining whether the count value of the counter for detecting the current position of the left side of the squeegee is equal to the desired count value of the counter for detecting the position of the left side of the squeegee. If the answer is YES in Step P407, the value of the memory M12 for storing the rotating direction of the motor for adjusting the left side is loaded in Step P408. If the answer is NO in Step P407, the program shifts to Step P415 to be described later.

Then, in Step P409, it is determined whether the value of the memory for storing the rotating direction of the motor for adjusting the left side is equal to 1. If the answer is YES, outputting of the normal rotation command to the driver 68 for the motor for adjusting the left side is stopped in Step P410, and the program proceeds to Step P411. If the answer is NO in Step P409, it is determined in Step P412 whether the value of the memory for storing the rotating direction of the motor for adjusting the left side is equal to 2.

If the answer is YES in Step P412, outputting of the reverse rotation command to the driver 68 for the motor for adjusting the left side is stopped in Step P413, and the program shifts to Step P411. If the answer is NO in Step P412, the program shifts to Step P415. Then, the count value S is loaded from the memory M11 in Step P411, whereafter 1 is added to the count value S of the memory M11 for overwriting in Step P414.

Then, in Step P415, the count value is loaded from the counter 74 for detecting the current position of the right side of the squeegee, and stored into the memory M5. Subsequently, in Step P416, the home position (count value of the counter) of the right side of the squeegee is loaded from the memory M6.

Then follows Step P417 in which the home position (count value of the counter) of the right side of the squeegee is subtracted from the count value of the counter 74 for detecting the current position of the right side of the squeegee to compute the count value difference for the right side, which is stored into the memory M7. Then, in Step P418, the current position of the right side of the squeegee is computed from the count value difference for the right side, and stored into the memory M8

Subsequently, in Step P419, the current position of the right side of the squeegee is outputted to the display device 64 for the current position of the right side of the squeegee. Then, in Step P420, the desired count value of the counter for detecting the position of the right side of the squeegee is loaded from the memory M10.

Then follows Step P421 for determining whether the count value of the counter for detecting the current position of the right side of the squeegee is equal to the desired count value of the counter for detecting the position of the right side of the squeegee. If the answer is YES in Step P421, the value of the memory M13 for storing the rotating direction of the motor for adjusting the right side is loaded in Step P422. If the answer is NO in Step P421, the program returns to Step P396.

Then, in Step P423, it is determined whether the value of the memory for storing the rotating direction of the motor for adjusting the right side is equal to 1. If the answer is YES, outputting of the normal rotation command to the driver 72 for the motor for adjusting the right side is stopped in Step P424, and the program proceeds to Step P425. If the answer is NO in Step P423, it is determined in Step P427 whether the value of the memory for storing the rotating direction of the motor for adjusting the right side is equal to 2.

If the answer is YES in Step P427, outputting of the reverse rotation command to the driver 72 for the motor for adjusting the right side is stopped in Step P428, and the program shifts to Step P425. If the answer is NO in Step P427, the program returns to Step P396.

Then, the count value S is loaded from the memory M11 in Step P425, whereafter 1 is added to the count value S of the memory M11 for overwriting in Step P426. Then, the program returns to Step P396. Subsequently, this procedure is repeated.

In accordance with the above-described motion flow, when the squeegee throw-on and throw-off automatic control is released, the right and left sides of the support shaft 27 are moved to the throw-off position, and the state of the counter 76 for counting the total rotational speed during squeegee throw-on is rendered inoperative.

According to the present embodiment, as described above, in the rotary screen printing press, the throw-on and throw-off of the squeegee 38 with respect to the inner peripheral surface of the screen printing forme 11*c*, and the adjustment of the throw-on position of the squeegee 38 can be performed automatically by the motors 36A and 36B. Thus, it becomes possible to lessen burden on the operator and cut down on the adjusting time, thereby increasing the rate of operation and decreasing wasted paper. On this occasion, according to the present embodiment, the right and left end portions of the support shaft 27 can be adjusted independently of each other. Thus, even when the squeegee 38 is mounted obliquely during its replacement, the posture of the squeegee 38 can be corrected, without the need to detach the squeegee 38 and mount it again on the holder 37.

Moreover, the home position for the throw-on and throw-off of the squeegee 38 with respect to the inner peripheral surface of the screen printing forme 11*c* can be adjusted, so that the throw-on and throw-off status can be reproduced with high accuracy.

Furthermore, the relative position between the home position and the throw-off position of the squeegee 38 is constant. Thus, control is easy.

Besides, the relative position between the home position and the throw-on position of the squeegee 38 is adjustable, so that the throw-on position of the squeegee 38 can be maintained always appropriately.

In addition, the relative position between the home position and the throw-on position of the squeegee 38 changes according to the amount of adjustment of the throw-on position by the operator. Thus, after the throw-on position adjustment by the operator, the throw-on position can be adjusted automatically.

Additionally, after the adjustment of the home position for the throw-on and throw-off of the squeegee 38 with respect to the inner peripheral surface of the screen printing forme 11*c*, the total rotational speed of the rotary screen cylinder 11, with the squeegee 38 being thrown on the inner peripheral surface of the screen printing forme 11*c*, is measured, and the throw-on position of the squeegee 38 with respect to the inner peripheral surface of the screen printing forme 11*c* is adjusted in accordance with the measured total rotational speed of the rotary screen cylinder 11. Thus, even if the squeegee 38 has worn, its always appropriate throw-on position can be maintained automatically.

Embodiment 2

Figure 13:
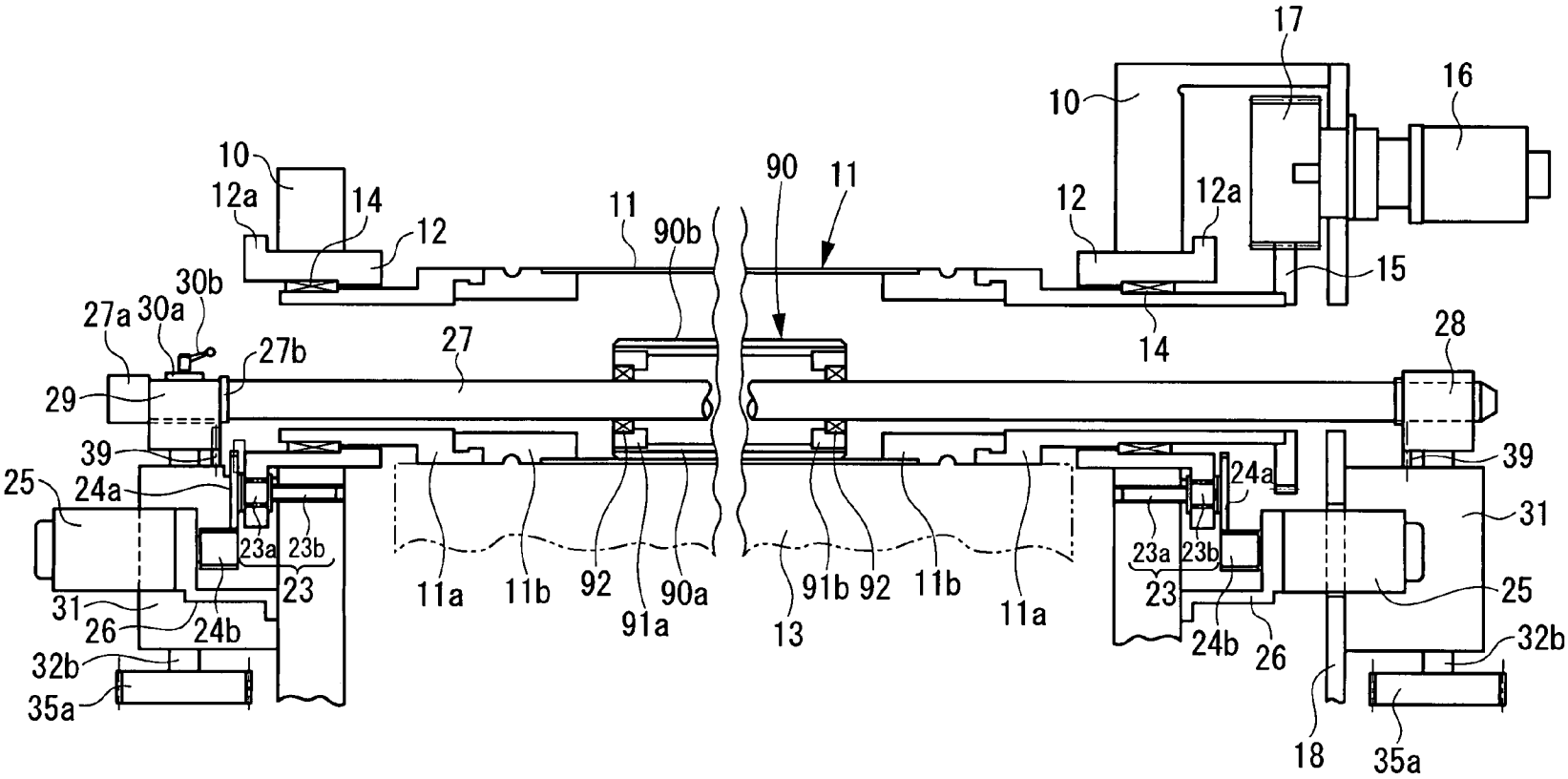
FIG. 13 is a schematic configurational sectional view of a rotary screen printing unit in a rotary screen printing press showing Embodiment 2 of the present invention.
Figure 14A:
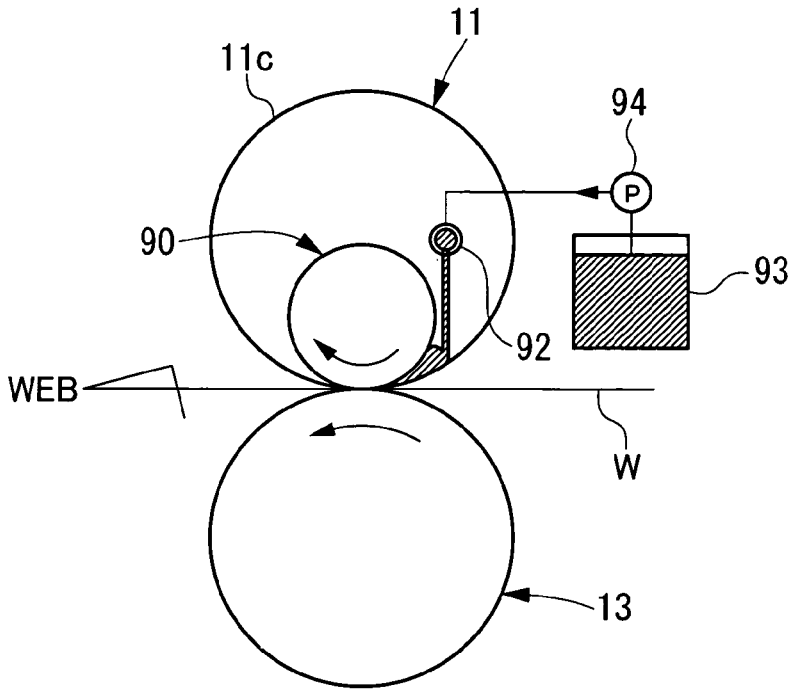
FIG. 14(*a*) is an explanation drawing of an ink supply system.
Figure 14B:
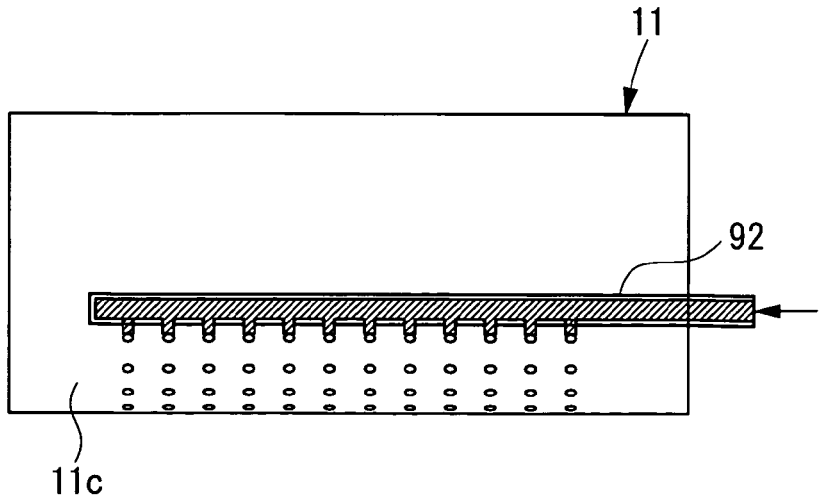
Figure 15A:
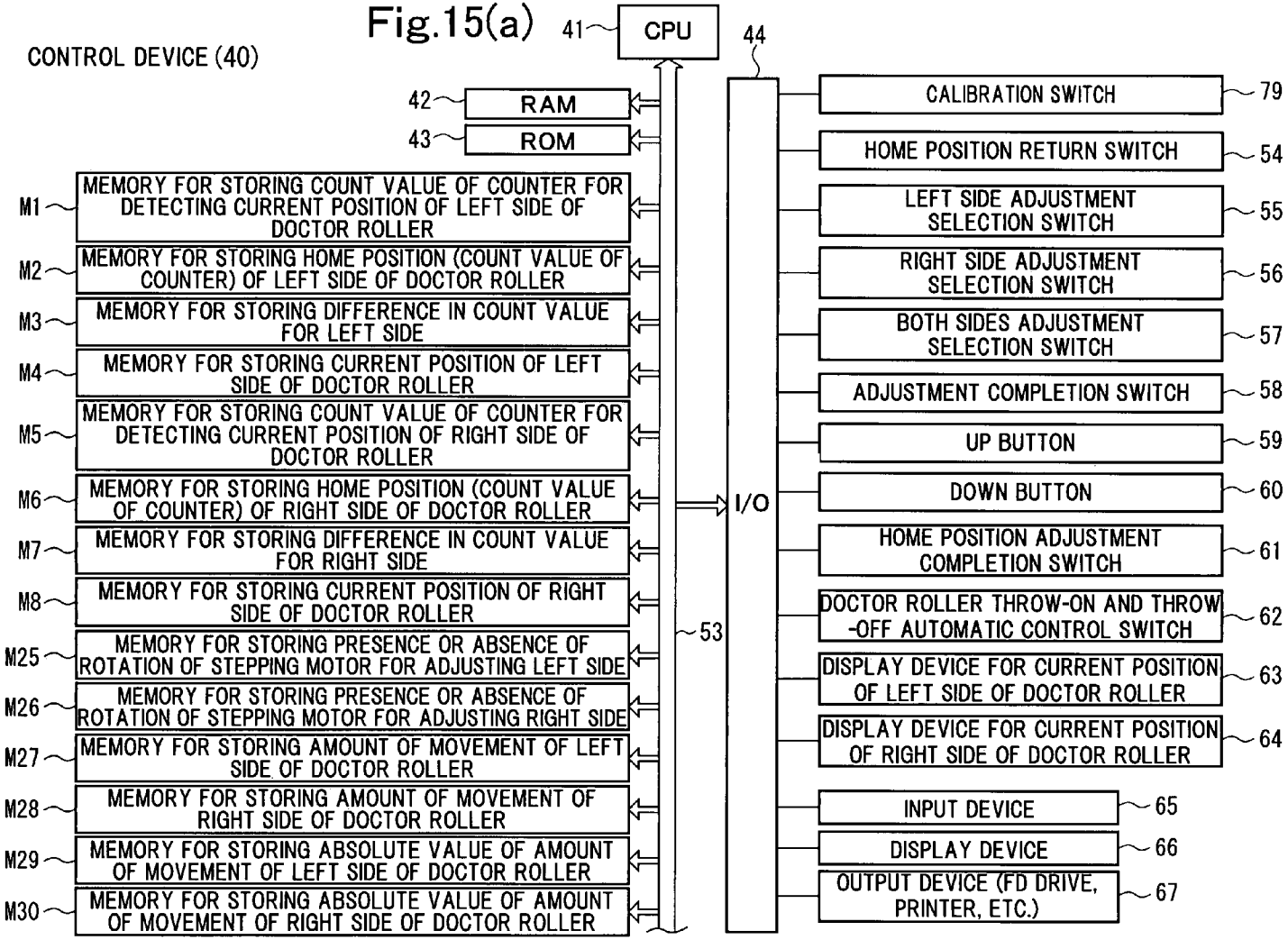
FIG. 15(*a*) is a control block diagram of a control device.
Figure 16A:
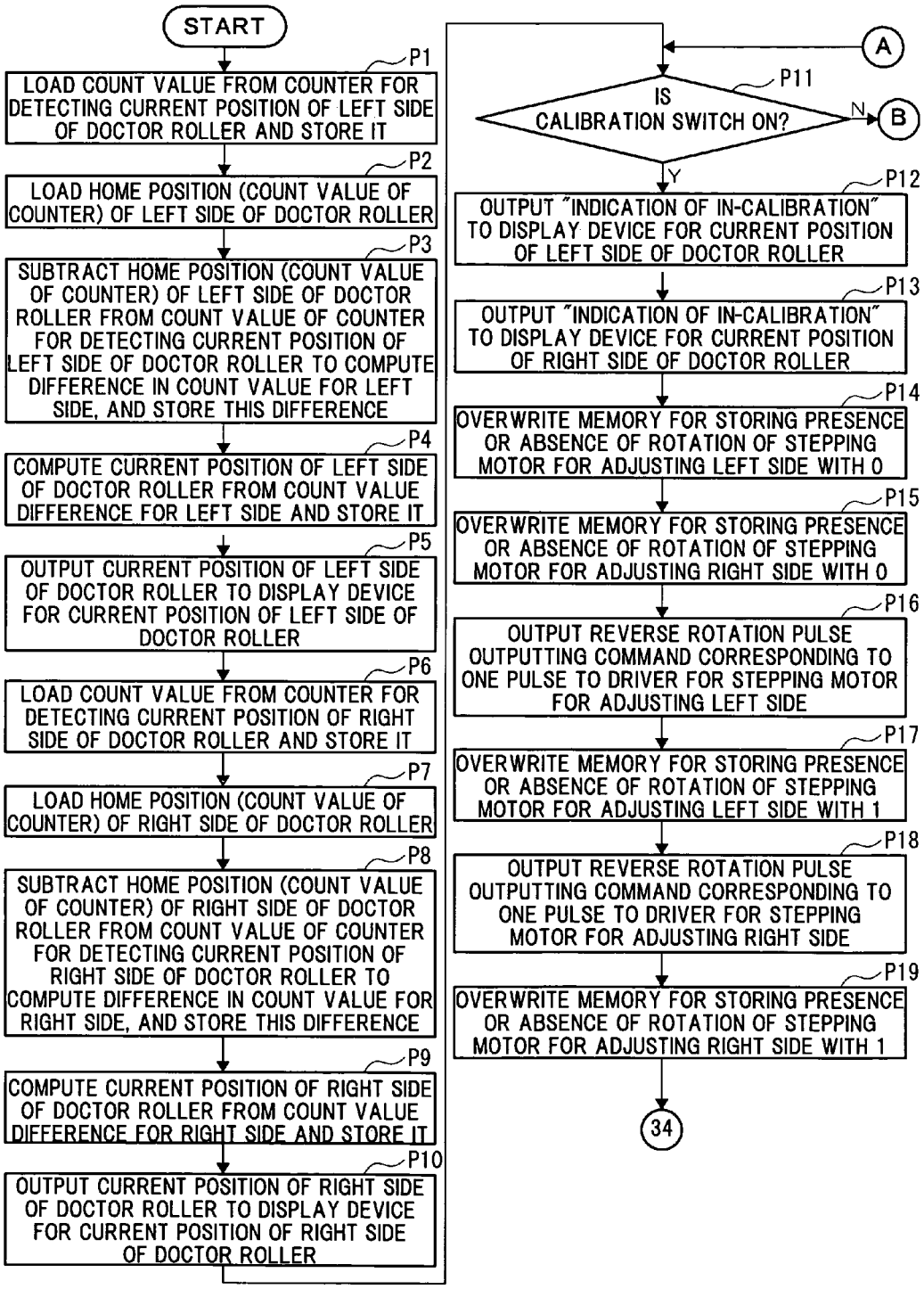
FIG. 16(*a*) is a motion flow chart of the control device.
Figure 16B:
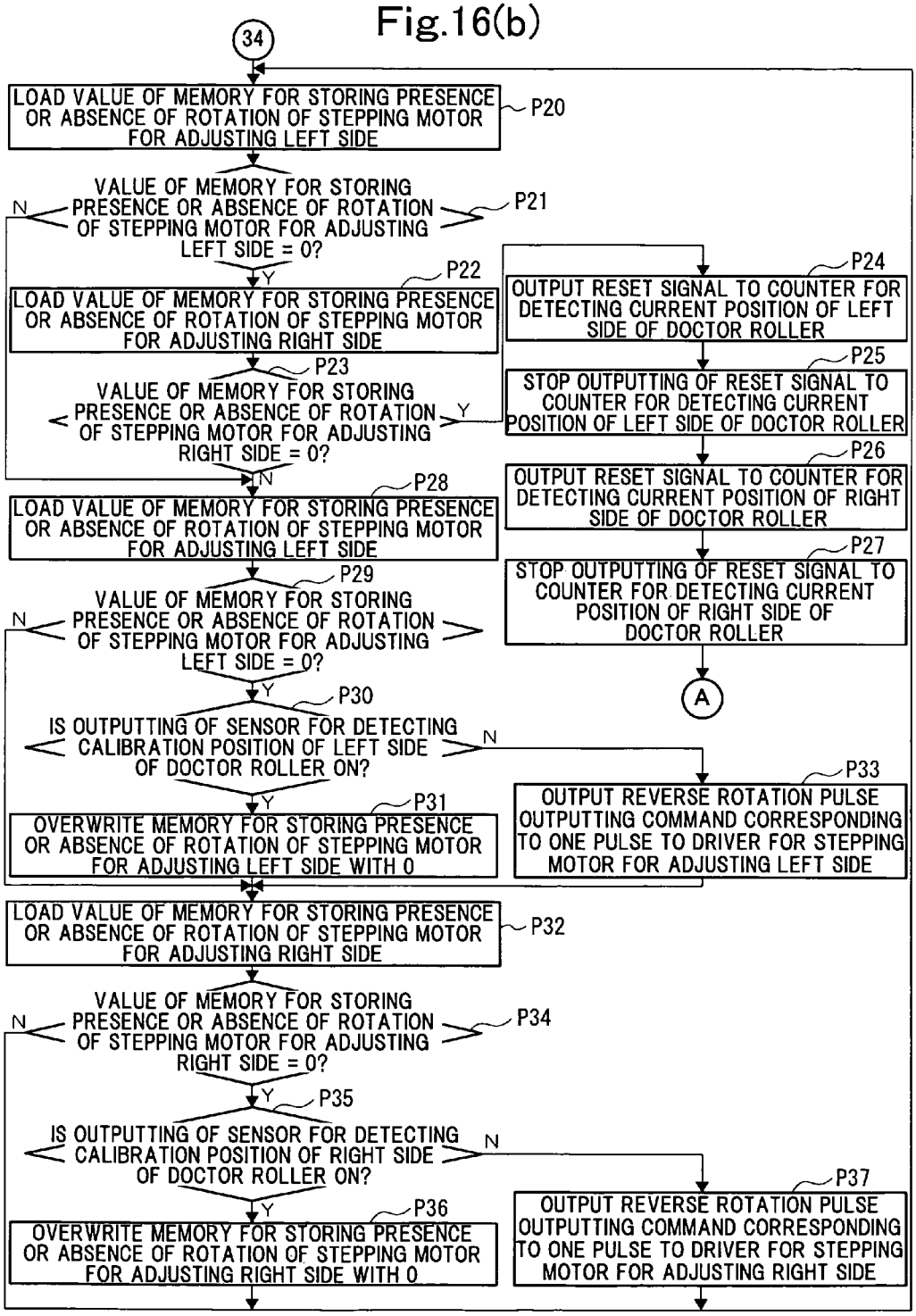
Figure 17A:
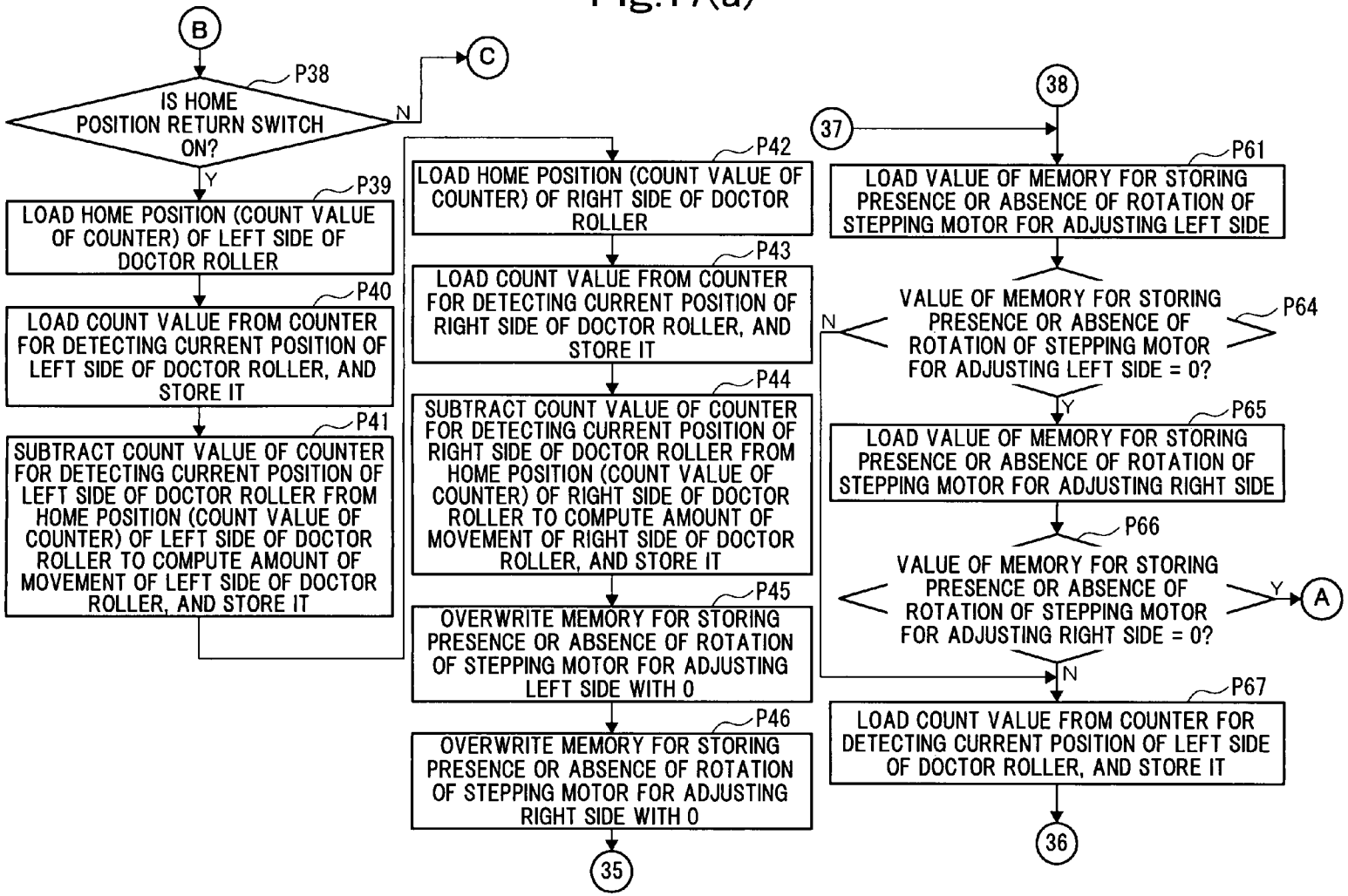
FIG. 17(*a*) is a motion flow chart of the control device.
Figure 17B:
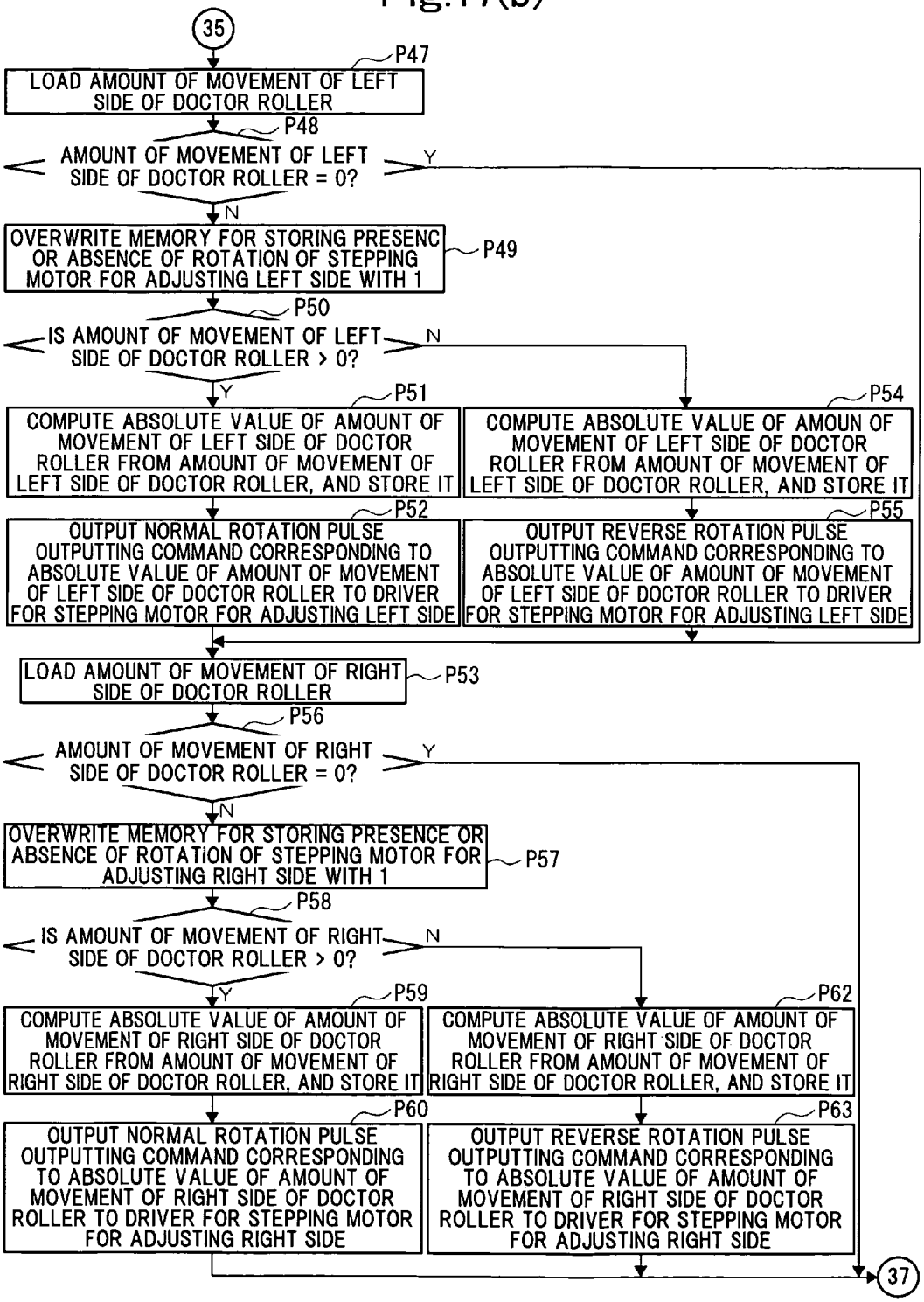
Figure 17C:
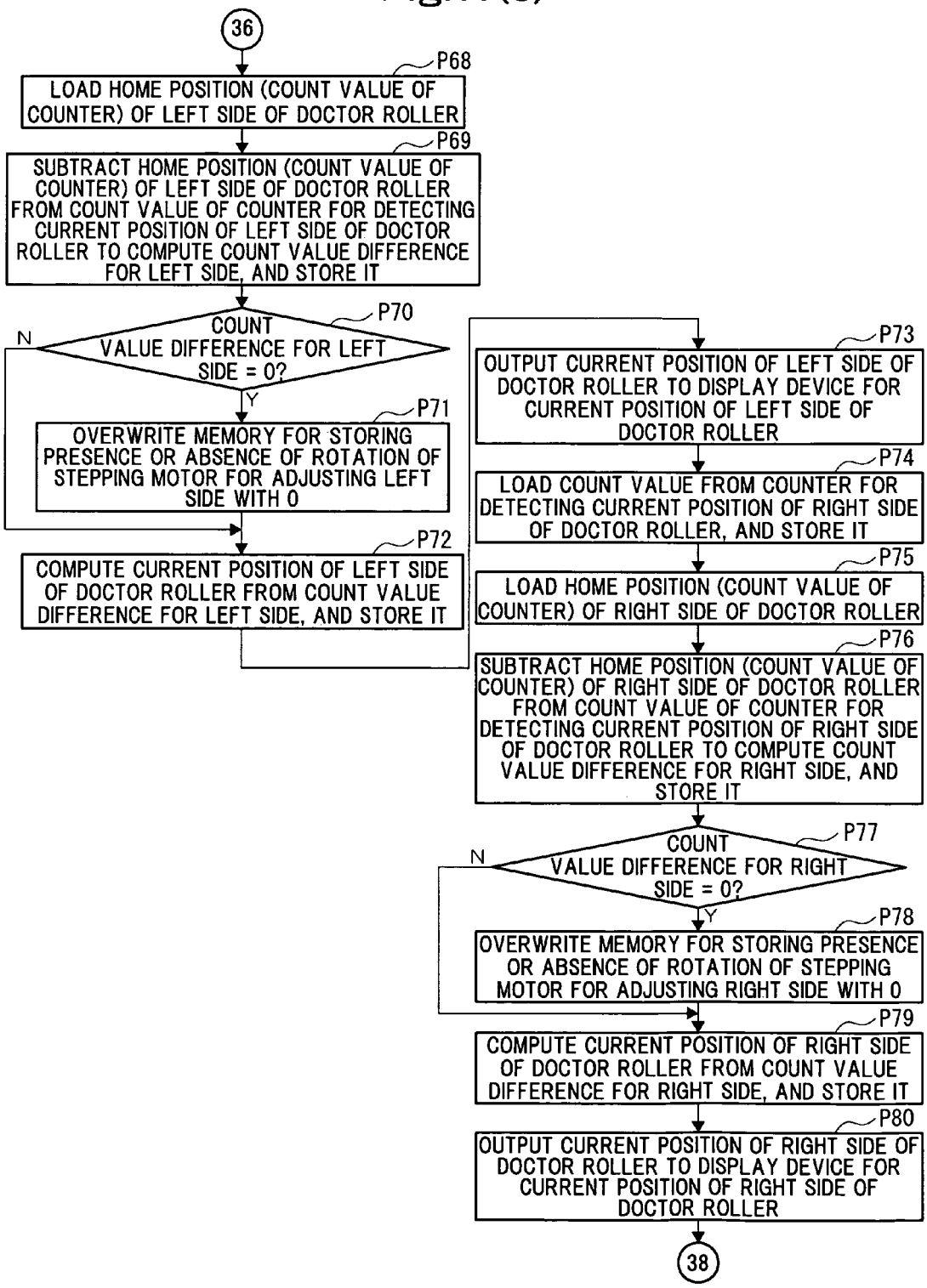
Figure 18A:
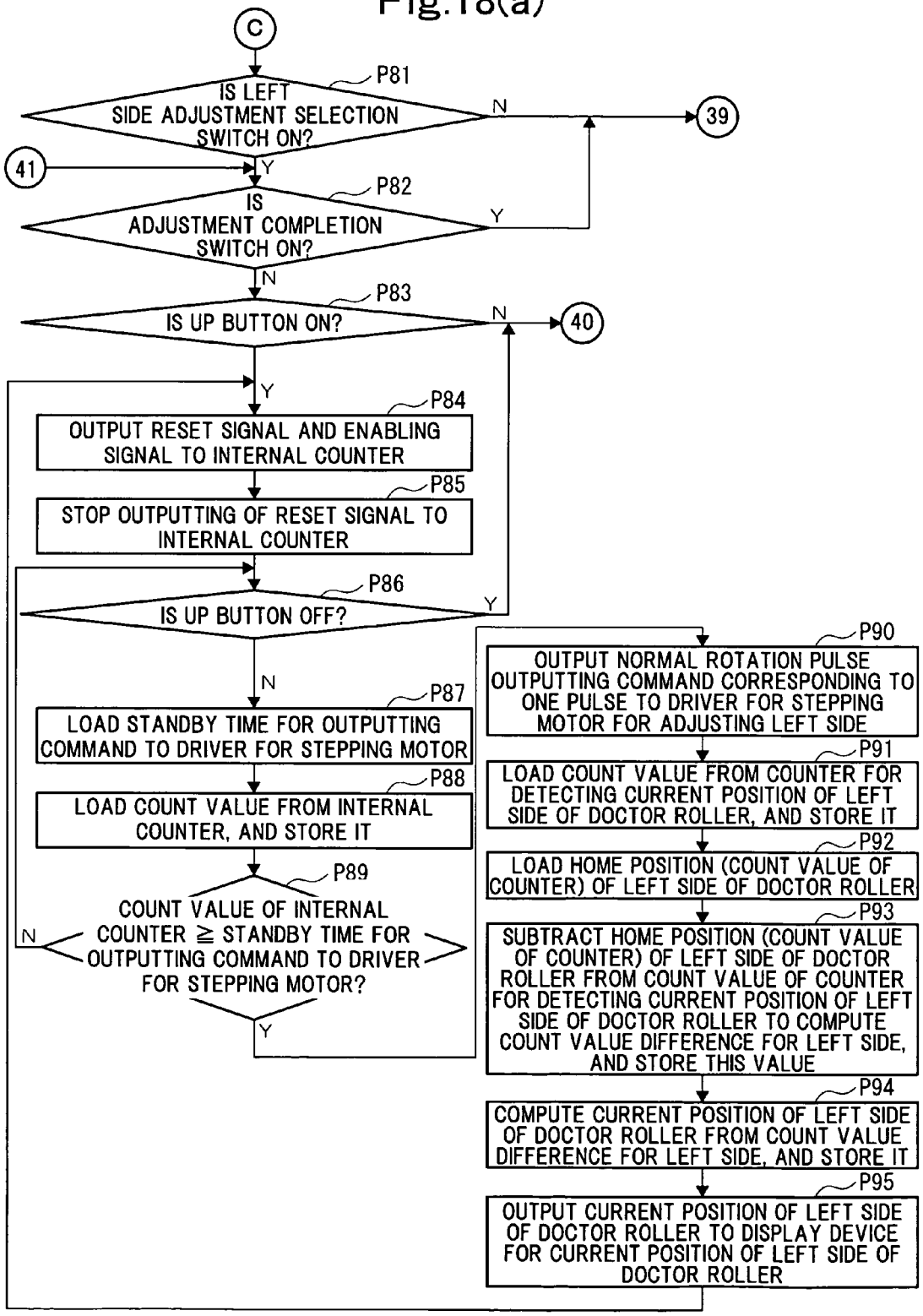
FIG. 18(*a*) is a motion flow chart of the control device.
Figure 18B:
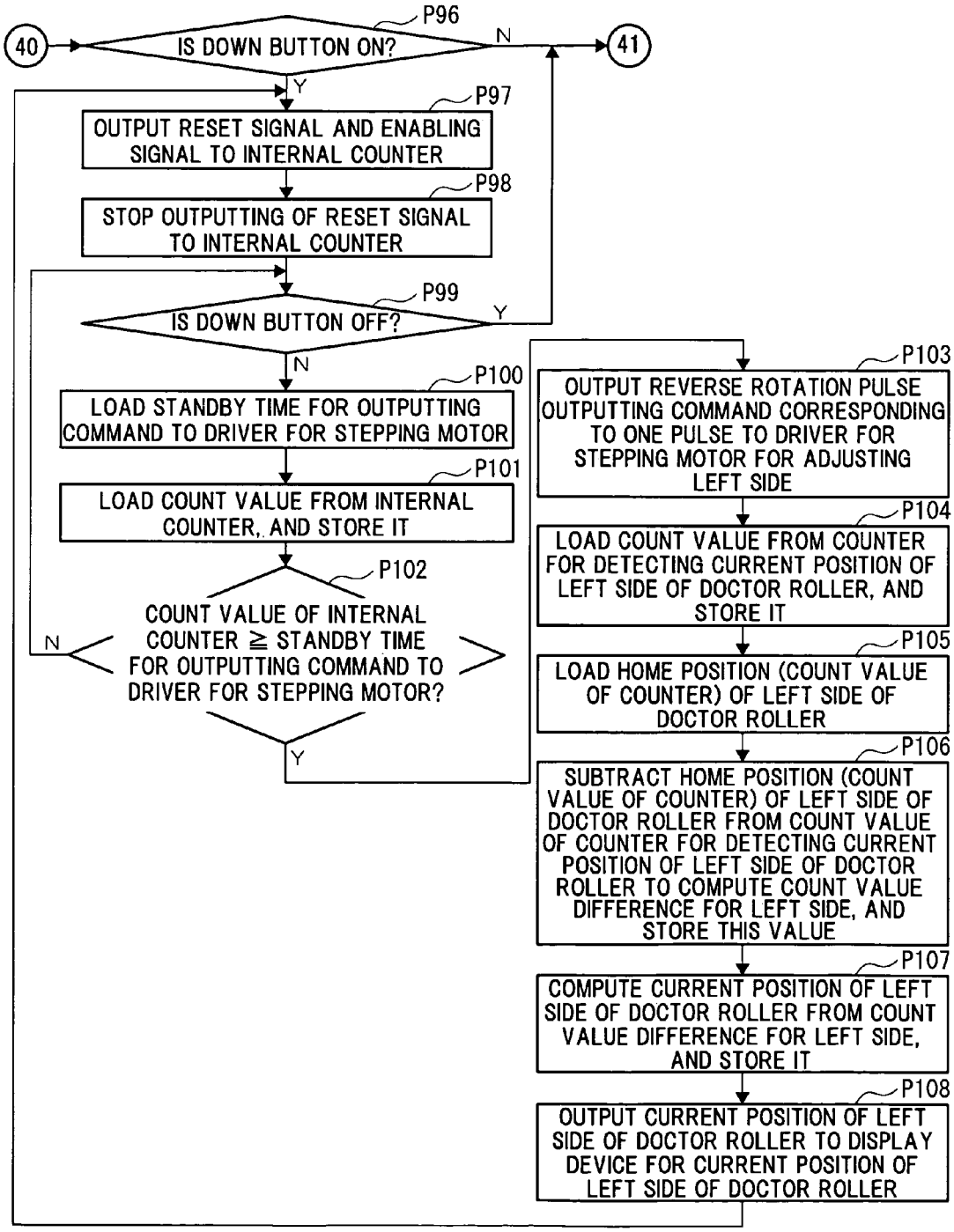
Figure 18C:
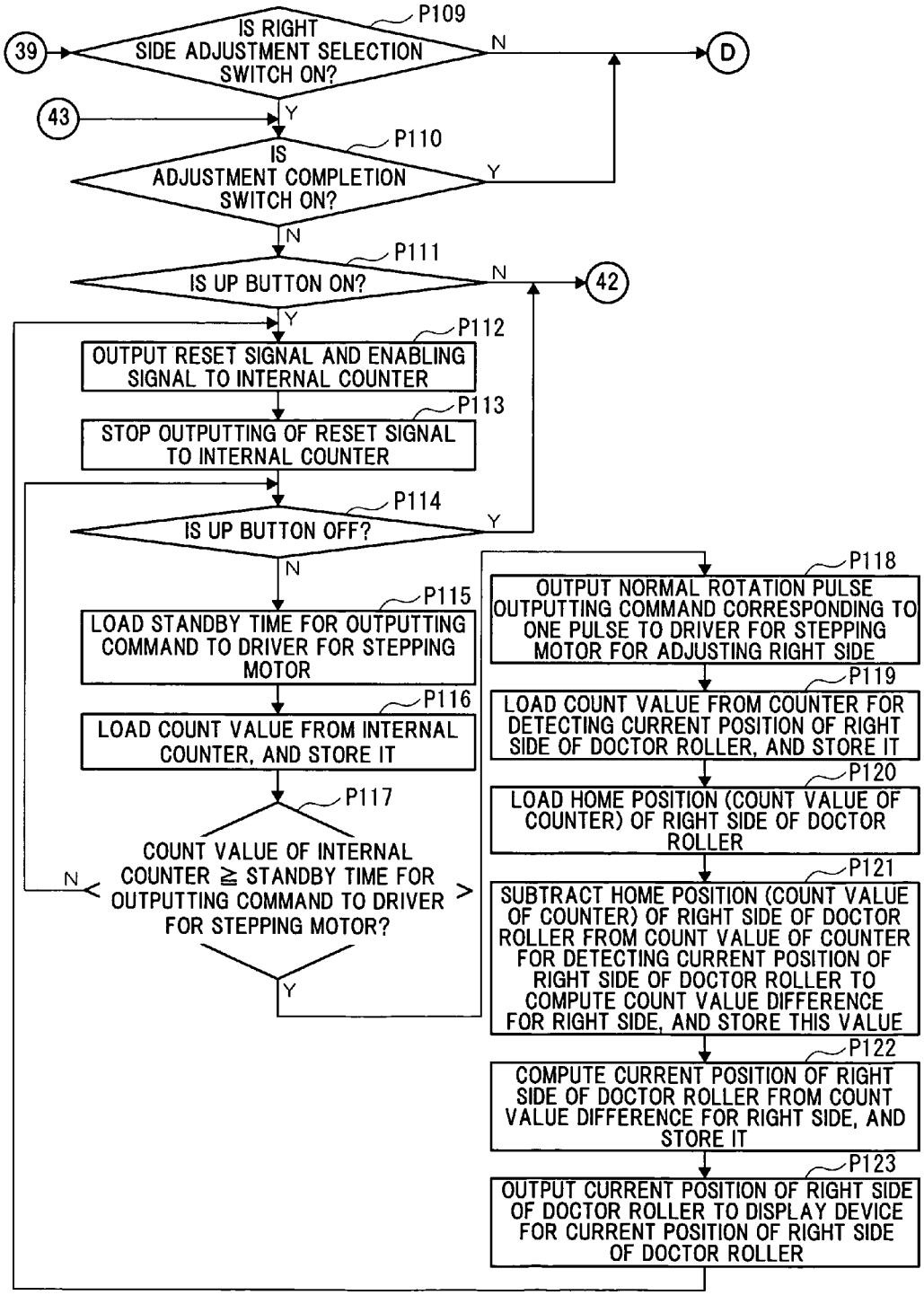
Figure 18D:
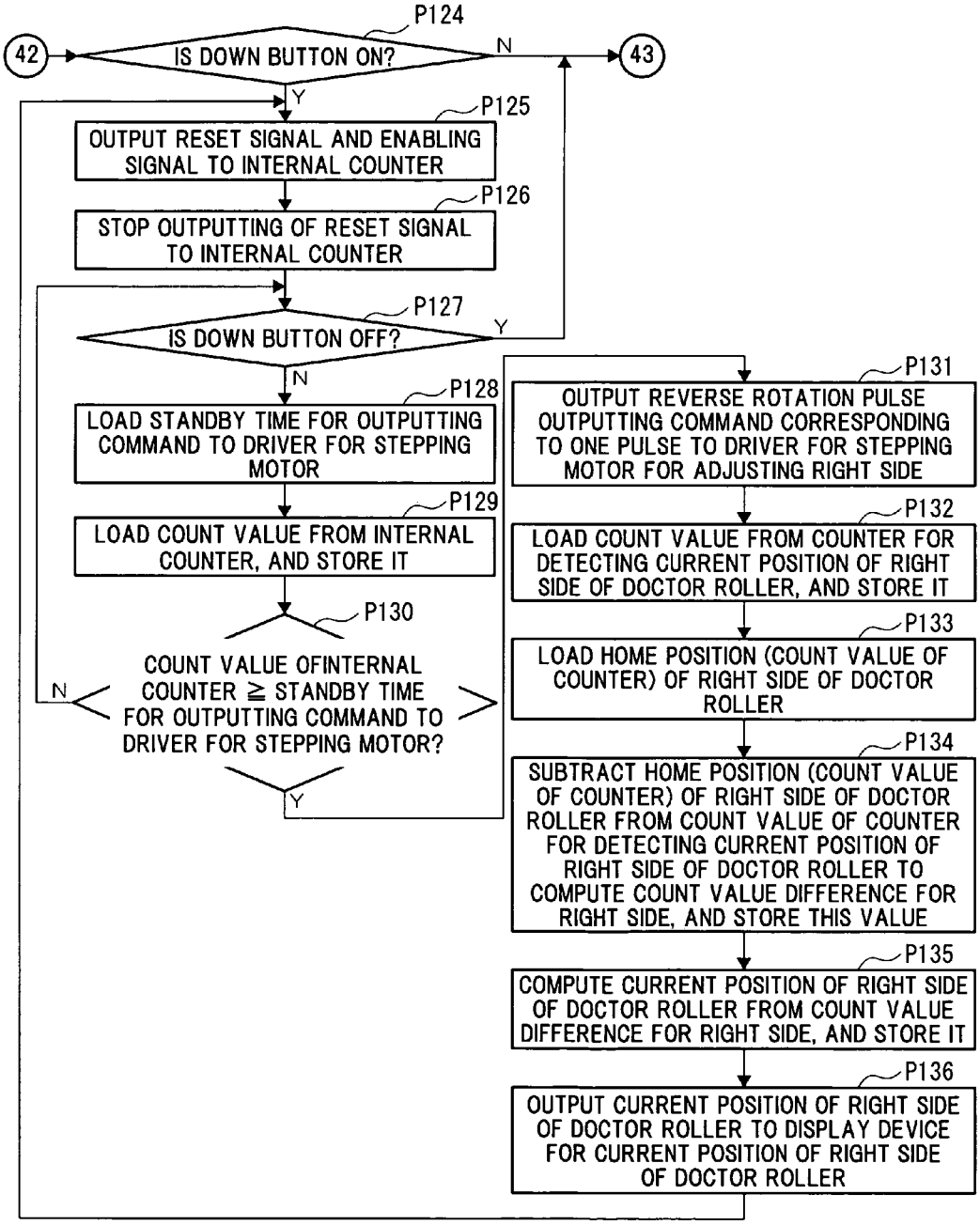
Figure 19A:
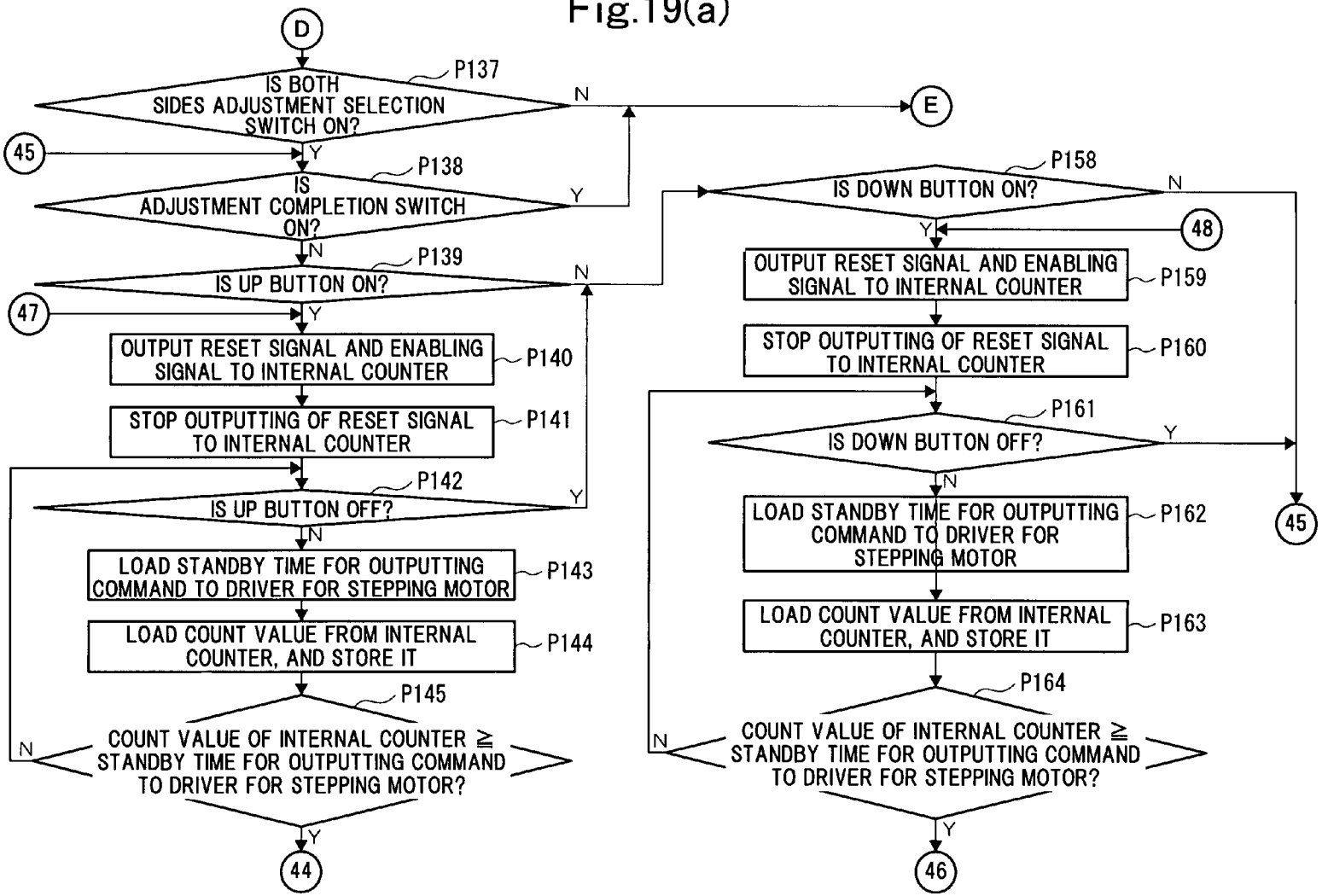
FIG. 19(*a*) is a motion flow chart of the control device.
Figure 19B:
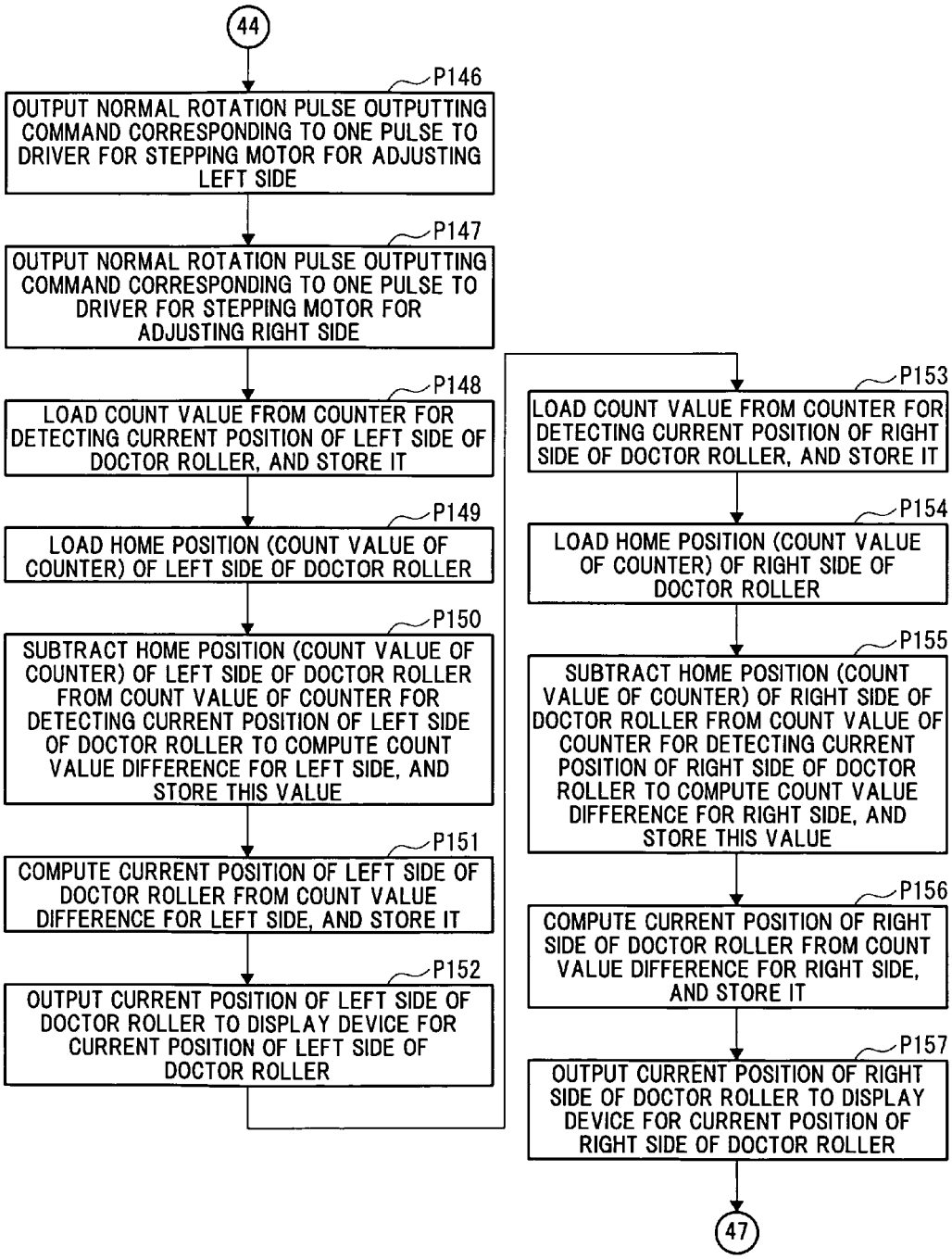
Figure 19C:
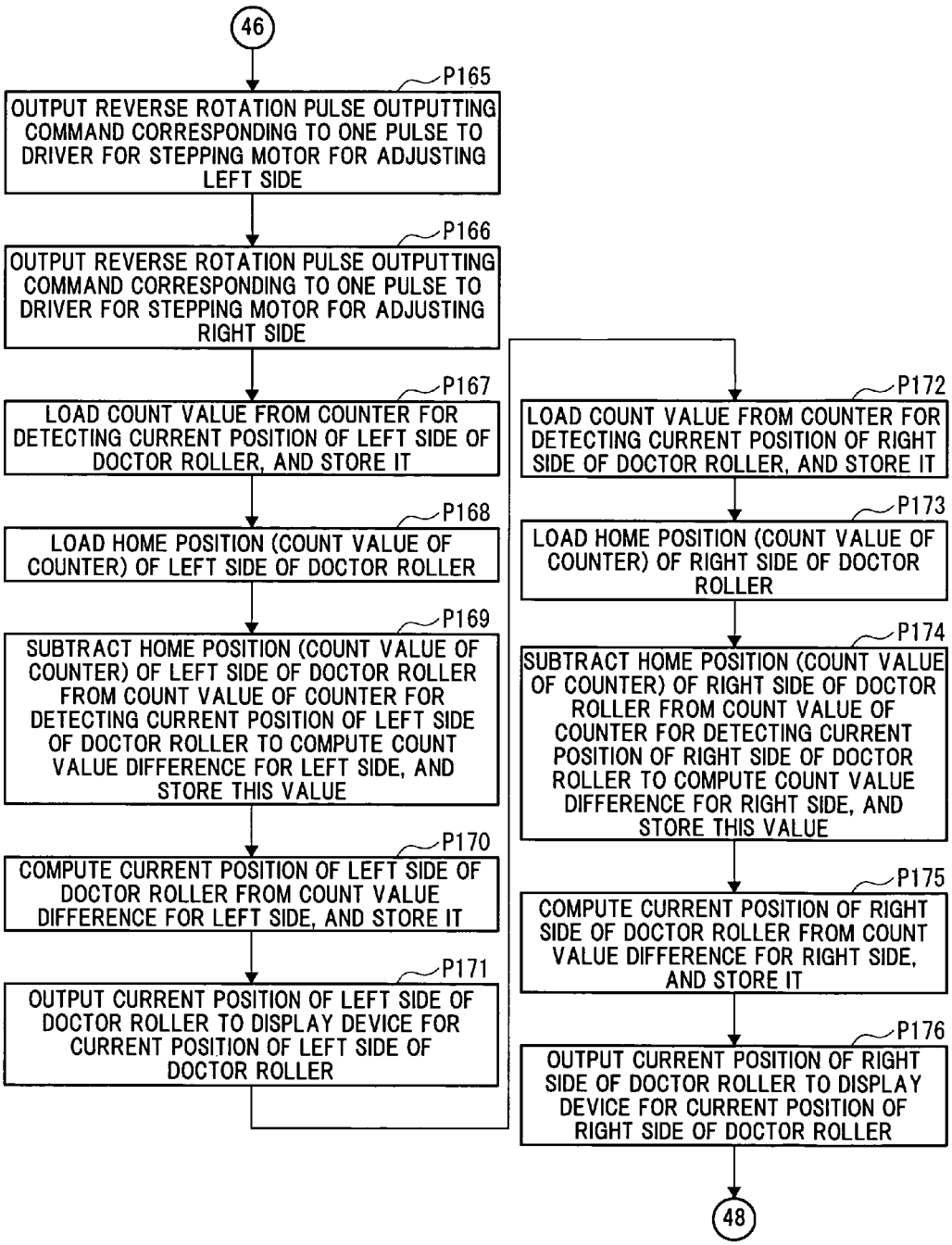
Figure 20:
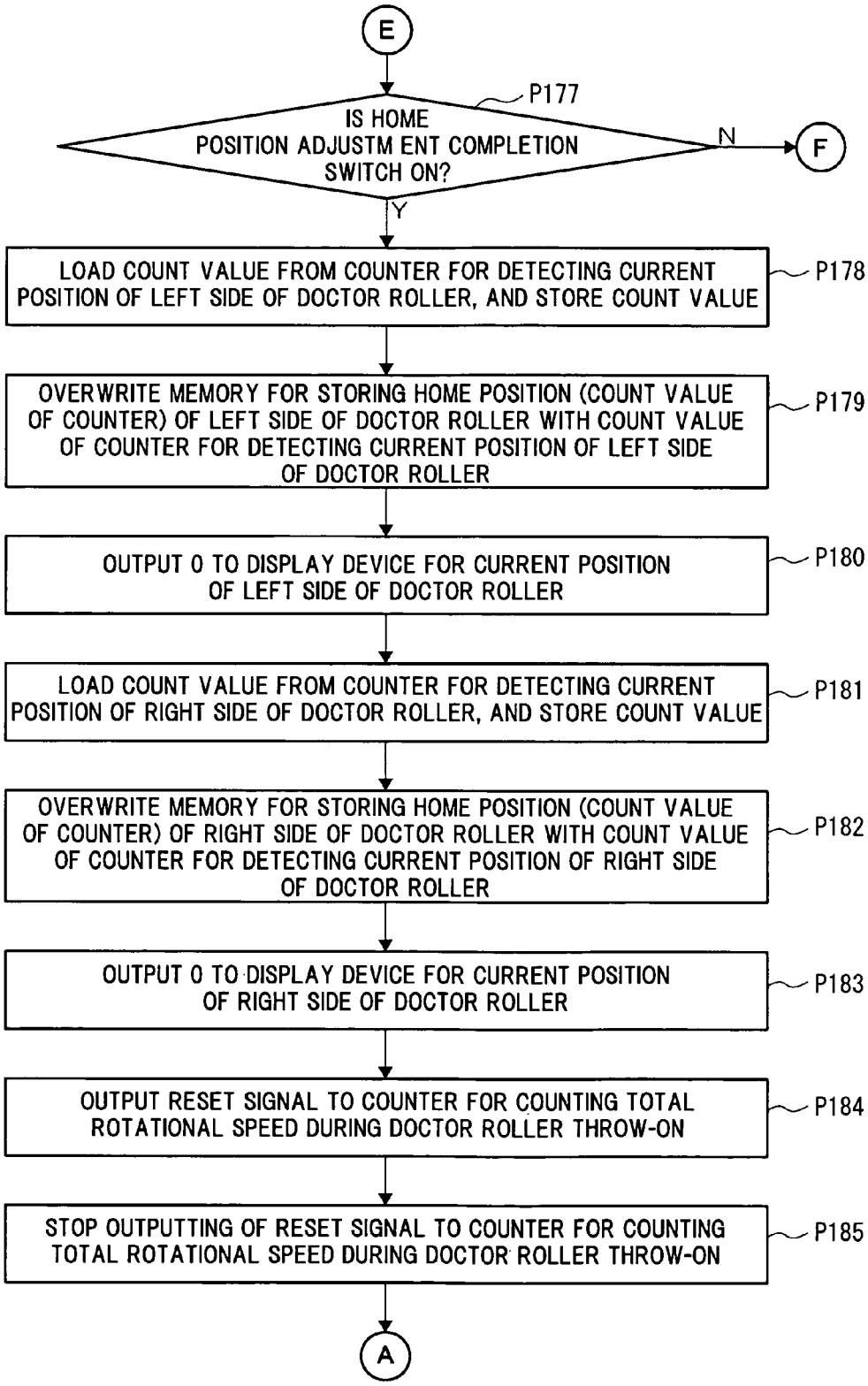
FIG. 20 is a motion flow chart of the control device.
Figure 21A:
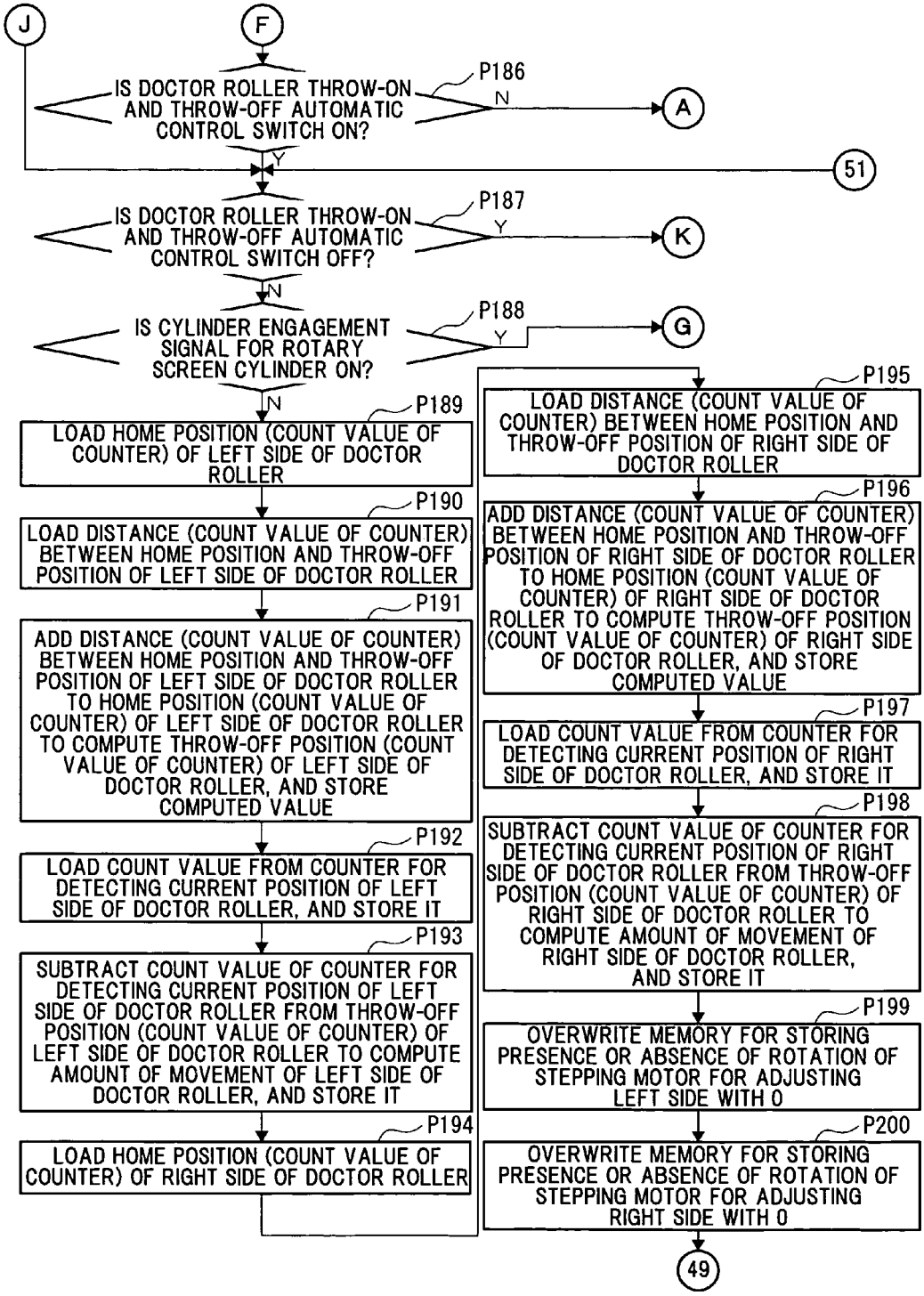
FIG. 21(*a*) is a motion flow chart of the control device.
Figure 21B:
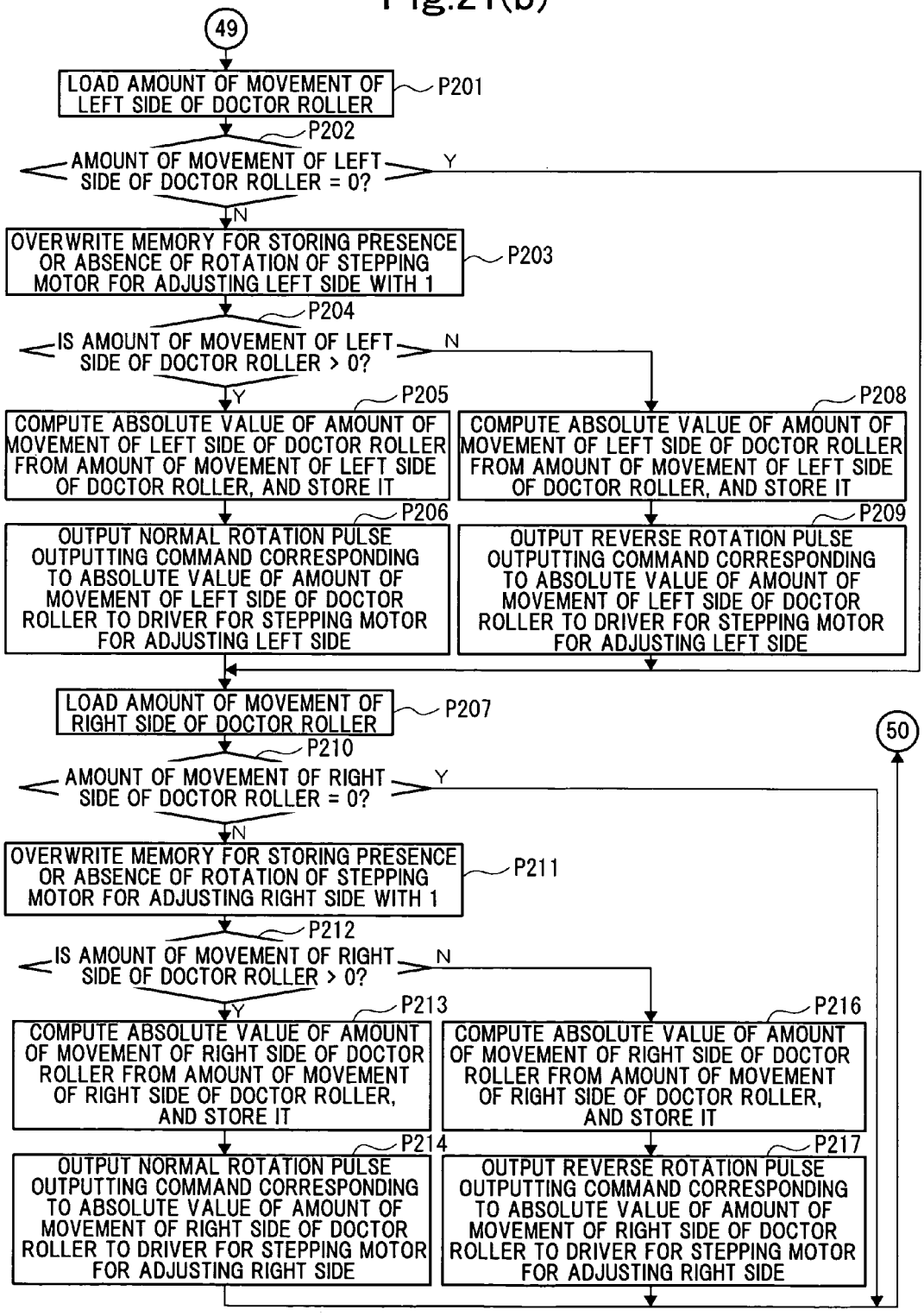
Figure 21C:
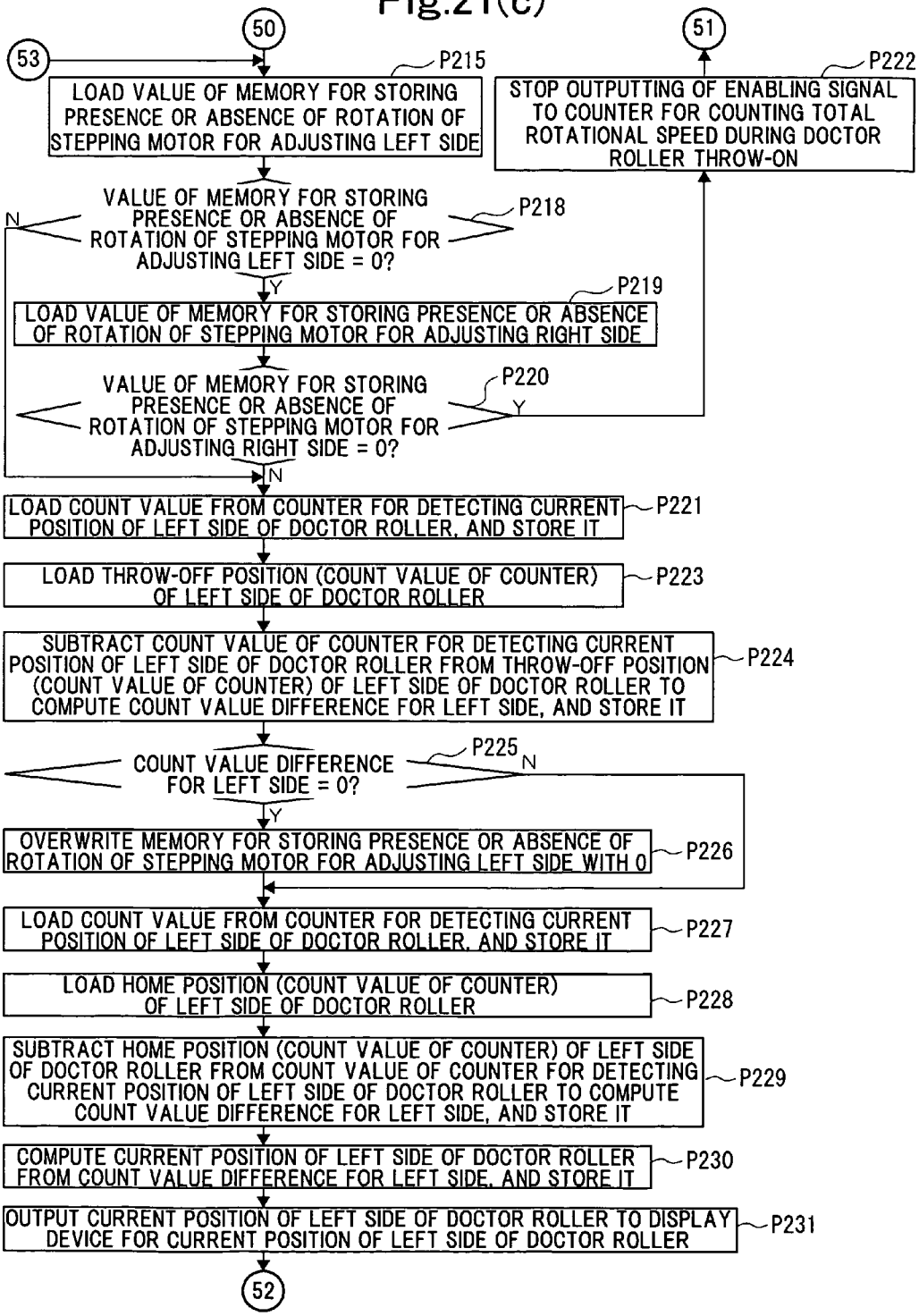
Figure 21D:
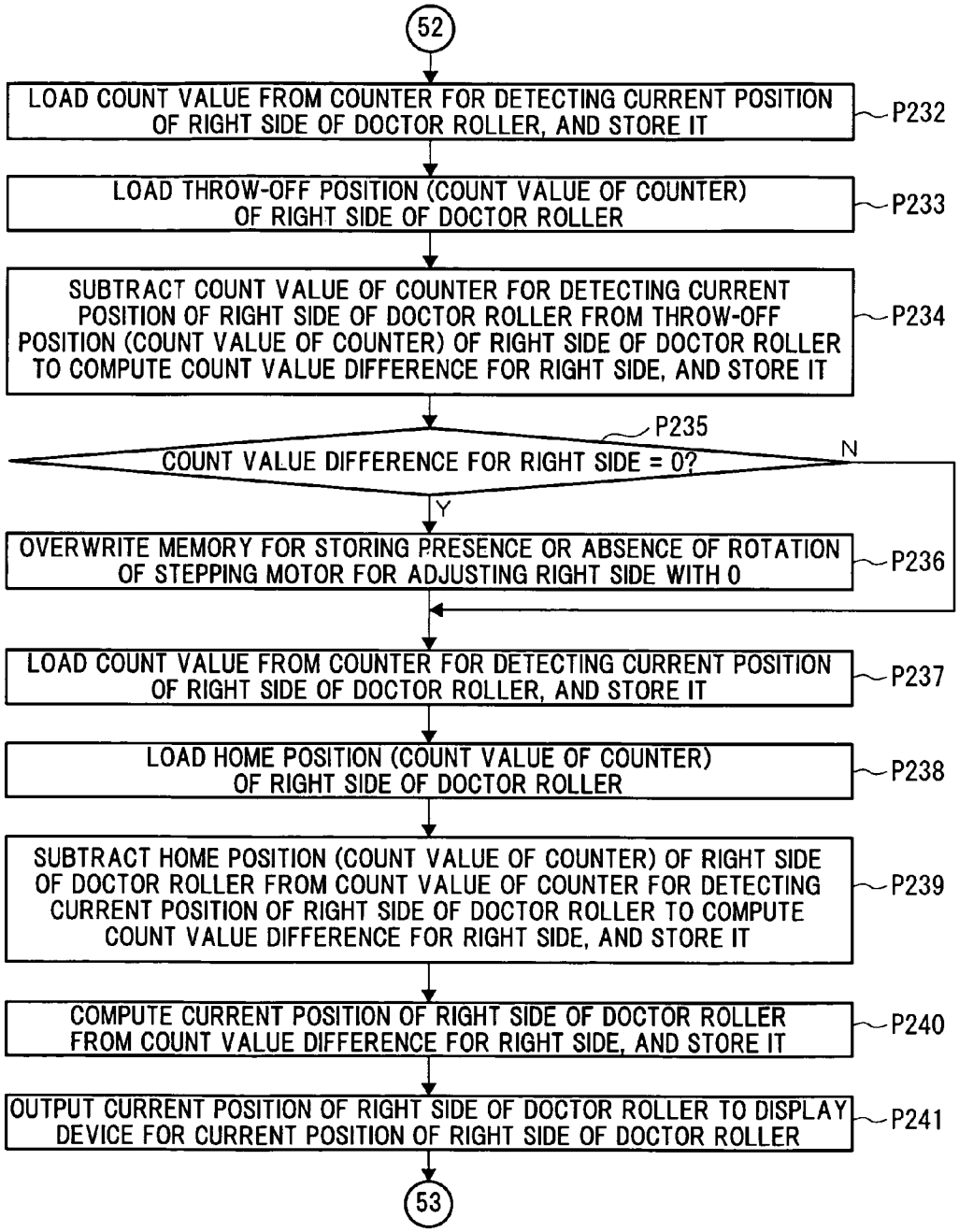
Figure 22A:
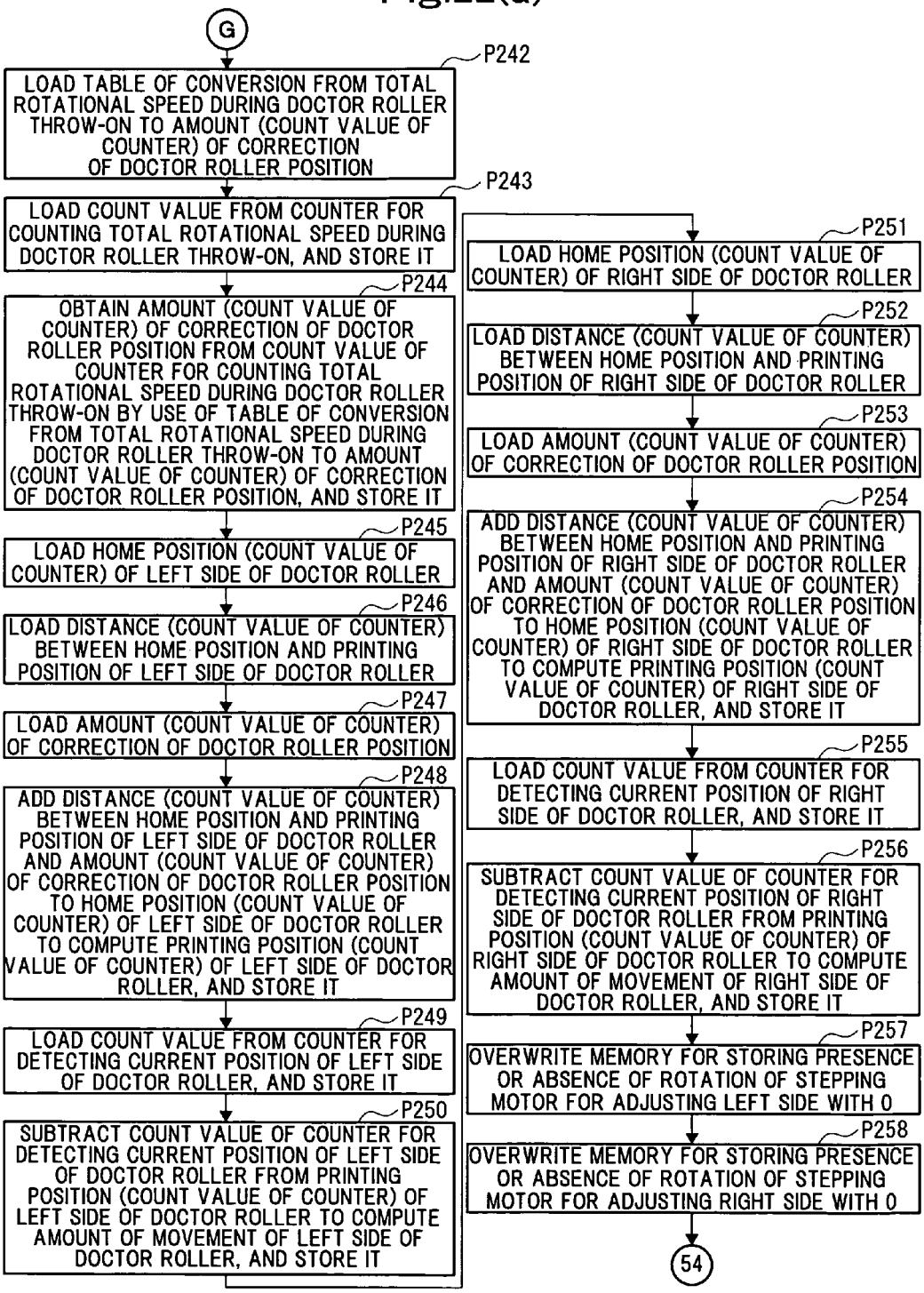
FIG. 22(*a*) is a motion flow chart of the control device.
Figure 22B:
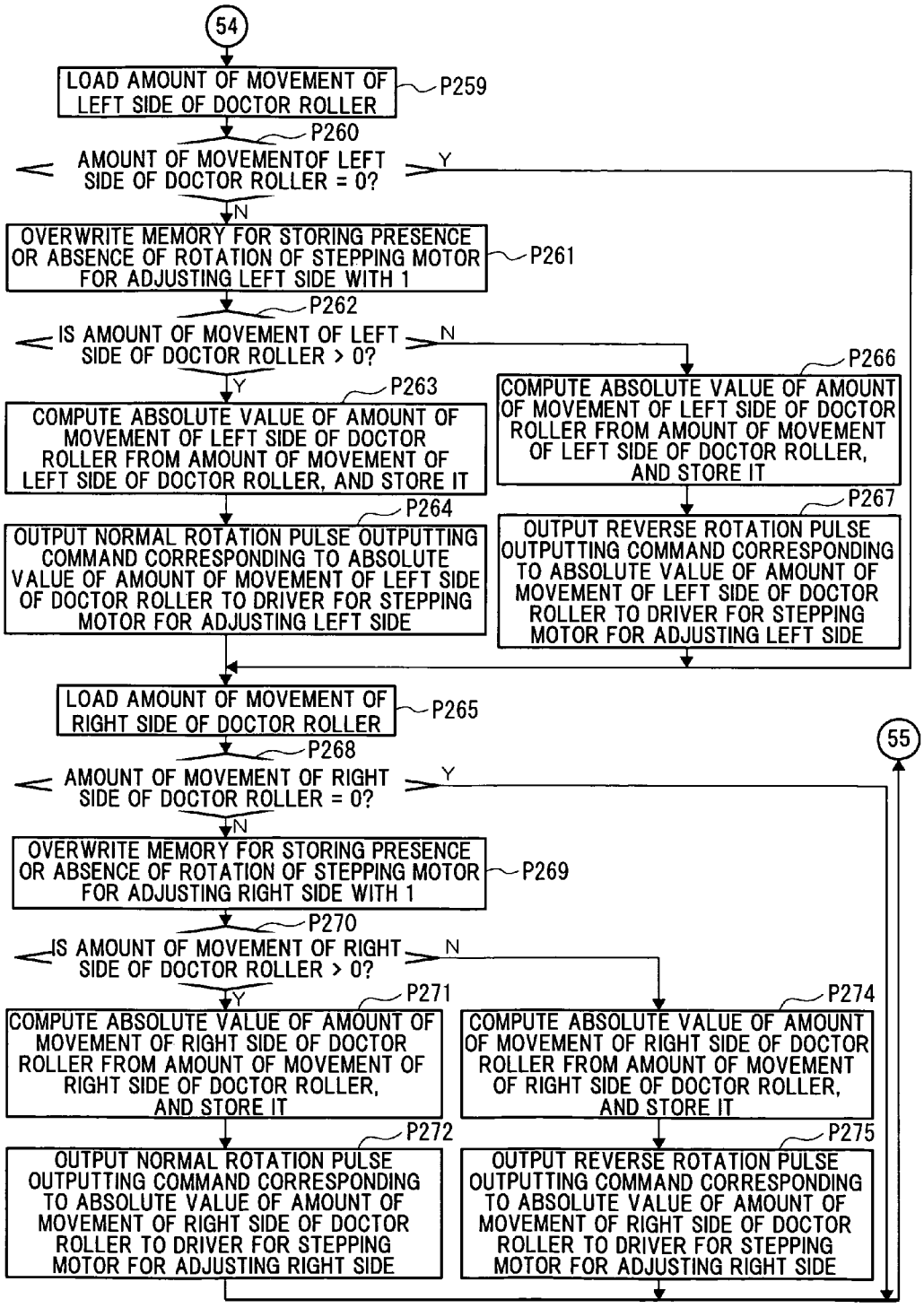
Figure 22C:
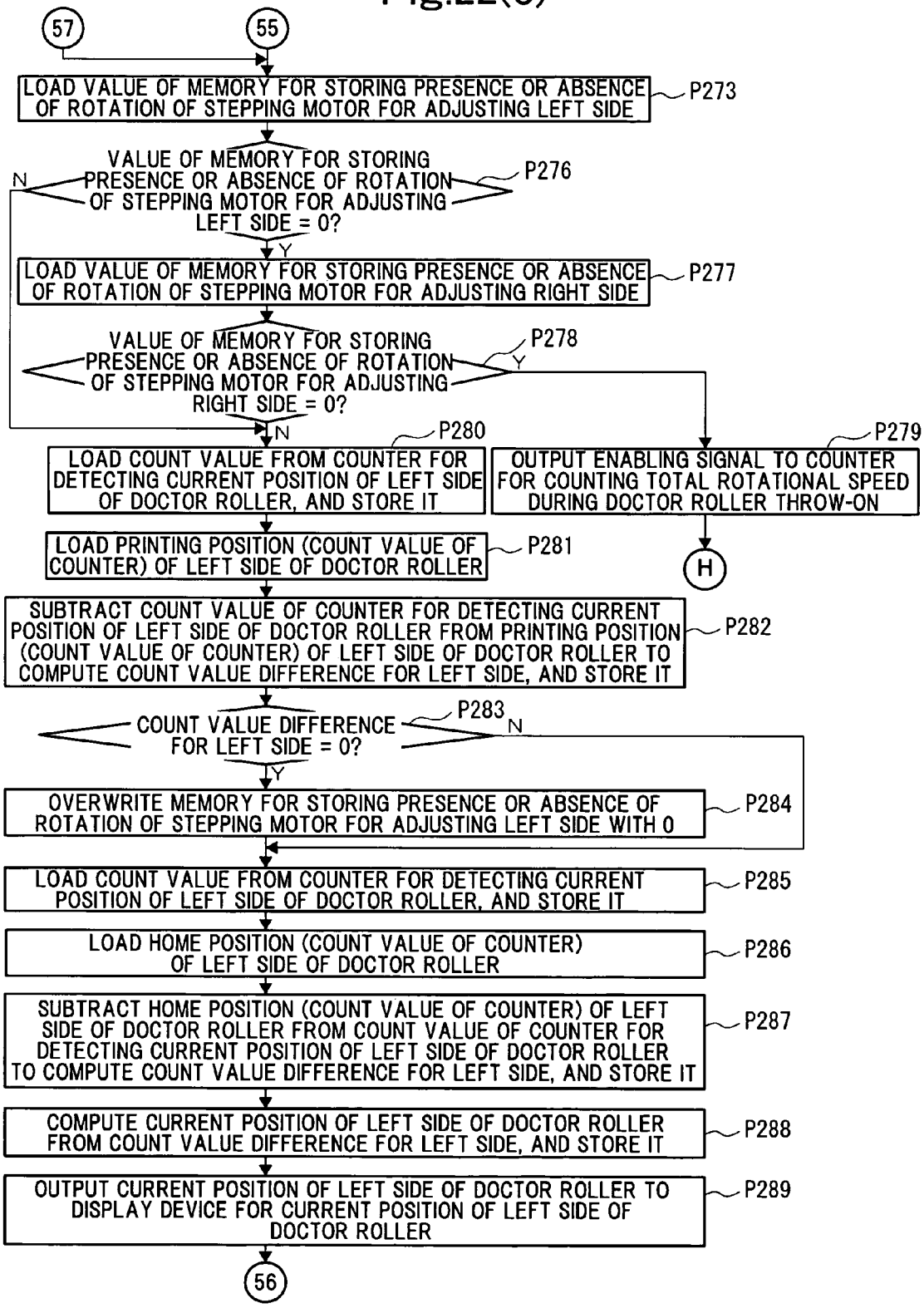
Figure 22D:
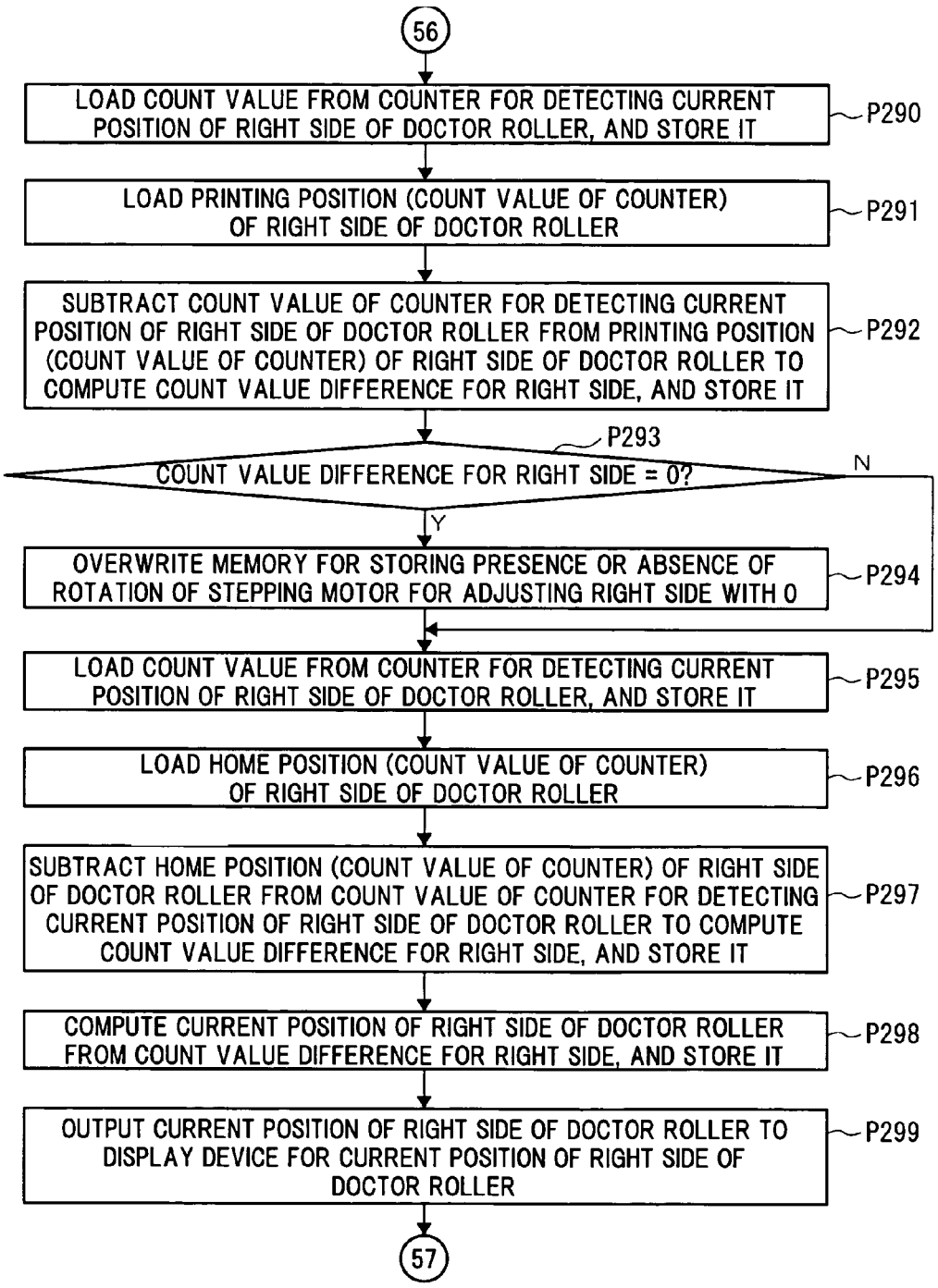
Figure 23A:
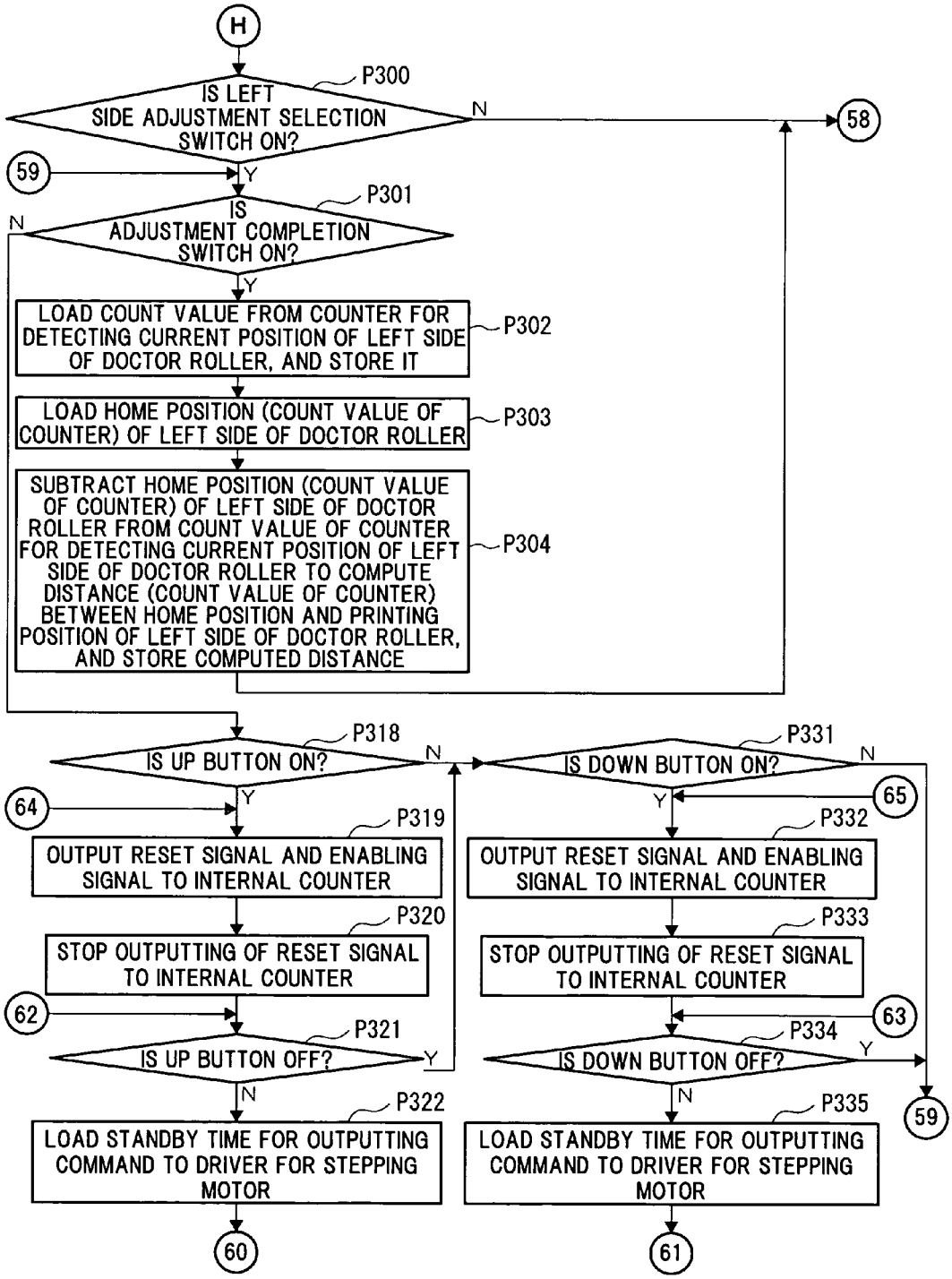
FIG. 23(*a*) is a motion flow chart of the control device.
Figure 23B:
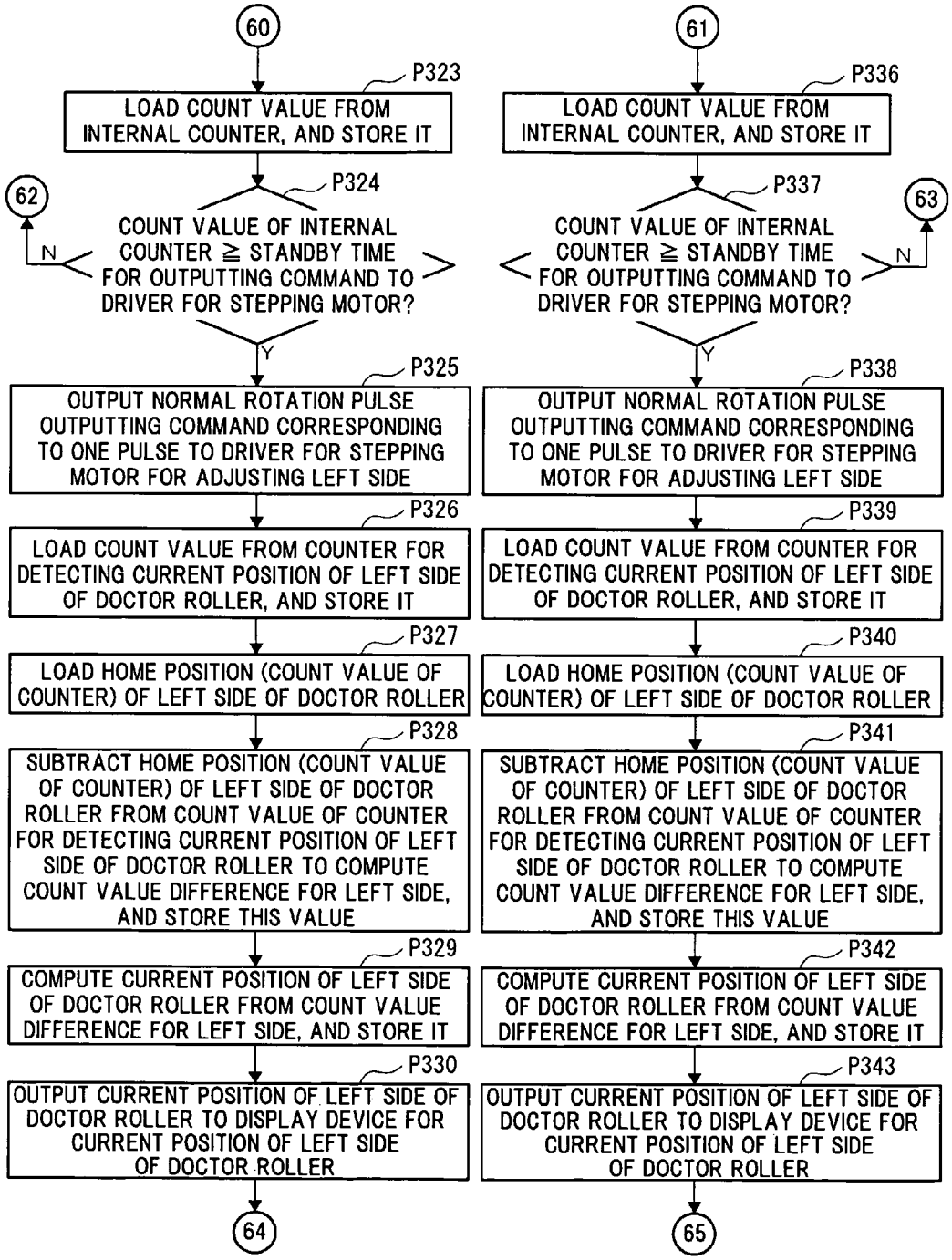
Figure 23C:
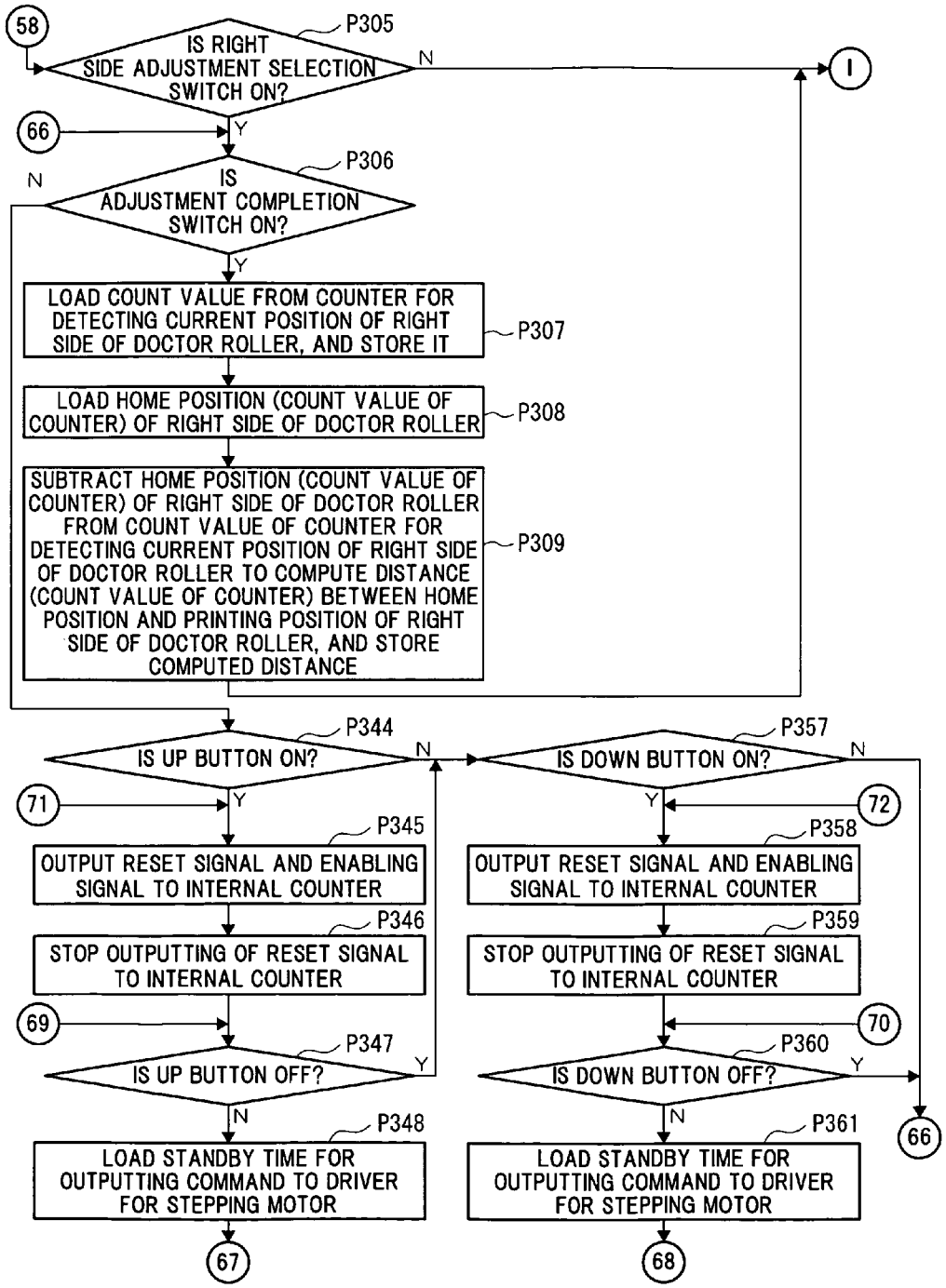
Figure 23D:
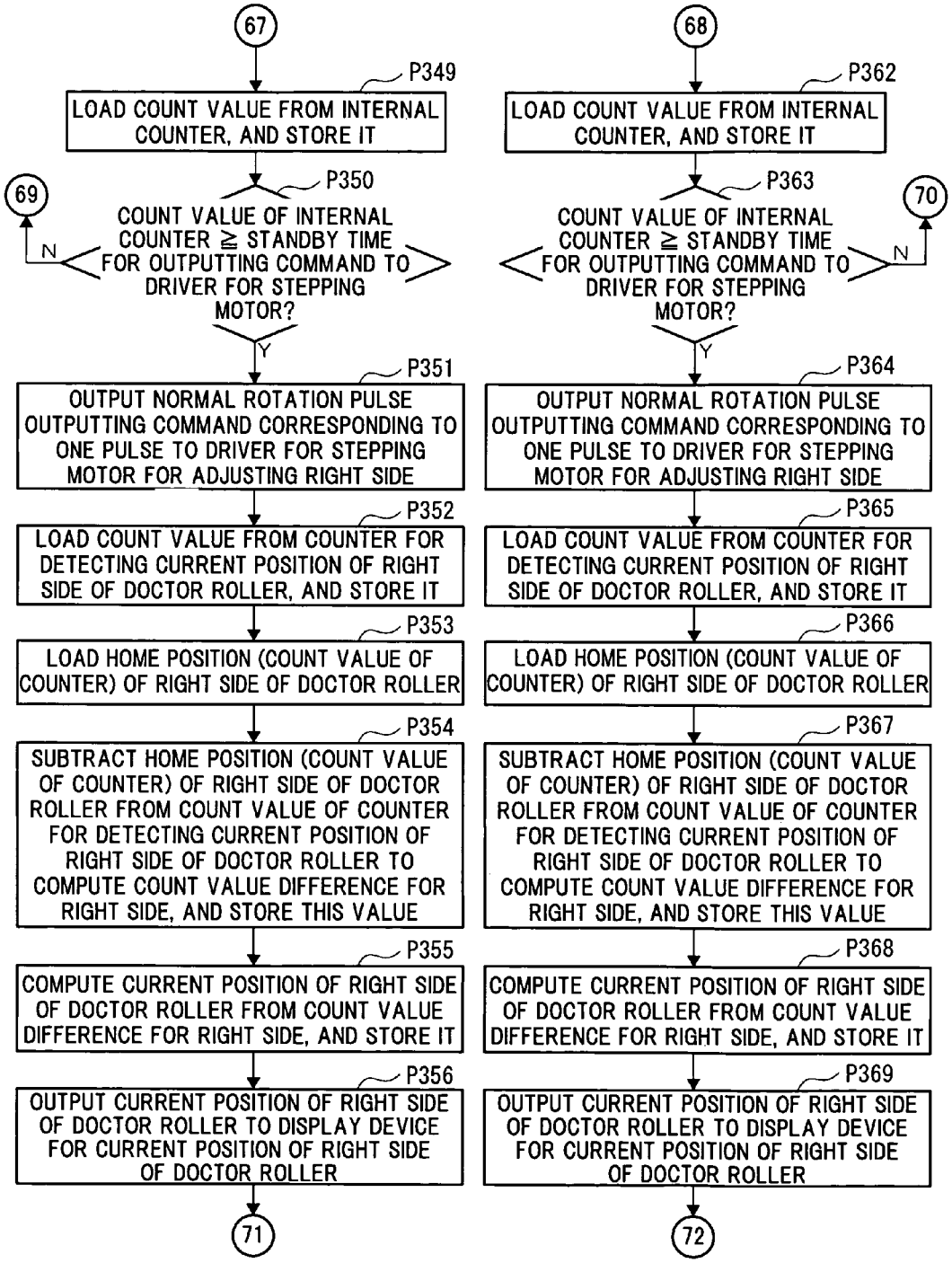
Figure 24A:
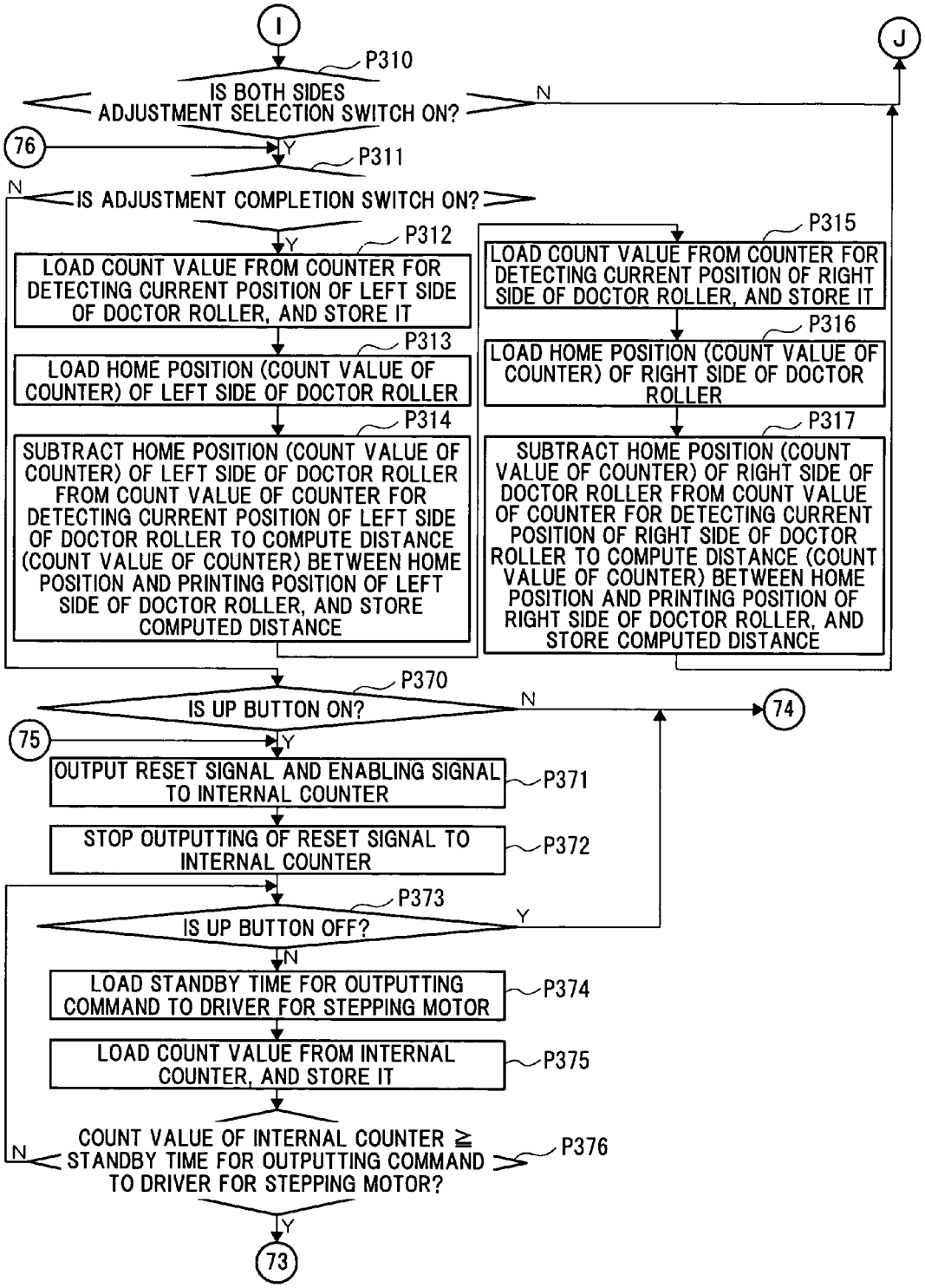
FIG. 24(*a*) is a motion flow chart of the control device.
Figure 24B:
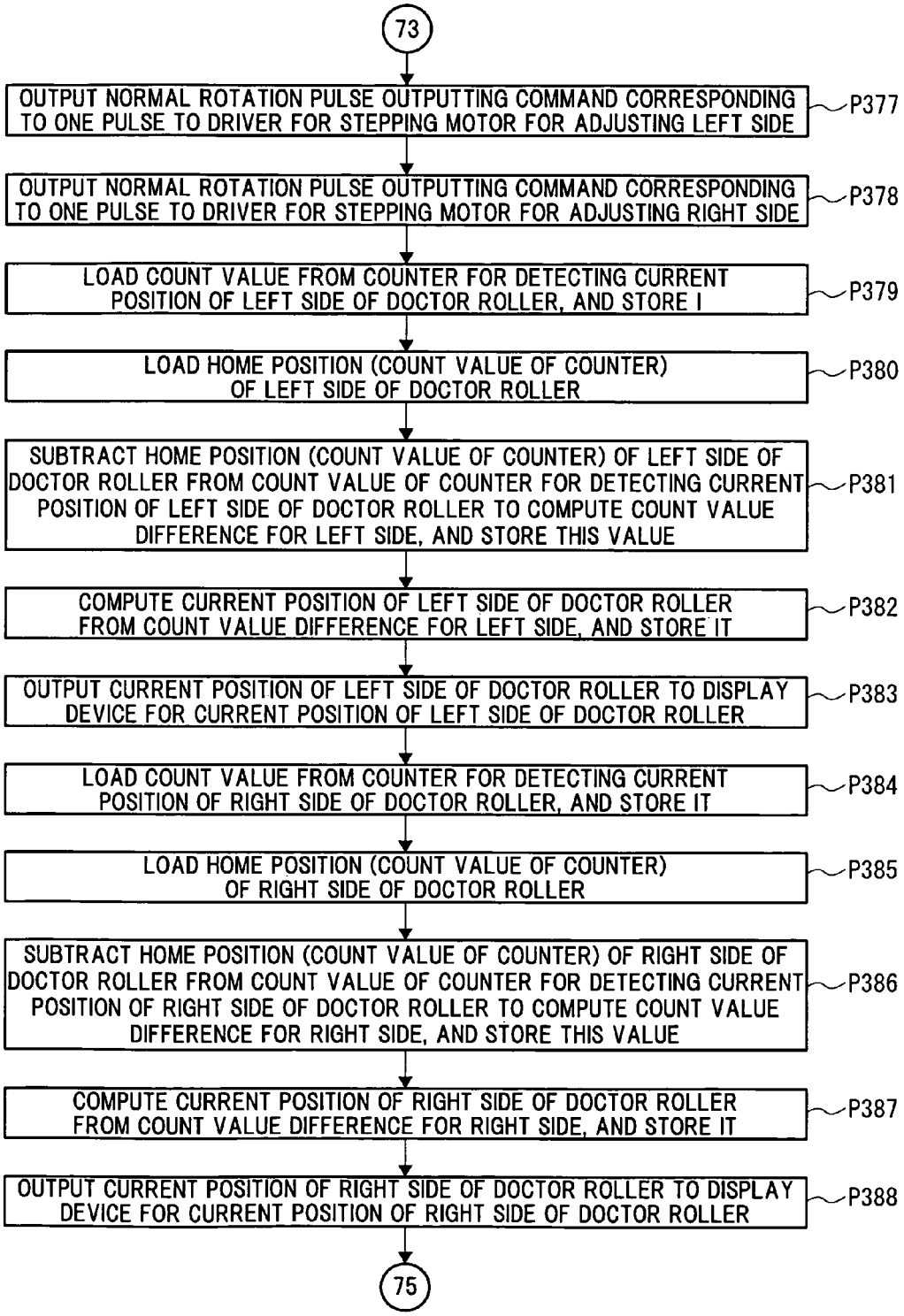
Figure 24C:
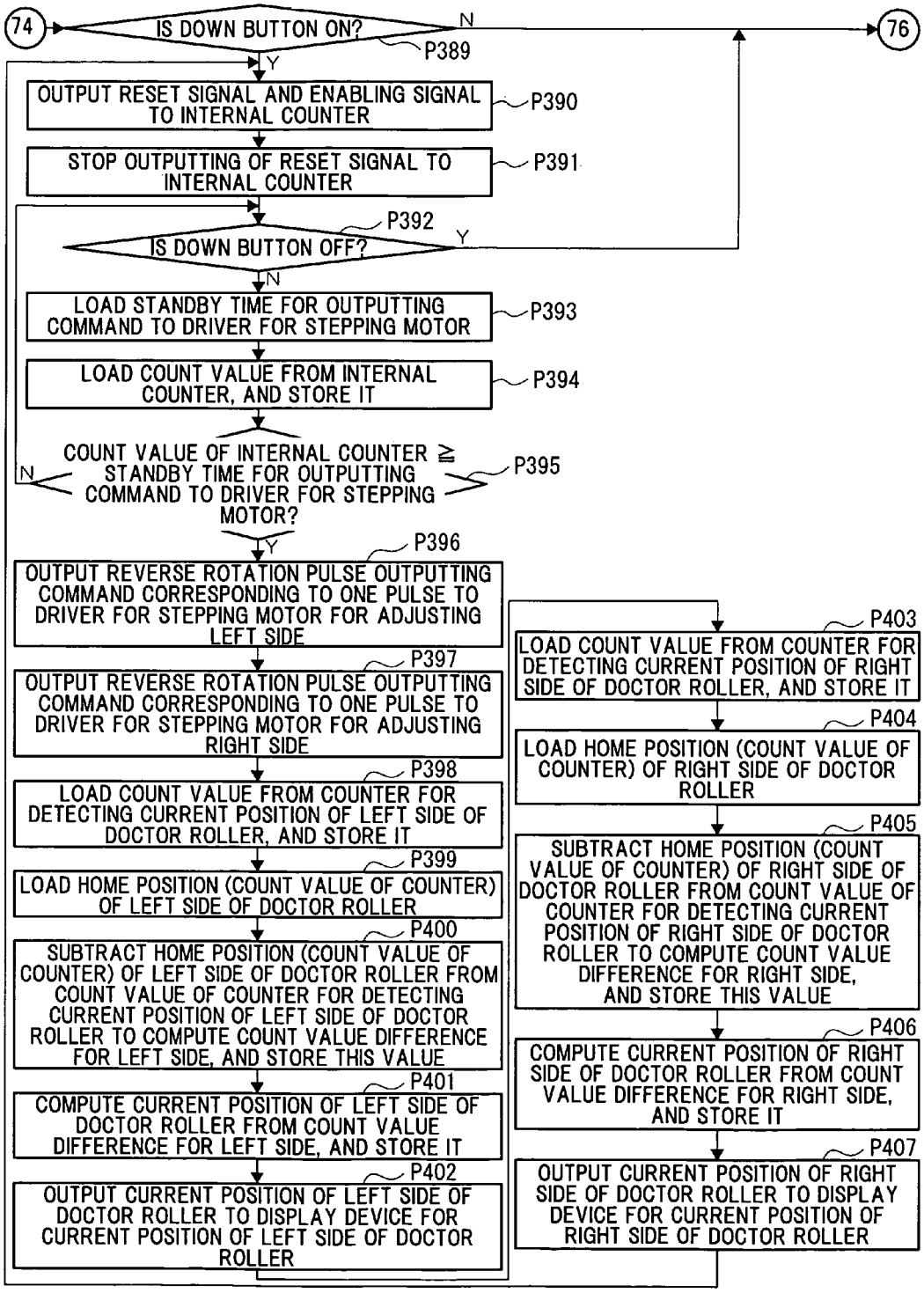
Figure 25A:
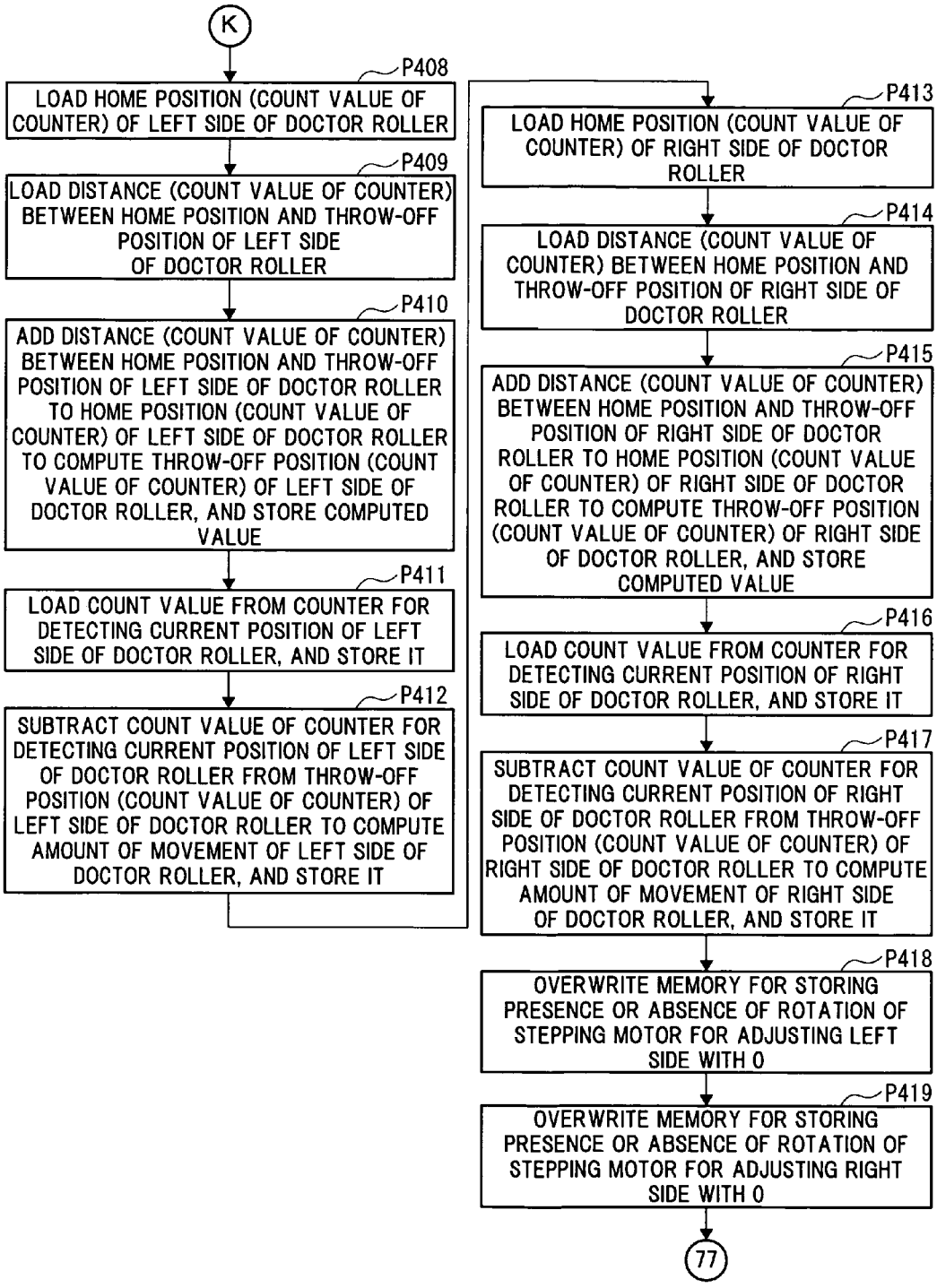
FIG. 25(*a*) is a motion flow chart of the control device.
Figure 25B:
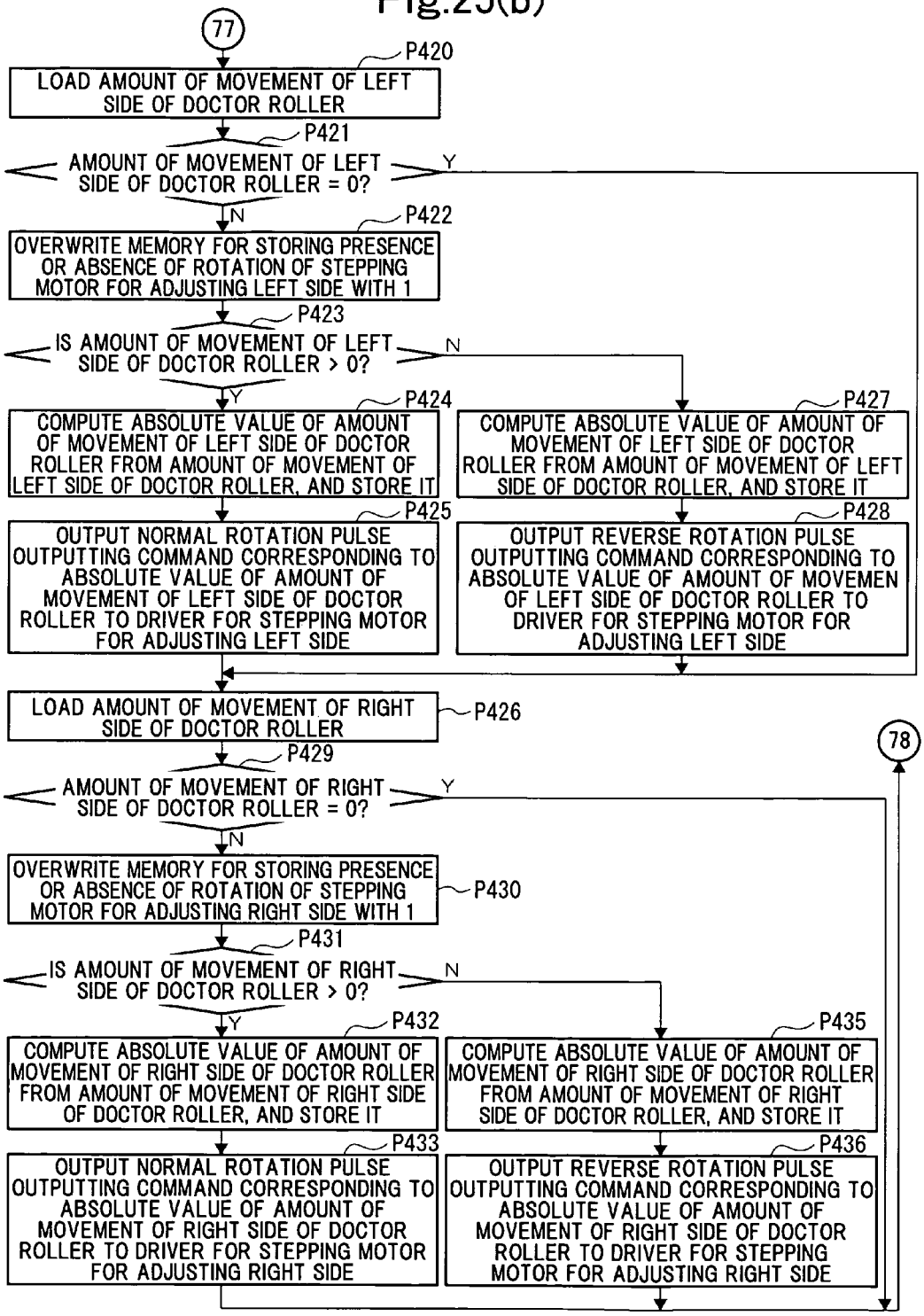
Figure 25C:
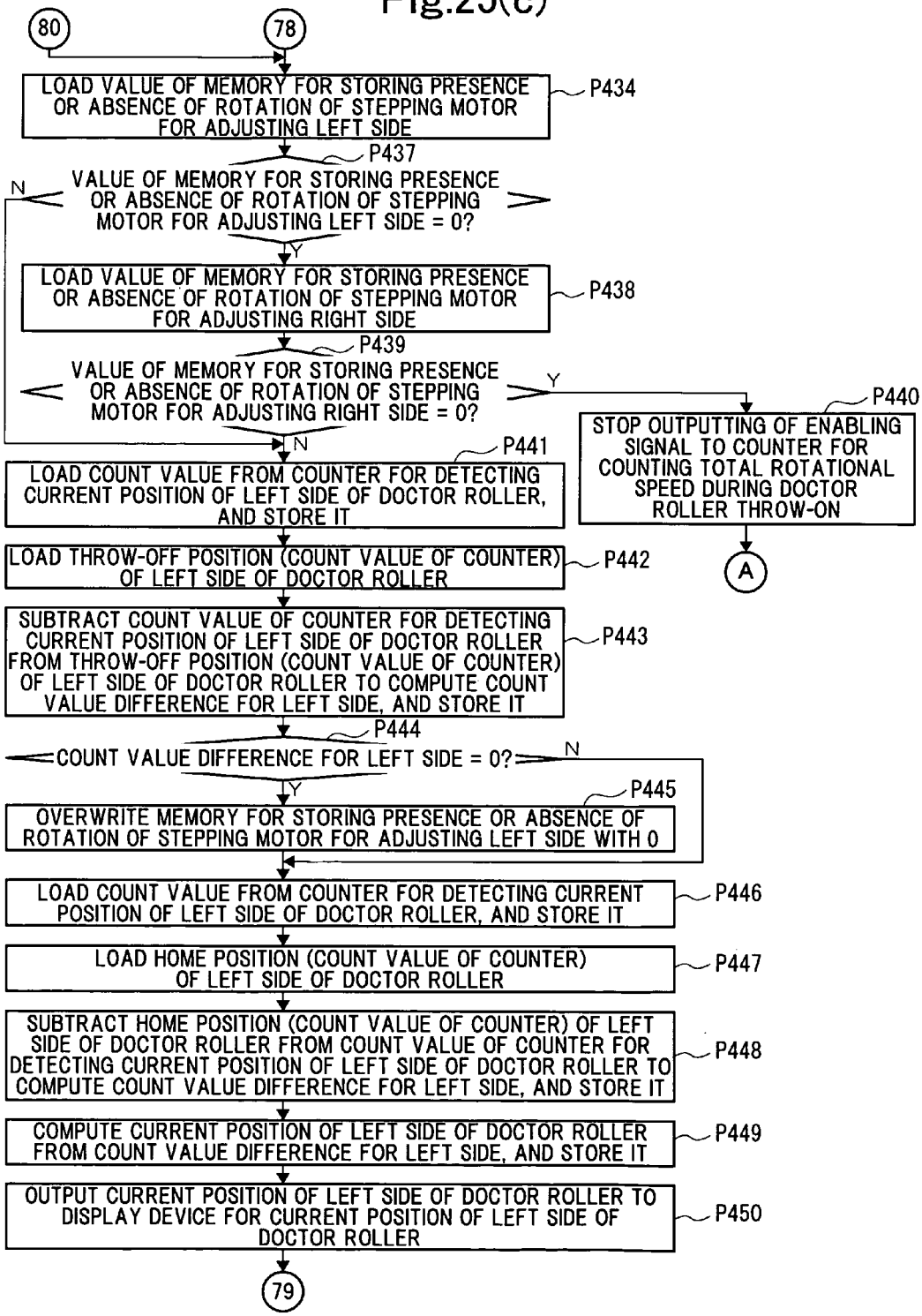
Figure 25D:
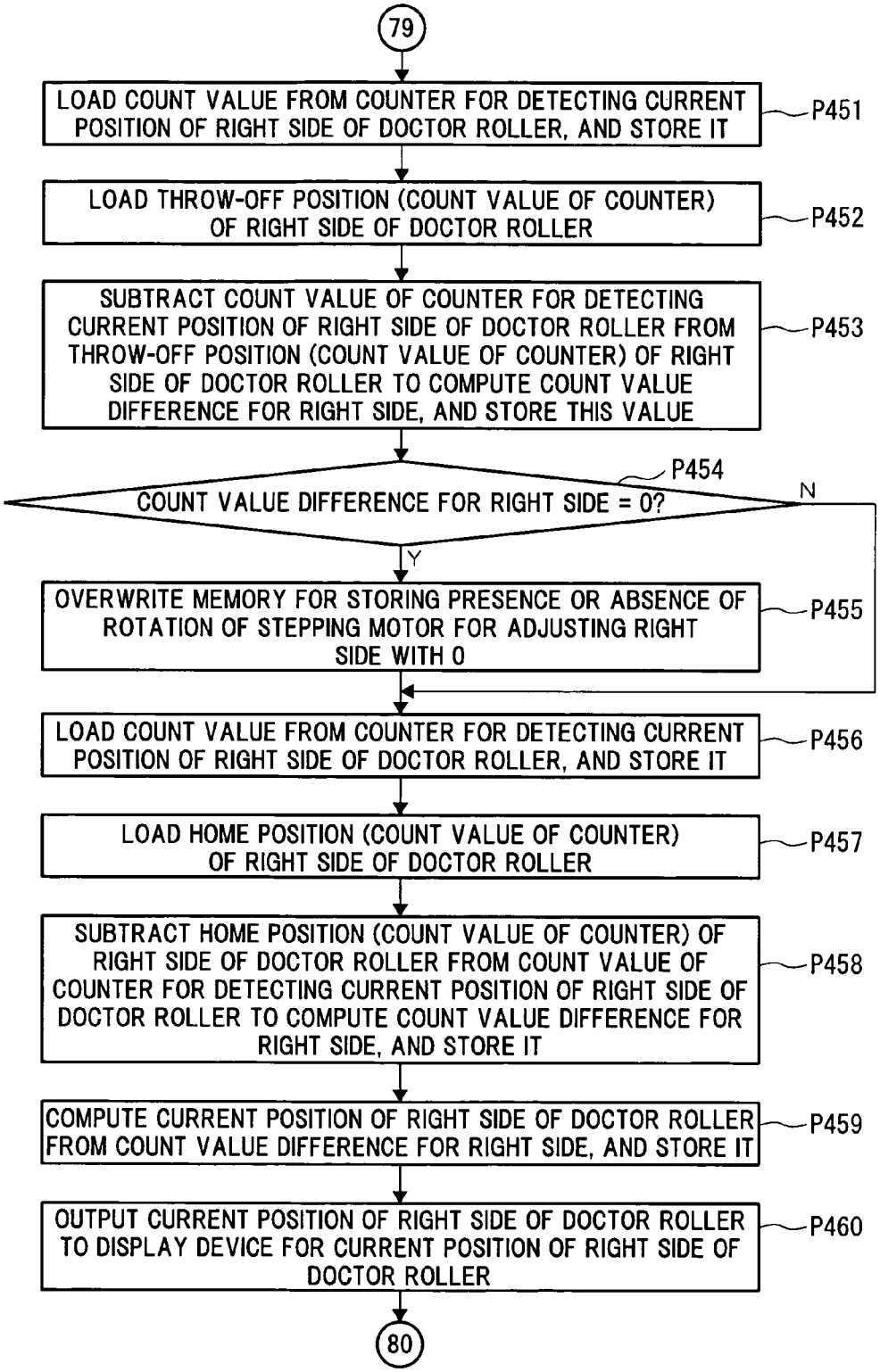

FIG. 13 is a schematic configurational sectional view of a rotary screen printing unit in a rotary screen printing press showing Embodiment 2 of the present invention. FIG. 14(*a*) is an explanation drawing of an ink supply system. FIG. 14(*b*) is an explanation drawing of an ink supply pipe. FIGS. 15(*a*)

and 15(*b*) are control block diagrams of a control device. FIGS. 16(*a*) and 16(*b*) are motion flow charts of the control device. FIGS. 17(*a*) to 17(*c*) are motion flow charts of the control device. FIGS. 18(*a*) to 18(*d*) are motion flow charts of the control device. FIGS. 19(*a*) to 19(*c*) are motion flow charts of the control device. FIG. 20 is a motion flow chart of the control device. FIGS. 21(*a*) to 21(*d*) are motion flow charts of the control device. FIGS. 22(*a*) to 22(*d*) are motion flow charts of the control device. FIGS. 23(*a*) to 23(*d*) are motion flow charts of the control device. FIGS. 24(*a*) to 24(*c*) are motion flow charts of the control device. FIGS. 25(*a*) to 25(*d*) are motion flow charts of the control device.

The present embodiment is an embodiment in which a stepping motor 81A for adjusting a left side and a stepping motor 81B for adjusting a right side (see FIG. 15(*b*)) are used instead of the motor 36A for adjusting the left side of the support shaft 27 and the motor 36B for adjusting the right side of the support shaft 27 in Embodiment 1, and a doctor roller 90 is used instead of the squeegee 38 as the ink transfer member, as shown in FIG. 13.

The doctor roller 90 has a double structure composed of an inner roller 90*a* formed from a metal and an outer roller 90*b* formed from rubber. The doctor roller 90 is rotatably supported on a support shaft 27 via bearings 92 at left and right end members 91*a* and 91*b* fitted into the inner roller 90*a*.

As shown in FIGS. 14(*a*) and 14(*b*), an ink supply pipe 92 is horizontally installed within the screen printing forme 11*c*, and ink stored within an external tank 93 is supplied to the ink supply tank 92 by a pump 94. The ink is dropped from the ink supply pipe 92 toward the inner peripheral surface of the screen printing forme 11*c* at multiple points in the cylinder axis direction of the rotary screen cylinder 11.

Thus, the outer peripheral surface of the doctor roller 90 makes a rolling contact with the inner peripheral surface of the screen printing forme 11*c*, whereby the ink supplied to the interior of the screen printing forme 11*c* through the ink supply pipe 92 is transferred to the printing surface of a web W via the holes of the screen printing forme 11*c*.

Other features are the same as those in Embodiment 1, so that duplicate explanations are omitted by reference to FIGS. 1 to 4(*a*), 4(*b*).

The control device 40 of the present embodiment comprises a CPU 41, an RAM 42, an ROM 43, and input/output devices 44 and 47 to 52 connected by a BUS line 53, as shown in FIGS. 15(*a*) and 15(*b*). To the BUS line 53, the following memories are connected: A memory M1 for storing the count value of a counter for detecting the current position of the left side of the doctor roller, a memory M2 for storing the home position (count value of the counter) of the left side of the doctor roller, a memory M3 for storing the difference in the count value for the left side, and a memory M4 for storing the current position of the left side of the doctor roller.

To the BUS line 53, the following memories are further connected: A memory M5 for storing the count value of a counter for detecting the current position of the right side of the doctor roller, a memory M6 for storing the home position (count value of the counter) of the right side of the doctor roller, a memory M7 for storing the difference in the count value for the right side, and a memory M8 for storing the current position of the right side of the doctor roller.

To the BUS line 53, the following memories are further connected: A memory M14 for storing the distance (count value of the counter) between the home position and the throw-off position of the left side of the doctor roller, a memory M15 for storing the throw-off position (count value of the counter) of the left side of the doctor roller, a memory M16 for storing the distance (count value of the counter) between the home position and the throw-off position of the right side of the doctor roller, a memory M17 for storing the throw-off position (count value of the counter) of the right side of the doctor roller, a memory M18 for storing a table of conversion from the total rotational speed during doctor roller throw-on to the amount (count value of the counter) of correction of the doctor roller position, and a memory M19 for storing the count value of a counter for counting the total rotational speed during doctor roller throw-on.

To the BUS line 53, the following memories are further connected: A memory M20 for storing the amount (count value of the counter) of correction of the doctor roller position, a memory M21 for storing the distance (count value of the counter) between the home position and the printing position of the left side of the doctor roller, a memory M22 for storing the printing position (count value of the counter) of the left side of the doctor roller, a memory M23 for storing the distance (count value of the counter) between the home position and the printing position of the right side of the doctor roller, and a memory M24 for storing the printing position (count value of the counter) of the right side of the doctor roller.

To the BUS line 53, the following memories are further connected: A memory M25 for storing the presence or absence of rotation of a stepping motor for adjusting a left side, a memory M26 for storing the presence or absence of rotation of a stepping motor for adjusting a right side, a memory M27 for storing the amount of movement of the left side of the doctor roller, a memory M28 for storing the amount of movement of the right side of the doctor roller, a memory M29 for storing the absolute value of the amount of movement of the left side of the doctor roller, a memory M30 for storing the absolute value of the amount of movement of the right side of the doctor roller, a memory M31 for storing a standby time for an outputting command to a driver for the stepping motor, and a memory M32 for storing the count value of an internal counter.

To the input/output device 44, the following are connected: A home position return switch 54, a left side adjustment selection switch 55, a right side adjustment selection switch 56, a both sides adjustment selection switch 57, an adjustment completion switch 58, an up button 59, a down button 60, a home position adjustment completion switch 61, a doctor roller throw-on and throw-off automatic control switch 62, a display device 63 for the current position of the left side of the doctor roller, a display device 64 for the current position of the right side of the doctor roller, an input device 65 such as a keyboard, a display device 66 such as a CRT or a display, an output device 67 such as a printer or a floppy disk (registered trademark) drive, and a calibration switch 79.

To the input/output device 47, a sensor 77 for detecting one rotation of the rotary screen cylinder is connected via a counter 76 for counting the total rotational speed during doctor roller throw-on. To the input/output device 48, a cylinder engagement circuit 78 for the rotary screen cylinder is connected. The sensor 77 for detecting one rotation of the rotary screen cylinder is provided in a rotating part of the rotary screen printing press so as to produce one pulse each time the rotary screen cylinder makes one rotation. Thus, the counter 76 for counting the total rotational speed during doctor roller throw-on is adapted to count the rotational speed (the number of rotations) of the rotary screen cylinder in an operating state.

To the input/output device 49, the stepping motor 81A for adjusting the left side is connected via a driver 80 for the stepping motor for adjusting the left side, and a counter 82 for detecting the current position of the left side of the doctor roller is also connected. The counter 82 for detecting the current position of the left side of the doctor roller is an up/down counter, which counts the count value up by 1 each time one normal rotation pulse is outputted to the stepping motor 81A for adjusting the left side, and counts the count value down by 1 each time one reverse rotation pulse is outputted thereto.

To the input/output device 50, the stepping motor 81B for adjusting the right side is connected via a driver 83 for the stepping motor for adjusting the right side, and a counter 85 for detecting the current position of the right side of the doctor roller is also connected. The counter 85 for detecting the current position of the right side of the doctor roller is likewise an up/down counter which counts the count value up by 1 each time one normal rotation pulse is outputted to the stepping motor 81B for adjusting the right side, and counts the count value down by 1 each time one reverse rotation pulse is outputted thereto.

To the input/output device 51, there are connected a sensor 86 for detecting the calibration position of the left side of the doctor roller, and a sensor 87 for detecting the calibration position of the right side of the doctor roller. The sensor 86 for detecting the calibration position of the left side of the doctor roller, and the sensor 87 for detecting the calibration position of the tight side of the doctor roller are fixed to the frames 10, and these sensors 86 and 87 are adapted to directly detect that the support shaft 27 has moved to a predetermined position in an upper part of an ordinary range of movement.

To the input/output device 52, an internal counter 88 is connected. The internal counter 88 counts clock pulses for operating the CPU 41, and measures in the operating state how much time has elapsed since the start of operation.

The control actions or motions of the control device 40 configured as above will be described in detail based on the motion flow charts of FIGS. 16(*a*) to 16(*d*), FIGS. 17(*a*) to 17(*c*), FIGS. 18(*a*) to 18(*d*), FIGS. 19(*a*) to 19(*c*), FIG. 20, FIGS. 21(*a*) to 21(*d*), FIGS. 22(*a*) to 22(*d*), FIGS. 23(*a*) to 23(*d*), FIGS. 24(*a*) to 24(*c*), and FIGS. 25(*a*) to 25(*d*).

In Step P1, the count value is loaded from the counter 82 for detecting the current position of the left side of the doctor roller, and stored into the memory M1. Then, in Step P2, the home position (count value of the counter) of the left side of the doctor roller is loaded from the memory M2. Then, in Step P3, the home position (count value of the counter) of the left side of the doctor roller is subtracted from the count value of the counter 82 for detecting the current position of the left side of the doctor roller to compute the difference in the count value for the left side, and this difference is stored into the memory M3.

Then, in Step P4, the current position of the left side of the doctor roller is computed from the count value difference for the left side, and stored into the memory M4, whereafter in Step P5, the current position of the left side of the doctor roller is outputted to the display device 63 for the current position of the left side of the doctor roller.

Then, in Step P6, the count value is loaded from the counter 85 for detecting the current position of the right side of the doctor roller, and stored into the memory M5. Then, in Step P7, the home position (count value of the counter) of the right side of the doctor roller is loaded from the memory M6. Then, in Step P8, the home position (count value of the counter) of the right side of the doctor roller is subtracted from the count value of the counter 85 for detecting the current position of the right side of the doctor roller to compute the difference in the count value for the right side, and this difference is stored into the memory M7.

Then, in Step P9, the current position of the right side of the doctor roller is computed from the count value difference for the right side, and stored into the memory M8, whereafter in Step P10, the current position of the right side of the doctor roller is outputted to the display device 64 for the current position of the right side of the doctor roller.

Then, in Step P11, it is determined whether the calibration switch 79 is ON. If the answer is YES, Step P12 is executed to output "indication of In-Calibration" to the display device 63 for the current position of the left side of the doctor roller. If the answer is NO, the program shifts to Step P38 to be described later.

Then, in Step P13, the "indication of In-Calibration" is outputted to the display device 64 for the current position of the right side of the doctor roller. Then follows Step P14 in which the memory M25 for storing the presence or absence of rotation of the stepping motor for adjusting the left side is overwritten with 0.

Then, in Step P15, the memory M26 for storing the presence or absence of rotation of the stepping motor for adjusting the right side is overwritten with 0. Subsequently, in Step P16, a reverse rotation pulse outputting command corresponding to one pulse is outputted to the driver 80 for the stepping motor for adjusting the left side.

Then, in Step P17, the memory M25 for storing the presence or absence of rotation of the stepping motor for adjusting the left side is overwritten with 1. Then, Step P18 is executed to output a reverse rotation pulse outputting command corresponding to one pulse to the driver 83 for the stepping motor for adjusting the right side.

Then, in Step P19, the memory M26 for storing the presence or absence of rotation of the stepping motor for adjusting the right side is overwritten with 1. Subsequently, in Step P20, the value of the memory M25 for storing the presence or absence of rotation of the stepping motor for adjusting the left side is loaded.

Then, in Step P21, it is determined whether the value of the memory for storing the presence or absence of rotation of the stepping motor for adjusting the left side is equal to 0. If the answer is YES, the value of the memory M26 for storing the presence or absence of rotation of the stepping motor for adjusting the right side is loaded in Step P22. If the answer is NO, the program shifts to Step P28 to be described later.

Then, in Step P23, it is determined whether the value of the memory for storing the presence or absence of rotation of the stepping motor for adjusting the right side is equal to 0. If the answer is NO, the program shifts to Step P28 to be described later. If the answer is YES, Step P24 is executed to output a reset signal to the counter 82 for detecting the current position of the left side of the doctor roller. Then follows Step P25 for stopping the outputting of the reset signal to the counter for detecting the current position of the left side of the doctor roller.

Then, Step P26 is executed to output a reset signal to the counter 85 for detecting the current position of the right side of the doctor roller. Then follows Step P27 to stop the outputting of the reset signal to the counter 85 for detecting the current position of the right side of the doctor roller. Then, the program returns to Step P11.

Subsequently, in Step P28, the value of the memory M25 for storing the presence or absence of rotation of the stepping motor for adjusting the left side is loaded. Then, in Step P29, it is determined whether the value of the memory for storing the presence or absence of rotation of the stepping motor for adjusting the left side is equal to 0.

If the answer is YES in Step P29, it is determined in Step P30 whether the output of the sensor 86 for detecting the calibration position of the left side of the doctor roller is ON. If the answer is NO, the program shifts to Step P32 to be described later.

If the answer is YES in Step P30, Step P31 is executed in which the memory M25 for storing the presence or absence of rotation of the stepping motor for adjusting the left side is overwritten with 0. Then, the program proceeds to Step P32. If the answer is NO in Step P30, Step P33 is executed in which a reverse rotation pulse outputting command corresponding to one pulse is outputted to the driver 80 for the stepping motor for adjusting the left side. Then, the program shifts to Step P32.

Subsequently, in Step P32, the value of the memory M26 for storing the presence or absence of rotation of the stepping motor for adjusting the right side is loaded. Then, in Step P34, it is determined whether the value of the memory for storing the presence or absence of rotation of the stepping motor for adjusting the right side is equal to 0.

If the answer is YES in Step P34, it is determined in Step P35 whether the output of the sensor 87 for detecting the calibration position of the right side of the doctor roller is ON. If the answer is NO in Step P34, the program returns to Step P20.

If the answer is YES in Step P35, Step P36 is executed in which the memory M26 for storing the presence or absence of rotation of the stepping motor for adjusting the right side is overwritten with 0. Then, the program returns to Step P20. If the answer is NO in Step P35, Step P37 is executed in which a reverse rotation pulse outputting command corresponding to one pulse is outputted to the driver 83 for the stepping motor for adjusting the right side. Then, the program returns to Step P20. In accordance with the above-described motion flow, the right and left sides of the support shaft 27 are moved to the positions where they are detected by the sensors 86, 87 for detecting the calibration position to correct power swing which occurs during control of the stepping motors.

Then, in Step P38 shifted from the aforementioned Step P11, it is determined whether the home position return switch 54 is ON. If the answer is YES, the home position (count value of the counter) of the left side of the doctor roller is loaded from the memory M2 in Step P39. If the answer is NO in Step P38, the program shifts to Step P81 to be described later.

Then, in Step P40, the count value is loaded from the counter 82 for detecting the current position of the left side of the doctor roller, and stored into the memory M1. Then follows Step P41 in which the count value of the counter for detecting the current position of the left side of the doctor roller is subtracted from the home position (count value of the counter) of the left side of the doctor roller to compute the amount of movement of the left side of the doctor roller, which is stored into the memory M27.

Then, in Step P42, the home position (count value of the counter) of the right side of the doctor roller is loaded from the memory M6. Then, in Step P43, the count value is loaded from the counter 85 for detecting the current position of the right side of the doctor roller, and stored into the memory M5.

Then follows Step P44 in which the count value of the counter for detecting the current position of the right side of the doctor roller is subtracted from the home position (count value of the counter) of the right side of the doctor roller to compute the amount of movement of the right side of the doctor roller, which is stored into the memory M28. Then, Step P45 is executed in which the memory M25 for storing the presence or absence of rotation of the stepping motor for adjusting the left side is overwritten with 0. Also, in Step P46, the memory M26 for storing the presence or absence of rotation of the stepping motor for adjusting the right side is overwritten with 0.

Then, in Step P47, the amount of movement of the left side of the doctor roller is loaded from the memory M27. Then, in Step P48, it is determined whether the amount of movement of the left side of the doctor roller is equal to 0. If the answer is YES in Step P48, the program shifts to Step P53 to be described later. If the answer is NO in Step P48, the memory M25 for storing the presence or absence of rotation of the stepping motor for adjusting the left side is overwritten with 1 in Step P49.

Then, in Step P50, it is determined whether the amount of movement of the left side of the doctor roller is larger than 0. If the answer is YES in Step P50, Step P51 is executed to compute the absolute value of the amount of movement of the left side of the doctor roller from the amount of movement of the left side of the doctor roller, and store it into the memory M29. Then, in Step P52, a normal rotation pulse outputting command corresponding to the absolute value of the amount of movement of the left side of the doctor roller is outputted to the driver 80 for the stepping motor for adjusting the left side. Then, the program proceeds to Step P53.

If the answer is NO in Step P50, Step P54 is executed to compute the absolute value of the amount of movement of the left side of the doctor roller from the amount of movement of the left side of the doctor roller, and store it into the memory M29. Then, in Step P55, a reverse rotation pulse outputting command corresponding to the absolute value of the amount of movement of the left side of the doctor roller is outputted to the driver 80 for the stepping motor for adjusting the left side. Then, the program shifts to Step P53.

Then, in Step P53, the amount of movement of the right side of the doctor roller is loaded from the memory M28. Then, in Step P56, it is determined whether the amount of movement of the right side of the doctor roller is equal to 0. If the answer is YES in Step P56, the program shifts to Step P61 to be described later. If the answer is NO in Step P56, the memory M26 for storing the presence or absence of rotation of the stepping motor for adjusting the right side is overwritten with 1 in Step P57.

Then, in Step P58, it is determined whether the amount of movement of the right side of the doctor roller is larger than 0. If the answer is YES in Step P58, Step P59 is executed to compute the absolute value of the amount of movement of the right side of the doctor roller from the amount of movement of the right side of the doctor roller, and store it into the memory M30. Then, in Step P60, a normal rotation pulse outputting command corresponding to the absolute value of the amount of movement of the right side of the doctor roller is outputted to the driver 83 for the stepping motor for adjusting the right side. Then, the program proceeds to Step P61.

If the answer is NO in Step P58, Step P62 is executed to compute the absolute value of the amount of movement of the right side of the doctor roller from the amount of movement of the right side of the doctor roller, and store it into the memory M30. Then, in Step P63, a reverse rotation pulse outputting command corresponding to the absolute value of the amount of movement of the right side of the doctor roller is outputted to the driver 83 for the stepping motor for adjusting the right side. Then, the program shifts to Step P61.

Subsequently, in Step P61, the value of the memory M25 for storing the presence or absence of rotation of the stepping motor for adjusting the left side is loaded. Then, in Step P64, it is determined whether the value of the memory for storing the presence or absence of rotation of the stepping motor for adjusting the left side is equal to 0. If the answer is YES in Step P64, the value of the memory M26 for storing the presence or absence of rotation of the stepping motor for adjusting the right side is loaded in Step P65. If the answer is NO in Step P64, the program shifts to Step P67 to be described later.

Then, in Step P66, it is determined whether the value of the memory for storing the presence or absence of rotation of the stepping motor for adjusting the right side is equal to 0. If the answer is YES in Step P66, the program returns to Step P11. If the answer is NO in Step P66, the program proceeds to Step P67.

Then, in Step P67, the count value is loaded from the counter 82 for detecting the current position of the left side of the doctor roller, and stored into the memory M1. Subsequently, in Step P68, the home position (count value of the counter) of the left side of the doctor roller is loaded from the memory M2.

Then, in Step P69, the home position (count value of the counter) of the left side of the doctor roller is subtracted from the count value of the counter 82 for detecting the current position of the left side of the doctor roller to compute the count value difference for the left side, which is stored into the memory M3. Then, in Step P70, it is determined whether the count value difference for the left side is equal to 0.

If the answer is YES in Step P70, the memory M25 for storing the presence or absence of rotation of the stepping motor for adjusting the left side is overwritten with 0 in Step P71, and the program proceeds to Step P72. If the answer is NO in Step P70, the program immediately shifts to Step P72.

Then, in Step P72, the current position of the left side of the doctor roller is computed from the count value difference for the left side, and stored into the memory M4. Then follows Step P73 in which the current position of the left side of the doctor roller is outputted to the display device 63 for the current position of the left side of the doctor roller.

Then, in Step P74, the count value is loaded from the counter 85 for detecting the current position of the right side of the doctor roller, and stored into the memory M5. Subsequently, in Step P75, the home position (count value of the counter) of the right side of the doctor roller is loaded from the memory M6.

Then, in Step P76, the home position (count value of the counter) of the right side of the doctor roller is subtracted from the count value of the counter 85 for detecting the current position of the right side of the doctor roller to compute the count value difference for the right side, which is stored into the memory M7. This is followed by Step P77 in which it is determined whether the count value difference for the right side is equal to 0.

If the answer is YES in Step P77, the memory M26 for storing the presence or absence of rotation of the stepping motor for adjusting the right side is overwritten with 0 in Step P78, and the program proceeds to Step P79. If the answer is NO in Step P77, the program immediately shifts to Step P79.

Then, in Step P79, the current position of the right side of the doctor roller is computed from the count value difference for the right side, and stored into the memory M8. Then follows Step P80 in which the current position of the right side of the doctor roller is outputted to the display device 64 for the current position of the right side of the doctor roller. Then, the program returns to Step P61. In accordance with the above motion flow, the right and left sides of the support shaft 27 are returned to the home positions at the point in time at which the home position return switch 54 has been pressed, in order to replace the doctor roller 90.

Then, in Step P81 shifted from the aforementioned Step P38, it is determined whether the left side adjustment selection switch 55 is ON. If the answer is YES, it is determined in Step P82 whether the adjustment completion switch 58 is ON. If the answer is NO in Step P81, the program shifts to Step P109 to be described later.

If the answer is YES in Step P82, the program shifts to Step P109. If the answer is NO in Step P82, it is determined in Step P83 whether the up button 59 is ON.

If the answer is YES in Step P83, this is followed by Step P84 in which a reset signal and an enabling signal are outputted to the internal counter 88. If the answer is NO in Step P83, the program shifts to Step P96 to be described later. Then, in Step P85, outputting of the reset signal to the internal counter 88 is stopped.

Then, in Step P86, it is determined whether the up button 59 is OFF. If the answer is YES, the program shifts to Step P96. If the answer is NO, the standby time for an outputting command to the driver for the stepping motor is loaded from the memory 31 in Step P87.

Subsequently, in Step P88, the count value is loaded from the internal counter 88, and stored into the memory M32. Then, in Step P89, it is determined whether the count value of the internal counter is equal to or greater than the standby time for the outputting command to the driver for the stepping motor. If the answer is YES in Step P89, Step P90 is executed in which a normal rotation pulse outputting command corresponding to one pulse is outputted to the driver 80 for the stepping motor for adjusting the left side. If the answer is NO in Step P89, the program returns to Step P86.

Then, in Step P91, the count value is loaded from the counter 82 for detecting the current position of the left side of the doctor roller, and stored into the memory M1. Subsequently, in Step P92, the home position (count value of the counter) of the left side of the doctor roller is loaded from the memory M2.

Then, in Step P93, the home position (count value of the counter) of the left side of the doctor roller is subtracted from the count value of the counter 82 for detecting the current position of the left side of the doctor roller to compute the count value difference for the left side, which is stored into the memory M3. This is followed by Step P94 in which the current position of the left side of the doctor roller is computed from the count value difference for the left side, and stored into the memory M4.

Then follows Step P95 in which the current position of the left side of the doctor roller is outputted to the display device 63 for the current position of the left side of the doctor roller. Then, the program returns to Step P84.

Then, in Step P96, it is determined whether the down button 60 is ON. If the answer is YES in Step P96, this is followed by Step P97 in which a reset signal and an enabling signal are outputted to the internal counter 88. If the answer is NO in Step P96, the program returns to Step P82. Then, in Step P98, outputting of the reset signal to the internal counter 88 is stopped.

Then, in Step P99, it is determined whether the down button 60 is OFF. If the answer is YES, the program returns to Step P82. If the answer is NO, the standby time for the outputting command to the driver for the stepping motor is loaded from the memory 31 in Step P100.

Subsequently, in Step P101, the count value is loaded from the internal counter 88, and stored into the memory M32. Then, in Step P102, it is determined whether the count value of the internal counter is equal to or greater than the standby time for the outputting command to the driver for the stepping motor. If the answer is YES in Step P102, Step P103 is executed in which a reverse rotation pulse outputting command corresponding to one pulse is outputted to the driver 80 for the stepping motor for adjusting the left side. If the answer is NO in Step P102, the program returns to Step P99.

Then, in Step P104, the count value is loaded from the counter 82 for detecting the current position of the left side of the doctor roller, and stored into the memory M1. Subsequently, in Step P105, the home position (count value of the counter) of the left side of the doctor roller is loaded from the memory M2.

Then, in Step P106, the home position (count value of the counter) of the left side of the doctor roller is subtracted from the count value of the counter 82 for detecting the current position of the left side of the doctor roller to compute the count value difference for the left side, which is stored into the memory M3. This is followed by Step P107 in which the current position of the left side of the doctor roller is computed from the count value difference for the left side, and stored into the memory M4.

Then follows Step P108 in which the current position of the left side of the doctor roller is outputted to the display device 63 for the current position of the left side of the doctor roller. Then, the program returns to Step P97.

Then, in Step P109, it is determined whether the right side adjustment selection switch 56 is ON. If the answer is YES, it is determined in Step P110 whether the adjustment completion switch 58 is ON. If the answer is NO in Step P109, the program shifts to Step P137 to be described later.

If the answer is YES in Step P110, the program shifts to Step P137. If the answer is NO in Step P110, it is determined in Step P111 whether the up button 59 is ON.

If the answer is YES in Step P111, this is followed by Step P112 in which a reset signal and an enabling signal are outputted to the internal counter 88. If the answer is NO in Step P111, the program shifts to Step P124 to be described later. Then, in Step P113, outputting of the reset signal to the internal counter 88 is stopped.

Then, in Step P114, it is determined whether the up button 59 is OFF. If the answer is YES, the program shifts to Step P124. If the answer is NO, the standby time for an outputting command to the driver for the stepping motor is loaded from the memory 31 in Step P115.

Subsequently, in Step P116, the count value is loaded from the internal counter 88, and stored into the memory M32. Then, in Step P117, it is determined whether the count value of the internal counter is equal to or greater than the standby time for the outputting command to the driver for the stepping motor. If the answer is YES in Step P117, Step P118 is executed in which a normal rotation pulse outputting command corresponding to one pulse is outputted to the driver 83 for the stepping motor for adjusting the right side. If the answer is NO in Step P117, the program returns to Step P114.

Then, in Step P119, the count value is loaded from the counter 85 for detecting the current position of the right side of the doctor roller, and stored into the memory M5. Subsequently, in Step P120, the home position (count value of the counter) of the right side of the doctor roller is loaded from the memory M6.

Then, in Step P121, the home position (count value of the counter) of the right side of the doctor roller is subtracted from the count value of the counter 85 for detecting the current position of the right side of the doctor roller to compute the count value difference for the right side, which is stored into the memory M7. This is followed by Step P122 in which the current position of the right side of the doctor roller is computed from the count value difference for the right side, and stored into the memory M8.

Then follows Step P123 in which the current position of the right side of the doctor roller is outputted to the display device 64 for the current position of the right side of the doctor roller. Then, the program returns to Step P112.

Then, in Step P124, it is determined whether the down button 60 is ON. If the answer is YES in Step P124, this is followed by Step P125 in which a reset signal and an enabling signal are outputted to the internal counter 88. If the answer is NO in Step P124, the program returns to Step P110. Then, in Step P126, outputting of the reset signal to the internal counter 88 is stopped.

Then, in Step P127, it is determined whether the down button 60 is OFF. If the answer is YES, the program returns to Step P110. If the answer is NO, the standby time for an outputting command to the driver for the stepping motor is loaded from the memory 31 in Step P128.

Subsequently, in Step P129, the count value is loaded from the internal counter 88, and stored into the memory M32. Then, in Step P130, it is determined whether the count value of the internal counter is equal to or greater than the standby time for the outputting command to the driver for the stepping motor. If the answer is YES in Step P130, Step P131 is executed in which a reverse rotation pulse outputting command corresponding to one pulse is outputted to the driver 83 for the stepping motor for adjusting the right side. If the answer is NO in Step P130, the program returns to Step P127.

Then, in Step P132, the count value is loaded from the counter 85 for detecting the current position of the right side of the doctor roller, and stored into the memory M5. Subsequently, in Step P133, the home position (count value of the counter) of the right side of the doctor roller is loaded from the memory M6.

Then, in Step P134, the home position (count value of the counter) of the right side of the doctor roller is subtracted from the count value of the counter 85 for detecting the current position of the right side of the doctor roller to compute the count value difference for the right side, which is stored into the memory M7. This is followed by Step P135 in which the current position of the right side of the doctor roller is computed from the count value difference for the right side, and stored into the memory M8.

Then follows Step P136 in which the current position of the right side of the doctor roller is outputted to the display device 64 for the current position of the right side of the doctor roller. Then, the program returns to Step P125.

Then, in Step P137, it is determined whether the both sides adjustment selection switch 57 is ON. If the answer is YES, it is determined in Step P138 whether the adjustment completion switch 58 is ON. If the answer is NO in Step P137, the program shifts to Step P177 to be described later.

If the answer is YES in Step P138, the program shifts to Step P177. If the answer is NO in Step P138, it is determined in Step P139 whether the up button 59 is ON.

If the answer is YES in Step P139, this is followed by Step P140 in which a reset signal and an enabling signal are outputted to the internal counter 88. If the answer is NO in Step P139, the program shifts to Step P158 to be described later. Then, in Step P141, outputting of the reset signal to the internal counter 88 is stopped.

Then, in Step P142, it is determined whether the up button 59 is OFF. If the answer is YES, the program shifts to Step P158. If the answer is NO, the standby time for an outputting command to the driver for the stepping motor is loaded from the memory 31 in Step P143.

Subsequently, in Step P144, the count value is loaded from the internal counter 88, and stored into the memory M32. Then, in Step P145, it is determined whether the count value of the internal counter is equal to or greater than the standby time for the outputting command to the driver for the stepping motor. If the answer is YES in Step P145, Step P146 is executed in which a normal rotation pulse outputting command corresponding to one pulse is outputted to the driver 80 for the stepping motor for adjusting the left side. If the answer is NO in Step P145, the program returns to Step P142.

Then, in Step P147, a normal rotation pulse outputting command corresponding to one pulse is outputted to the driver 83 for the stepping motor for adjusting the right side. Then, in Step P148, the count value is loaded from the counter 82 for detecting the current position of the left side of the doctor roller, and stored into the memory M1. Subsequently, in Step P149, the home position (count value of the counter) of the left side of the doctor roller is loaded from the memory M2.

Then, in Step P150, the home position (count value of the counter) of the left side of the doctor roller is subtracted from the count value of the counter 82 for detecting the current position of the left side of the doctor roller to compute the count value difference for the left side, which is stored into the memory M3. This is followed by Step P151 in which the current position of the left side of the doctor roller is computed from the count value difference for the left side, and stored into the memory M4.

Then follows Step P152 in which the current position of the left side of the doctor roller is outputted to the display device 63 for the current position of the left side of the doctor roller. Then, in Step P153, the count value is loaded from the counter 85 for detecting the current position of the right side of the doctor roller, and stored into the memory M5. Subsequently, in Step P154, the home position (count value of the counter) of the right side of the doctor roller is loaded from the memory M6.

Then, in Step P155, the home position (count value of the counter) of the right side of the doctor roller is subtracted from the count value of the counter 85 for detecting the current position of the right side of the doctor roller to compute the count value difference for the right side, which is stored into the memory M7. This is followed by Step P156 in which the current position of the right side of the doctor roller is computed from the count value difference for the right side, and stored into the memory M8.

Then follows Step P157 in which the current position of the right side of the doctor roller is outputted to the display device 64 for the current position of the right side of the doctor roller. Then, the program returns to Step P140.

Then, in Step P158, it is determined whether the down button 60 is ON. If the answer is YES in Step P158, this is followed by Step P159 in which a reset signal and an enabling signal are outputted to the internal counter 88. If the answer is NO in Step P158, the program returns to Step P138. Then, in Step P160, outputting of the reset signal to the internal counter 88 is stopped.

Then, in Step P161, it is determined whether the down button 60 is OFF. If the answer is YES, the program returns to Step P138. If the answer is NO, the standby time for an outputting command to the driver for the stepping motor is loaded from the memory 31 in Step P162.

Subsequently, in Step P163, the count value is loaded from the internal counter 88, and stored into the memory M32. Then, in Step P164, it is determined whether the count value of the internal counter is equal to or greater than the standby time for the outputting command to the driver for the stepping motor. If the answer is YES in Step P164, Step P165 is executed in which a reverse rotation pulse outputting command corresponding to one pulse is outputted to the driver 80 for the stepping motor for adjusting the left side. If the answer is NO in Step P164, the program returns to Step P161.

Then, in Step P166, a reverse rotation pulse outputting command corresponding to one pulse is outputted to the driver 83 for the stepping motor for adjusting the right side. Then, in Step P167, the count value is loaded from the counter 82 for detecting the current position of the left side of the doctor roller, and stored into the memory M1. Subsequently, in Step P168, the home position (count value of the counter) of the left side of the doctor roller is loaded from the memory M2.

Then, in Step P169, the home position (count value of the counter) of the left side of the doctor roller is subtracted from the count value of the counter 82 for detecting the current position of the left side of the doctor roller to compute the count value difference for the left side, which is stored into the memory M3. This is followed by Step P170 in which the current position of the left side of the doctor roller is computed from the count value difference for the left side, and stored into the memory M4.

Then follows Step P171 in which the current position of the left side of the doctor roller is outputted to the display device 63 for the current position of the left side of the doctor roller. Then, in Step P172, the count value is loaded from the counter 85 for detecting the current position of the right side of the doctor roller, and stored into the memory M5. Subsequently, in Step P173, the home position (count value of the counter) of the right side of the doctor roller is loaded from the memory M6.

Then, in Step P174, the home position (count value of the counter) of the right side of the doctor roller is subtracted from the count value of the counter 85 for detecting the current position of the right side of the doctor roller to compute the count value difference for the right side, which is stored into the memory M7. This is followed by Step P175 in which the current position of the fight side of the doctor roller is computed from the count value difference for the right side, and stored into the memory M8.

Then follows Step P176 in which the current position of the right side of the doctor roller is outputted to the display device 64 for the current position of the right side of the doctor roller. Then, the program returns to Step P159. In accordance with the above-described motion flow, there is performed the home position adjustment of the support shaft 27 after replacement of the doctor roller 90 by the operator's manual operation, in other words, the paralleling of right and left end portions of the doctor roller 90.

Then, in Step P177 shifted from the aforementioned Step P137 and Step P138, it is determined whether the home position adjustment completion switch 61 is ON. If the answer is YES, Step P178 is executed to load the count value from the counter 82 for detecting the current position of the left side of the doctor roller, and store the count value into the memory M1. If the answer is NO in Step P177, the program shifts to Step P186 to be described later.

Then, in Step P179, the memory M2 for storing the home position (count value of the counter) of the left side of the doctor roller is overwritten with the count value of the counter 82 for detecting the current position of the left side of the doctor roller. Subsequently, in Step P180, 0 is outputted to the display device 63 for the current position of the left side of the doctor roller.

Then, Step P181 is executed to load the count value from the counter 85 for detecting the current position of the right side of the doctor roller, and store the count value into the memory M5. Then, in Step P182, the memory M6 for storing the home position (count value of the counter) of the right side of the doctor roller is overwritten with the count value of the counter 85 for detecting the current position of the right side of the doctor roller.

Subsequently, in Step P183, 0 is outputted to the display device 64 for the current position of the right side of the doctor roller, whereafter in Step P184 a reset signal is outputted to the counter 76 for counting the total rotational speed during doctor roller throw-on. Then, Step P185 is executed to stop outputting of the reset signal to the counter 76 for counting the total rotational speed during doctor roller throw-on, and the program returns to Step P11. In accordance with the above-described motion flow, the home position of the support shaft 27 after replacement of the doctor roller 90, which has been adjusted by the operator's manual operation, is stored as a subsequent new home position. Moreover, the state of the counter 76 for counting the total rotational speed during doctor roller throw-on is brought to the initial state (is reset).

Then, in Step P186 shifted from the aforementioned Step P177, it is determined whether the doctor roller throw-on and throw-off automatic control switch 62 is ON. If the answer is YES, it is determined in Step P187 whether the doctor roller throw-on and throw-off automatic control switch 62 is OFF. If the answer is NO in Step P186, the program returns to Step P11.

If the answer is YES in Step P187, the program shifts to Step P408 to be described later. If the answer is NO in Step P187, it is determined in Step P188 whether a cylinder engagement signal for the rotary screen cylinder 11 has been rendered ON by the cylinder engagement circuit 78 for the rotary screen cylinder.

If the answer is YES in Step P188, the program shifts to Step P242. If the answer is NO in Step P188, the home position (count value of the counter) of the left side of the doctor roller is loaded from the memory M2 in Step P189.

Then, in Step P190, the distance (count value of the counter) between the home position and the throw-off position of the left side of the doctor roller is loaded from the memory M14. Then follows Step P191 in which the distance (count value of the counter) between the home position and the throw-off position of the left side of the doctor roller is added to the home position (count value of the counter) of the left side of the doctor roller to compute the throw-off position (count value of the counter) of the left side of the doctor roller, and the computed value is stored into the memory M15.

Then, in Step P192, the count value is loaded from the counter 82 for detecting the current position of the left side of the doctor roller, and stored into the memory M1. Then, in Step P193, the count value of the counter for detecting the current position of the left side of the doctor roller is subtracted from the throw-off position (count value of the counter) of the left side of the doctor roller to compute the amount of movement of the left side of the doctor roller, which is stored into the memory M27.

Then follows Step P194 in which the home position (count value of the counter) of the right side of the doctor roller is loaded from the memory M6. Then, in Step P195, the distance (count value of the counter) between the home position and the throw-off position of the right side of the doctor roller is loaded from the memory M16. Subsequently, in Step P196, the distance (count value of the counter) between the home position and the throw-off position of the right side of the doctor roller is added to the home position (count value of the counter) of the right side of the doctor roller to compute the throw-off position (count value of the counter) of the right side of the doctor roller, which is stored into the memory M17.

Then, in Step P197, the count value is loaded from the counter 85 for detecting the current position of the right side of the doctor roller, and stored into the memory M5. Then, in Step P198, the count value of the counter for detecting the current position of the left side of the doctor roller is subtracted from the throw-off position (count value of the counter) of the right side of the doctor roller to compute the amount of movement of the right side of the doctor roller, which is stored into the memory M28.

Then, in Step P199, the memory M25 for storing the presence or absence of rotation of the stepping motor for adjusting the left side is overwritten with 0. Subsequently, in Step P200, the memory M26 for storing the presence or absence of rotation of the stepping motor for adjusting the right side is overwritten with 0.

Then, in Step P201, the amount of movement of the left side of the doctor roller is loaded from the memory M27. Then, in Step P202, it is determined whether the amount of movement of the left side of the doctor roller is equal to 0. If the answer is YES in Step P202, the program shifts to Step P207 to be described later. If the answer is NO in Step P202, the memory M25 for storing the presence or absence of rotation of the stepping motor for adjusting the left side is overwritten with 1 in Step P203.

Then, in Step P204, it is determined whether the amount of movement of the left side of the doctor roller is larger than 0. If the answer is YES in Step P204, Step P205 is executed to compute the absolute value of the amount of movement of the left side of the doctor roller from the amount of movement of the left side of the doctor roller, and store it into the memory M29. Then, in Step P206, a normal rotation pulse outputting command corresponding to the absolute value of the amount of movement of the left side of the doctor roller is outputted to the driver 80 for the stepping motor for adjusting the left side. Then, the program proceeds to Step P207.

If the answer is NO in Step P204, Step P208 is executed to compute the absolute value of the amount of movement of the left side of the doctor roller from the amount of movement of the left side of the doctor roller, and store it into the memory M29. Then, in Step P209, a reverse rotation pulse outputting command corresponding to the absolute value of the amount of movement of the left side of the doctor roller is outputted to the driver 80 for the stepping motor for adjusting the left side. Then, the program shifts to Step P207.

Then, in Step P207, the amount of movement of the right side of the doctor roller is loaded from the memory M28. Then, in Step P210, it is determined whether the amount of movement of the right side of the doctor roller is equal to 0. If the answer is YES in Step P210, the program shifts to Step P215 to be described later. If the answer is NO in Step P210, the memory M26 for storing the presence or absence of rotation of the stepping motor for adjusting the right side is overwritten with 1 in Step P211.

Then, in Step P212, it is determined whether the amount of movement of the right side of the doctor roller is larger than 0. If the answer is YES in Step P212, Step P213 is executed to compute the absolute value of the amount of movement of the right side of the doctor roller from the amount of movement of the right side of the doctor roller, and store it into the memory M30. Then, in Step P214, a normal rotation pulse outputting command corresponding to the absolute value of the amount of movement of the right side of the doctor roller is outputted to the driver 83 for the stepping motor for adjusting the right side. Then, the program proceeds to Step P215.

If the answer is NO in Step P212, Step P216 is executed to compute the absolute value of the amount of movement of the right side of the doctor roller from the amount of movement of the right side of the doctor roller, and store it into the memory M30. Then, in Step P217, a reverse rotation pulse outputting command corresponding to the absolute value of the amount of movement of the right side of the doctor roller is outputted to the driver 83 for the stepping motor for adjusting the right side. Then, the program shifts to Step P215.

Subsequently, in Step P215, the value of the memory M25 for storing the presence or absence of rotation of the stepping motor for adjusting the left side is loaded. Then, in Step P218, it is determined whether the value of the memory for storing the presence or absence of rotation of the stepping motor for adjusting the left side is equal to 0. If the answer is YES in Step P218, the program proceeds to Step P219. If the answer is NO in Step P218, the program shifts to Step P221 to be described later.

Then, in Step P219, the value of the memory M26 for storing the presence or absence of rotation of the stepping motor for adjusting the right side is loaded. Subsequently, in Step P220, it is determined whether the value of the memory for storing the presence or absence of rotation of the stepping motor for adjusting the right side is equal to 0. If the answer is YES in Step P220, outputting of the enabling signal to the counter 76 for counting the total rotational speed during doctor roller throw-on is stopped in Step P222. Then, the program returns to Step P187.

Then, in Step P221, the count value is loaded from the counter 82 for detecting the current position of the left side of the doctor roller, and stored into the memory M1. Subsequently, in Step P223, the throw-off position (count value of the counter) of the left side of the doctor roller is loaded from the memory M15.

Then, in Step P224, the count value of the counter for detecting the current position of the left side of the doctor roller is subtracted from the throw-off position (count value of the counter) of the left side of the doctor roller to compute the count value difference for the left side, which is stored into the memory M3. Then, in Step P225, it is determined whether the count value difference for the left side is equal to 0.

If the answer is YES in Step P225, the memory M25 for storing the presence or absence of rotation of the stepping motor for adjusting the left side is overwritten with 0 in Step P226. Subsequently, in Stop P227, the count value is loaded from the counter 82 for detecting the current position of the left side of the doctor roller, and stored into the memory M1.

If the answer is NO in Step P225, the program immediately shifts to Step P227. Subsequently, in Step P228, the home position (count value of the counter) of the left side of the doctor roller is loaded from the memory M2. Then, in Step P229, the home position (count value of the counter) of the left side of the doctor roller is subtracted from the count value of the counter 82 for detecting the current position of the left side of the doctor roller to compute the count value difference for the left side, which is stored into the memory M3.

This is followed by Step P230 in which the current position of the left side of the doctor roller is computed from the count value difference for the left side, and stored into the memory M4. Then follows Step P231 in which the current position of the left side of the doctor roller is outputted to the display device 63 for the current position of the left side of the doctor roller.

Then, in Step P232, the count value is loaded from the counter 85 for detecting the current position of the right side of the doctor roller, and stored into the memory M5. Subsequently, in Step P233, the throw-off position (count value of the counter) of the right side of the doctor roller is loaded from the memory M17.

Then, in Step P234, the count value of the counter 85 for detecting the current position of the right side of the doctor roller is subtracted from the throw-off position (count value of the counter) of the right side of the doctor roller to compute the count value difference for the right side, which is stored into the memory M7. Then, in Step P235, it is determined whether the count value difference for the right side is equal to 0.

If the answer is YES in Step P235, the memory M26 for storing the presence or absence of rotation of the stepping motor for adjusting the right side is overwritten with 0 in Step P236. Subsequently, in Step P237, the count value is loaded from the counter 85 for detecting the current position of the right side of the doctor roller, and stored into the memory M5.

If the answer is NO in Step P235, the program immediately shifts to Step P237. Subsequently, in Step P238, the home position (count value of the counter) of the right side of the doctor roller is loaded from the memory M6. Then, in Step P239, the home position (count value of the counter) of the right side of the doctor roller is subtracted from the count value of the counter 85 for detecting the current position of the right side of the doctor roller to compute the count value difference for the right side, which is stored into the memory M7.

This is followed by Step P240 in which the current position of the right side of the doctor roller is computed from the count value difference for the right side, and stored into the memory M8. Then follows Step P241 in which the current position of the right side of the doctor roller is outputted to the display device 64 for the current position of the right side of the doctor roller. Then, the program returns to Step P215. In accordance with the above-described motion flow, when the cylinder engagement signal for the rotary screen cylinder 11 is not ON, in other words, when printing is not done using the rotary screen cylinder 11, the right and left sides of the support shaft 27 are moved to the throw-off position, and the state of the counter 76 for counting the total rotational speed during doctor roller throw-on is rendered inoperative.

Then, in Step P242 shifted from the aforementioned Step P188, the table of conversion from the total rotational speed during doctor roller throw-on to the amount (count value of the counter) of correction of the doctor roller position is loaded from the memory M18. Then, in Step P243, the count value is loaded from the counter 76 for counting the total rotational speed during doctor roller throw-on, and stored into the memory M19.

Then, in Step P244, the amount (count value of the counter) of correction of the doctor roller position is obtained from the count value of the counter for counting the total rotational speed during doctor roller throw-on by use of the table of conversion from the total rotational speed during doctor roller throw-on to the amount (count value of the counter) of correction of the doctor roller position, and the obtained amount is stored into the memory M20. Then follows Step P245 in which the borne position (count value of the counter) of the left side of the doctor roller is loaded from the memory M2.

Then, in Step P246, the distance (count value of the counter) between the home position and the printing position of the left side of the doctor roller is loaded from the memory M21. Subsequently, in Step P247, the amount (count value of the counter) of correction of the doctor roller position is loaded from the memory M20.

Then, in Step P248, the distance (count value of the counter) between the home position and the printing position of the left side of the doctor roller and the amount (count value of the counter) of correction of the doctor roller position are added to the home position (count value of the counter) of the left side of the doctor roller to compute the printing position (count value of the counter) of the left side of the doctor roller, which is stored into the memory M22. Then, in Step P249, the count value is loaded from the counter 82 for detecting the current position of the left side of the doctor roller, and stored into the memory M1.

Then, in Step P250, the count value of the counter for detecting the current position of the left side of the doctor roller is subtracted from the printing position (count value of the counter) of the left side of the doctor roller to compute the amount of movement of the left side of the doctor roller, and this amount is stored into the memory M27. Then, in Step P251, the home position (count value of the counter) of the right side of the doctor roller is loaded from the memory M2.

Then follows Step P252 in which the distance (count value of the counter) between the home position and the printing position of the right side of the doctor roller is loaded from the memory M23. Then, in Step P253, the amount (count value of the counter) of correction of the doctor roller position is loaded from the memory M20.

Then, in Step P254, the distance (count value of the counter) between the home position and the printing position of the right side of the doctor roller and the amount (count value of the counter) of correction of the doctor roller position are added to the home position (count value of the counter) of the right side of the doctor roller to compute the printing position (count value of the counter) of the right side of the doctor roller, which is stored into the memory M24. Then, in Step P255, the count value is loaded from the counter 85 for detecting the current position of the right side of the doctor roller, and stored into the memory M1.

Then, in Step P256, the count value of the counter for detecting the current position of the right side of the doctor roller is subtracted from the printing position (count value of the counter) of the right side of the doctor roller to compute the amount of movement of the right side of the doctor roller, which is stored into the memory M28. Subsequently, in Step P257, the memory M25 for storing the presence or absence of rotation of the stepping motor for adjusting the left side is overwritten with 0. Then, in Step P258, the memory M26 for storing the presence or absence of rotation of the stepping motor for adjusting the right side is overwritten with 0.

Then, in Step P259, the amount of movement of the left side of the doctor roller is loaded from the memory M27. Then, in Step P260, it is determined whether the amount of movement of the left side of the doctor roller is equal to 0. If the answer is YES in Step P260, the program shifts to Step P265 to be described later. If the answer is NO in Step P260, the memory M25 for storing the presence or absence of rotation of the stepping motor for adjusting the left side is overwritten with 1 in Step P261.

Then, in Step P262, it is determined whether the amount of movement of the left side of the doctor roller is larger than 0. If the answer is YES in Step P262, Step P263 is executed to compute the absolute value of the amount of movement of the left side of the doctor roller from the amount of movement of the left side of the doctor roller, and store it into the memory M29. Then, in Step P264, a normal rotation pulse outputting command corresponding to the absolute value of the amount of movement of the left side of the doctor roller is outputted to the driver 80 for the stepping motor for adjusting the left side. Then, the program proceeds to Step P265.

If the answer is NO in Step P262, Step P266 is executed to compute the absolute value of the amount of movement of the left side of the doctor roller from the amount of movement of the left side of the doctor roller, and store it into the memory M29. Then, in Step P267, a reverse rotation pulse outputting command corresponding to the absolute value of the amount of movement of the left side of the doctor roller is outputted to the driver 80 for the stepping motor for adjusting the left side. Then, the program shifts to Step P265.

Then, in Step P265, the amount of movement of the right side of the doctor roller is loaded from the memory M28. Then, in Step P268, it is determined whether the amount of movement of the right side of the doctor roller is equal to 0. If the answer is YES in Step P268, the program shifts to Step P273 to be described later. If the answer is NO in Step P268, the memory M26 for storing the presence or absence of rotation of the stepping motor for adjusting the right side is overwritten with 1 in Step P269.

Then, in Step P270, it is determined whether the amount of movement of the right side of the doctor roller is larger than 0. If the answer is YES in Step P270, Step P271 is executed to compute the absolute value of the amount of movement of the right side of the doctor roller from the amount of movement of the right side of the doctor roller, and store it into the memory M30. Then, in Step P272, a normal rotation pulse outputting command corresponding to the absolute value of the amount of movement of the right side of the doctor roller is outputted to the driver 83 for the stepping motor for adjusting the right side. Then, the program proceeds to Step P273.

If the answer is NO in Step P270, Step P274 is executed to compute the absolute value of the amount of movement of the right side of the doctor roller from the amount of movement of the right side of the doctor roller, and store it into the memory M30. Then, in Step P275, a reverse rotation pulse outputting command corresponding to the absolute value of the amount of movement of the right side of the doctor roller is outputted to the driver 83 for the stepping motor for adjusting the right side. Then, the program shifts to Step P273.

Subsequently, in Step P273, the value of the memory M25 for storing the presence or absence of rotation of the stepping motor for adjusting the left side is loaded. Then, in Step P276, it is determined whether the value of the memory for storing the presence or absence of rotation of the stepping motor for adjusting the left side is equal to 0.

If the answer is YES in Step P276, the value of the memory M26 for storing the presence or absence of rotation of the stepping motor for adjusting the right side is loaded in Step P277. If the answer is NO in Step P276, the program shifts to Step P280 to be described later.

Subsequently, in Step P278, it is determined whether the value of the memory for storing the presence or absence of rotation of the stepping motor for adjusting the right side is equal to 0. If the answer is YES in Step P278, Step P279 is executed to output an enabling signal to the counter 76 for counting the total rotational speed during doctor roller throw-on. Then, the program shifts to Step P300 to be described later. If the answer is NO in Step P278, the program shifts to Step P280.

Then, in Step P280, the count value is loaded from the counter 82 for detecting the current position of the left side of the doctor roller, and stored into the memory M1. Subsequently, in Step P281, the printing position (count value of the counter) of the left side of the doctor roller is loaded from the memory M22.

Then, in Step P282, the count value of the counter for detecting the current position of the left side of the doctor roller is subtracted from the printing position (count value of the counter) of the left side of the doctor roller to compute the count value difference for the left side, which is stored into the memory M3. Then, in Step P283, it is determined whether the count value difference for the left side is equal to 0.

If the answer is YES in Step P283, the memory M25 for storing the presence or absence of rotation of the stepping motor for adjusting the left side is overwritten with 0 in Step P284. Then, the program proceeds to Step P285. If the answer is NO in Step P283, the program immediately shifts to Step P285.

Subsequently, in Step P285, the count value is loaded from the counter 82 for detecting the current position of the left side of the doctor roller, and stored into the memory M1. Subsequently, in Step P286, the home position (count value of the counter) of the left side of the doctor roller is loaded from the memory M2.

Then, in Step P287, the home position (count value of the counter) of the left side of the doctor roller is subtracted from the count value of the counter 82 for detecting the current position of the left side of the doctor roller to compute the count value difference for the left side, which is stored into the memory M3. This is followed by Step P288 in which the current position of the left side of the doctor roller is computed from the count value difference for the left side, and stored into the memory M4. Then, in Step P289, the current position of the left side of the doctor roller is outputted to the display device 63 for the current position of the left side of the doctor roller.

Then, in Step P290, the count value is loaded from the counter 85 for detecting the current position of the right side of the doctor roller, and stored into the memory M5. Subsequently, in Step P291, the printing position (count value of the counter) of the right side of the doctor roller is loaded from the memory M24.

Then, in Step P292, the count value of the counter for detecting the current position of the right side of the doctor roller is subtracted from the printing position (count value of the counter) of the right side of the doctor roller to compute the count value difference for the right side, which is stored into the memory M7. Then, in Step P293, it is determined whether the count value difference for the right side is equal to 0.

If the answer is YES in Step P293, the memory M26 for storing the presence or absence of rotation of the stepping motor for adjusting the right side is overwritten with 0 in Step P294. Then, the program proceeds to Step P295. If the answer is NO in Step P293, the program immediately shifts to Step P295.

Subsequently, in Step P295, the count value is loaded from the counter 85 for detecting the current position of the right side of the doctor roller, and stored into the memory M5. Subsequently, in Step P296, the home position (count value of the counter) of the right side of the doctor roller is loaded from the memory M6.

Then, in Step P297, the home position (count value of the counter) of the right side of the doctor roller is subtracted from the count value of the counter for detecting the current position of the right side of the doctor roller to compute the count value difference for the right side, which is stored into the memory M7. This is followed by Step P298 in which the current position of the right side of the doctor roller is computed from the count value difference for the right side, and stored into the memory M9. Then follows Step P299 in which the current position of the right side of the doctor roller is outputted to the display device 64 for the current position of the right side of the doctor roller. Then, the program returns to Step P273. In accordance with the above-described motion flow, when the cylinder engagement signal for the rotary screen cylinder 11 is ON, in other words, when printing is done using the rotary screen cylinder 11, the right and left sides of the support shaft 27 are moved to the printing position, and the state of the counter 76 for counting the total rotational speed during doctor roller throw-on is rendered operative.

Then, in Step P300 shifted from the aforementioned Step P279, it is determined whether the left side adjustment selection switch 55 is ON. If the answer is YES, it is determined in Step P301 whether the adjustment completion switch 58 is ON. If the answer is NO in Step P300, the program shifts to Step P305 to be described later.

If the answer is YES in Step P301, Step P302 is executed in which the count value is loaded from the counter 82 for detecting the current position of the left side of the doctor roller, and stored into the memory M1. Then, in Step P303, the home position (count value of the counter) of the left side of the doctor roller is loaded from the memory M2.

Then, in Step P304, the home position (count value of the counter) of the left side of the doctor roller is subtracted from the count value of the counter for detecting the current position of the left side of the doctor roller to compute the distance (count value of the counter) between the home position and the printing position of the left side of the doctor roller, and the computed distance is stored into the memory M21. Then, the program proceeds to Step P305 to be described later.

If the answer is NO in Step P301, it is determined in Step P318 whether the up button 59 is ON.

If the answer is YES in Step P318, this is followed by Step P319 in which a reset signal and an enabling signal are outputted to the internal counter 88. If the answer is NO in Step P318, the program shifts to Step P331 to be described later. Then, in Step P320, outputting of the reset signal to the internal counter 88 is stopped.

Then, in Step P321, it is determined whether the up button 59 is OFF. If the answer is YES, the program shifts to Step P331. If the answer is NO, the standby time for an outputting command to the driver for the stepping motor is loaded from the memory 31 in Step P322.

Subsequently, in Step P323, the count value is loaded from the internal counter 88, and stored into the memory M32. Then, in Step P324, it is determined whether the count value of the internal counter is equal to or greater than the standby time for the outputting command to the driver for the stepping motor. If the answer is YES in Step P324, Step P325 is executed in which a normal rotation pulse outputting command corresponding to one pulse is outputted to the driver 80 for the stepping motor for adjusting the left side. If the answer is NO in Step P324, the program returns to Step P321.

Then, in Step P326, the count value is loaded from the counter 82 for detecting the current position of the left side of the doctor roller, and stored into the memory M1. Subsequently, in Step P327, the home position (count value of the counter) of the left side of the doctor roller is loaded from the memory M2.

Then, in Step P328, the home position (count value of the counter) of the left side of the doctor roller is subtracted from the count value of the counter 82 for detecting the current position of the left side of the doctor roller to compute the count value difference for the left side, which is stored into the memory M3. This is followed by Step P329 in which the current position of the left side of the doctor roller is computed from the count value difference for the left side, and stored into the memory M4.

Then follows Step P330 in which the current position of the left side of the doctor roller is outputted to the display device 63 for the current position of the left side of the doctor roller. Then, the program returns to Step P319.

Then, in Step P331, it is determined whether the down button 60 is ON. If the answer is YES, this is followed by Step P332 in which a reset signal and an enabling signal are outputted to the internal counter 88. If the answer is NO in Step P331, the program returns to Step P301. Then, in Step P333, outputting of the reset signal to the internal counter 88 is stopped.

Then, in Step P334, it is determined whether the down button 60 is OFF. If the answer is YES, the program returns to Step P301. If the answer is NO, the standby time for an outputting command to the driver for the stepping motor is loaded from the memory 31 in Step P335.

Subsequently, in Step P336, the count value is loaded from the internal counter 88, and stored into the memory M32. Then, in Step P337, it is determined whether the count value of the internal counter is equal to or greater than the standby time for the outputting command to the driver for the stepping motor. If the answer is YES in Step P337, Step P338 is executed in which a reverse rotation pulse outputting command corresponding to one pulse is outputted to the driver 80 for the stepping motor for adjusting the left side. If the answer is NO in Step P337, the program returns to Step P334.

Then, in Step P339, the count value is loaded from the counter 82 for detecting the current position of the left side of the doctor roller, and stored into the memory M1. Subsequently, in Step P340, the home position (count value of the counter) of the left side of the doctor roller is loaded from the memory M2.

Then, in Step P341, the home position (count value of the counter) of the left side of the doctor roller is subtracted from the count value of the counter 82 for detecting the current position of the left side of the doctor roller to compute the count value difference for the left side, which is stored into the memory M3. This is followed by Step P342 in which the current position of the left side of the doctor roller is computed from the count value difference for the left side, and stored into the memory M4.

Then follows Step P343 in which the current position of the left side of the doctor roller is outputted to the display device 63 for the current position of the left side of the doctor roller. Then, the program returns to Step P332.

Then, in Step P305, it is determined whether the right side adjustment selection switch 56 is ON. If the answer is YES, it is determined in Step P306 whether the adjustment completion switch 58 is ON. If the answer is NO in Stop P305, the program shifts to Step P310.

If the answer is YES in Step P306, Step P307 is executed in which the count value is loaded from the counter 85 for detecting the current position of the right side of the doctor roller, and stored into the memory M5. Then, in Step P308, the home position (count value of the counter) of the right side of the doctor roller is loaded from the memory M6.

Then, in Step P309, the home position (count value of the counter) of the right side of the doctor roller is subtracted from the count value of the counter for detecting the current position of the right side of the doctor roller to compute the distance (count value of the counter) between the home position and the printing position of the right side of the doctor roller, and the computed distance is stored into the memory M23. Then, the program proceeds to Step P310 to be described later.

If the answer is NO in Step P306, it is determined in Step P344 whether the up button 59 is ON.

If the answer is YES in Step P344, this is followed by Step P345 in which a reset signal and an enabling signal are outputted to the internal counter 88. If the answer is NO in Step P344, the program shifts to Step P357 to be described later. Then, in Step P346, outputting of the reset signal to the internal counter 88 is stopped.

Then, in Step P347, it is determined whether the up button 59 is OFF. If the answer is YES, the program shifts to Step P357. If the answer is NO, the standby time for an outputting command to the driver for the stepping motor is loaded from the memory 31 in Step P348.

Subsequently, in Step P349, the count value is loaded from the internal counter 88, and stored into the memory M32. Then, in Step P350, it is determined whether the count value of the internal counter is equal to or greater than the standby time for the outputting command to the driver for the stepping motor. If the answer is YES in Step P350, Step P351 is executed in which a normal rotation pulse outputting command corresponding to one pulse is outputted to the driver 80 for the stepping motor for adjusting the right side. If the answer is NO in Step P350, the program returns to Step P347.

Then, in Step P352, the count value is loaded from the counter 82 for detecting the current position of the right side of the doctor roller, and stored into the memory M6. Subsequently, in Step P353, the home position (count value of the counter) of the right side of the doctor roller is loaded from the memory M6.

Then, in Step P354, the home position (count value of the counter) of the right side of the doctor roller is subtracted from the count value of the counter 82 for detecting the current position of the right side of the doctor roller to compute the count value difference for the right side, which is stored into the memory M7. This is followed by Step P355 in which the current position of the right side of the doctor roller is computed from the count value difference for the right side, and stored into the memory M8.

Then follows Step P356 in which the current position of the right side of the doctor roller is outputted to the display device 64 for the current position of the right side of the doctor roller. Then, the program returns to Step P345.

Then, in Step P357, it is determined whether the down button 60 is ON. If the answer is YES, this is followed by Step P358 in which a reset signal and an enabling signal are outputted to the internal counter 88. If the answer is NO in Step P357, the program returns to Step P306. Then, in Step P359, outputting of the reset signal to the internal counter 88 is stopped.

Then, in Step P360, it is determined whether the down button 60 is OFF. If the answer is YES, the program returns to Step P306. If the answer is NO, the standby time for an outputting command to the driver for the stepping motor is loaded from the memory 31 in Step P361.

Subsequently, in Step P362, the count value is loaded from the internal counter 88, and stored into the memory M32. Then, in Step P363, it is determined whether the count value of the internal counter is equal to or greater than the standby time for the outputting command to the driver for the stepping motor. If the answer is YES in Step P363, Step P364 is executed in which a reverse rotation pulse outputting command corresponding to one pulse is outputted to the driver 83 for the stepping motor for adjusting the right side. If the answer is NO in Step P363, the program returns to Step P360.

Then, in Step P365, the count value is loaded from the counter 85 for detecting the current position of the right side of the doctor roller, and stored into the memory M5. Subsequently, in Step P366, the home position (count value of the counter) of the right side of the doctor roller is loaded from the memory M6.

Then, in Step P367, the home position (count value of the counter) of the right side of the doctor roller is subtracted from the count value of the counter 85 for detecting the current position of the right side of the doctor roller to compute the count value difference for the right side, which is stored into the memory M7. This is followed by Step P368 in which the current position of the right side of the doctor roller is computed from the count value difference for the right side, and stored into the memory M8.

Then follows Step P369 in which the current position of the right side of the doctor roller is outputted to the display device 64 for the current position of the right side of the doctor roller. Then, the program returns to Step P358.

Then, in Step P310 shifted from the aforementioned Step P305 and Step P309, it is determined whether the both sides adjustment selection switch 57 is ON. If the answer is YES, it is determined in Step P311 whether the adjustment completion switch 58 is ON. If the answer is NO in Step P310, the program returns to Step P187.

If the answer is YES in Step P311, Step P312 is executed in which the count value is loaded from the counter 82 for detecting the current position of the left side of the doctor roller, and stored into the memory M1. Then, in Step P313, the home position (count value of the counter) of the left side of the doctor roller is loaded from the memory M2.

Then, in Step P314, the home position (count value of the counter) of the left side of the doctor roller is subtracted from the count value of the counter for detecting the current position of the left side of the doctor roller to compute the distance (count value of the counter) between the home position and the printing position of the left side of the doctor roller, and the computed distance is stored into the memory M21. Subsequently, in Step P315, the count value is loaded from the counter 85 for detecting the current position of the right side of the doctor roller, and stored into the memory M5.

Then, in Step P316, the home position (count value of the counter) of the right side of the doctor roller is loaded from the memory M6. Then, in Step P317, the home position (count value of the counter) of the right side of the doctor roller is subtracted from the count value of the counter for detecting the current position of the right side of the doctor roller to compute the distance (count value of the counter) between the home position and the printing position of the right side of the doctor roller, and the computed distance is stored into the memory M23. Then, the program returns to Step P187.

If the answer is NO in Step P311, it is determined in Step P370 whether the up button 59 is ON.

If the answer is YES in Step P370, this is followed by Step P371 in which a reset signal and an enabling signal are outputted to the internal counter 88. If the answer is NO in Step P370, the program shifts to Step P389 to be described later. Then, in Step P372, outputting of the reset signal to the internal counter 88 is stopped.

Then, in Step P373, it is determined whether the up button 59 is OFF. If the answer is YES, the program shifts to Step P389. If the answer is NO, the standby time for an outputting command to the driver for the stepping motor is loaded from the memory 31 in Step P374.

Subsequently, in Step P375, the count value is loaded from the internal counter 88, and stored into the memory M32. Then, in Step P376, it is determined whether the count value of the internal counter is equal to or greater than the standby time for the outputting command to the driver for the stepping motor. If the answer is YES in Step P376, Step P377 is executed in which a normal rotation pulse outputting command corresponding to one pulse is outputted to the driver 80 for the stepping motor for adjusting the left side. If the answer is NO in Step P376, the program returns to Step P373.

Then, in Step P378, a normal rotation pulse outputting command corresponding to one pulse is outputted to the driver 83 for the stepping motor for adjusting the right side. Subsequently, in Step P379, the count value is loaded from the counter 82 for detecting the current position of the left side of the doctor roller, stored into the memory M1. Then, in Step P380, the home position (count value of the counter) of the left side of the doctor roller is loaded from the memory M2.

Then, in Step P381, the home position (count value of the counter) of the left side of the doctor roller is subtracted from the count value of the counter 82 for detecting the current position of the left side of the doctor roller to compute the count value difference for the left side, which is stored into the memory M3. This is followed by Step P382 in which the current position of the left side of the doctor roller is computed from the count value difference for the left side, and stored into the memory M4.

Then follows Step P383 in which the current position of the left side of the doctor roller is outputted to the display device 63 for the current position of the left side of the doctor roller. Subsequently, in Step P384, the count value is loaded from the counter 85 for detecting the current position of the right side of the doctor roller, and stared into the memory M5. Then, in Step P395, the home position (count value of the counter) of the right side of the doctor roller is loaded from the memory M6.

Then, in Step P386, the home position (count value of the counter) of the right side of the doctor roller is subtracted from the count value of the counter 85 for detecting the current position of the right side of the doctor roller to compute the count value difference for the right side, which is stored into the memory M7. This is followed by Step P387 in which the current position of the right side of the doctor roller is computed from the count value difference for the right side, and stored into the memory M8.

Then follows Step P388 in which the current position of the right side of the doctor roller is outputted to the display device 64 for the current position of the right side of the doctor roller. Then, the program returns to Step P371.

Then, in Step P389, it is determined whether the down button 60 is ON. If the answer is YES, this is followed by Step P390 in which a reset signal and an enabling signal are outputted to the internal counter 88. If the answer is NO in Step P389, the program returns to Step P311. Then, in Step P391, outputting of the reset signal to the internal counter 88 is stopped.

Then, in Step P392, it is determined whether the down button 60 is OFF. If the answer is YES, the program returns to Step P311. If the answer is NO, the standby time for an outputting command to the driver for the stepping motor is loaded from the memory 31 in Step P393.

Subsequently, in Step P394, the count value is loaded from the internal counter 88, and stored into the memory M32. Then, in Step P395, it is determined whether the count value of the internal counter is equal to or greater than the standby time for the outputting command to the driver for the stepping motor. If the answer is YES in Step P395, Step P396 is executed in which a normal rotation pulse outputting command corresponding to one pulse is outputted to the driver 80 for the stepping motor for adjusting the left side. If the answer is NO in Step P395, the program returns to Step P392.

Then, in Step P397, a normal rotation pulse outputting command corresponding to one pulse is outputted to the driver 83 for the stepping motor for adjusting the right side. Subsequently, in Step P398, the count value is loaded from the counter 82 for detecting the current position of the left side of the doctor roller, and stored into the memory M1. Then, in Step P399, the home position (count value of the counter) of the left side of the doctor roller is loaded from the memory M2.

Then, in Step P400, the home position (count value of the counter) of the left side of the doctor roller is subtracted from the count value of the counter 82 for detecting the current position of the left side of the doctor roller to compute the count value difference for the left side, which is stored into the memory M3. This is followed by Step P401 in which the current position of the left side of the doctor roller is computed from the count value difference for the left side, and stored into the memory M4.

Then follows Step P402 in which the current position of the left side of the doctor roller is outputted to the display device 63 for the current position of the left side of the doctor roller. Subsequently, in Step P403, the count value is loaded from the counter 85 for detecting the current position of the right side of the doctor roller, and stored into the memory M5. Then, in Step P404, the home position (count value of the counter) of the right side of the doctor roller is loaded from the memory M6.

Then, in Step P405, the home position (count value of the counter) of the right side of the doctor roller is subtracted from the count value of the counter 85 for detecting the current position of the right side of the doctor roller to compute the count value difference for the right side, which is stored into the memory M7. This is followed by Step P406 in which the current position of the right side of the doctor roller is computed from the count value difference for the right side, and stored into the memory M8.

Then follows Step P407 in which the current position of the right side of the doctor roller is outputted to the display device 64 for the current position of the right side of the doctor roller. Then, the program returns to Step P390. In accordance with the above-described motion flow, the distance between the home position and the printing position of the support shaft 27, which has been adjusted by the operator's manual operation during printing, is stored as a new distance between the home position and the printing position. In other words, the adjusted printing position is stored as the new printing position.

Then, in Step P408 shifted from the aforementioned Step P187, the home position (count value of the counter) of the left side of the doctor roller is loaded from the memory M2. Then, in Step P409, the distance (count value of the counter) between the home position and the throw-off position of the left side of the doctor roller is loaded from the memory M14.

Then follows Step P410 in which the distance (count value of the counter) between the home position and the throw-off position of the left side of the doctor roller is added to the home position (count value of the counter) of the left side of the doctor roller to compute the throw-off position (count value of the counter) of the left side of the doctor roller, and the computed value is stored into the memory M15. Then, in Step P411, the count value is loaded from the counter 82 for detecting the current position of the left side of the doctor roller, and stored into the memory M1.

Then, in Step P412, the count value of the counter for detecting the current position of the left side of the doctor roller is subtracted from the throw-off position (count value of the counter) of the left side of the doctor roller to compute the amount of movement of the left side of the doctor roller, which is stored into the memory M27. Then follows Step P413 in which the home position (count value of the counter) of the right side of the doctor roller is loaded from the memory M2.

Then, in Step P414, the distance (count value of the counter) between the home position and the throw-off position of the right side of the doctor roller is loaded from the memory M16. Subsequently, in Step P415, the distance (count value of the counter) between the home position and the throw-off position of the right side of the doctor roller is added to the home position (count value of the counter) of the right side of the doctor roller to compute the throw-off position (count value of the counter) of the right side of the doctor roller, which is stored into the memory M17. Then, in Step P416, the count value is loaded from the counter 85 for detecting the current position of the right side of the doctor roller, and stored into the memory M5.

Then, in Step P417, the count value of the counter for detecting the current position of the right side of the doctor roller is subtracted from the throw-off position (count value of the counter) of the right side of the doctor roller to compute the amount of movement of the right side of the doctor roller, which is stored into the memory M28. Then, in Step P418, the memory M25 for storing the presence or absence of rotation of the stepping motor for adjusting the left side is overwritten with 0. Subsequently, in Step P419, the memory M26 for storing the presence or absence of rotation of the stepping motor for adjusting the right side is overwritten with 0.

Then, in Step P420, the amount of movement of the left side of the doctor roller is loaded from the memory M27. Then, in Step P421, it is determined whether the amount of movement of the left side of the doctor roller is equal to 0. If the answer is YES in Step P421, the program shifts to Step P426 to be described later. If the answer is NO in Step P421, the memory M25 for storing the presence or absence of rotation of the stepping motor for adjusting the left side is overwritten with 1 in Step P422.

Then, in Step P423, it is determined whether the amount of movement of the left side of the doctor roller is larger than 0. If the answer is YES in Step P423, Step P424 is executed to compute the absolute value of the amount of movement of the left side of the doctor roller from the amount of movement of the left side of the doctor roller, and store it into the memory M29. Then, in Step P425, a normal rotation pulse outputting command corresponding to the absolute value of the amount of movement of the left side of the doctor roller is outputted to the driver 80 for the stepping motor for adjusting the left side. Then, the program proceeds to Step P426.

If the answer is NO in Step P423, Step P427 is executed to compute the absolute value of the amount of movement of the left side of the doctor roller from the amount of movement of the left side of the doctor roller, and store it into the memory M29. Then, in Step P428, a reverse rotation pulse outputting command corresponding to the absolute value of the amount of movement of the left side of the doctor roller is outputted to the driver 80 for the stepping motor for adjusting the left side. Then, the program shifts to Step P426.

Then, in Step P426, the amount of movement of the right side of the doctor roller is loaded from the memory M28. Then, in Step P429, it is determined whether the amount of movement of the right side of the doctor roller is equal to 0. If the answer is YES in Step P429, the program shifts to Step P434 to be described later. If the answer is NO in Step P429, the memory M26 for storing the presence or absence of rotation of the stepping motor for adjusting the right side is overwritten with 1 in Step P430.

Then, in Step P431, it is determined whether the amount of movement of the right side of the doctor roller is larger than 0. If the answer is YES in Step P431, Step P432 is executed to compute the absolute value of the amount of movement of the right side of the doctor roller from the amount of movement of the right side of the doctor roller, and store it into the memory M30. Then, in Step P433, a normal rotation pulse outputting command corresponding to the absolute value of the amount of movement of the right side of the doctor roller is outputted to the driver 83 for the stepping motor for adjusting the right side. Then, the program proceeds to Step P434.

If the answer is NO in Step P431, Step P435 is executed to compute the absolute value of the amount of movement of the right side of the doctor roller from the amount of movement of the right side of the doctor roller, and store it into the memory M30. Then, in Step P436, a reverse rotation pulse outputting command corresponding to the absolute value of the amount of movement of the right side of the doctor roller is outputted to the driver 83 for the stepping motor for adjusting the right side. Then, the program shifts to Step P434.

Subsequently, in Step P434, the value of the memory M25 for storing the presence or absence of rotation of the stepping motor for adjusting the left side is loaded. Then, in Step P437, it is determined whether the value of the memory for storing the presence or absence of rotation of the stepping motor for adjusting the left side is equal to 0.

If the answer is YES in Step P437, the value of the memory M26 for storing the presence or absence of rotation of the stepping motor for adjusting the right side is loaded in Step P438. If the answer is NO in Step P437, the program shifts to Step P441 to be described later.

Then, in Step P439, it is determined whether the value of the memory for storing the presence or absence of rotation of the stepping motor for adjusting the right side is equal to 0. If the answer is YES in Step P439, outputting of the enabling signal to the counter 76 for counting the total rotational speed during doctor roller throw-on is stopped in Step P440. Then, the program returns to Step P11. If the answer is NO in Step P439, the program shifts to Step P441.

Then, in Step P441, the count value is loaded Step counter 82 for detecting the current position of the left side of the doctor roller, and stored into the memory M1. Subsequently, in Step P442, the throw-off position (count value of the counter) of the left side of the doctor roller is loaded from the memory M15.

Then, in Step P443, the count value of the counter for detecting the current position of the left side of the doctor roller is subtracted from the throw-off position (count value of the counter) of the left side of the doctor roller to compute the count value difference for the left side, which is stored into the memory M3. Then, in Step P444, it is determined whether the count value difference for the left side is equal to 0.

If the answer is YES in Step P444, the memory M25 for storing the presence or absence of rotation of the stepping motor for adjusting the left side is overwritten with 0 in Step P445. Then, the program proceeds to Step P446. If the answer is NO in Step P444, the program immediately shifts to Step P446.

Subsequently, in Step P446, the count value is loaded from the counter 82 for detecting the current position of the left side of the doctor roller, and stored into the memory M1. Then, in Step P447, the home position (count value of the counter) of the left side of the doctor roller is loaded from the memory M2.

Then, in Step P448, the home position (count value of the counter) of the left side of the doctor roller is subtracted from the count value of the counter for detecting the current position of the left side of the doctor roller to compute the count value difference for the left side, which is stored into the memory M3. This is followed by Step P449 in which the current position of the left side of the doctor roller is computed from the count value difference for the left side, and stored into the memory M4. Then follows Step P450 in which the current position of the left side of the doctor roller is outputted to the display device 63 for the current position of the left side of the doctor roller.

Then, in Step P451, the count value is loaded from the counter 85 for detecting the current position of the right side of the doctor roller, and stored into the memory M5. Subsequently, in Step P452, the throw-off position (count value of the counter) of the right side of the doctor roller is loaded from the memory M17.

Then, in Step P453, the count value of the counter for detecting the current position of the right side of the doctor roller is subtracted from the throw-off position (count value of the counter) of the right side of the doctor roller to compute the count value difference for the right side, which is stored into the memory M7. Then, in Step P454, it is determined whether the count value difference for the right side is equal to 0.

If the answer is YES in Step P454, the memory M26 for storing the presence or absence of rotation of the stepping motor for adjusting the right side is overwritten with 0 in Step P455. Then, the program proceeds to Step P456. If the answer is NO in Step P454, the program immediately shifts to Step P456.

Then, in Step P456, the count value is loaded from the counter 85 for detecting the current position of the right side of the doctor roller, and stored into the memory M5. Subsequently in Step P457, the home position (count value of the counter) of the right side of the doctor roller is loaded from the memory M6.

Then, in Step P458, the hone position (count value of the counter) of the right side of the doctor roller is subtracted from the count value of the counter for detecting the current position of the right side of the doctor roller to compute the count value difference for the right side, which is stored into the memory M7. This is followed by Step P459 in which the current position of the right side of the doctor roller is computed from the count value difference for the right side, and stored into the memory M8. Then follows Step P460 in which the current position of the right side of the doctor roller is outputted to the display device 64 for the current position of the right side of the doctor roller. Then, the program returns to Step P434. Subsequently, this procedure is repeated.

In accordance with the above-described motion flow, when doctor roller throw-on and throw-off automatic control is released, the right and left sides of the support shaft 27 are moved to the throw-off position, and the state of the counter 76 for counting the total rotational speed during doctor roller throw-on is rendered inoperative.

As described above, according to the present embodiment as well, the throw-on and throw-off of the doctor roller 90 with respect to the inner peripheral surface of the screen printing forme 11*c*, and the adjustment of the throw-on position can be performed by the stepping motors 81A and SIB. Thus, the same actions and effects as those in Embodiment 1 are obtained.

The invention thus described, it will be obvious that the same may be varied in many ways. For example, the present invention can be applied to a stencil printing press such as a rotary screen printing press. Such variations are not to be regarded as a departure from the spirit and scope of the invention, and all such modifications as would be obvious to one skilled in the art are intended to be included within the scope of the following claims.

What is claimed is:

1. An ink transfer member position adjusting method of a rotary stencil printing press including, a stencil printing plate cylinder which supports a stencil printing plate and is supported rotatably, and an ink transfer member which is located within the stencil printing plate cylinder and, when printing is done, contacts an inner peripheral surface of the stencil printing plate to transfer ink stored within the stencil printing plate cylinder to a material to be printed via holes of the stencil printing plate and, when printing is stopped, leaves the inner peripheral surface of the stencil printing plate, the method comprising:

performing, by a motor, movement of the ink transfer member to a position for replacement of the ink transfer member, movements of the ink transfer member to a position of a throw-off, different from the position for replacement, with respect to the inner peripheral surface of the stencil plating plate, movement of the ink transfer member to a position of a throw-on with respect to the inner peripheral surface of the stencil printing plate, and adjustment of the position of the throw-on.

2. The ink transfer member position adjusting method of a rotary stencil printing press according to claim 1, wherein the position for replacement of the ink transfer member is a home position for the ink transfer member, and the home position is a home position for the throw-on and the throw-off of the ink transfer member, and the home position for the throw-on and throw-off of the ink transfer member can be adjusted with respect to the inner peripheral surface of the stencil printing plate.

3. The ink transfer member position adjusting method of a rotary stencil printing press according to claim 2, wherein a relative position between the home position and the position of the throw-off is constant.

4. The ink transfer member position adjusting method of a rotary stencil printing press according to claim 2, wherein a relative position between the home position and the position of the throw-on can be adjusted.

5. The ink transfer member position adjusting method of a rotary stencil printing press according to claim 4, wherein the relative position between the home position and the position of the throw-on changes according to an amount of adjustment of the position of the throw-on by an operator.

6. The ink transfer member position adjusting method of a rotary stencil printing press according to claim 1, further comprising:

obtaining a total number of rotation of the rotary stencil printing press in a state in which the ink transfer member has been thrown on the inner peripheral surface of the stencil printing plate after adjustment of a home position for the throw-on and throw-off of the ink transfer member with respect to the inner peripheral surface of the stencil printing plate; and adjusting the position of the throw-on of the ink transfer member with respect to the inner peripheral surface of the stencil printing plate in accordance with the obtained total number of rotation of the rotary stencil printing press.

7. The ink transfer member position adjusting method of a rotary stencil printing press according to claim 1, wherein the rotary stencil printing press further includes a support shaft that supports the ink transfer member, a first bearing member that supports a first end of the support shaft, a second bearing member that supports a second end, opposite to the first end, of the support shaft, a first frame that supports the first bearing member, and a second frame that supports the second bearing member, and wherein the stencil printing plate cylinder is provided between the first and second frames, a first bearing is provided at a side opposite to the stencil printing plate cylinder with respect to the first frame, and a second bearing is provided at a side opposite to the stencil printing plate cylinder with respect to the second frame.

8. An ink transfer member position adjusting apparatus of a rotary stencil printing press, comprising:

a stencil printing plate cylinder which supports a stencil printing plate and is supported rotatably;

an ink transfer member which is located within the stencil printing plate cylinder and, when printing is done, contacts an inner peripheral surface of the stencil printing plate to transfer ink stored within the stencil printing plate cylinder to a material to be printed via holes of the stencil printing plate and, when printing is stopped, leaves the inner peripheral surface of the stencil printing plate;

a motor for performing movement of the ink transfer member to a position for replacement of the ink transfer member, movement of the ink transfer member to a position of a throw-off, different from the position for replacement, with respect to the inner peripheral surface of the stencil printing plate, movement of the ink transfer member to a position of a throw-on with respect to the inner peripheral surface of the stencil printing plate, and adjustment of the position of the throw-on; and a control unit that controls driving of the motor.

9. The ink transfer member position adjusting apparatus of a rotary stencil printing press according to claim 8, wherein the position for replacement of the ink transfer member is a home position for the ink transfer member, the home position is a home position for the throw-on and the throw-off of the ink transfer member, and the control unit adjusts the home position for the throw-on and throw-off of the ink transfer member with respect to the inner peripheral surface of the stencil printing plate.

10. The ink transfer member position adjusting apparatus of a rotary stencil printing press according to claim 9, wherein the control unit renders constant a relative position between the home position and the position of the throw-off.

11. The ink transfer member position adjusting apparatus of a rotary stencil printing press according to claim 9, wherein the control unit adjusts a relative position between the home position and the position of the throw-on.

12. The ink transfer member position adjusting apparatus of a rotary stencil printing press according to claim 11, wherein the control unit changes the relative position between the home position and the position of the throw-on according to an amount of adjustment of the position of the throw-on by an operator.

13. The ink transfer member position adjusting apparatus of a rotary stencil printing press according to claim 8, wherein the control unit, obtaining a total number of rotation of the rotary stencil printing press in a state in which the ink transfer member has been thrown on the inner peripheral surface of the stencil printing plate after adjustment of a home position for the throw-on and throw-off of the ink transfer member with respect to the inner peripheral surface of the stencil printing plate, and adjusts the position of the throw-on of the ink transfer member with respect to the inner peripheral surface of the stencil printing plate in accordance with the obtained total number of rotation of the rotary stencil printing press.

14. The ink transfer member position adjusting apparatus of a rotary stencil printing press according to claim 8, further comprising:

a support shaft that supports the ink transfer member;

a first bearing member that supports a first end of the support shaft;

a second bearing member that supports a second end, opposite to the first end, of the support shaft; and a first frame that supports the first bearing member, and a second frame that supports the second bearing member, wherein the stencil printing plate cylinder is provided between the first and second frames, a first bearing is provided at a side opposite to the stencil printing plate cylinder with respect to the first frame, and a second bearing is provided at a side opposite to the stencil printing plate cylinder with respect to the second frame.

* * * * *